US007273325B2

(12) United States Patent
Watanabe et al.

(10) Patent No.: US 7,273,325 B2
(45) Date of Patent: Sep. 25, 2007

(54) THERMAL PRINTER AND CUTTER

(75) Inventors: Sumio Watanabe, Shinagawa (JP); Yukihiro Mori, Shinagawa (JP); Masahiro Tsuchiya, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 32 days.

(21) Appl. No.: 10/832,382

(22) Filed: Apr. 27, 2004

(65) Prior Publication Data

US 2005/0036820 A1 Feb. 17, 2005

(30) Foreign Application Priority Data

Aug. 12, 2003 (JP) ..... 2003-292507
Sep. 2, 2003 (JP) ..... 2003-310277
Sep. 10, 2003 (JP) ..... 2003-318518

(51) Int. Cl.
*B41J 15/18* (2006.01)

(52) U.S. Cl. ..... 400/621; 400/593; 400/120.01; 101/226; 83/564

(58) Field of Classification Search ..... 400/593, 400/621, 613, 120.01; 101/226; 83/564, 83/627, 601
See application file for complete search history.

(56) References Cited

U.S. PATENT DOCUMENTS 5,090,285 A 2/1992 Kondo
5,579,043 A * 11/1996 Patry ..... 347/222
5,749,277 A 5/1998 Walker
6,003,217 A * 12/1999 Graves et al. ..... 29/24.5
6,363,824 B1 * 4/2002 Granger ..... 83/334
6,447,187 B1 * 9/2002 Robinson ..... 400/621
6,508,600 B1 * 1/2003 Nonaka ..... 400/621

FOREIGN PATENT DOCUMENTS

| | | |
|---|---|---|
| EP | 0 687 531 | 11/1994 |
| EP | 1 093 928 | 4/2001 |
| JP | 11-048187 | 2/1999 |
| JP | 2000-061881 | 2/2000 |
| JP | 2000-094767 | 4/2000 |

* cited by examiner

*Primary Examiner*—Daniel J. Colilla
*Assistant Examiner*—Kevin D. Williams
(74) *Attorney, Agent, or Firm*—Staas & Halsey LLP

(57) ABSTRACT

A thermal printer includes a first module having a motor and a thermal head support member to fix a thermal head, the thermal head support member having a fixed blade part working as a blade and an a second module being detachably coupled with the first module, the second module having a platen roller, a movable blade member and a movable blade member movement mechanism to move the movable blade member, wherein the movable blade member is disposed to face the fixed blade part and driving force of the motor is conveyed to the movable blade member movement mechanism, and thereby a cutter part is formed.

7 Claims, 94 Drawing Sheets

1071
1072
1072-1
1072-2
1072-3
1072-4
1073
1073a
1072-2b
1072-3b
1074
1074a
1075
YP1
YP2
YP3
YP4
D
E
F
G
X1
X2
Y1
Y2
Z1
Z2

2071
YP4
YP3
YP2
YP1
2073
2072-1
2072-2
2072
2075
2072-3
2074
2072-4
D
E
F
G 2072-1
2073a
2072-2b
2072-2

2072-3
2072-3b
2074a
2072-4
Z1
X1
Y2
Z2
Y1
X2

2071A
2072A-1
2072A-2
2072A-3
2072A-4
2073A-2b
2073A-3b
2090
2091
2092
2100
2101
2102
2110
2111
YP1
YP2
YP3
YP4
D
E
F
γ
X1
X2
Y1
Y2
Z1
Z2

2261～2264: TWO CONSECUTIVELY PRINTED TICKETS FOR FIRST TO FOURTH MEMBERS 2271, 2273, 2275, 2277: FIRST TICKETS FOR FIRST TO FOURTH MEMBERS 2272, 2274, 2276, 2278: SECOND TICKETS FOR FIRST TO FOURTH MEMBERS

FIG.72D
FIG.72E
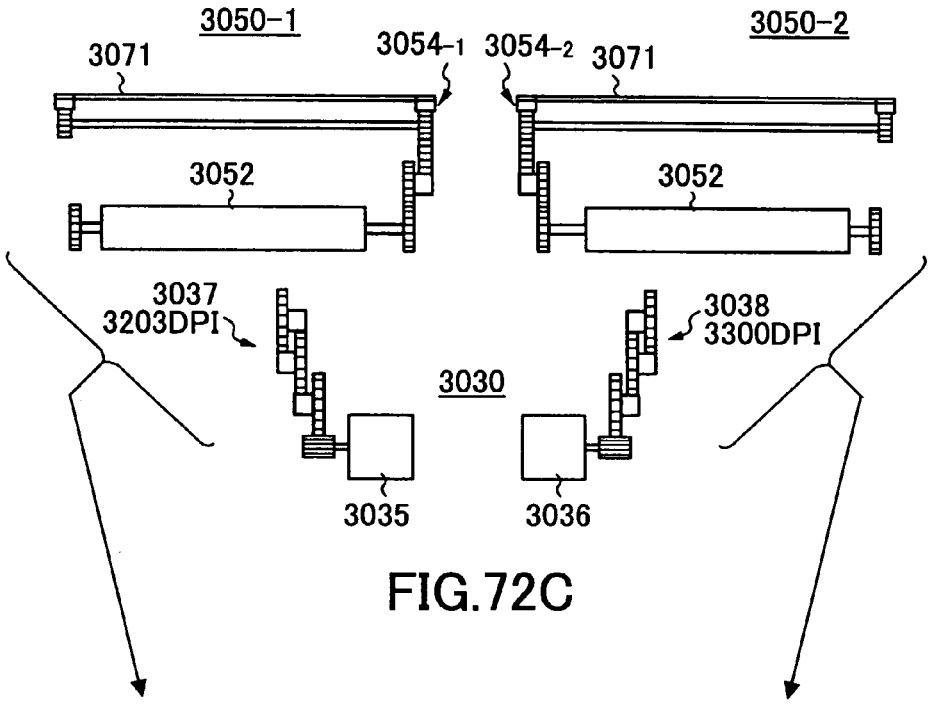
FIG.72C
FIG.72A
FIG.72B
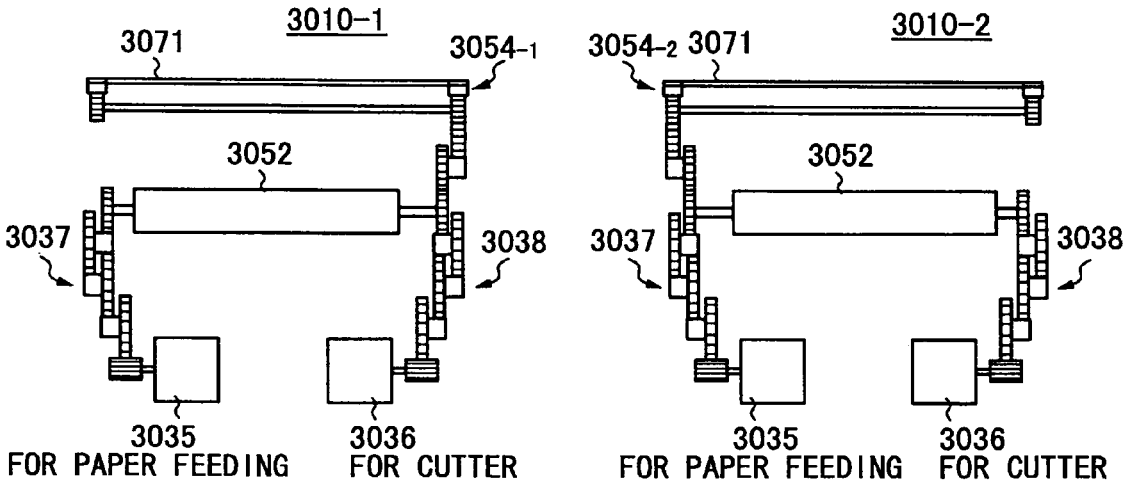

THERMAL PRINTER AND CUTTER

BACKGROUND OF THE INVENTION

1. Field of the Invention

The present invention relates to a thermal printer and a cutter. More particularly, the present invention relates to a thermal printer and a cutter that can cut a paper in such a way that a printed portion of the paper can be partially cut to leave a plurality connection points.

2. Description of the Related Art

A thermal printer device having a function to automatically cut a roll paper is often incorporated in a POS (Point Of Sale) terminal and a ticket vending machine.

For example, as disclosed in Japanese Laid-Open Patent Application No. 2000-094767, a conventional automatically paper cutting type of thermal printer has a structure such that a cutter device, which is configured as an individual unit, is mounted to a thermal printer body including a thermal head, a platen and a motor. Such a cutter device includes a fixed blade, a movable blade and a motor to move the movable blade.

Accordingly, it is difficult to realize a small-sized thermal printer because the thermal printer includes both the thermal printer body and the cutter device. This difficulty also incurs difficult miniaturization of a POS terminal and a ticket vending machine.

Also, it is desirable that a mobile terminal device has a function to automatically cut a paper. However, such a mobile terminal device cannot include a thermal printer device capable of automatically a paper from the viewpoint of the size, and currently a paper is manually cut in a mobile terminal device.

In addition, a movable blade includes an almost V-shaped blade part configured from a pair of slope edges. When the movable blade moves in a direction to overlap a fixed blade, two contact points between the blade part of the movable blade and a blade part of the fixed move from both sides to the center thereof. A paper is cut by shear force at the contact points.

The movable blade is configured to have one or more notch parts along each of the slope edge of the blade part. The movable blade is controlled in such a way that the movable blade is finally shifted to a desired position. If the movable blade is finally shifted over a short distance, a paper can be partially cut to leave a plurality of connection points. Also, if the movable blade is finally shifted over a moderate distance, a paper can be partially cut to leave one connection point. Moreover, if the movable blade is finally shifted over a great distance, a paper can completely cut.

Such a movable blade is shaped to have one or more notch parts along the slope edges thereof, and the blade part is discontinuously formed. When an outer-side blade part cuts a paper to an end thereof, the cut operation is temporarily halted, and subsequently the paper is cut by an inner-side blade part. In this fashion, a cutting left part is formed at a portion where the cut operation is temporarily halted.

Thus, it is necessary to smoothly restart the cut operation using the inner-side blade part.

In addition, a thermal printer generally prints a paper at the print resolution of 203 dpi with respect to a paper feed direction. Moreover, a thermal printer than can a paper at a higher printer resolution with respect to a paper feed direction, for example, at the print resolution of 300 dpi, is commercially available. For example, such a higher resolution printable thermal printer is used to pint a barcode and others.

Conventionally, an automatically paper cutting type of thermal printer has a structure such that a cutter device, which is an individual device, having a fixed blade, a movable blade and a motor to move the movable blade is mounted to the thermal printer body having a thermal head, a platen and a motor. It is difficult to shorten the height of a thermal printer having such a structure. In order to overcome this difficulty, a thermal printer designed to shorten the height thereof by providing a cutter at a portion of the thermal printer is proposed. In this thermal printer, a first module having a thermal head, a fixed blade and first and second motors is detachably coupled with a second module having a platen roller and a movable blade. The platen roller is rotated by the first motor, and the movable blade is sled by the second motor.

In order to manufacture two kinds of thermal printers, that is, a thermal printer having the structure such that the first module is detachably coupled with the second module and printable at the print resolution of 203 dpi with respect to a paper feed direction, and a thermal printer having the structure such that the first module is detachably coupled with the second module and printable, for example, at the print resolution of 300 dpi with respect to a paper feed direction, a manufacturer needs to separately design and prepare as the first module two kinds of modules: a module having a structure such that the first motor and a gear set from the first motor to the platen roller can correspond to the print resolution of 300 dpi with respect to a paper feed direction and a module corresponding to the print resolution of 203 dpi with respect to a paper feed direction. Thus, if two kinds of thermal printers having the same dimension and the same specification except for the print resolution with respect to the paper feed direction are fabricated, the fabrication cost of each of the thermal printers and the fabrication cost of one type of thermal printer are the same. In other words, it can be expected to reduce the fabrication cost of the individual thermal printers in the case where the two kinds of thermal printers having the almost same specifications are fabricated.

SUMMARY OF THE INVENTION

It is a general object of the present invention to provide a thermal printer in which one or more of the above-mentioned problems are eliminated.

A first more specific object of the present invention is to provide a thermal printer that can realize miniaturization and weight saving thereof.

A second more specific object of the present invention is to provide a cutter that can restart halted cutting operation smoothly.

A third more specific object of the present invention is to provide a thermal printer of which fabrication cost can be reduced by designing a common architecture for different types of the first modules.

In order to achieve the above-mentioned objects, there is provided according to one aspect of the present invention a thermal printer, including: a first module having a motor and a thermal head support member to fix a thermal head, the thermal head support member having a fixed blade part working as a blade; and a second module being detachably coupled with the first module, the second module having a platen roller, a movable blade member and a movable blade member movement mechanism to move the movable blade member, wherein the movable blade member is disposed to face the fixed blade part and driving force of the motor is conveyed to the movable blade member movement mechanism, and thereby a cutter part is formed.

Additionally, there is provided according to another aspect of the present invention a thermal printer, including: a first module having a motor and a thermal head support member to fix a thermal head, the thermal head having a fixed blade part working as a blade; and a second module being detachably coupled with the first module, the second module having a platen roller, a movable blade member and a movable blade member movement mechanism to move the movable blade member, wherein the movable blade member is disposed to face the fixed blade part and driving force of the motor is conveyed to the movable blade member movement mechanism, and thereby a cutter part is formed.

According to one aspect of the present invention, in a condition where the second module is coupled with the first module, a cutter part is formed such that the movable blade member faces the fixed blade. As a result, compared to a conventional thermal printer having a structure such that a separate cutter device is mounted in an upper side of the first module, the thermal printer according to the above-mentioned embodiments of the present invention can be designed to have a small height and a small size. Also, since the thermal head support member includes the fixed blade part, the weight of the thermal printer can decrease compared to a conventional thermal printer having a structure such that a separate fixed blade part is incorporated therein.

Additionally, there is provided according to another aspect of the present invention a cutter for cutting a paper in plural point left cutting, one-point left cutting and completely cutting manners, including: a fixed blade; a movable blade having an almost V-shaped blade part configured to have a notch part to form a final uncut part at a V-shape bottom thereof and at least one notch part to form an uncut part along each slope thereof, each of the at least one notch part having a sharp part in a center side of an entrance thereof; and a movable blade movement mechanism sliding the movable blade, wherein when the movable blade moves in a direction to overlap the fixed blade so as to cut the paper, a contact portion between a blade part of the fixed blade and the blade part of the movable blade moves from both sides of the movable blade to a center of the movable blade, and the paper is cut to leave a plurality of points, a single point and no point depending on movement of the movable blade.

Additionally, there is provided according to another aspect of the present a cutter for cutting a paper in plural point left cutting, one-point left cutting and completely cutting manners, including: a fixed blade; a movable blade being positioned in an upper surface side of the fixed blade, the movable blade having an almost V-shaped blade part configured to have a notch part to form a final uncut part at a V-shape bottom thereof and at least one notch part to form an uncut part along each slope thereof, each of the at least one notch part having a sharp part in a center side of an entrance thereof, the sharp part being curved in a direction of an upper surface of the movable blade; and a movable blade movement mechanism sliding the movable blade, wherein when the movable blade moves in a direction to overlap the fixed blade so as to cut the paper, a contact portion between a blade part of the fixed blade and the blade part of the movable blade moves from both sides of the movable blade to a center of the movable blade, and the paper is cut to leave a plurality of points, a single point and no point depending on movement of the movable blade.

Additionally, there is provided according to another aspect of the present invention a cutter for cutting a paper in plural point left cutting, one-point left cutting and completely cutting manners, including: a fixed blade; a movable blade being positioned in an upper surface side of the fixed blade, the movable blade having an almost V-shaped blade part configured to include a notch part to form a final uncut part at a V-shape bottom thereof and at least one notch part to form an uncut part along each slope thereof, each of the at least one notch part having a slope surface facing an entrance thereof on an under surface in a center side relative to the entrance, the slope surface inclining toward an upper side in a direction of the entrance; and a movable blade movement mechanism sliding the movable blade, wherein when the movable blade moves in.a direction to overlap the fixed blade so as to cut the paper, a contact portion between a blade part of the fixed blade and the blade part of the movable blade moves from both sides of the movable blade to a center of the movable blade, and the paper is cut to leave a plurality of points, a single point and no point depending on movement of the movable blade.

Additionally, there is provided according to another aspect of the present invention a cutter for cutting a paper in plural point left cutting, one-point left cutting and completely cutting manners, including: a fixed blade; a movable blade having an almost V-shaped blade part configured to include a notch part to form a final uncut part at a V-shape bottom thereof and at least one notch part to form an uncut part along each slope thereof, each of the at least one notch part having shape such that a width of an inner side thereof is greater than a width of an entrance thereof; and a movable blade movement mechanism sliding the movable blade, wherein when the movable blade moves in a direction to overlap the fixed blade so as to cut the paper, a contact portion between a blade part of the fixed blade and the blade part of the movable blade moves from both sides of the movable blade to a center of the movable blade, and the paper is cut to leave a plurality of points, a single point and no point depending on movement of the movable blade.

Additionally, there is provided according to another aspect of the present a cutter for cutting a paper in plural point left cutting, one-point left cutting and completely cutting manners, including: a fixed blade; a movable blade having an almost V-shaped blade part configured to include a notch part to form a final uncut part at a V-shape bottom thereof and at least one notch part to form an uncut part along each slope thereof, each of the at least one notch part having an uncut part cutting blade part to cut an uncut part in an inner side thereof, the movable blade being disposed such that the uncut part cutting blade part is located off a sliding direction of the movable blade; a movable blade movement mechanism sliding the movable blade; and a control part controlling movement of the movable blade so as to locate the movable blade at a desired position, wherein when the movable blade moves in a direction to overlap the fixed blade so as to cut the paper, a contact portion between a blade part of the fixed blade and the blade part of the movable blade moves from both sides of the movable blade to a center of the movable blade, and the paper is cut to leave a plurality of points, a single point and no point depending on movement of the movable blade.

Additionally, there is provided according to another aspect of the present invention a cutter for cutting a paper in plural point left cutting, one-point left cutting and completely cutting manners wherein the cutter is provided in a printer, including: a fixed blade; a movable blade having an almost V-shaped blade part configured to include a notch part to form a final uncut part at a V-shape bottom thereof and at least one notch part to form an uncut part along each slope thereof, each of the at least one notch part having an uncut part cutting blade part to cut an uncut part in an inner side thereof; a movable blade movement mechanism sliding the movable blade; and a control part controlling movement of the movable blade by controlling an operation of the movable blade movement mechanism in association with a print operation of the printer, wherein when the movable blade moves in a direction to overlap the fixed blade so as to cut the paper, a contact portion between a blade part of the fixed blade and the blade part of the movable blade moves from both sides of the movable blade to a center of the movable blade, and the paper is cut to leave a plurality of points, a single point and no point depending on movement of the movable blade.

According to one aspect of the present invention, when a paper restarts to be cut from a condition where the cutting of the paper is temporarily stopped, the sharp part pierces the paper to smoothly restart the cutting of the paper. As a result, the cutter can smoothly cut the paper to leave a plurality of points even after long term use thereof.

Additionally, there is provided according to another aspect of the present a thermal printer, including: a first module having a thermal head. A fixed blade, first and second pulse motors, a first gear set conveying rotational driving of the first pulse motor, and a second gear set conveying rotational driving of the second pulse motor; and a second module being detachably coupled with the first module, the second module having a platen roller, a movable blade member, and a movable blade member slide mechanism, in response to supply of rotational force, sliding the movable blade member, the platen roller applying pressure to the thermal head, the movable blade member facing the fixed blade, the platen roller being coupled with an output side gear of the first gear set, the movable blade member slide mechanism being coupled with an output side gear of the second gear set, wherein the first gear set has a reduction ratio to achieve a paper feed pitch corresponding to a standard resolution, and the second gear set has a reduction ratio to achieve a paper feed pitch corresponding to a resolution other than the standard resolution.

According to one aspect of the present invention, in order to manufacture thermal printers having a first paper feed pitch and a second paper feed pitch, that is to manufacture two kinds of thermal printers having different paper feed pitches, two kinds of second modules having simple structures must be prepared. However, a complicated structure of a first module can be designed to have common parts. As a result, it is possible to reduce the fabrication cost of the thermal printer.

Other objects, features and advantages of the present invention will become more apparent from the following detailed description when read in conjunction with the accompanying drawings.

BRIEF DESCRIPTION OF THE DRAWINGS

FIGS. 72A through 72E are diagrams illustrating an exemplary structure of a thermal printer according to a third embodiment of the present invention;

DETAILED DESCRIPTION OF THE PREFERRED EMBODIMENTS

In the following, embodiments of the present invention will be described with reference to the accompanying drawings.

A first embodiment of the present invention is described.

Figure 1:
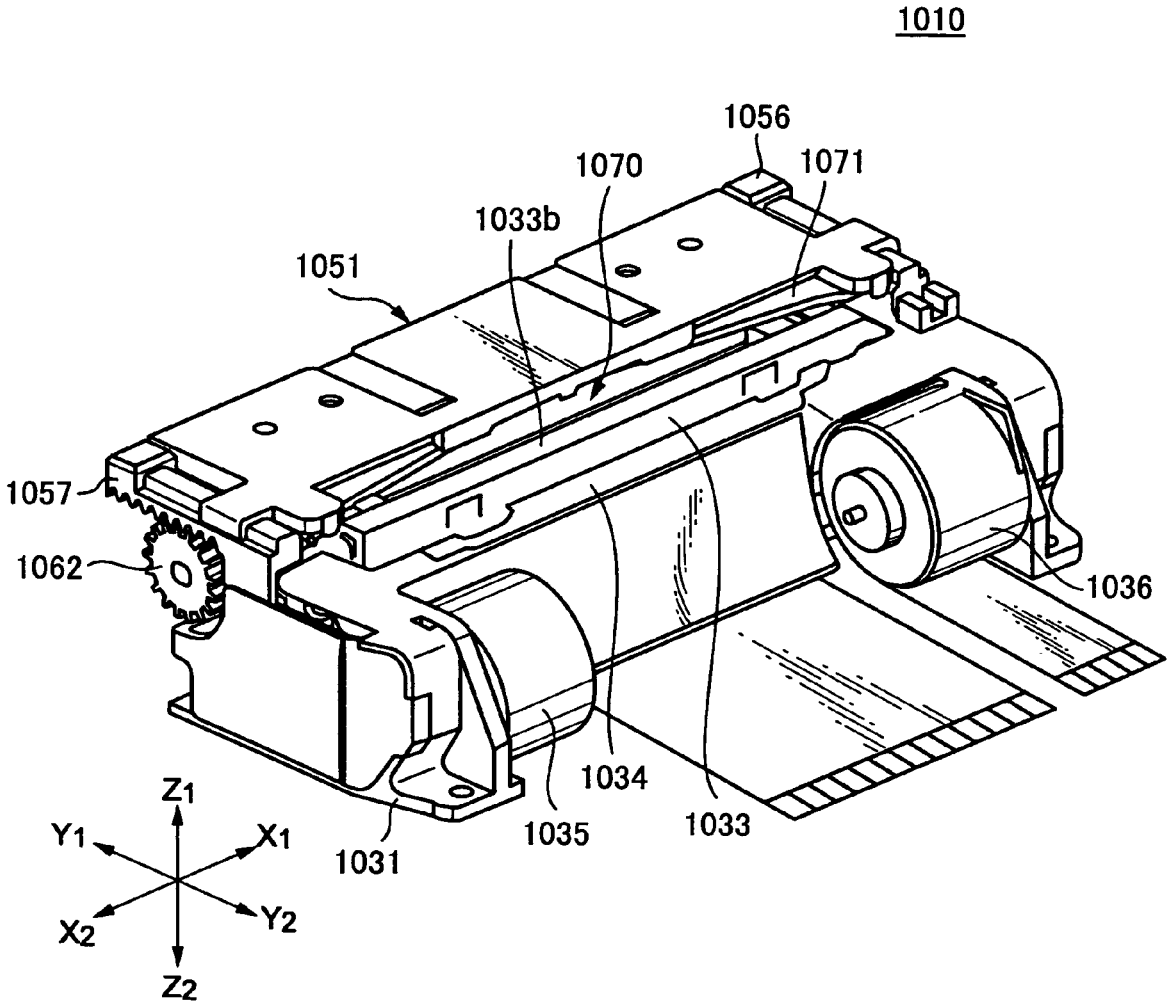
FIG. 1 is a perspective view showing a thermal printer according to a first embodiment of the present invention.
Figure 2:
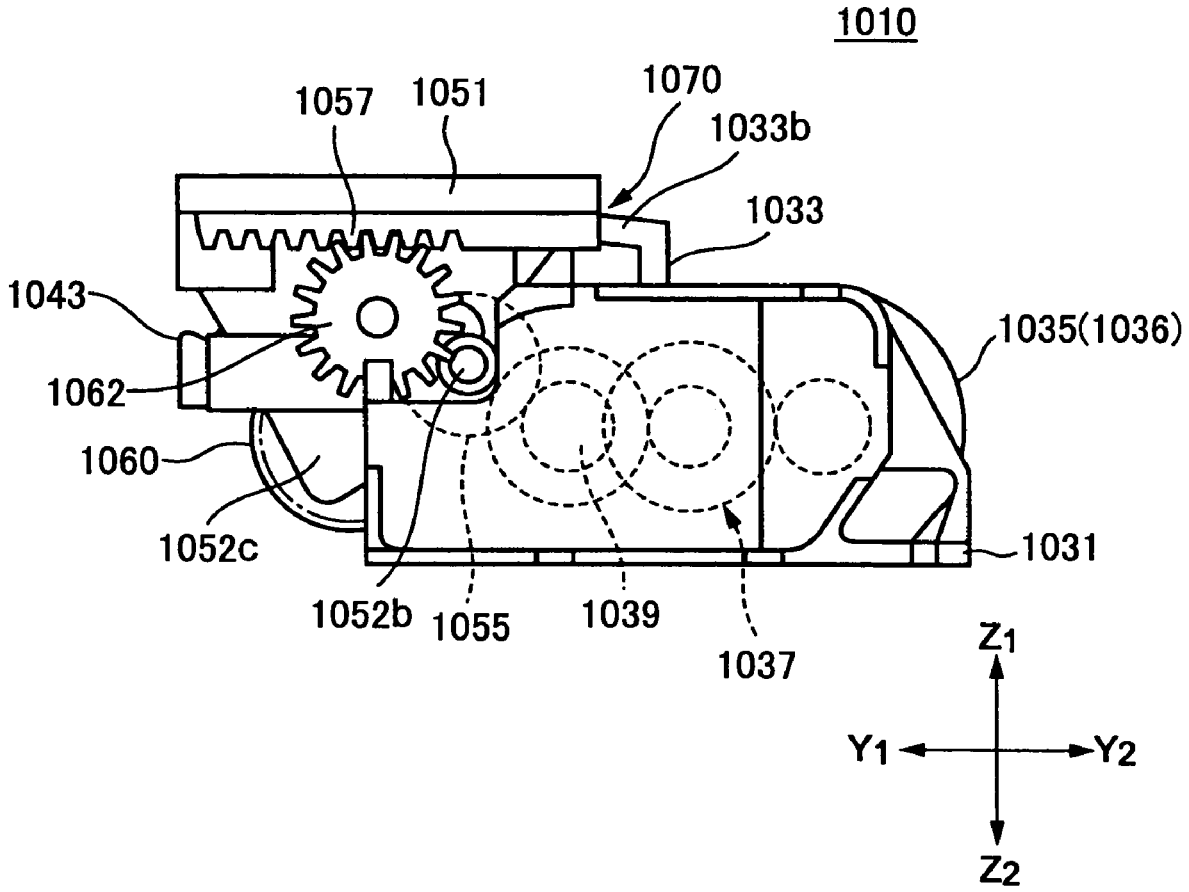
FIG. 2 is a side view showing the thermal printer shown in FIG. 1.
Figure 3A:
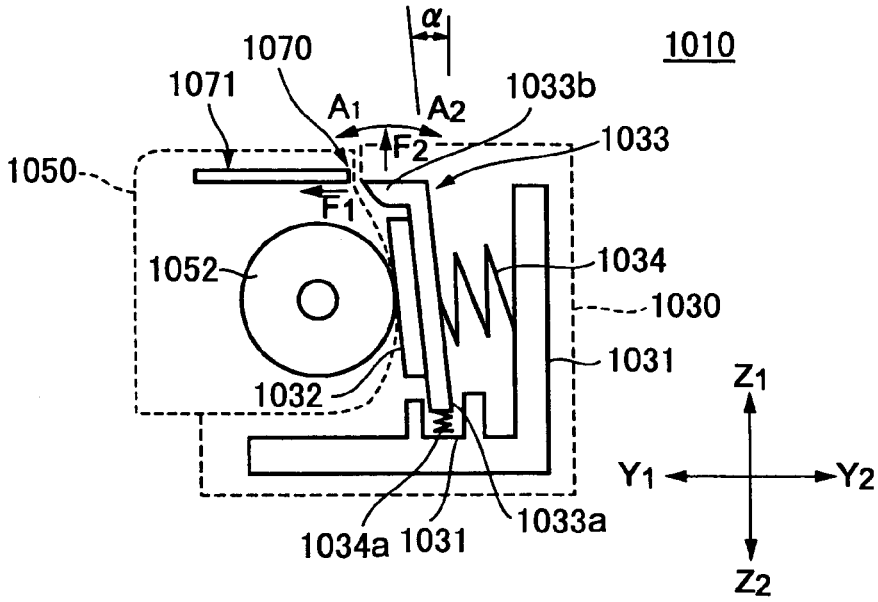
FIGS. 3A through 3C are schematic diagrams showing the thermal printer shown in FIG. 1.
Figure 3B:
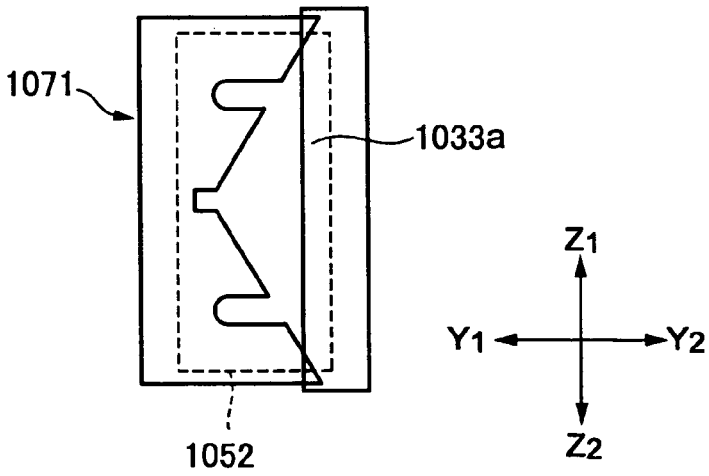
Figure 3C:
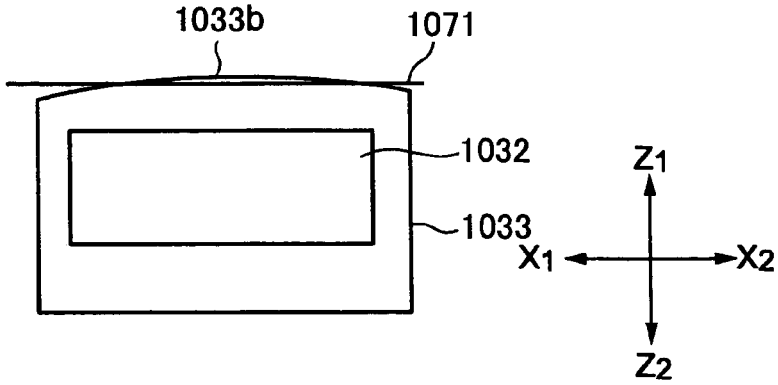
Figure 4A:
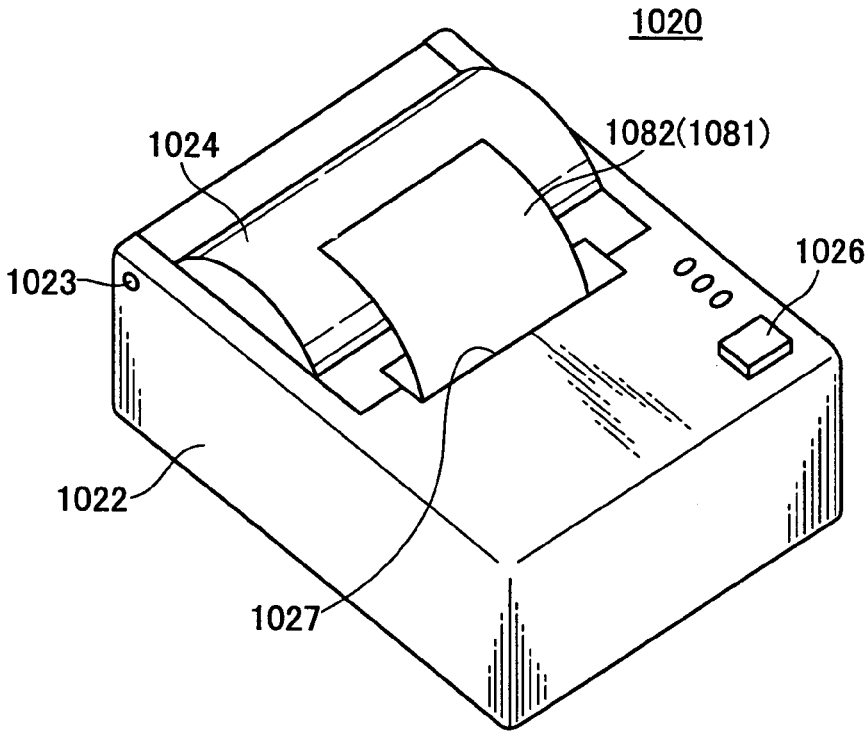
FIGS. 4A and 4B are perspective views showing a mobile terminal device incorporating the thermal printer shown in FIG. 1.
Figure 4B:
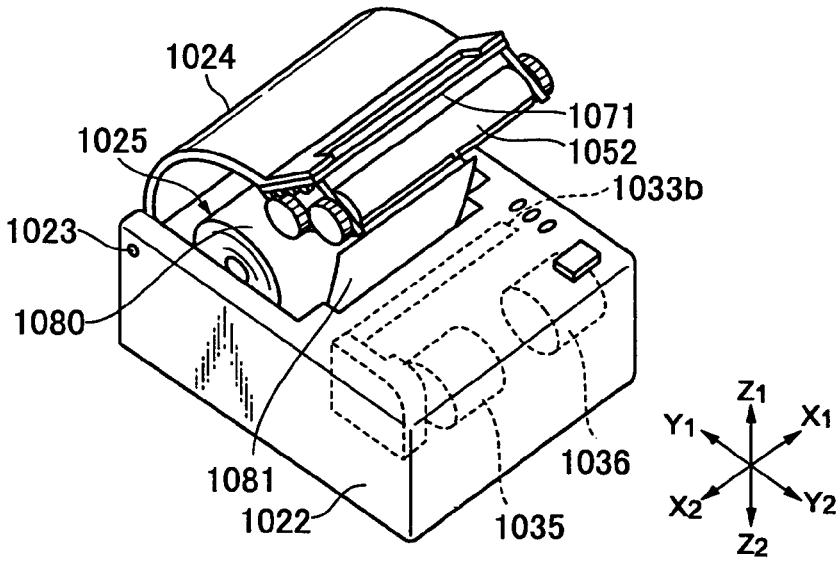
Figure 5:
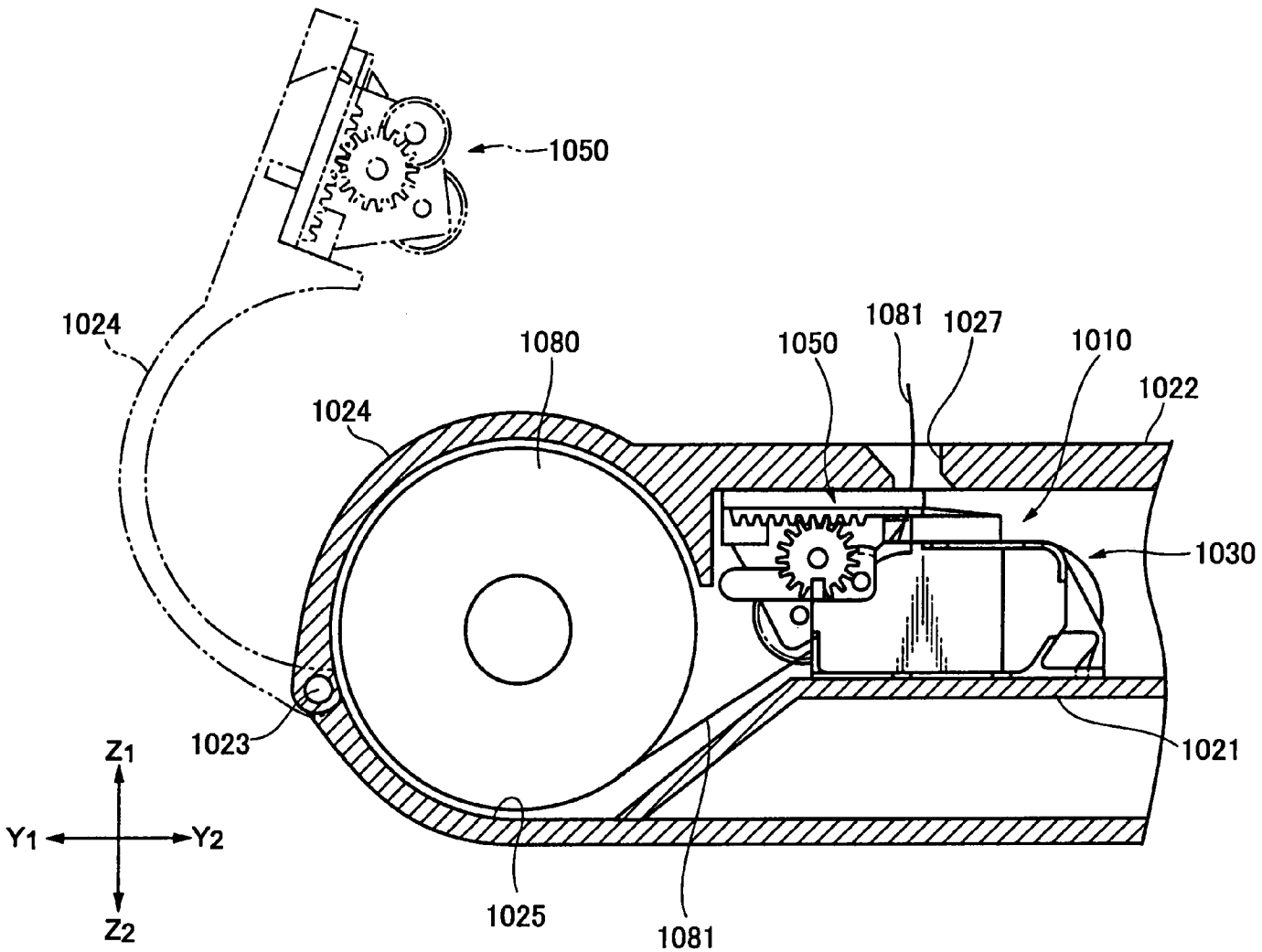
FIG. 5 is a diagram illustrating an exemplary structure of a printer part of the mobile terminal device shown in FIG. 4.

FIG. 1 and FIG. 2 show a thermal printer 1010 according to the first embodiment of the present invention. FIGS. 3A through 3C are schematic views showing the terminal printer 1010. The thermal printer 1010 is configured as a line printing and clamshell type thermal printer. FIGS. 4A and 4B show a mobile terminal device 1020 incorporating the thermal line printer 1010. FIG. 5 shows an exemplary structure of the mobile terminal device 1020 in a case where the mobile terminal device 1020 includes the thermal line printer 1010. Throughout these drawings, the X1-X2 shaft, the Y1-Y2 shaft and the Z1-Z2 shaft represent the width direction, the length direction and the height direction, respectively.

[Overall Structure and Operation]

Figure 6:
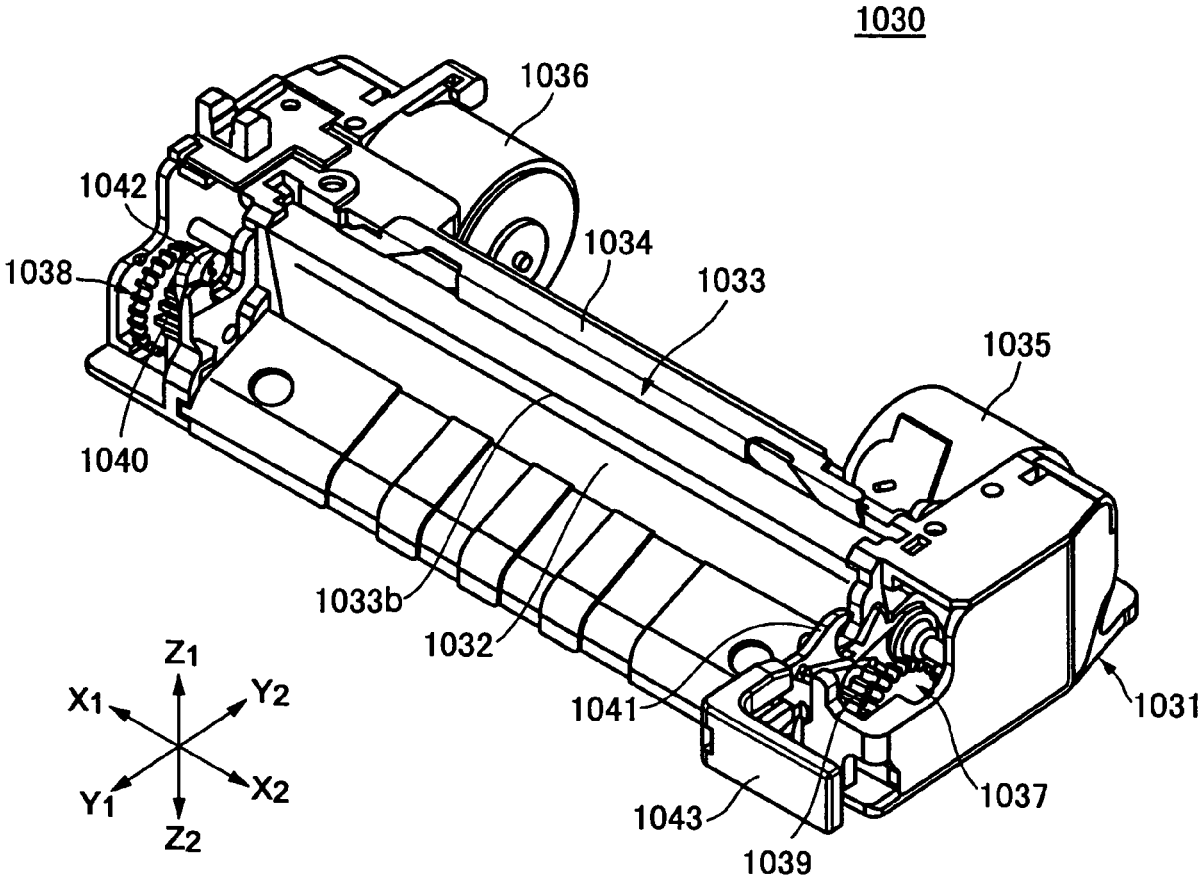
FIG. 6 is a perspective view showing a first module according to an embodiment of the present invention.
Figure 7:
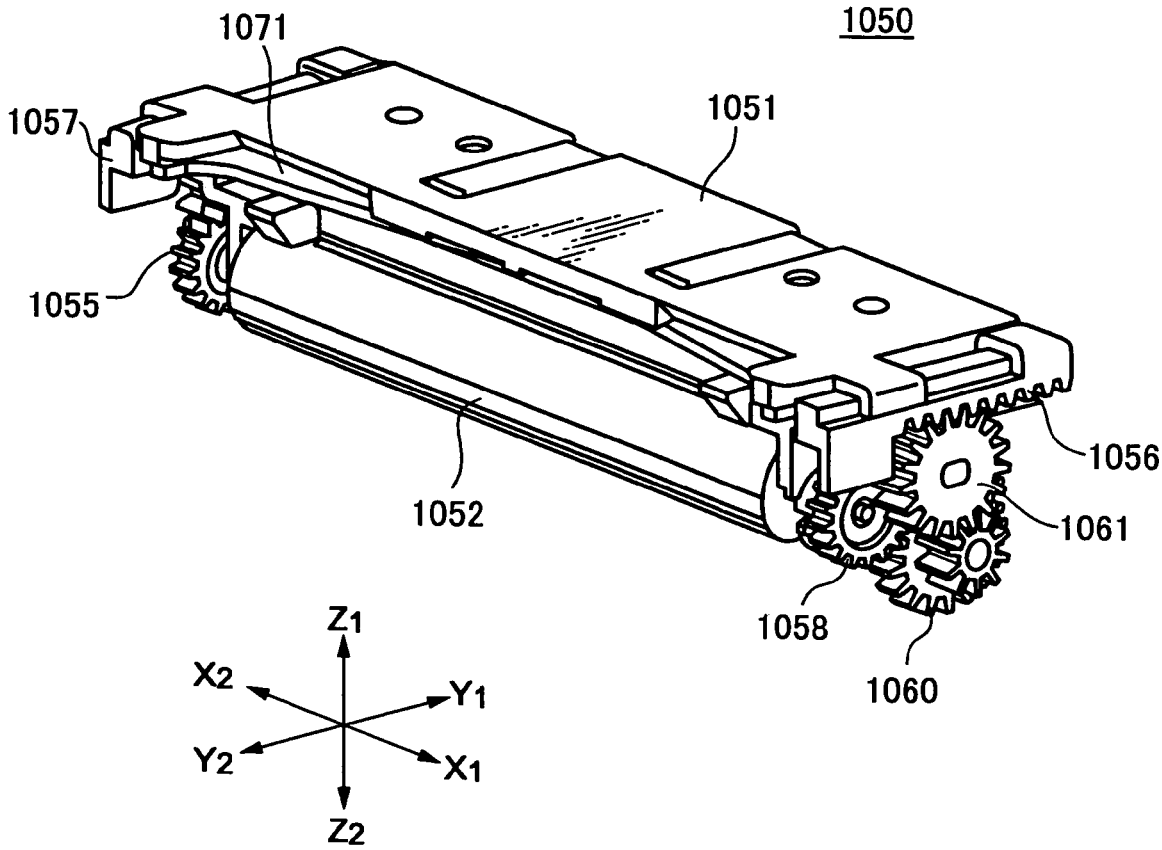
FIG. 7 is a perspective view showing a second module according to an embodiment of the present invention.

The thermal printer 1010 has such a structure that a first module 1030 shown in FIG. 6 is detachably combined with a second module 1050 shown in FIG. 7 and a cutter part 1070 is formed in a condition where the second module 1050 is combined with the first module 1030. The cutter part 1070 is disposed in the downstream side from a printing part with respect to a paper feed direction.

As shown in FIG. 6, the first module 1030 includes a thermal head support member 1033 having such a structure that a thermal head 1032 is fixed to a first support member 1031, a head pressure applying plate spring member 1034, first and second pulse motors 1035 and 1036, first and second gears 1037 and 1038 and platen roller lock members 1041 and 1042.

The thermal head support member 1033 has a size corresponding to the width of the first support member 1031. As shown in FIG. 3A, a Z2 end part 1033*a* of the thermal head support member 1033 is supported by a support part 1031*a* of the first support member 1031 in such a way that the thermal head support member 1033 can move in a small angle range in the A1-A2 direction, and the thermal head support member 1033 is inclined by an angle $\alpha$ in the Y1 direction with respect to the vertical surface of the thermal printer 1010. The thermal head 1032, which is fixed on the Y1 side surface of the first support member 1031, is pushed in the Al direction by the plate spring member 1034. The thermal head support member 1033 has a fixed blade part 1033*b*. The fixed blade part 1033*b* is formed by projecting the Z1 directional end of the thermal head support member 1033, which is made of a metal plate, in the Y1 direction. As shown in FIG. 3C, the fixed blade part 1033*b* is slightly convex-curved in the Z1 direction. A plate spring 1034*a*, which is integrally formed in the plate spring member 1034, is embraced in the support part 1031*a*, and the Z2 end part 1033*a* is supported by the plate spring member 1034*a*. In this structure, the fixed blade part 1033*b* can move in a small range in the Y1-Y2 direction and the Z1-Z2 direction. In addition, if the fixed blade 1033*b* moves in the Y2 direction, a Y1 directional blade pressure F1 is generated by spring force of the plate spring member 1034. Also, if the fixed blade 1033*b* moves in the Z2 direction, a Z1 directional blade pressure F2 is generated by spring force of the plate spring 1034*a*.

Figure 8:
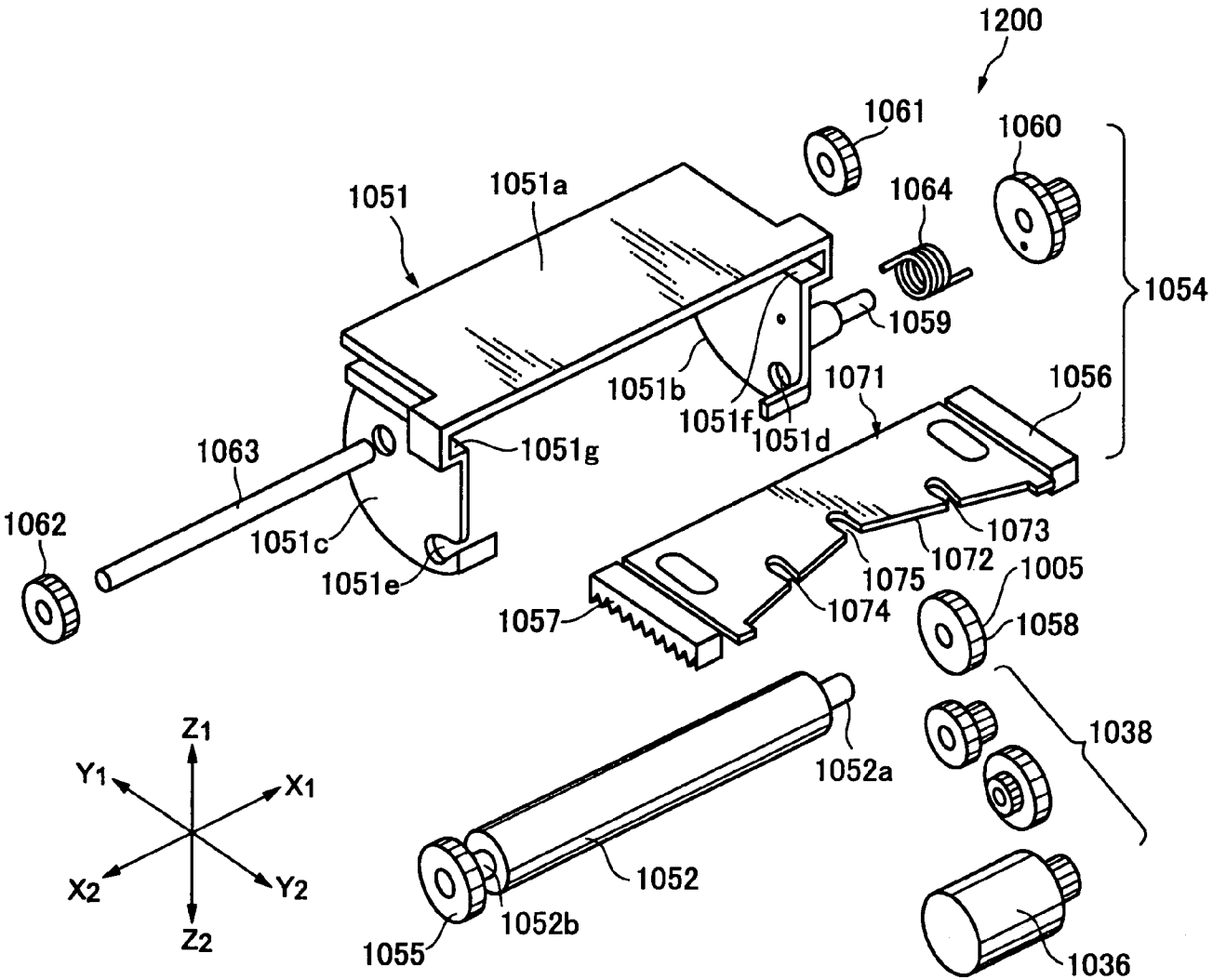
FIG. 8 is an exploded perspective view of the second module shown in FIG. 7.
Figure 9:
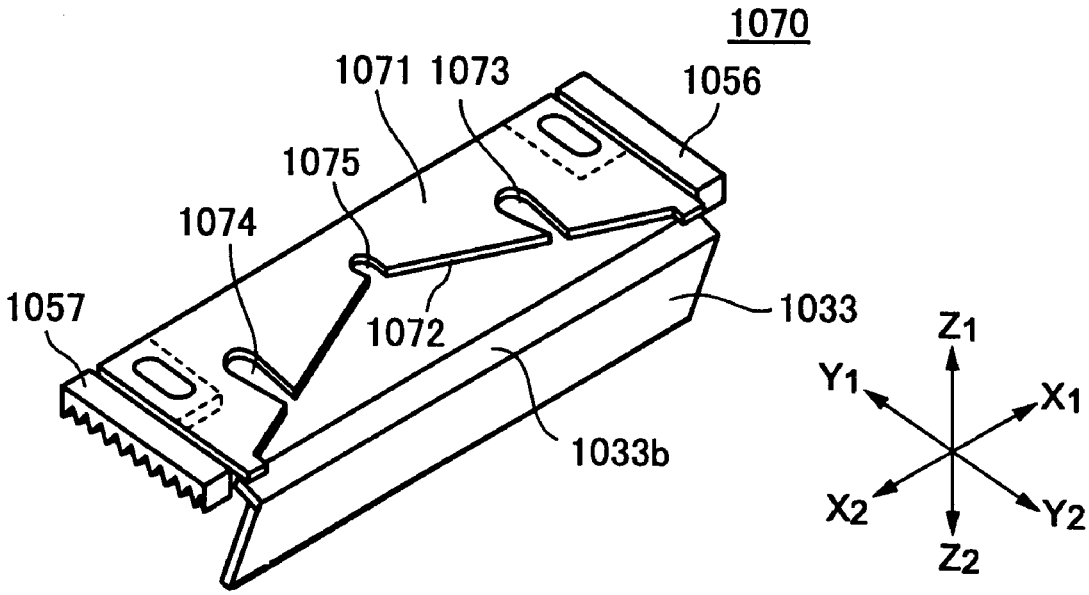
FIG. 9 is a diagram illustrating a cutter part according to an embodiment of the present invention.

The first pulse motor 1035 is for rotationally driving a platen, and a gear of the spindle of the first pulse motor 1035 is engaged with the first gear 1037. On the other hand, the second pulse motor 1036 is for shifting a movable blade, and a gear 1036*a* of the spindle of the second pulse motor 1036 is engaged with the second gear 1038, as illustrated in FIG. 8. In the illustration, a small diameter gear 1039 is provided in the output side of the first gear 1037, and a small diameter gear 1040 is provided in the output side of the second gear 1038.

As shown in FIG. 6, the platen lock members 1041 and 1042 are disposed in the X2 and X1 sides, respectively. Also, an operation knob 1043 is provided to the platen lock member 1041.

As shown in FIG. 7 and FIG. 8, a second module 1050 has such a structure that a platen roller 1052, a movable blade member 1071 and a gear 1054 are mounted to an almost U-shaped second support member 1051. FIG. 8 is an exploded perspective view showing the second module 1050 wherein the shape of each member thereof is roughly illustrated. A mechanism 1200 to slide the movable blade member 1071 back and forth is composed of the gear 1054 and racks 1056 and 1057.

The almost U-shaped second support member 1051 includes a top plate part 1051*a* and flange parts 1051*b* and 1051*c* disposed in the both sides of the top plate part 1051*a*. The platen roller 1052 is supported by having such a structure that shaft parts 1052*a* and 1052*b*, which are projected at the both sides of the platen roller 1052, are engaged with shaft receiver parts 1051*d* and 1051*e*, respectively, of the second support member 1051. In addition, a gear 1055 is fixed to the shaft part 1052*b*. The movable blade member 1071 includes a V-shaped blade part 1072 having the V-shape bottom in the Y directional side, and is fixed to the rack parts 1056 and 1057 in the X1 and X2 sides, respectively. The movable blade member 1071 is supported by having such a structure that the rack parts 1056 and 1057 are supported to guide parts 1051*f* and 1051*g* formed in flange parts 1051*b* and 1051*c*, respectively, and can be shifted in the Y1-Y2 direction. The cutter part 1070 is composed of the fixed blade part 1033*b* formed in the thermal head support member 1033 and the movable blade member 1071. The cutter part 1070 can cut a paper in such ways that the paper can be partially cut except for three points, two points and one point. In order to realize these cutting manners, the movable blade member 1071 includes three notch parts 1073, 1074 and 1075, the shapes of which are described in detail below. The gear set 1054 includes a gear 1058 supported by the shaft part 1052*a*, a gear 1060 supported by a shaft 1059 on the flange part 1051*b* by being engaged with the gear 1058, a pinion 1061 engaged with the gear 1060, and another pinion 1062. The pinions 1061 and 1062 are fixed to both ends of an shaft member 1063 bridged between the flange parts 1051*b* and 1051*c*, and are engaged with the racks 1056 and 1057, respectively. A recovery spring 1064 is tensed between the gear 1060 and the flange part 1051*b* by the shaft 1059. The recovery spring 1064 forces the movable blade member 1071 to be shifted in the Y1 direction and be pulled in the interior of the second support member 1051.

The thermal line printer 1010 is incorporated into the mobile terminal device 1020, as illustrated in FIGS. 4A and 4B and FIG. 5. The mobile terminal device 1020 includes a chassis 1021, a casing 1022 for covering the chassis 1021, a lid 1024 supported to the Y1 side shaft 1023, a Y1 side roll paper accommodation part 1025, and an operation button 1026 on the casing 1022. The first module 1030 is fixed at a position in the casing 1022 so as to face the roll paper accommodation part 1025. The second module 1050 is fixed on bottom surface of the edge part of the lid 1024.

As shown by dot lines in FIG. 4B and FIG. 5, the lid 1024 is opened, and a thermal paper roll 1080 is mounted in the roll accommodation part 1025. Then, when the lid 1024 is closed, the second module 1050 is combined with the first module 1030, as illustrated in FIG. 4A and FIG. 5. Specifically, the shaft parts 1052*a* and 1052*b* of the platen roller 1052 are locked by being engaged with the platen roller lock members 1041 and 1042, and the platen roller 1052 presses the paper 1081 on the thermal head 1032. The end of the paper 1081 is protruded from an exit 1027. Also, the cutter part 1070 is formed to have such a structure that the blade part 1072 of the movable blade member 1071 is located to face the fixed blade part 1033*b*. In addition, the gear 1055 is engaged with the small diameter gear 1039, and the gear 1058 is engaged with the small diameter gear 1040.

In response to an print instruction, the thermal head 1032 is driven and heated, and at the same time, the motor 1035 is driven to rotate the platen roller 1052 via the first gear set 1037 and the gear 1055. At this time, a printed paper portion 1082 passes the cutter part 1070, and is propelled out from the exit 1027. Heat generated in the thermal head 1032 is released through the thermal head support member 1033. Upon completion of the printing, a cut instruction is issued, and the motor 1036 is driven. Then, the racks 1056 and 1057 are driven via the second gear set 1038, the gear set 1054 and the pinions 1061 and 1062. Also, both X1-X2 sides of the movable blade member 1071 are driven, and the movable blade member 1071 is slid in the Y2 direction through guidance of the X1-X2 sides by guide parts 1051*f* and 1051*g*. Then, the motor 1036 is inversely driven so that the movable blade member 1071 is slid back in the Y1 direction and the printed paper portion 1082 is cut.

When the operation knob 1043 is manipulated, the locked shaft parts 1052*a* and 1052*b* of the platen roller 1052 are unlocked, and a thermal paper roll can be replenished from the opened lid 1024.

It is noted that the thermal head support member 1033 may be inclined in the Y2 direction with respect to the vertical surface of the thermal printer 1010 by contrast with the above-mentioned structure.

[Structure and Operation of the Cutter Part 1070]

An exemplary structure of the cutter part 1070 is described.

As shown in FIGS. 3A through 3C, FIG. 9 and FIG. 10, the movable blade member 1071 is disposed to face the fixed blade 1033*b*. The fixed blade 1033*b* is formed as a portion of the thermal head support member 1033, and the cutter part 1070 has no fixed blade member as an independent component. Accordingly, the thermal line printer 1010 can be configured from a smaller number of components than conventional thermal line printers, and thereby it is possible to shorten the dimension of the thermal line printer 1010 with respect to the Z1-Z2 direction. As a result, the thermal line printer 1010 can be designed to have a shortened height and a reduced weight.

As shown in FIG. 3C, the fixed blade part 1033*b* is slightly convex-curved with respect to the Z1 direction. In addition, as shown in FIG. 3B, the blade part 1072 of the movable blade member 1071 is V-shaped such that the V-shape has the bottom in the Y1 direction. Thus, when the movable blade member 1071 is slid in the Y2 direction, the blade part 1072 of the movable blade member 1071 is in contact with the fixed blade part 1033*b* at two contact points. Then, while predefined blade pressure is applied to the contact points, the contact points move from both ends to the center of the X1-X2 direction. Thereby, proper shear force makes it possible to smoothly cut a paper.

Figure 10:
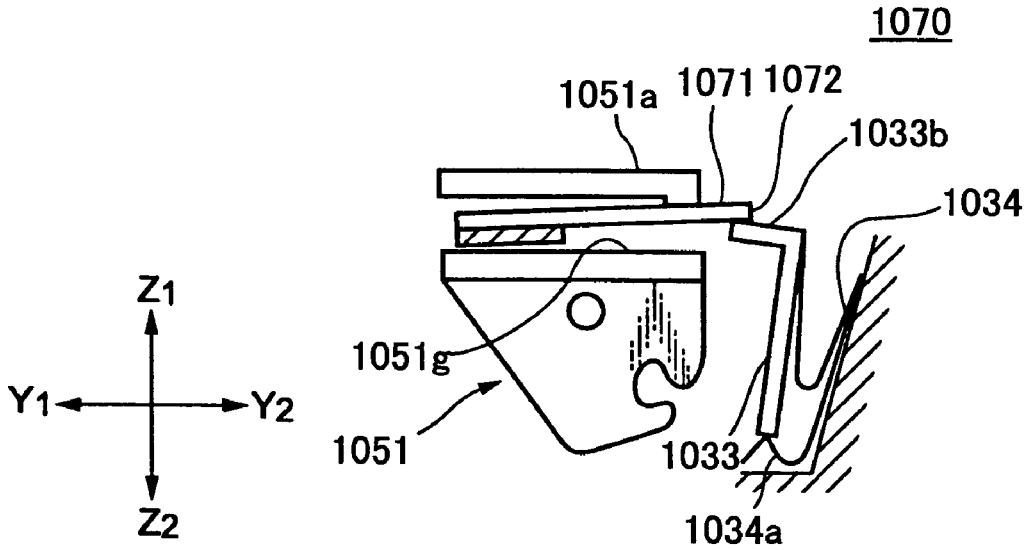
FIG. 10 is a side view showing the cutter part shown in FIG. 9.

A description is given of how blade pressure is generated. As shown in FIG. 10, the movable blade member 1071 has limited movement in the Z1 direction in such a way that both sides of the X1-X2 direction are guided by the top plate part 1051*a*. In this structure, the blade part 1072 of the movable blade member 1071 is slid in the Y2 direction under a condition where the blade part 1072 applies Y2 directional force to the fixed blade part 1033*b*. As a result, the Z2 and Y2 directional forces are applied to the fixed blade part 1033*b*, and the fixed blade part 1033*b* is shifted in the Y2 and Z2 directions as the plate spring member 1034 and the plate spring 1034*a*. Thereby, spring forces of the plate spring member 1034 and the plate spring 1034*a* cause Y1 directional blade pressure F1 and Z1 directional blade pressure F2, respectively, for the fixed blade part 1033*b*. Thus, like the case where the fixed blade member is incorporated as an independent component, the blade pressures F1 and F2 is generated.

Also, as shown in FIG. 3A, the thermal head support member 1033 is inclined by the angle a in the Y1 direction with respect to the vertical surface of the thermal line printer 1010. During Y1 directional shifting of the movable blade member 1071, when the thermal head support member 1033 is rotated in the Al direction in a condition where the thermal head support member 1033 is coupled to the movable blade member 1071, the fixed blade part 1033*b* is shifted in the Z1-Z2 direction away from the Z2 direction and the blade part 1072. As a result, friction between the movable blade member 1071 and the fixed blade part 1033*b* can be reduced. Accordingly, it is possible to smoothly slide the movable blade member 1071 back in the Y1 direction.

If the thermal head support member 1033 is inclined in the Y2 direction with respect to the vertical surface of the thermal line printer 1010, the appropriate curve of the plate spring 1034*a* makes it possible to absorb extremely high blade pressure during the Y2 directional sliding of the movable blade member 1071.

Figures 11A, 11B, 11C:
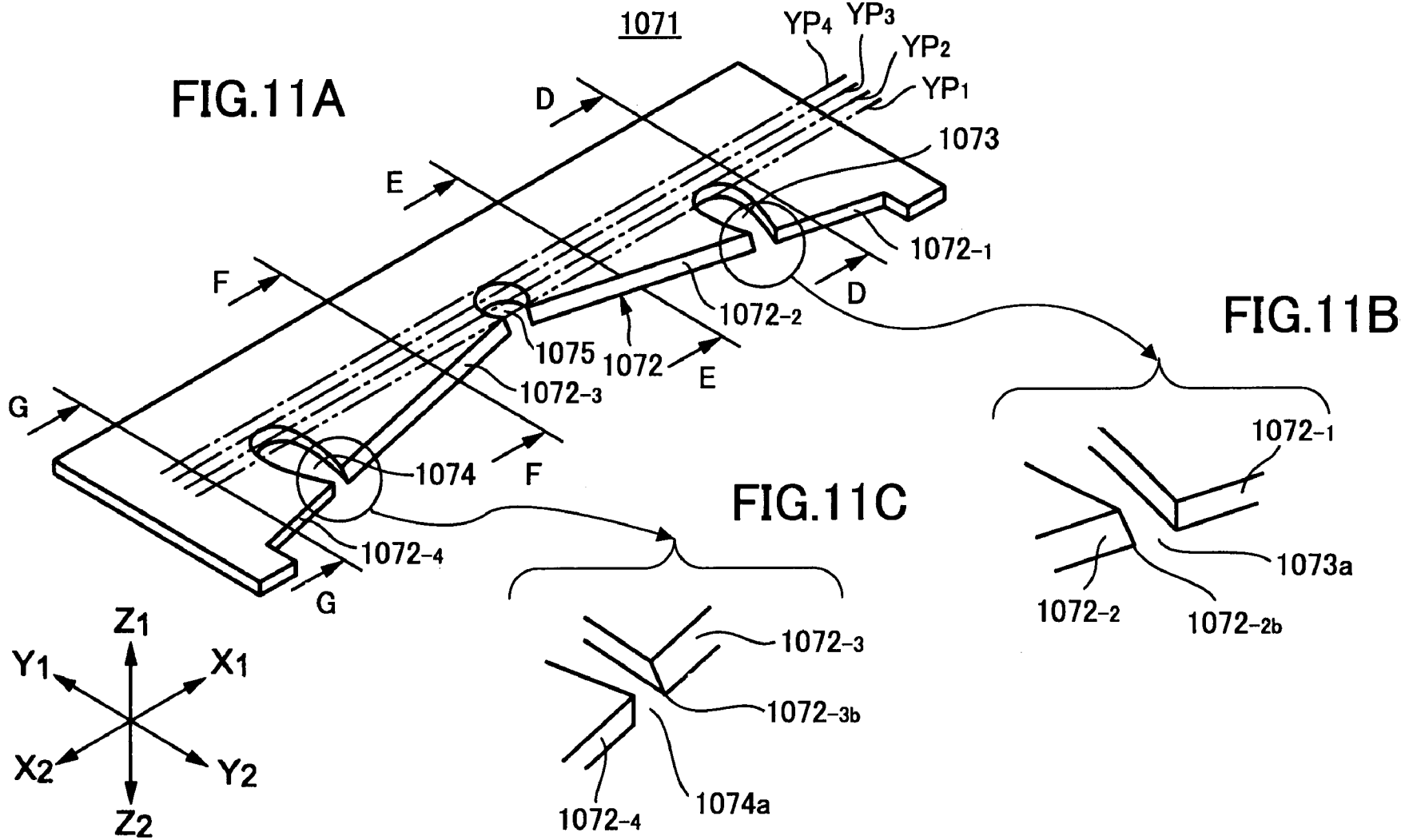
FIGS. 11A through 11G are enlarged views showing a movable blade member and portions thereof according to an embodiment of the present invention.
Figure 12:
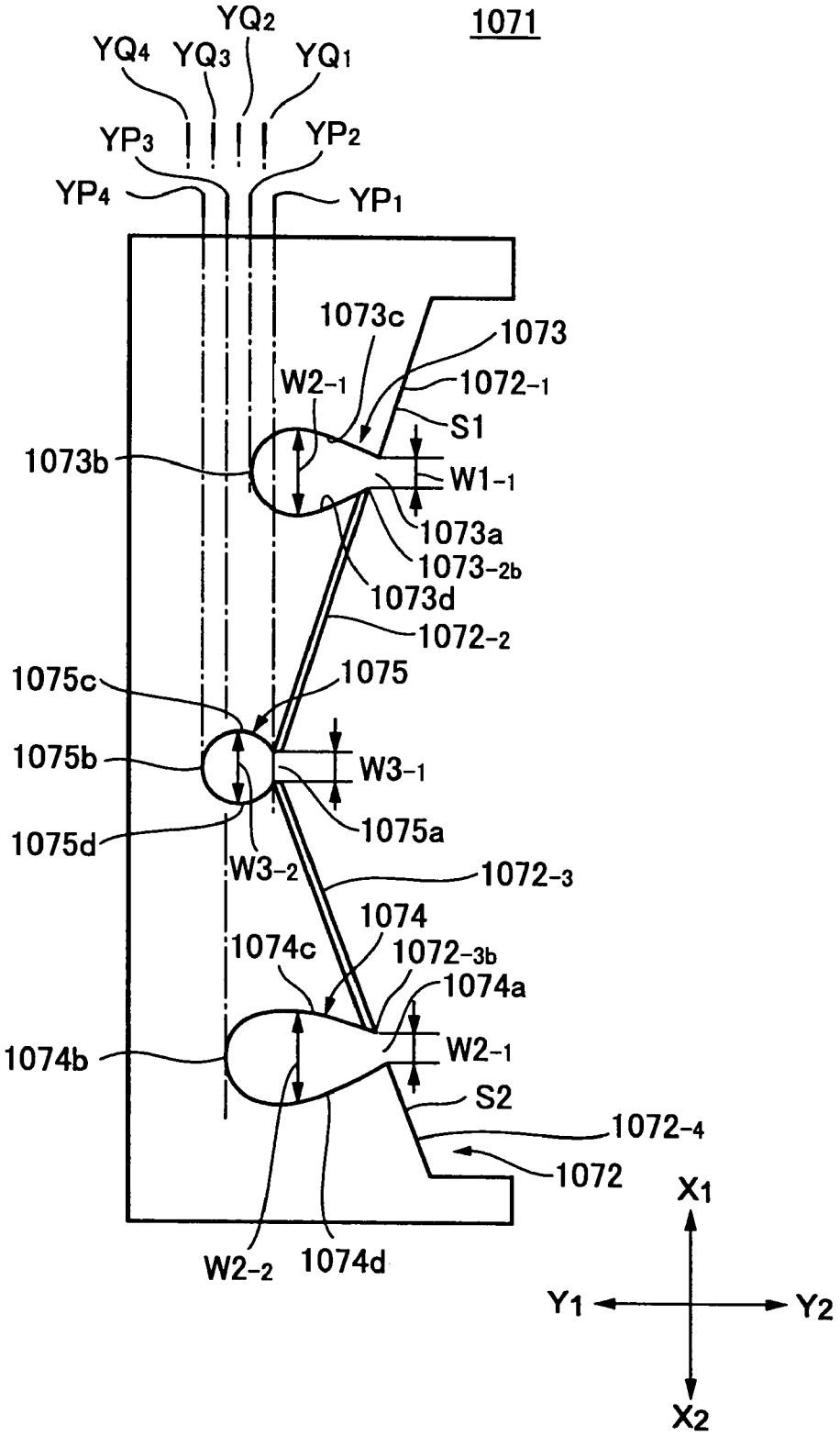
FIG. 12 is a plan view showing the movable blade member shown in FIG. 11.

Also, as shown in FIG. 11A and FIG. 12, the movable blade member 1071 includes the V-shaped blade part 1072 having a pair of slopes S1 and S2. In addition, the movable blade member 1071 includes a first notch part 1073 along the slope S1, a second notch part 74 along the slope S2, and a third notch part 1075 at the bottom of the V shape. The third notch part 75 is formed as an almost circle, and the first and second notch parts 1073 and 1074 are formed as ovals having long axes in the Y1-Y2 direction.

As shown in FIG. 12, the first notch part 1073 includes an entrance part 1073*a* having a width W11 with respect to the X1-X2 direction, a most inner edge part 1073*b* located at the most inner position with respect to the Y1 direction, and edge parts 1073*c* and 1073*d* located between the entrance part 1073*a* and the most inner edge part 1073*b*. Each of the edge parts 1073*c* and 1073*d* is widen in the X1-X2 direction toward the Y1 direction from the entrance part 1073*a*. In other words, a width W21 between edge parts 1073*c* and 1073*d* is greater than the width W11 of the entrance part 1073*a*, that is, W21>W11.

Like the first notch part 1073, the second notch part 1074 includes an entrance part 1074*a* having a width W21, a most inner edge part 1074*b*, and edge parts 1074*c* and 1074*d* located to have a width W22 between the edge parts 1074*c* and 1074*d*. For the second notch part 1074, it holds that W22>W12.

The third notch part 1075 includes an entrance part 1075*a* having a width W13, a most inner edge part 1075*b*, and edge parts 1075*c* and 1075*d* located to have a width W23 between the edge parts 1075*c* and 1075*d*. For the third notch part 1075, it holds that W23>W13.

Regarding the Y1-Y2 direction, YP2, YP3 and YP4 represent positions of the most inner edge parts 1073*b*, 1074*b* and 1075*b*, respectively. Also, YP1 represents a position slightly shifted in the Y1 direction from the entrance part 1075*a* of the third notch part 1075. YP1 is positioned in the nearest side with respect to the Y2 direction. YP2 is positioned in the Y1 directional side from YP1. YP3 is positioned in the Y1 directional side from YP2. YP4 is positioned in the Y1 directional side from YP3. Thus, YP1, YP2, YP3 and YP4 are aligned in this order with respect to the Y1 direction. In other words, the most inner edge parts 1073*b*, 1074*b* and 1075*b* of the first, the second and the third notch parts 1073, 1074 and 1075, respectively, are positioned differently with respect to the Y1-Y2 direction.

In FIG. 12, YQ1 through YQ4 represent positions of the fixed blade part 1033*b* relative to the position of the movable blade member 1071. YQ2 is positioned between YP2 and YP3. YQ3 is positioned between YP3 and YP4. YQ4 is positioned in the Y1 directional side from YP4. YQ1 is positioned in the Y2 directional side from YP1.

Figure 11D:
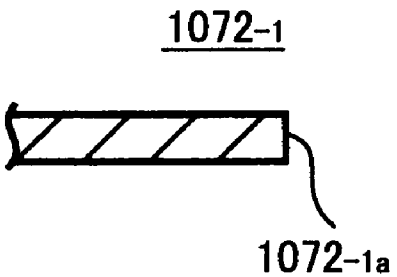
Figure 11E:
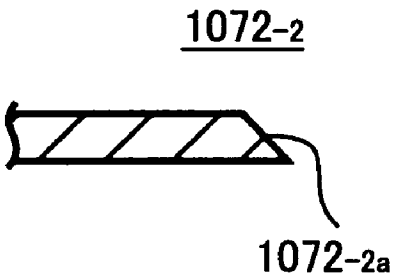
Figure 11F:
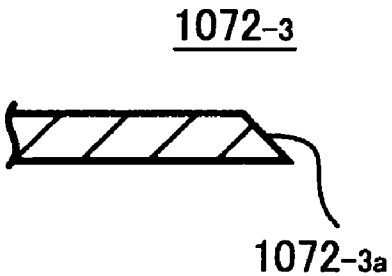
Figure 11G:
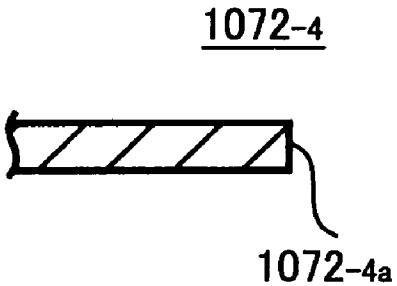

The blade part 1072 is described. The blade part 1072 includes a blade part 1072-1, which is an X1 side portion of the blade part 1072 from the first notch part 1073, a blade part 1072-2, which is a portion of the blade part 1072 between the first and the third notch parts 1073 and 1075, a blade portion 1072-3, which is a portion of the blade part 1072 between the second and the third notch parts 1074 and 1075, and a blade portion 1072-4, which is an X2 side portion of the blade part 1072 from the second notch part 1074. As shown in FIGS. 11D and 11G, the blade parts 1072-1 and 1072-4 include vertical surfaces 1072-1*a* and 1072-4*a*. As shown in FIGS. 11E and 11F, the blade parts 1072-2 and 1072-3 include slope surfaces 1072-2*a* and 1072-3*a* projecting in the Z1 side in the Y2 direction. The blade part 1072-2 having the slope surface 1072-2*a* is wedge-shaped, and as shown in FIG. 11B, the blade part 1072-2 includes a sharp part 1072-2*b*, which is sharpened in the Y2 direction, at the X1 end, that is, at a position facing the entrance part 1073*a* of the blade part 1072-2. Similarly, the blade part 1072-3 is wedge-shaped, and as shown in FIG. 11C, the blade part 1072-3 includes a sharp part 1072-3*b*, which is sharpened in the Y2 direction, at the X2 end, that is, at a position facing the entrance part 1073*a* of the blade part 1072-3. As described below, the sharp parts 1072-2*b* and 1072-3*b* occupy positions where cutting of a paper is restarted by piercing the paper, and the sharp shapes are useful to start to smoothly cut the paper.

An exemplary paper cut operation of the cutter part 1070 is described.

Figure 13A:
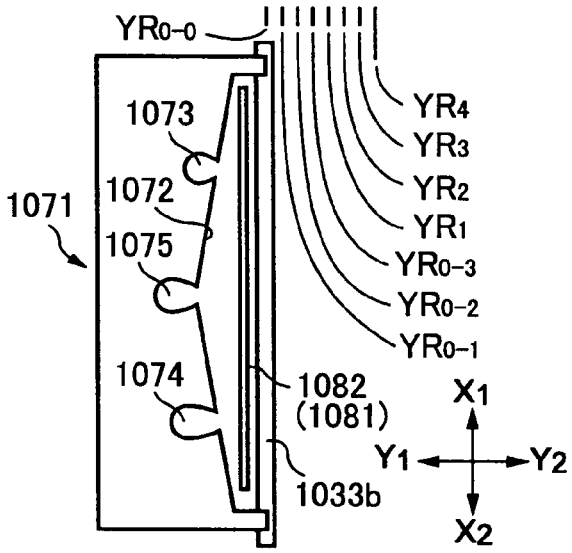
FIGS. 13A and 13B are diagrams illustrating the cutter part shown in FIG. 9 before operation.
Figure 13B:
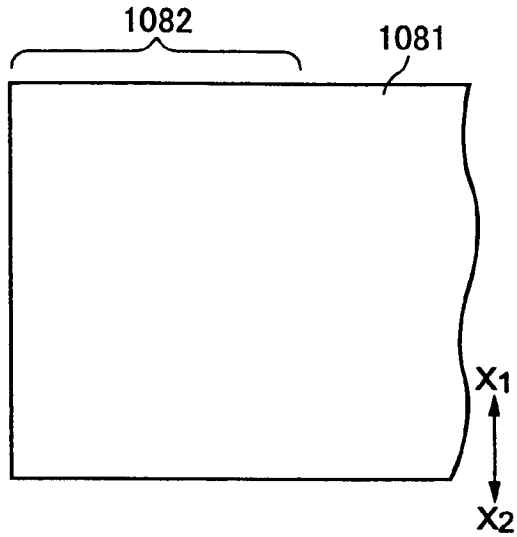

FIGS. 13A and 13B show an exemplary condition of the cutter part 1070 before start of the operation. FIG. 14 through FIG. 20 illustrate positions of the movable blade member 1071 slid in the Y2 direction and paper cutting conditions corresponding to the positions. FIGS. 14A through 20A show positions of the movable blade member 1071 relative to the fixed blade part 1033*b*. FIGS. 14B through 20B show paper cutting conditions. The movable blade member 1071 is shifted to YR4 via YR0-1, TR0-2, YR0-1, TR0-3, YR1, YR2 and YR3. Depending on types of instructions, the final position of the movable blade member 1071 may be set as YR1, YR2 or YR3. It is noted that YR1, YR2, YR3 and YR4 correspond to YQ1, YQ2, YQ3 and YQ4, respectively.

As shown FIGS. 13A and 13B, the movable blade member 1071, which is in a status where the operation of the movable blade member 1071 is not started, is positioned at YR0-0, and the paper 1081 has not been cut.

Figure 14A:
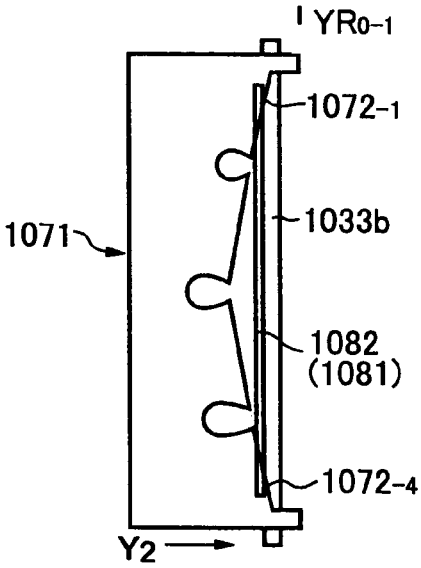
FIGS. 14A and 14B are diagrams showing a condition where the movable blade member starts to be slid to start cutting.
Figure 14B:
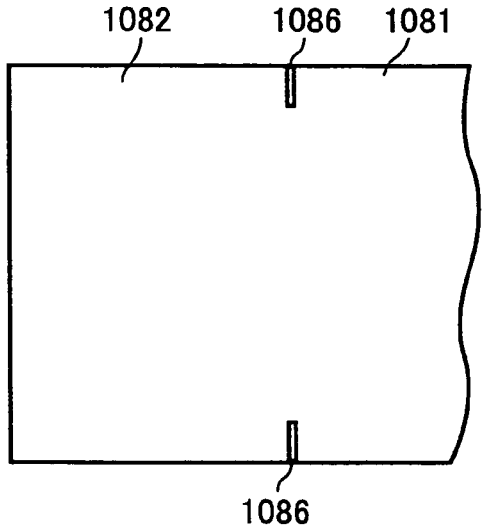

When the movable blade member 1071 starts to move in the Y2 direction, the blade parts 1072-1 and 1072-4 overlap the fixed blade part 1033*b*, and the paper 1081 starts to be cut from the X1 and X2 sides. In a condition where the movable blade member 1071 is positioned at YR0-1 as illustrated in FIG. 14A, the paper 1081 is in a cutting condition where the paper 1081 has a cut portion 1086 shown in FIG. 14B.

Figure 15A:
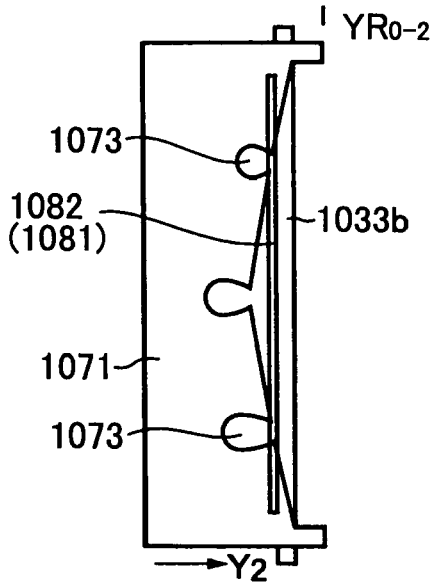
FIGS. 15A and 15B are diagrams showing a condition where the movable blade member is further slid and the cutting is interrupted.
Figure 15B:
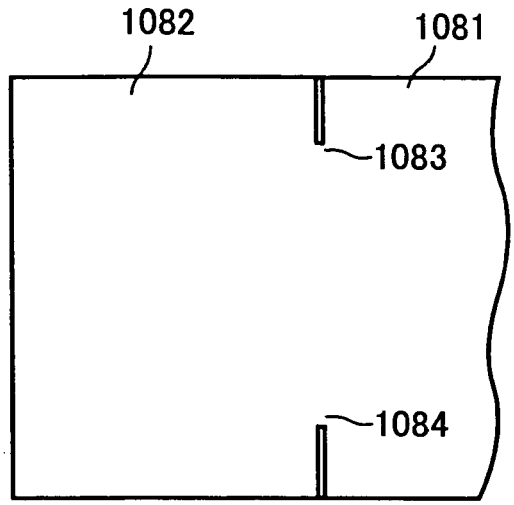

When the movable blade member 1071 moves to YR0-2 as illustrated in FIG. 15A, the entrance parts 1073*a* and 1074*a* of the first and the second. notch parts 1073 and 1074, respectively, overlap the fixed blade part 1033*b*, and the cutting of the paper 1081 stops. As shown in FIG. 15B, first and second uncut portions 1083 and 1084 start to be formed in the paper 1081. The first uncut portion 1083 of the first notch part 1073 is in a condition shown in FIG. 21B.

Figure 16A:
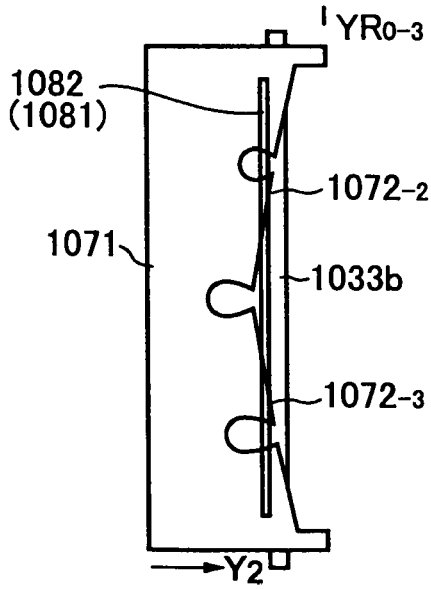
FIGS. 16A and 16B are diagrams showing a condition where the movable blade member is further slid and the cutting restarts.
Figure 16B:
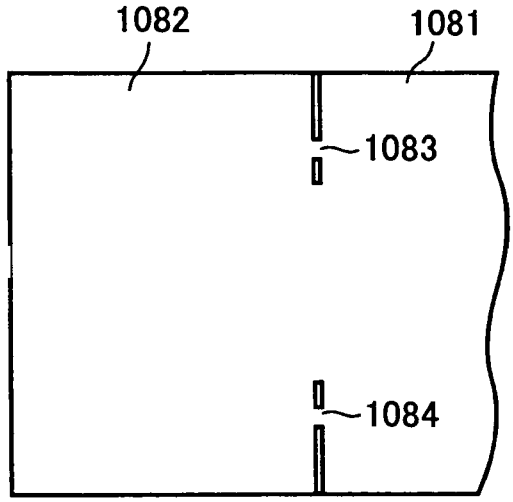

When the movable blade member 1071 moves to the YR0-3 as illustrated in FIG. 16A, the blade parts 1072-2 and 1072-3 start to overlap the fixed blade part 1033*b*, and the cutting of the paper 1081 restarts. As shown in FIG. 16B, the first and the second uncut portions 1083 and 1084 are formed, and the paper 1081 restarts to be cut from the X2 end of the first uncut part 1083 and the X1 end of the second uncut part 1084. The first uncut portion 1083 of the first notch part 1073 is in a condition shown in FIG. 21C.

Here, the cutting of the paper 1081 restarts with a portion other than the cut ends of the paper 1081, that is, the surface of the paper 1081. In order to smoothly restart the cutting of the paper 1081, the paper 1081 is pierced by the sharp parts 1072-2*b* and 1072-3*b*. Also, as in the case shown in FIG. 14A, the paper 1081 is cut by shear force generated through movement of contact points where blade pressure is applied. Accordingly, since it is possible to prevent generation of paper powder, the thermal printer 1010 having the cutter part 1070 is preferably used, for example, in a kitchen from the aspect of good hygiene.

Figure 17A:
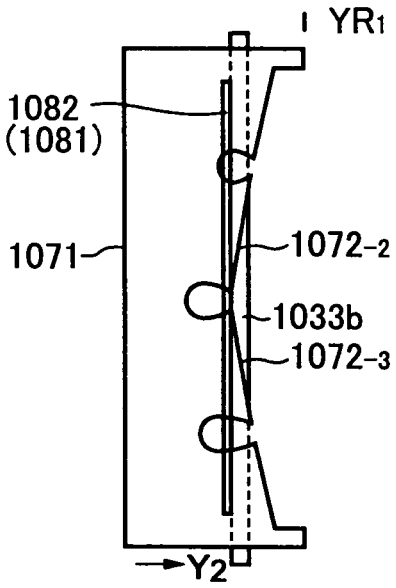
FIGS. 17A and 17B are diagrams showing a condition where the movable blade member is further slid and a paper is cut in three-point left partial cutting.
Figure 17B:
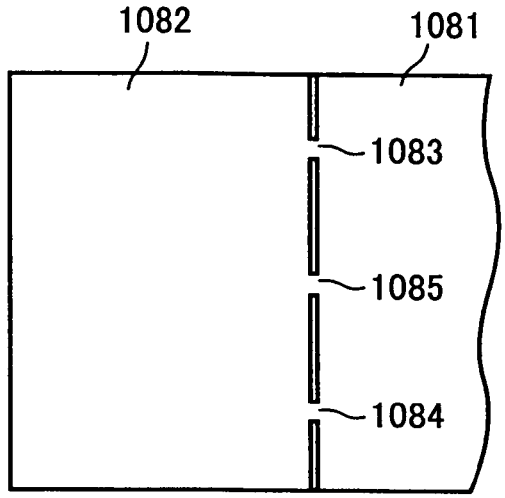

When the movable blade member 1071 moves to YR1 as illustrated in FIG. 17A, the blade parts 1072-2 and 1072-3 pass through the fixed blade part 1033*b*, and the third notch part 1075 overlaps the fixed blade part 1033*b*. At this time, as shown in FIG. 17B, a third uncut part 1085 is formed in the paper 1081. The paper 1081 is cut in a condition where the third uncut part 1085 is formed at the center with respect to the width direction of the paper 1081 and the first and the second uncut parts 1083 and 1084 are formed at the both ends thereof, that is, in a three-point left partial cutting condition. The first uncut portion 1083 of the first notch part 1073 is in a condition shown in FIG. 21D.

Figure 18A:
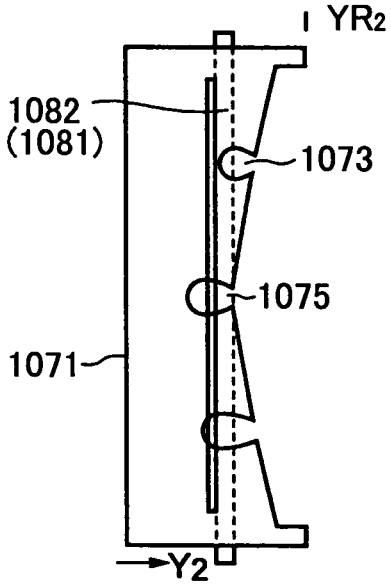
FIGS. 18A and 18B are diagrams showing a condition where the movable blade member is further slid and the paper is cut in two-point left partial cutting.
Figure 18B:
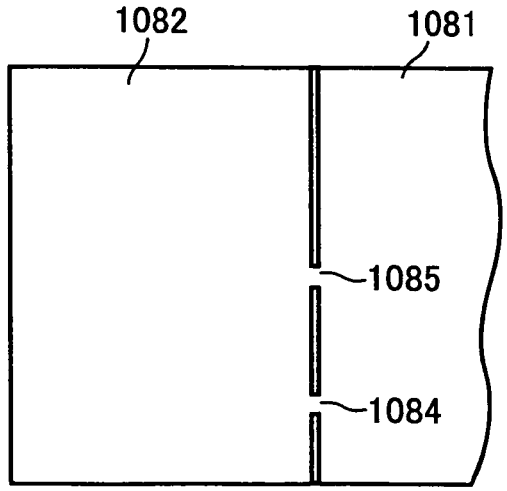
Figure 21A:
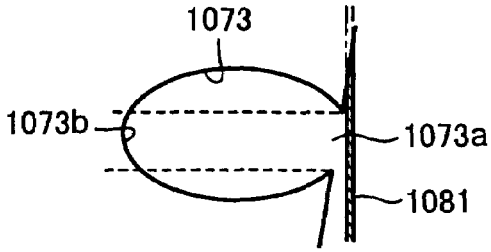
FIGS. 21A through 21F are diagrams showing operations of a first notch part to form a first uncut part and then to cut the first uncut part.
Figure 21B:
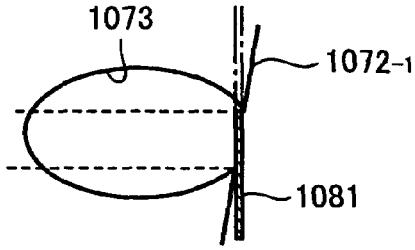
Figure 21C:
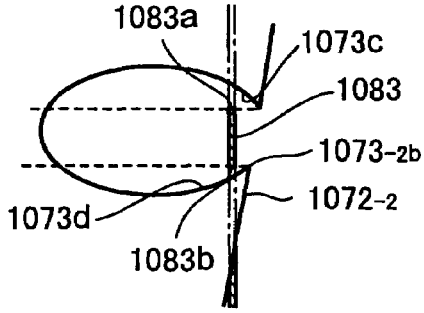
Figure 21D:
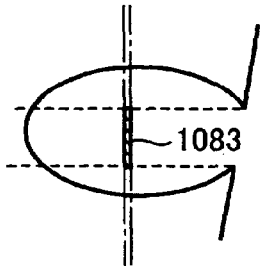
Figure 21E:
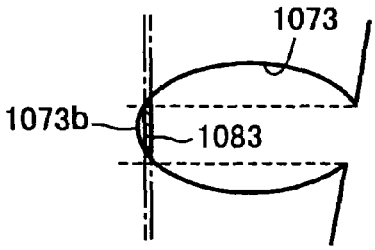
Figure 21F:
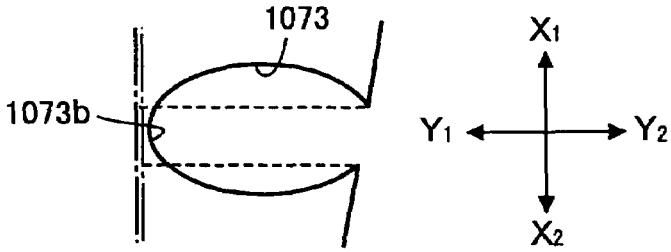

When the movable blade member 1071 moves to YR2 as illustrated in FIG. 18A, the whole portion of the first notch part 1073 reaches the fixed blade part 1033*b*, as illustrated in FIGS. 21E and 21F, and the most inner edge part 1073*b* of the first notch part 1073 cuts the first uncut part 1083 in cooperation with the movable blade member 1071. At this time, the paper 1081 is cut in a condition where the third and the second uncut parts 1085 and 1084 are formed as illustrated in FIG. 18B, that is, in a two-point left partial cutting condition.

Figure 19A:
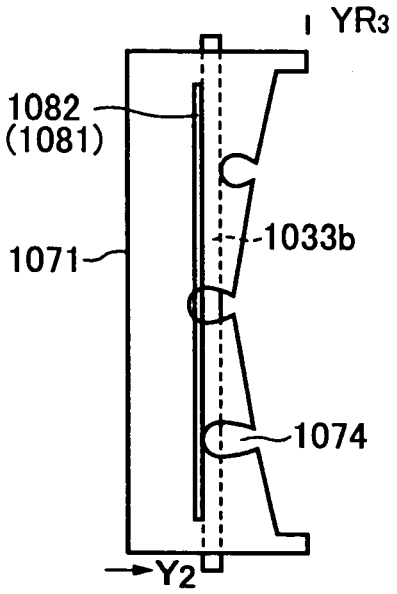
FIGS. 19A and 19B are diagrams showing a condition where the movable blade member is further slid and the paper is cut in one-point left partial cutting.
Figure 19B:
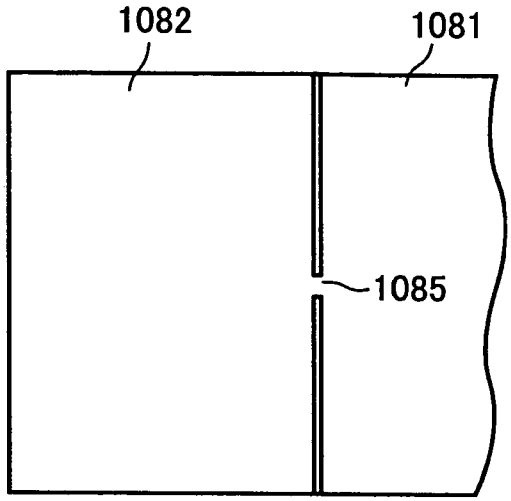

When the movable blade member 1071 moves to YR3 as illustrated in FIG. 19A, the whole portion of the second notch part 1074 reaches the fixed blade part 1033*b*, and the most inner edge part 1074*b* of the second notch part 1074 cuts the second uncut part 1084 in cooperation with the movable blade member 1071. At this time, the paper 1081 is cut in a condition where only the third uncut part 1085 is formed as illustrated in FIG. 19B, that is, in a one-point left partial cutting condition.

Figure 20A:
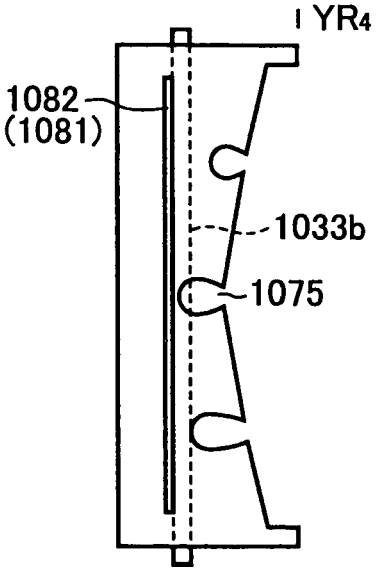
FIGS. 20A and 20B are diagrams showing a condition where the movable blade member is further slid and the paper is completely.
Figure 20B:
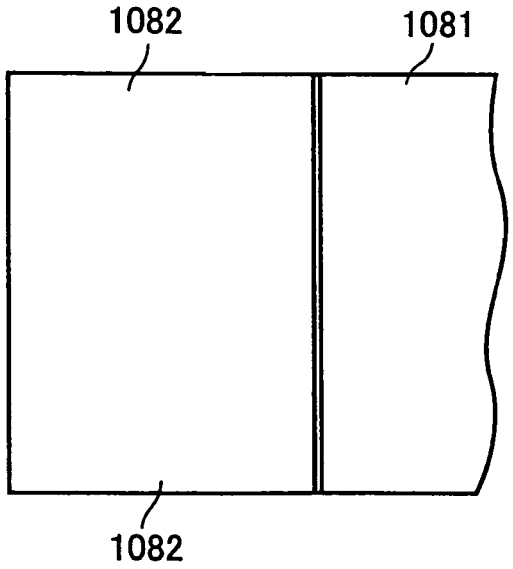

When the movable blade member 1071 moves to YR4 as illustrated in FIG. 20A, the whole portion of the third notch part 1075 reaches the fixed blade part 1033*b*, and the most inner edge part 1075*b* of the third notch part 1075 cuts the third uncut part 1085 in cooperation with the movable blade member 1071. The paper 1081 is completely cut as illustrated in FIG. 20B, and the printed paper portion 1082 is separated from the paper 1081.

Here, by appropriately setting a program of a microcomputer, the second pulse motor 1036 can be controlled in such a way that the movable blade member 1071 moves to YR1 and then returns, moves to YR2 and then returns, or moves YR3 and then returns.

When the movable blade member 1071 moves to YR1 and returns, the paper 1081 is cut in three-point left partial cutting condition as illustrated in FIG. 17B. When the movable blade member 1071 moves to YR2 and then returns, the paper 1081 is cut in the two-point left partial cutting condition as illustrated in FIG. 18C. When the movable blade member 1071 moves to YR3 and then returns, the paper 1081 is cut in the one-point left partial cutting condition, as illustrated in FIG. 19C. In these conditions, a user can separate the printed paper portion 1082 from the paper 1081 by tearing the printed paper portion 1082.

In particular, if the printed paper portion 1082 is cut in the three-point left partial cutting condition or the two-point left partial cutting condition, the printed paper portion 1082 is coupled to the paper 1081 via a plurality of connection points located away from each other with respect to the width direction of the paper 1081. For this reason, even if the paper 1081 has a strong wind, it is possible to prevent the printed paper portion 1082 from be rotated and reversed. Accordingly, the mobile terminal device 1020 having the thermal printer 1010 can be preferably used to print ordered menu contents, for example, in a kitchen where the mobile terminal device 1020 has a strong wind from an electric fan. On the other hand, if the printed paper portion 1082 that is cut in the one-point left partial cutting condition has a strong wind, there is a risk that the printed paper portion 1082 may be rotated and reversed by the uncut portion and thereby a user cannot properly read the ordered menu contents. However, there is no possibility that such a problem may occur in the three-point left partial cutting and the two-point left partial cutting.

An exemplary relation between the first notch part 1073 and the first uncut part 1083 is described.

As shown in FIGS. 21B through 21D, the first notch part 1073 is shifted in the Y2 direction from the formed first uncut part 1083, and the first uncut part 1083 intrudes the interior of the first notch part 1073.

As shown in FIG. 12 and FIG. 21A, the edge parts 1073*c* and 1073*d* of the first notch part 1073 are widened in the X1-X2 direction toward the Y1 direction from the entrance part 1073*a*.

Thus, the edge part 1073*c* moves from the X1 edge 1083*a* of the formed first uncut part 1083 to the X1 side, and the edge part 1073*d* moves from the X2 edge 1083*b* of the first uncut part 1083 to the X2 side. Accordingly, the edge parts 1073*c* and 1073*d* are not in friction with the first uncut part 1083, and thereby no Y2 directional friction force occurs in the first uncut part 1083. As a result, no unnecessary twist force arises in the paper 1081.

The same discussion holds in a relation between the second notch part 1074 and the formed second uncut part 1084, and no Y2 directional force arises in the second uncut part 1084. In addition, the same discussion holds in a relation between the third notch part 1075 and the formed third uncut part 1085, and no Y2 directional force arises in the third uncut part 1085.

Thus, the paper 1081 can be cut in such a way that no unnecessary twist force arises in the paper 1081.

Also, the first notch part 1073 has a smoothly curved shape such that the most inner edge part 1073 and the edge parts 1073*c* and 1073*d* are not sharply crooked. For this reason, the contact point between the edge part of the first notch part 1073 and the fixed blade part 1033*b* can move smoothly during cutting, and there is no possibility that the edge part of the first uncut part 1073 may be engaged and locked with the fixed blade part 1033*b*. In addition, the contact points between the edge parts of the second and the third notch parts 1074 and 1075 and the fixed blade part 1033*b* can move smoothly, and there is no possibility that the edge parts of the second and the third notch parts 1074 and 1075 are engaged and locked with the fixed blade part 1033*b*.

[Variations of the Movable Blade Member 1071]

Next, variations of the movable blade member 1071 are described.

Figures 22A, 22B, 22C:
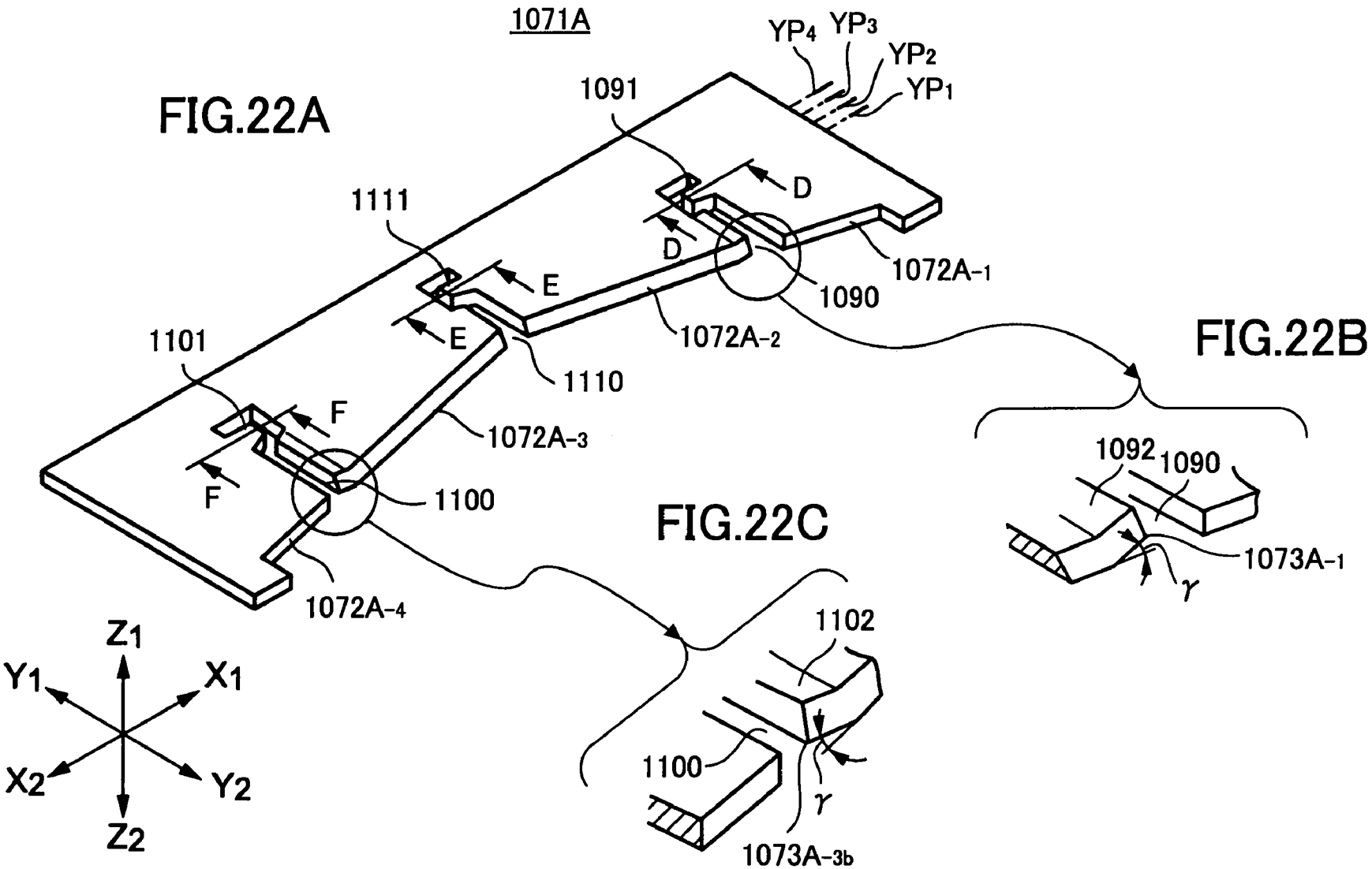
FIGS. 22A through 22F are diagrams showing a first variation of the movable blade member.
Figure 22D:
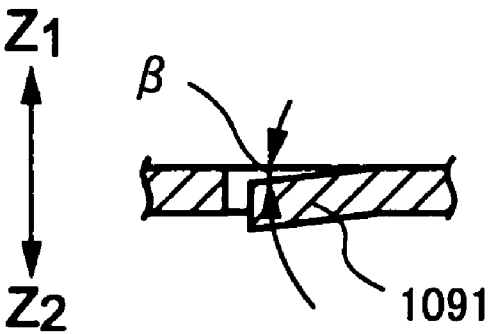
Figure 22E:
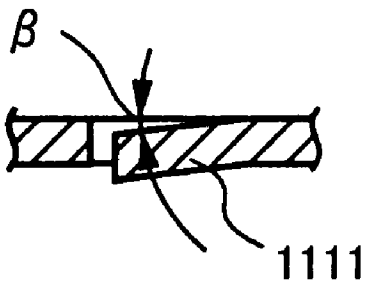
Figure 22F:
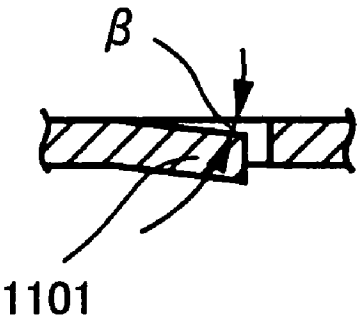
Figure 23:
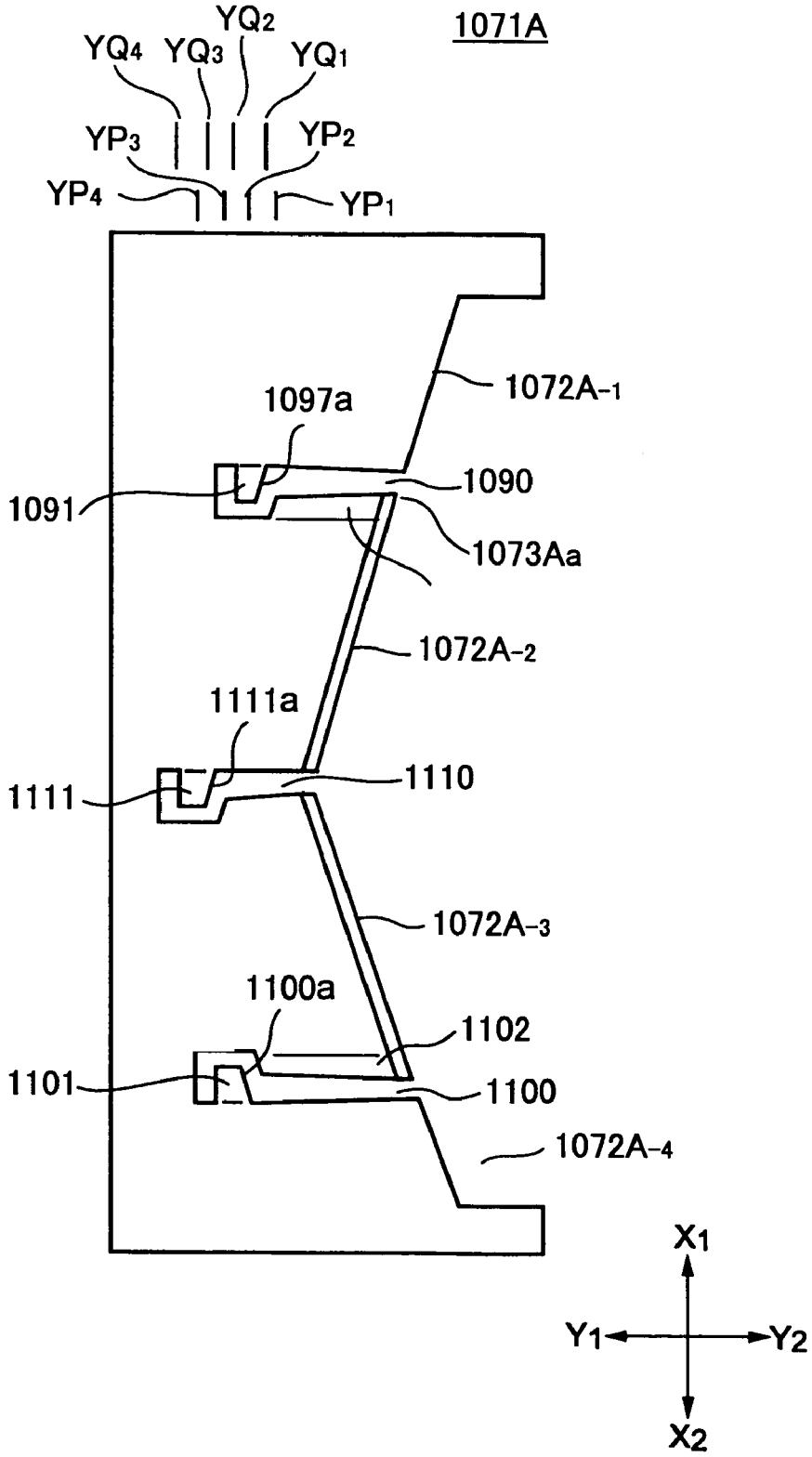
FIG. 23 is a plan view showing the movable blade member shown in FIG. 22.
Figures 24A, 24B, 24C:
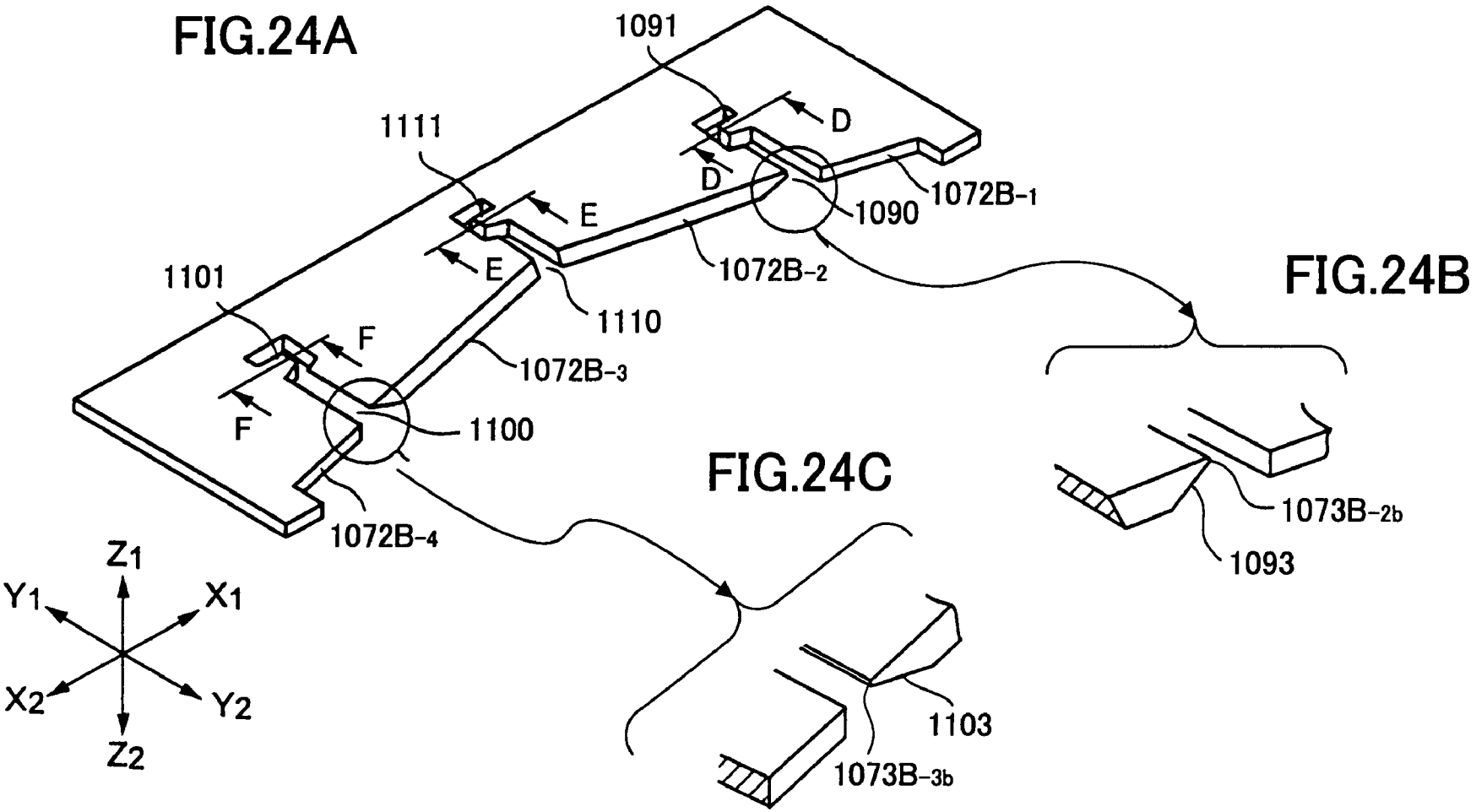
FIGS. 24A through 24F are diagrams showing a second variation of the movable blade member.
Figure 24D:
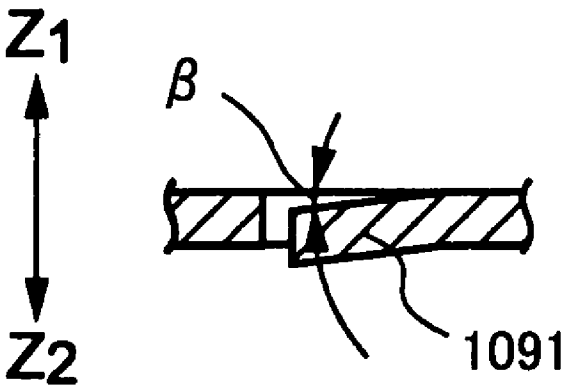
Figure 24E:
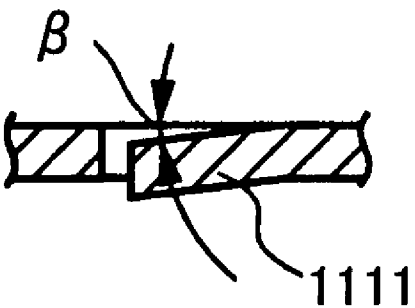
Figure 24F:
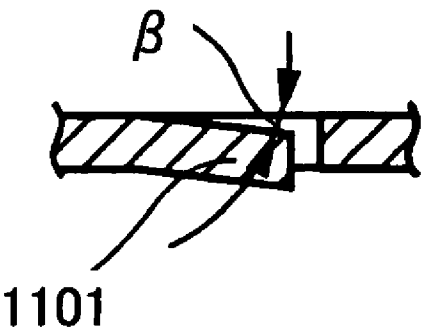

FIG. 22 and FIG. 23 show an exemplary movable blade member 1071A according to a first variation. In the illustration, components corresponding to the components shown in FIG. 11 and FIG. 12 are designated by the same reference numerals. A movable blade member 1071A includes a first notch part 1073A, a second notch part 1074A and a third notch part 1075A. The first notch part 1073A includes a slit 1090 and a tongue-shaped blade part 1091 located in the inner side of the slit 1090. The second notch part 1074A includes a slit 1100 and a tongue-shaped blade part 1111 located in the inner side of the slit 1101. The third notch part 1075A includes a slit 1110 and a tongue-shaped blade part 1111 located in the inner side of the slit 1110. Sharp parts 1072A-2*b* and 1072A-3*b* are formed in the center side of the movable blade member 1071A of a portion facing entrances of the first and the second notch parts 1073A and 1074A. Each of the slits 1090, 1100 and 1110 is taper-shaped such that the width of the inner side thereof is slightly greater that the width of the entrance thereof. The tongue-shaped blade parts 1091, 1101 and 1111 correspond to the most inner edge parts 1073*b*, 1074*b* and 1075*b*, and are disposed at positions corresponding to the most inner edge parts 1073*b*, 1074*b* and 1075*b*, respectively. As shown in FIGS. 22D, 22E and 22F, the tongue-shaped blade parts 1091, 1101 and 1111 are inclined by β in the Z2 direction, and respective Y2 edges 1091*a*, 1101*a* and 1111*a* are slightly inclined in the Y1 side. Accordingly, the tongue-shaped blade parts 1091, 1101 and 1111 are in point-contact with the fixed blade part, and each of the uncut parts 1083, 1084 and 1085 is cut from one side of the width direction by moving the contact point.

In the movable blade member 1071A, an X2 side portion 1092 of the slit 1090, that is, a center side portion from the slit 1090 of the movable blade member 1071A, is inclined by γ in the Z1 direction, as illustrated in FIG. 22B. Also, an X1 side portion 1102 of the slit 1100, that is, a center side portion from the slit 1100 of the movable blade member 1071A, is inclined by γ in the Z1 direction, as illustrated in FIG. 22C. In process of Y2 directional sliding of the movable blade member 1071A, edge parts of the blade parts 1072A-2 and 1072A-3 smoothly move over the fixed blade part. Thus, the blade part in point-contact with the fixed blade parts can be smoothly switched from the blade parts 1072A-1 and 1072A-4 to the blade parts 1072A-2 and 1072A-3, respectively, without locking.

FIG. 24 shows an exemplary movable blade member 1071B according to a second variation. The movable blade member 1071B differs from the movable blade member 1071A in the shape of the portions 1092 and 1102. As shown in FIGS. 24B and 24C, Z2 side surfaces of the portions 1092 and 1102 are formed as slope surfaces 1093 and 1103. In this structure, the blade part in point-contact with fixed blade part can be smoothly switched from the blade parts 1072B-1 and 1072B-4 to the blade parts 1072B-2 and 1072B-3, respectively, without locking.

Another embodiment of the present invention is described.

Figure 25A:
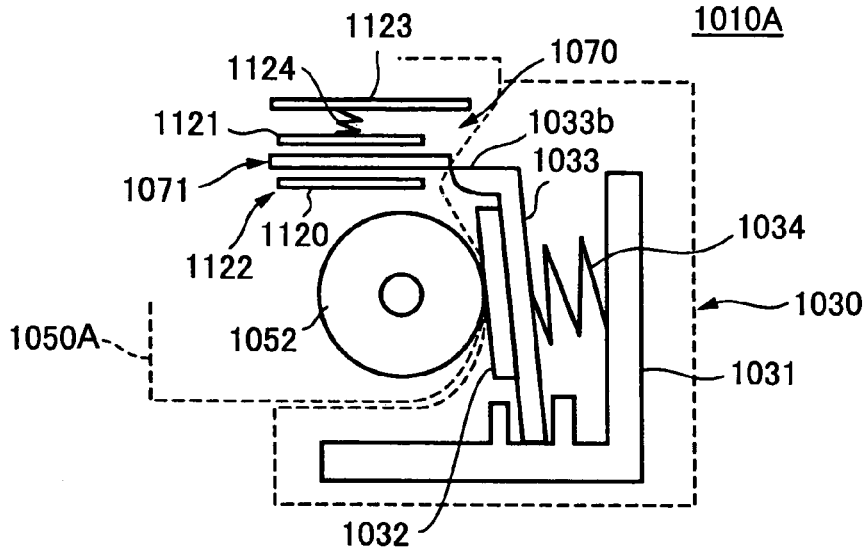
FIGS. 25A through 25C are diagrams showing a thermal printer according to another embodiment of the present invention.
Figure 25B:
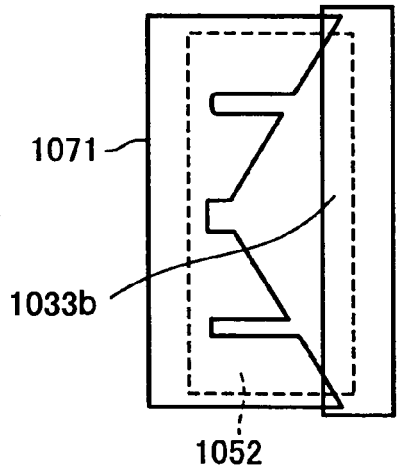
Figure 25C:
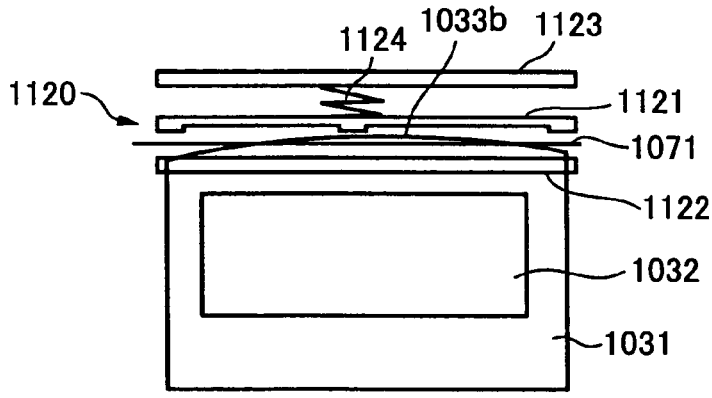

FIGS. 25A through 25C roughly show an exemplary thermal printer 1010A according to one embodiment of the present invention. In the illustration, components corresponding to the components shown in FIGS. 3A through 3C are designated by the same reference numerals.

A thermal printer 1010A differs from the thermal printer 1010 shown in FIG. 3 in a support mechanism of the movable blade member 1071 and a support mechanism for the first support member 1031 of the thermal head support member 1033.

Like conventional structures, the thermal head support member 1033 is supported on the first support member 1031 in an immobilized condition. In association, the movable blade member 1071 can be moved in the Z1 direction, and Z2 directional blade pressure can be generated.

The movable blade member 1071 is supported in a guide unit 1122 having upper and lower guide plates 1120 and 1121 in a condition where the movable blade member 1071 can be slid. A cover 1123 is fixed to the first support member 1031. The guide unit 1122 is disposed in the lower side of the cover 1123, and a spring 1124 is provided between the guide unit 1122 and the cover 1123.

When the movable blade member 1071 is slid in the Y2 direction in a condition where the movable blade member 1071 is in point-contact with the fixed blade part 1033*a*, the spring 1124 is compressed, and the movable blade member 1071 together with the guide unit 1122 moves in the Z1 direction. Spring force of the spring 1124 generates Z2 directional blade pressure.

Another embodiment of the present invention is described.

Figure 26A:
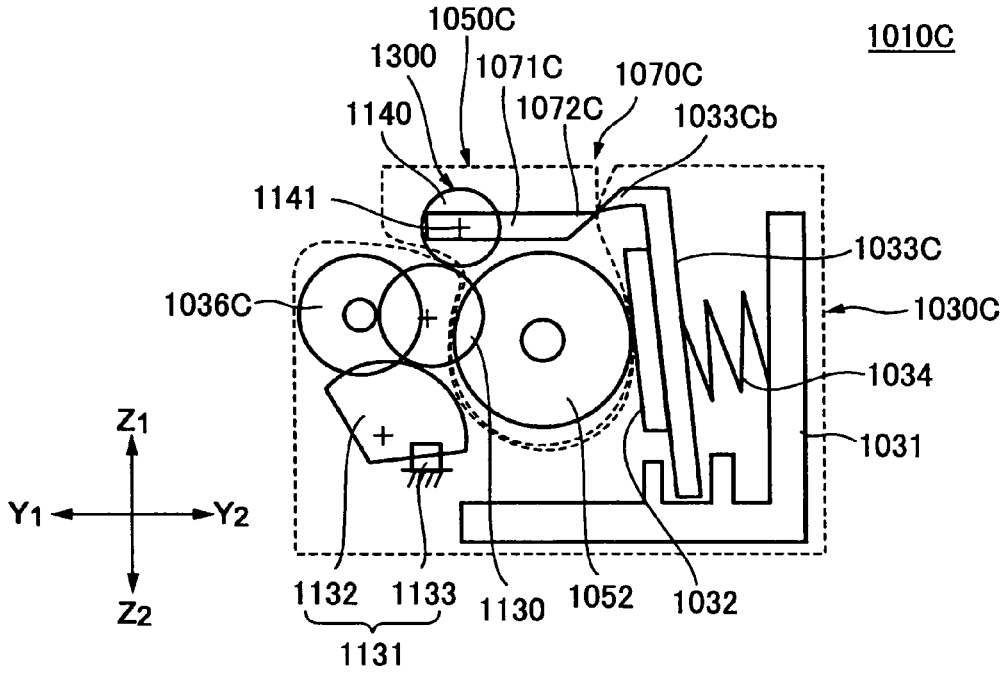
FIGS. 26A through 26C are diagrams showing a thermal printer according to another embodiment of the present invention.
Figure 26B:
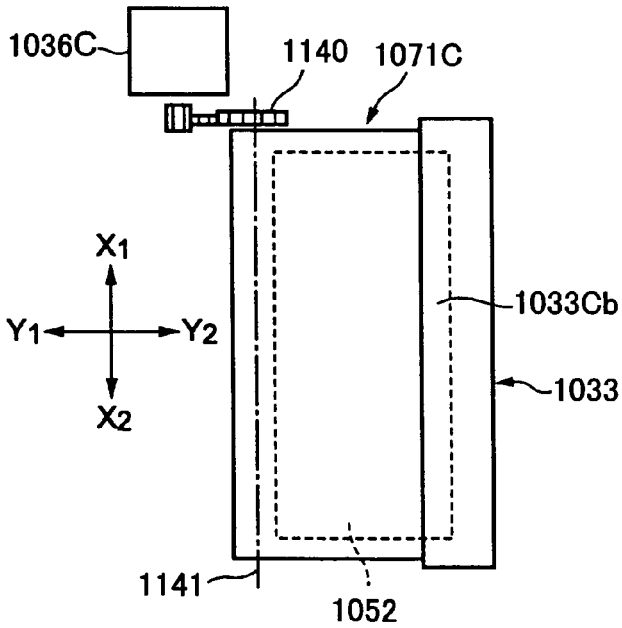
Figure 26C:
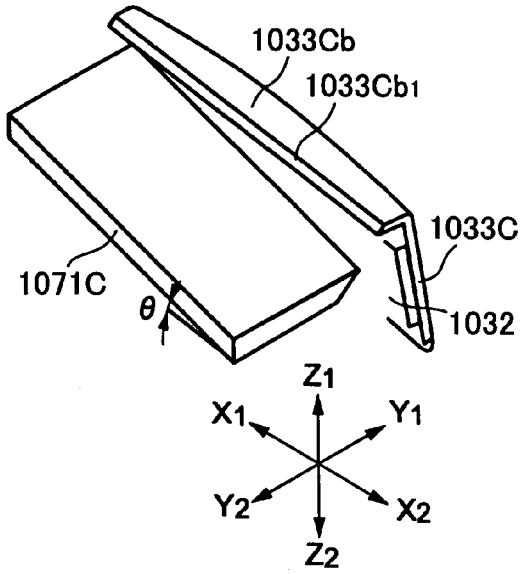

FIGS. 26A through 26C show an exemplary thermal printer 1010C according to one embodiment of the present invention. The thermal printer 1010B differs from the above-mentioned thermal printers 1010 and 1010A in that a movable blade member 1071C turns back and forth and vibrates.

The thermal printer 1010C is configured to have such a structure that a second module 1050C shown in FIG. 7 is detachably coupled with a first module 1030C shown in FIG. 6. Also, a cutter part 1070C is formed in a condition where the second module 1050C is coupled with the first module 1030C.

The first module 1030C includes a thermal head support member 1033C, where a thermal head 1032 is fixed to the first support member 1031, a head pressure applying plate spring member 1034, a pulse motor 1036C, a gear 1130 and a home position detection mechanism 1131. A fixed blade part 1033Cb is integrally formed at the upper end of the thermal head support member 1033C. The fixed blade part 1033Cb includes a slope surface 1033Cb1 in the upper surface side. The detection mechanism 1131 is for detecting that the movable blade member 1071B reaches a first position, and includes a fan-shaped gear 1132 and a photo coupler 1133.

The second module 1050C includes a platen roller 1052, a movable blade member 1071C and a gear 1140. The movable blade member 1071C can be rotated by an shaft 1141. A mechanism 1300 to turn back and forth the movable blade member 1071C includes the gear 140 and the shaft 1141. A blade part 1072C of the movable blade member 1071C includes a slope surface 1072Ca in the Z2 side. Also, the movable blade member 1071C is inclined by a small angle θ such that the X1 directional end falls in the Z2 direction. Also, the length of the movable blade member 1071C with respect to the X1-X2 direction is greater than the distance between portions of the second support member 1051C to support both sides of the platen roller 1052.

Figure 27A:
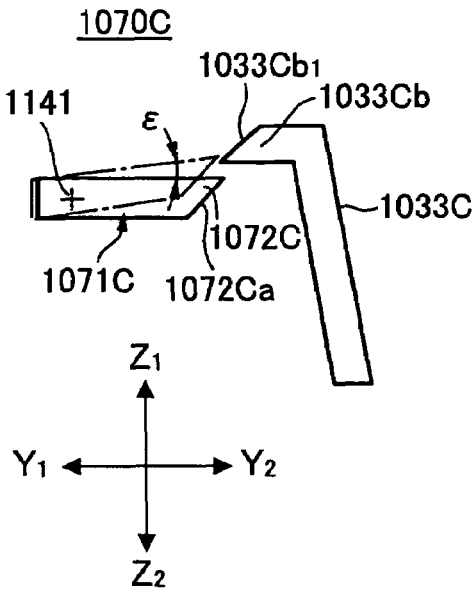
FIGS. 27A through 27M are diagrams showing operations of the cutter part shown in FIG. 26 and cutting conditions of a paper.
Figure 27B:
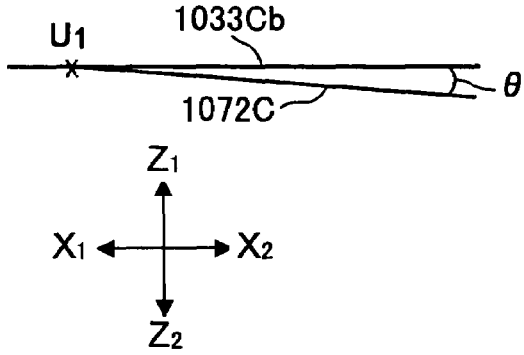
Figure 27C:
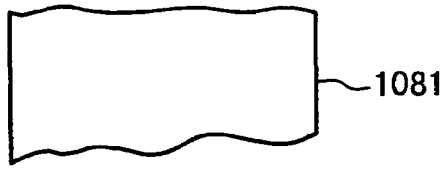

When the second module 1050C is coupled with the first module 1030C, the platen roller 1052 feeds a paper between the second module 1050C and the first module 1030C, as illustrated in FIGS. 26A through 26C, and the paper is pressed on the thermal head 1032. A cutter part 1070C is formed to face the blade part 1072C of the movable blade member 1071C on the fixed blade part 1033Cb. The blade part 1072C is in point-contact with the fixed blade part 1033Cb at an X2 side point U1, as illustrated in FIGS. 27A and 27B. A movement center shaft 1141 of the blade part 1072C is positioned in the Z2 side from the edge of the blade part 1072C. The paper 1081 passes between the movable blade member 1071C and the fixed blade part 1033Cb.

Figure 27D:
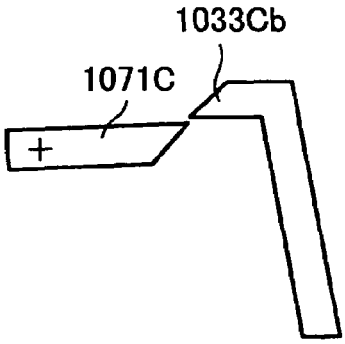

In response to a print instruction, the thermal head 1032 is driven and heated. At the same time, the platen roller 1052 is rotated to print data on the paper 1081. Upon completion of the printing, a cut instruction is issued, and the motor 1036C is driven at a predefined number of pulse signals to turn the movable blade member 1071C counterclockwise by an angle ϵ via the gears 1130 and 1140, as illustrated in FIGS. 27D and 27G. At this time, the contact point between the blade part 1072C and the fixed blade part 1033Cb moves from U1 to U3 via U2 in the X1 direction, as illustrated in FIGS. 27E and 27H, and thereby the paper 1081 is completely cut from the X2 side, as illustrated in FIGS. 27F and 27I.

Figure 27E:
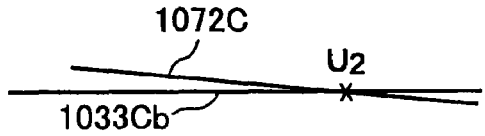
Figure 27F:
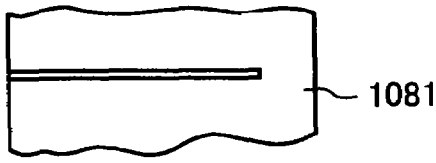
Figure 27G:
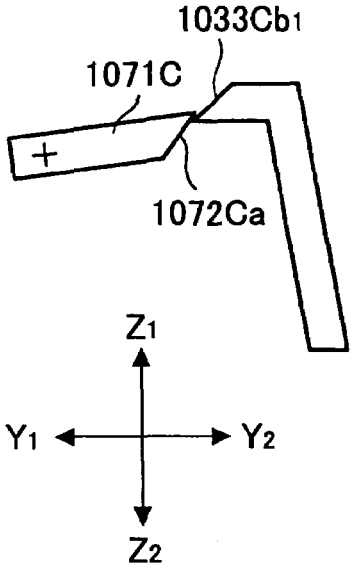
Figure 27H:
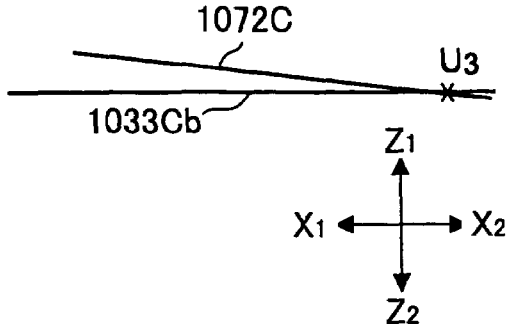
Figure 27I:
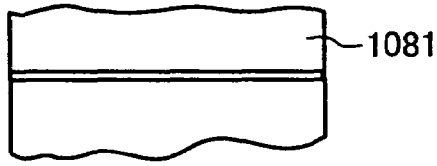
Figure 27J:
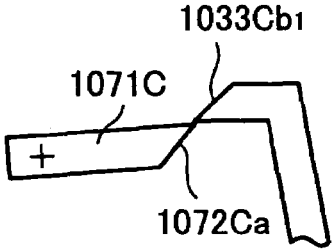
Figure 27K:
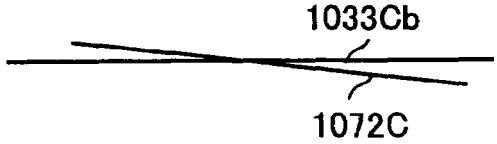
Figure 27L:
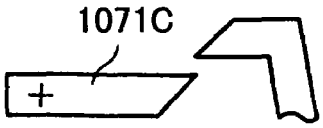
Figure 27M:
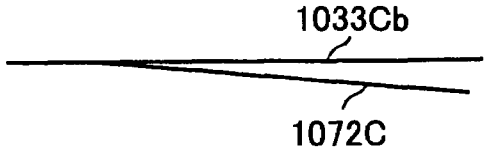

When the movable blade member 1071C turns to a position shown in FIG. 27G, the motor 1036C is inversely driven to turn back the movable blade member 1071C clockwise as illustrated in FIGS. 27J and 27L, and the detection mechanism 1131 detects that the movable blade member 1071C returns back to the home position thereof. Here, while the movable blade member 1071C is turning back, the slope surface 1072C of the blade part 1072C generates force to slide the blade part 1072C away from the fixed blade part 1033Cb. As a result, it is possible to smoothly turn back the movable blade member 1071C during the sliding of the blade part 1072C away from the fixed blade part 1033Cb.

Alternatively, by controlling the number of pulse signals applied to the pulse motor 1036C, the movable blade member 1071C may be turned to the position shown in FIG. 27D and 27E and then turned back. In this case, the paper 1081 is partially cut as illustrated in FIG. 27F.

Another embodiment of the present invention is described.

Figure 28:
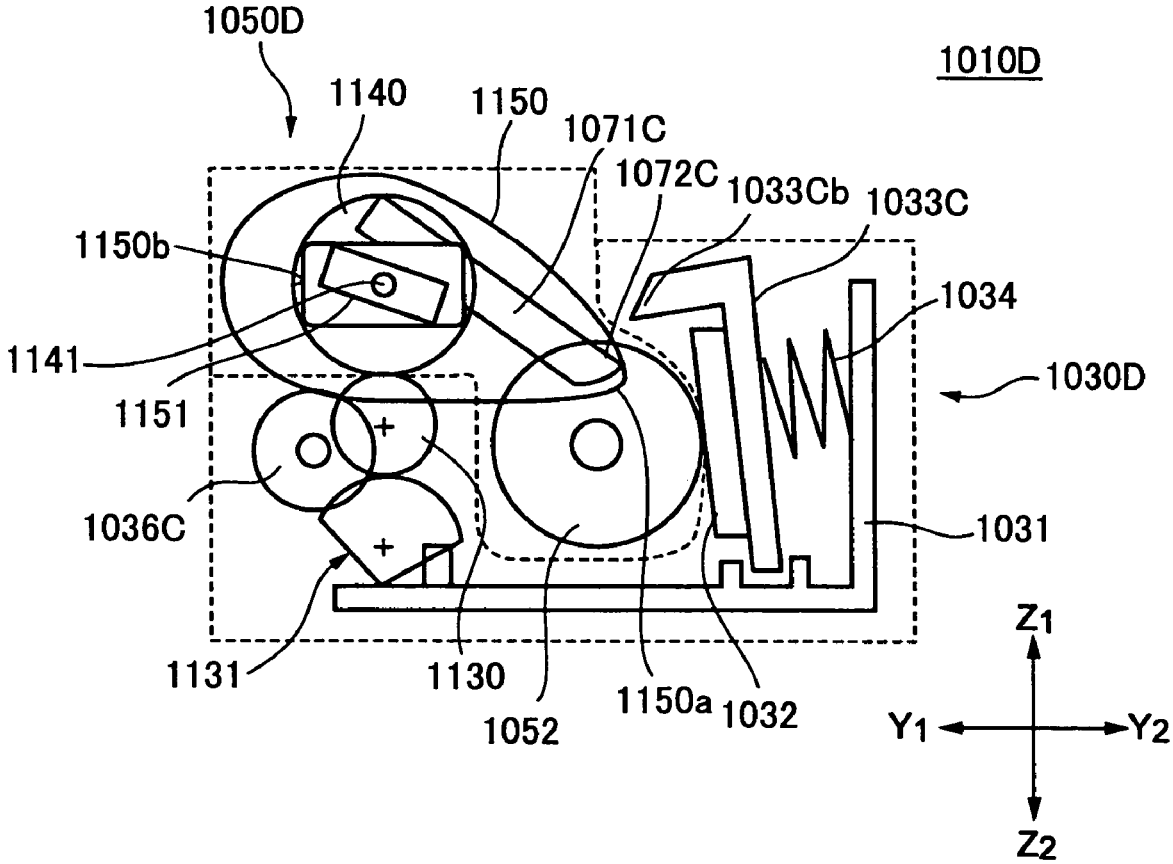
FIG. 28 is a diagram showing a thermal printer according to another embodiment of the present invention.

FIG. 28 shows an exemplary thermal printer 1010D according to one embodiment of the present invention. The thermal printer 1010D has such a structure that a second module 1050D is detachably coupled with a first module 1030D, a cutter part 1070D is integrally included, and a cam 1150 is additionally provided to the thermal printer 1010C shown in FIG. 26A.

The cam 150, which is for temporarily stopping a fixed blade part 1033Cb provided at the upper end of the thermal head support member 1033C, includes a protrusion part 1150*a* and a rectangular aperture 1150*b*.

A rectangular block 1151 is fixed to an shaft 1141 of the movable blade member 1071C. The block 1151 is loosely engaged with the opening of the aperture 1150*b*, and the block 1151 can be turned in a range of a predefined angle separately from the cam 1140. Specifically, when the movable blade member 1071C starts to be turned, the cam 1140 does not move up to a predefined angle, and then the cam 1140 is turned integrally with the movable blade member 1071C.

Figure 29A:
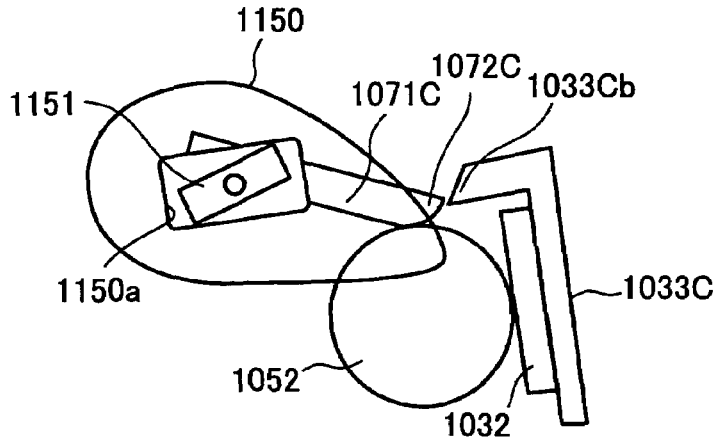
FIGS. 29A through 29C are diagrams showing operations of the cutter part shown in FIG. 28.
Figure 29B:
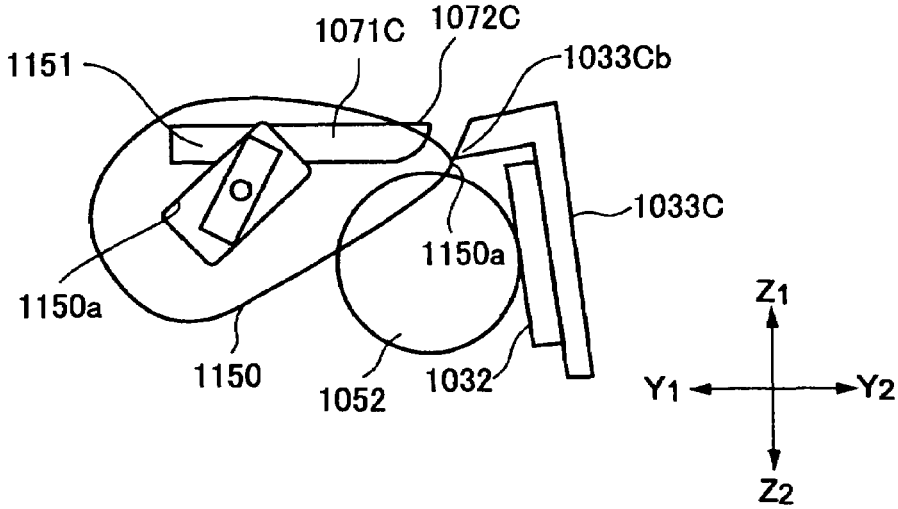
Figure 29C:
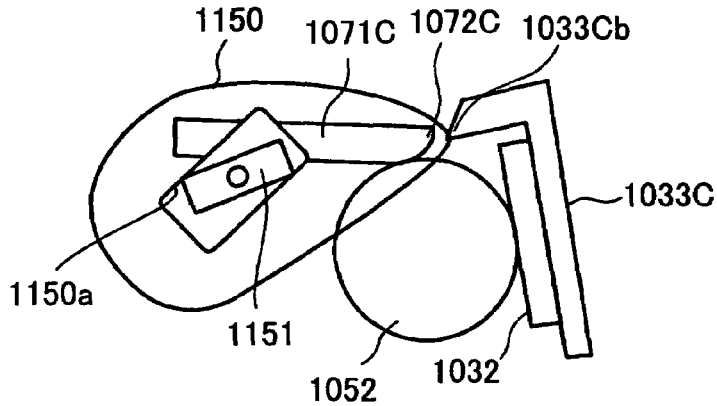

In a case where the second module 1050D is coupled with the first module 1030D, the thermal printer 1010D has a structure as illustrated in FIG. 28. The protrusion part 1150*a* of the cam 1140 is positioned in the Z2 side from the fixed blade part 1033Cb. In response to a cut instruction, when the motor 1036C is driven at a predefined number of pulse signals, the movable blade member 1071C is turned counterclockwise in a condition where the cam 1140 is stopped, as illustrated in FIG. 29A, and the paper 1081 is cut in cooperation of the movable blade member 1071C and the fixed blade part 1033Cb. Subsequently, the cam 1140 is turned counterclockwise, and then the cam 1140 is stopped in a condition where the protrusion part 1150*a* depresses the fixed blade part 1033Cb in the Y2 direction, as illustrated in FIG. 29B. Then, the motor 1036C is inversely driven to turn the movable blade member 1071C clockwise in a condition where the cam 1140 is stopped, and the blade part 1072C passes through a portion of the fixed blade part 1033Cb in the Z2 direction without contact with the fixed blade part 1033Cb, as illustrated in FIG. 29C. Subsequently, the cam 1140 is turned clockwise, and the fixed blade part 1033Cb is released from the protrusion part 1150*a*, as illustrated in FIG. 28. Thus, it is possible to smoothly turn back the movable blade member 1071C without friction between the blade part 1072C and the fixed blade part 1033Cb.

Another embodiment of the present invention is described.

Figure 30:
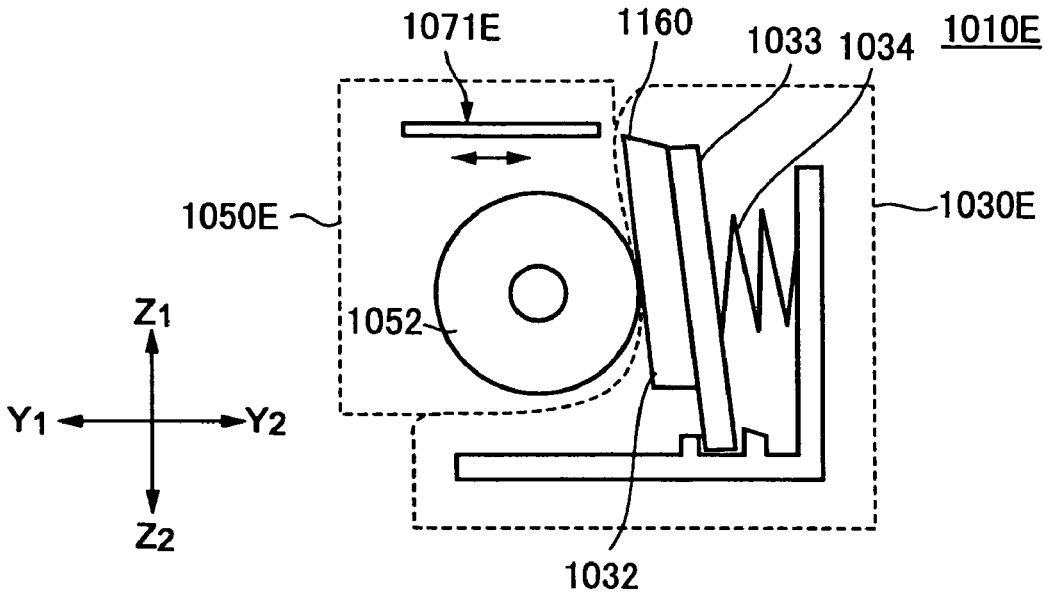
FIG. 30 is a diagram showing a thermal printer according to another embodiment of the present invention.

FIG. 30 shows an exemplary thermal printer 1010E according to one embodiment of the present invention. The thermal printer 1010E has such a structure that the Z1 edge of a thermal head 1032E made of ceramic is used as a fixed blade 1160 and a movable blade member 1071E made of hard ceramic is slid.

A second module 1050E is detachably coupled with a first module 1030E. In this condition, a cutter part 1070E is formed. The cutter part 1070E includes a fixed blade 1160 being the Z1 edge of a thermal head 1032E and a movable blade member 1071E slid in the Y2 direction.

Another embodiment of the present invention is described.

Figure 31:
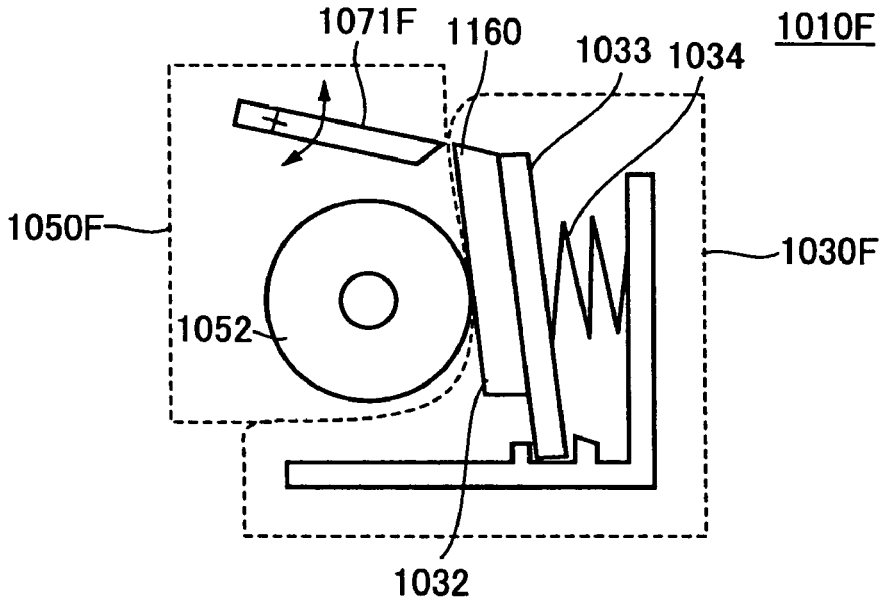
FIG. 31 is a diagram showing a thermal printer according to another embodiment of the present invention.

FIG. 31 shows an exemplary thermal printer 1010F according to one embodiment of the present invention. The thermal printer 1010F has such a structure that the Z1 edge of a thermal head 1032E made of ceramic is used as a fixed blade 1160 and a movable blade member 1071F made of hard ceramic is turned back and forth and oscillates.

A second module 1050F is detachably coupled with a first module 1030F. In this condition, a cutter part 1070F is formed. The cutter part 1070F includes a fixed blade 1160 being the Z1 edge of a thermal head 1032E and a movable blade member 1071F moving back and forth.

A second embodiment of the present invention is described.

Figure 32:
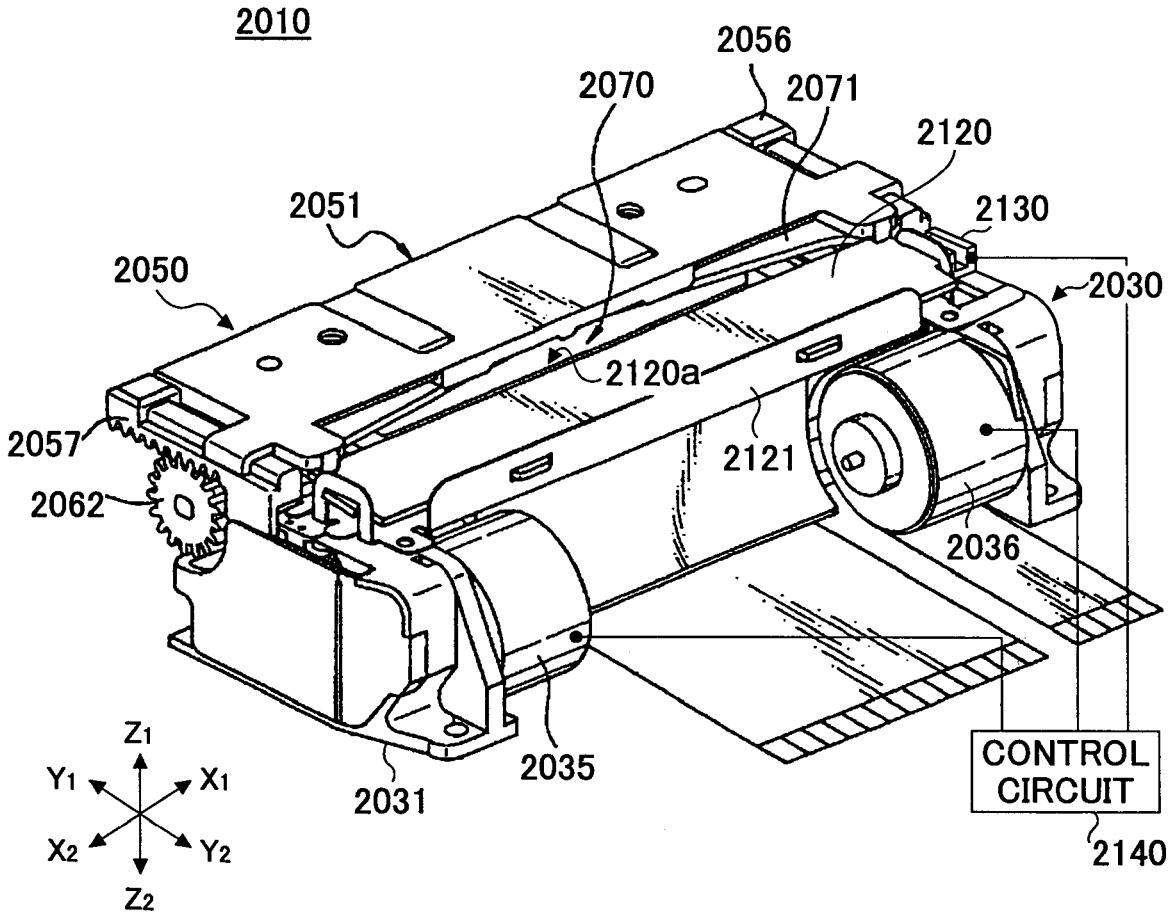
FIG. 32 is a perspective view showing a thermal printer having a cutter part according to a second embodiment of the present invention.
Figure 33:
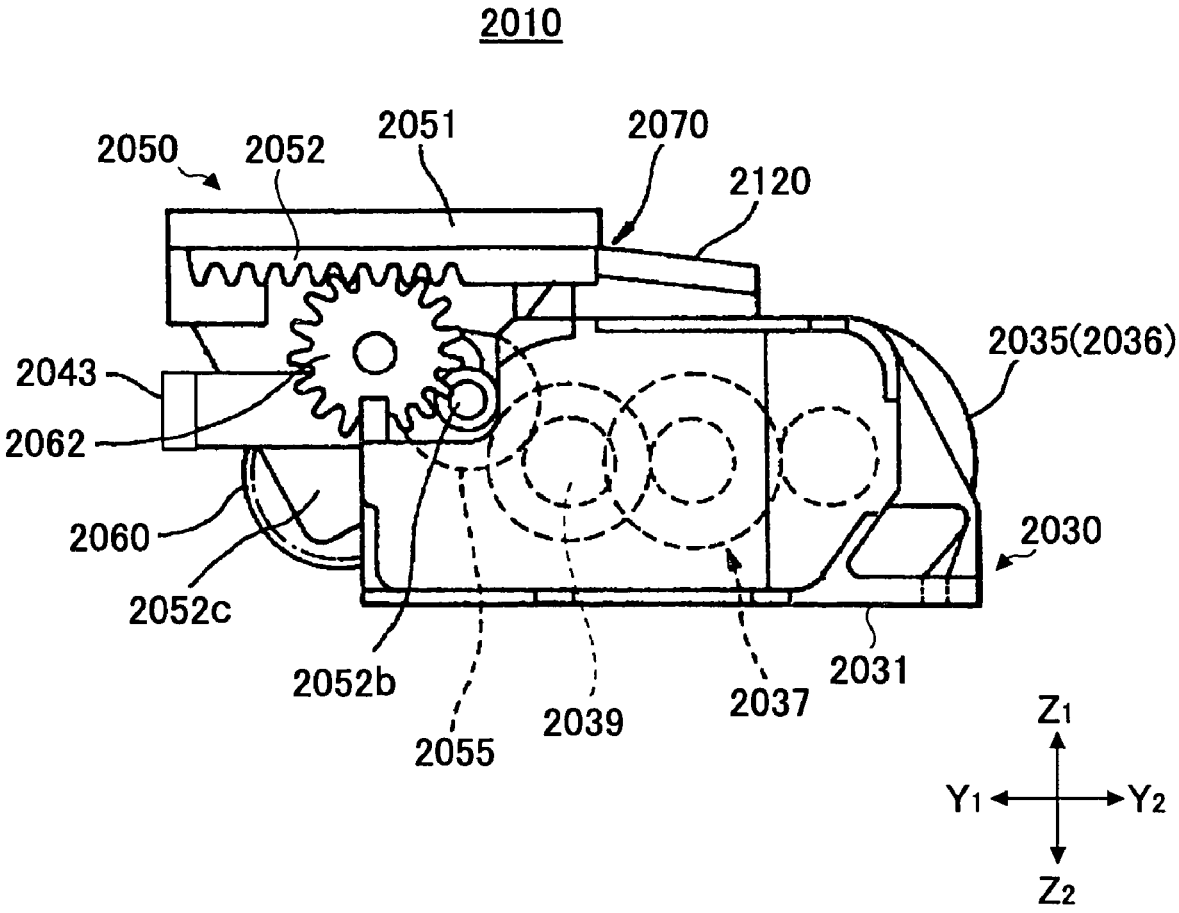
FIG. 33 is a side view showing the thermal printer shown in FIG. 32.
Figure 34A:
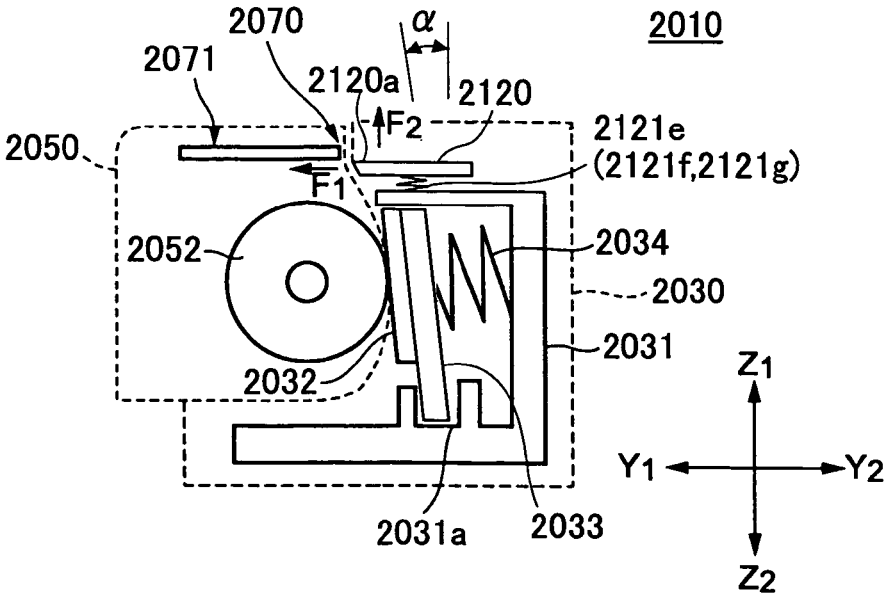
FIGS. 34A and 34B are schematic diagrams showing the thermal printer shown in FIG. 32.
Figure 34B:
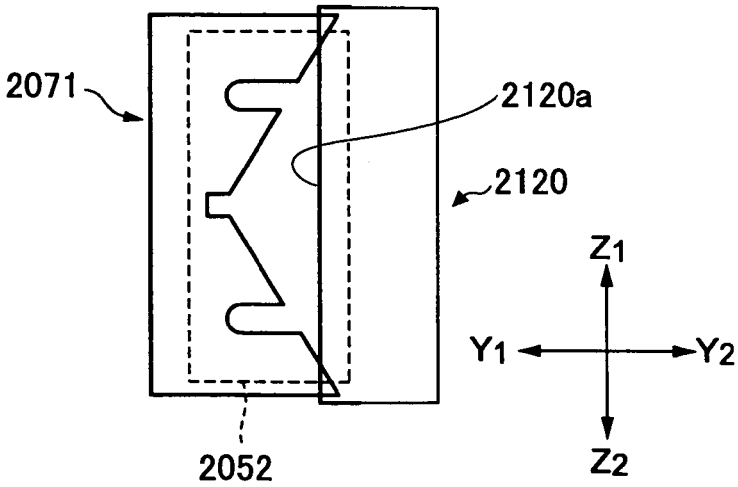
Figure 35A:
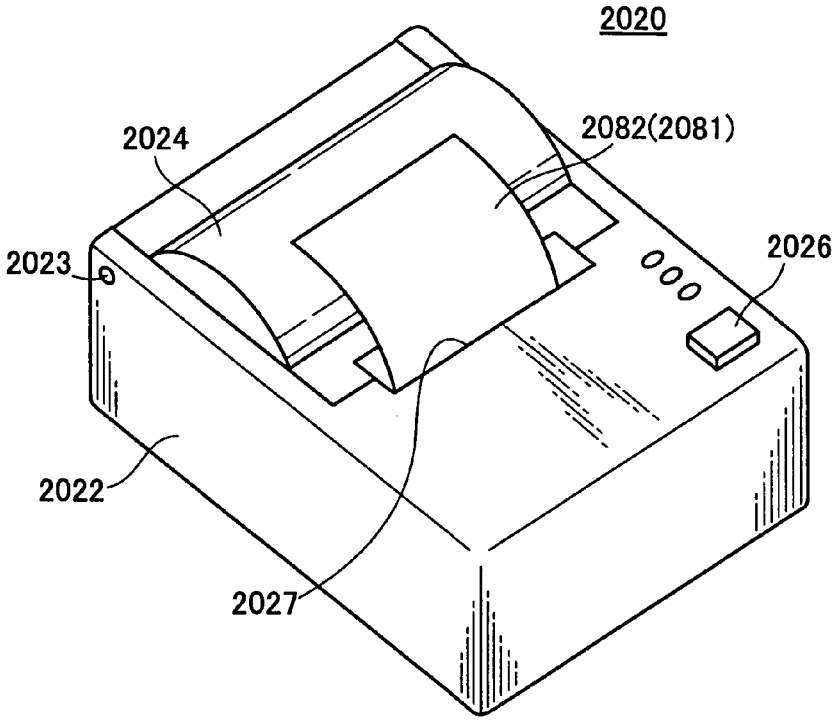
FIGS. 35A and 35B are diagrams illustrating a mobile terminal device having the thermal printer shown in FIG. 32.
Figure 35B:
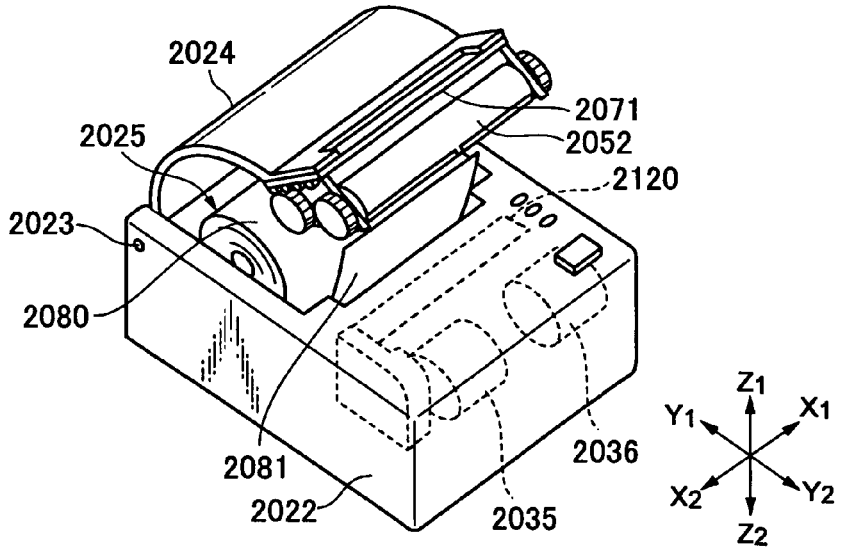
Figure 36:
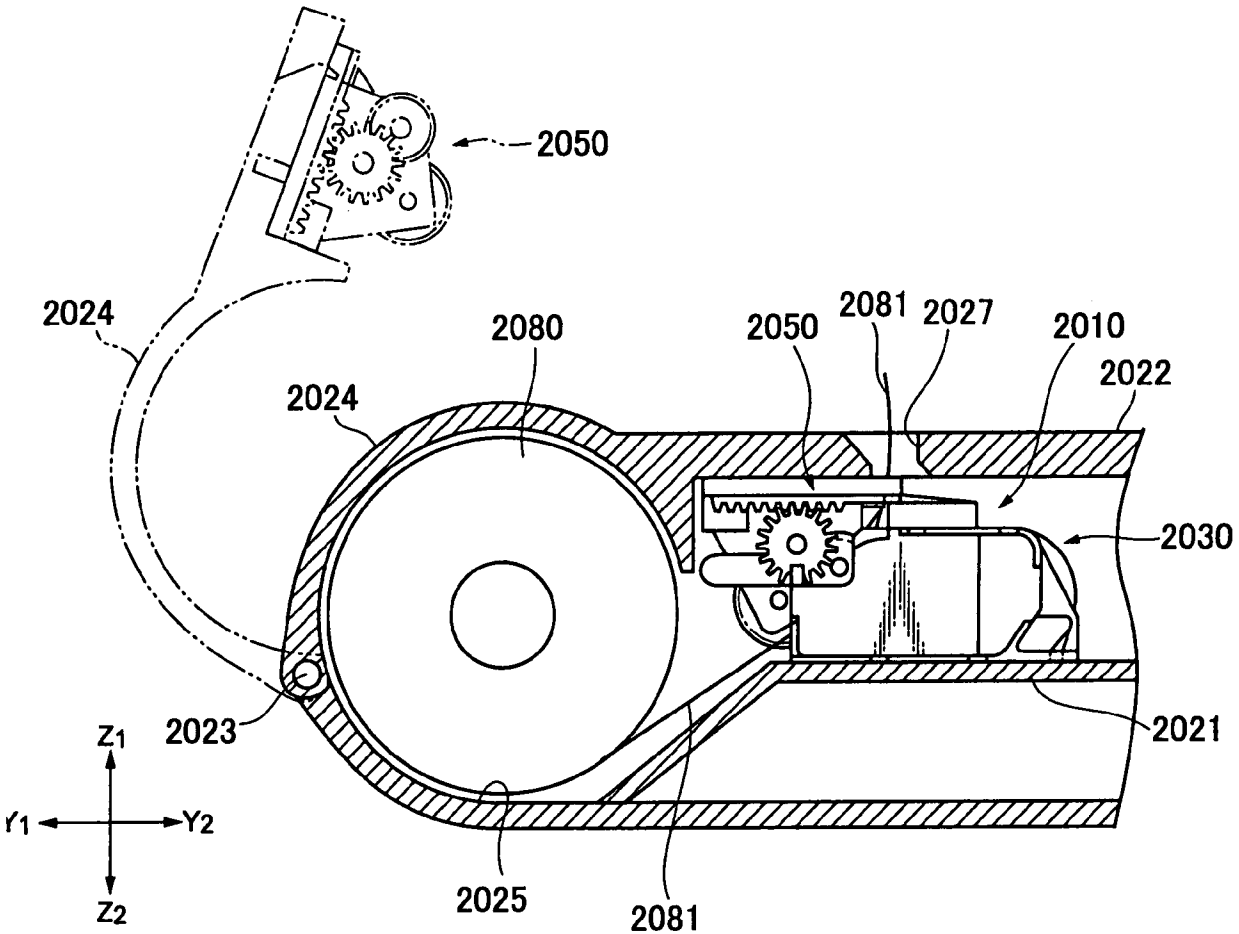
FIG. 36 is a diagram illustrating an exemplary structure of a printer part of the mobile terminal device shown in FIG. 35.

FIG. 32 and FIG. 33 show an exemplary thermal printer 2010 having a cutter 2070 according to the second embodiment of the present invention. FIGS. 34A and 34B roughly show the thermal printer 2010. The thermal printer 2010 is a line printing and clamshell type printer. FIGS. 35A and 35B show an exemplary mobile terminal device 2020 incorporating the thermal printer 2010. FIG. 36 shows an exemplary structure of the mobile terminal device 2020 in a condition where the thermal printer 2010 is incorporated into the mobile terminal device 2020. Throughout these drawings, the axes X1-X2, Y1-Y2 and Z1-Z2 represent width, length and height directions, respectively, of the thermal printer 2010.

[Overall Structure and Operation of the Thermal Printer 2010]

Figure 37:
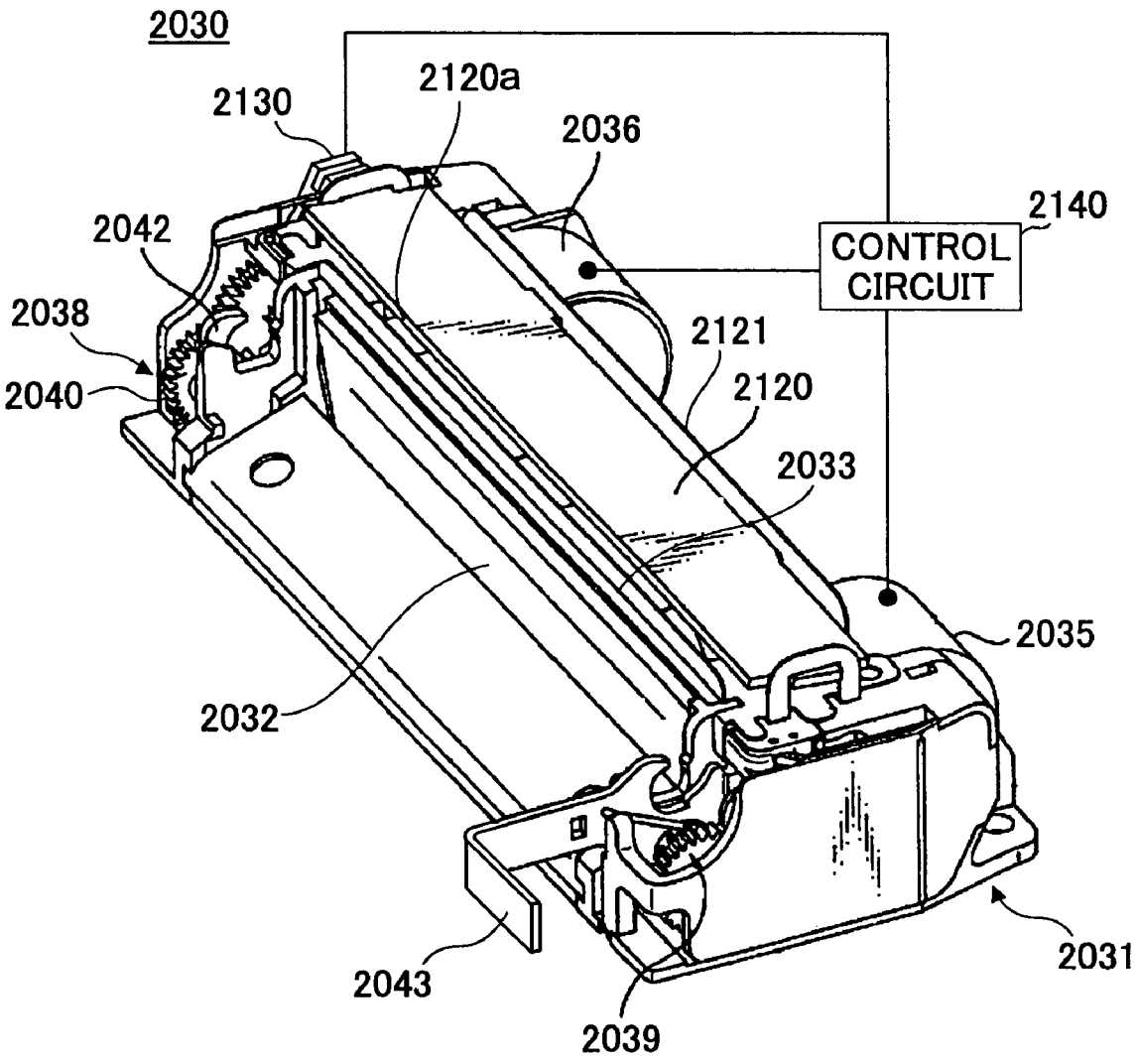
FIG. 37 is a perspective view showing a first module according to an embodiment of the present invention;.
Figure 39:
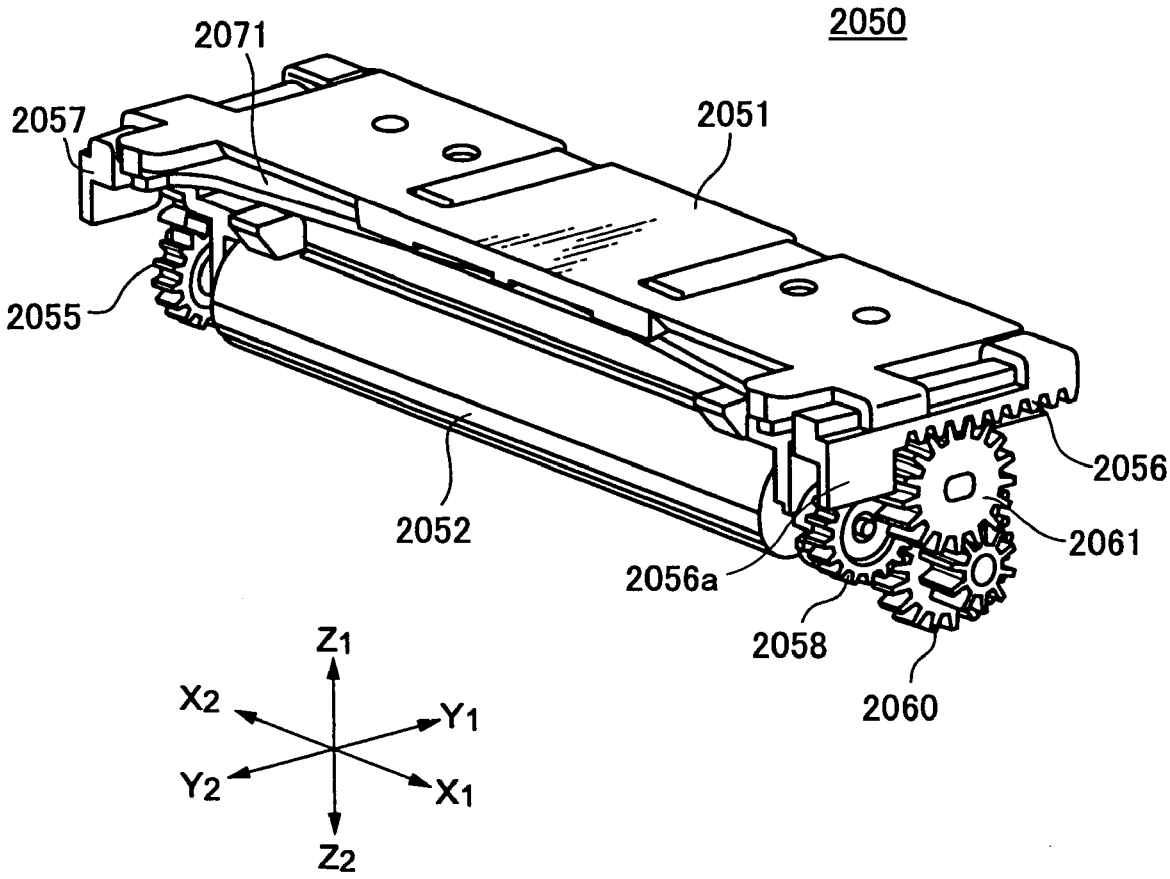
FIG. 39 is a perspective view showing a second module according to an embodiment of the present invention.

The thermal printer 2010 has such a structure that a first module 2030 shown in FIG. 37 is detachably combined with a second module 2050 shown in FIG. 39, a cutter part 2070 is formed in a condition where the second module 2050 is coupled with the first module 2030, and a control circuit 2140 configured from a microcomputer controls print and cut operations. The cutter part 2070 is disposed in the downstream side from a printing part with respect to a paper feed direction.

As shown in FIG. 37, the first module 2030 includes a thermal head support member 2033 having such a structure that a fixed blade member 2120 and a thermal head 2032 are fixed to a first support member 2031, a head pressure applying plate spring member 2034, first and second pulse motors 2035 and 2036, first and second gear sets 2037 and 2038, platen roller lock members 2041 and 2042, and a photo interrupter 2130.

Figure 38:
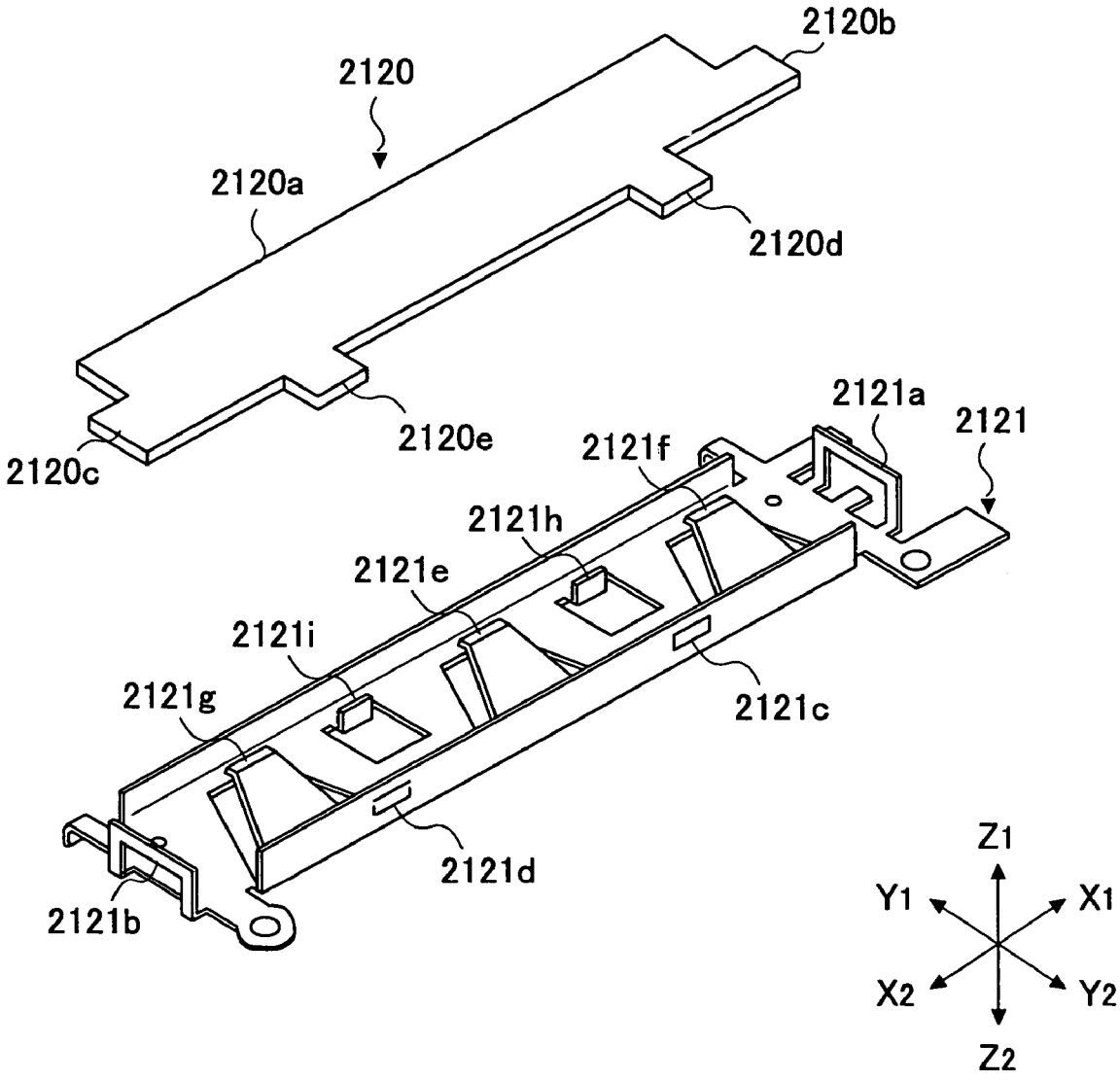
FIG. 38 is an exploded perspective view showing a fixed blade member and a support member shown in FIG. 37.
Figure 42:
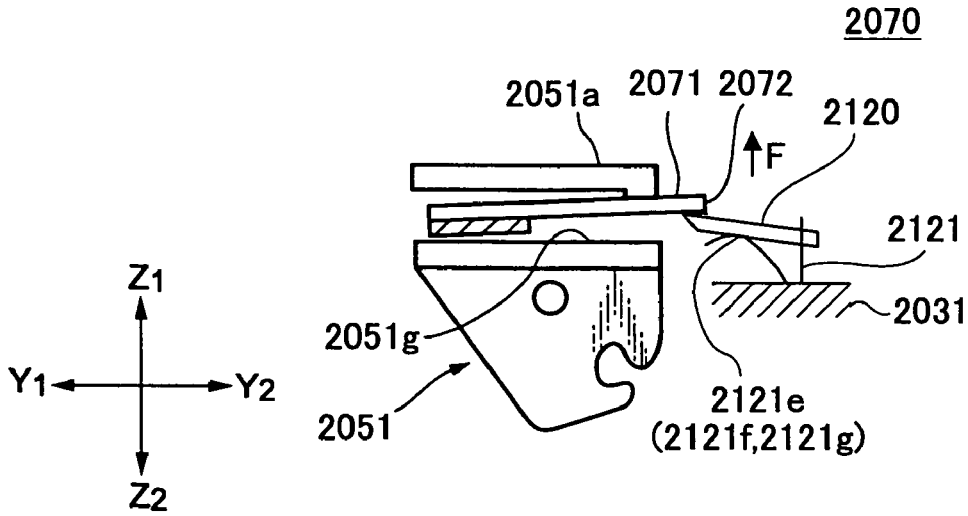
FIG. 42 is a side view showing the cutter part shown in FIG. 41.

The fixed blade member 2120, which is plate-shaped, includes a blade part 2120*a*. As shown in FIG. 38, the fixed blade member 2120 is mounted to a support member 2121 in such a way that an X1 side convex part 2120*b*, an X2 side convex part 2120*c*, convex parts 2120*d* and 2120*e* along the Y2 side edge are engaged with hole parts 2121*a* through 2121*d*, respectively, of the support member 2121, and the support member 2121 is screwed on the first support member 2031. The support member 2121, which is a press molded article formed from a thin metal plate, includes plate spring parts 2121*e* through 2121*g*, which are formed to be raised, and support portions 2121*h* and 2121*i*. The fixed blade member 2120 is supported by the support portions 2121*h* and 2121*i*, and Z1 directional force is applied to the fixed blade member 2120 by the plate spring parts 2121*e* through 2121*g*. As shown in FIG. 42, the side of the blade part 2120*a* of the fixed blade part 2120 is pressed up in the Z1 direction around a portion where the convex parts 2120*d* and 2120*e* are engaged with hole parts 2121*c* and 2121*d*. When the fixed blade member 2120 moves down in the Z2 direction and the plate spring parts 2121*e* through 2121*g* are curved, Z1 directional blade pressure F occurs in the fixed blade member 2120 due to spring force of the curved plate spring parts 2121*e* through 2121*g*.

The thermal head support member 2033 has a size corresponding to the width of the first support member 2031. As shown in FIG. 34A, a Z2 end part of the thermal head support member 2033 is supported by a support part 2031*a* of the first support member 2031 such that the thermal head support member 2033 can move in a small angle range, and the thermal head support member 2033 is inclined by an angle a in the Y1 direction with respect to a vertical surface of the thermal printer 2010. The thermal head 2032, which is fixed on the Y1 side surface of the first support member 2031, is pushed in the Y1 direction by the plate spring member 1034.

Figure 40:
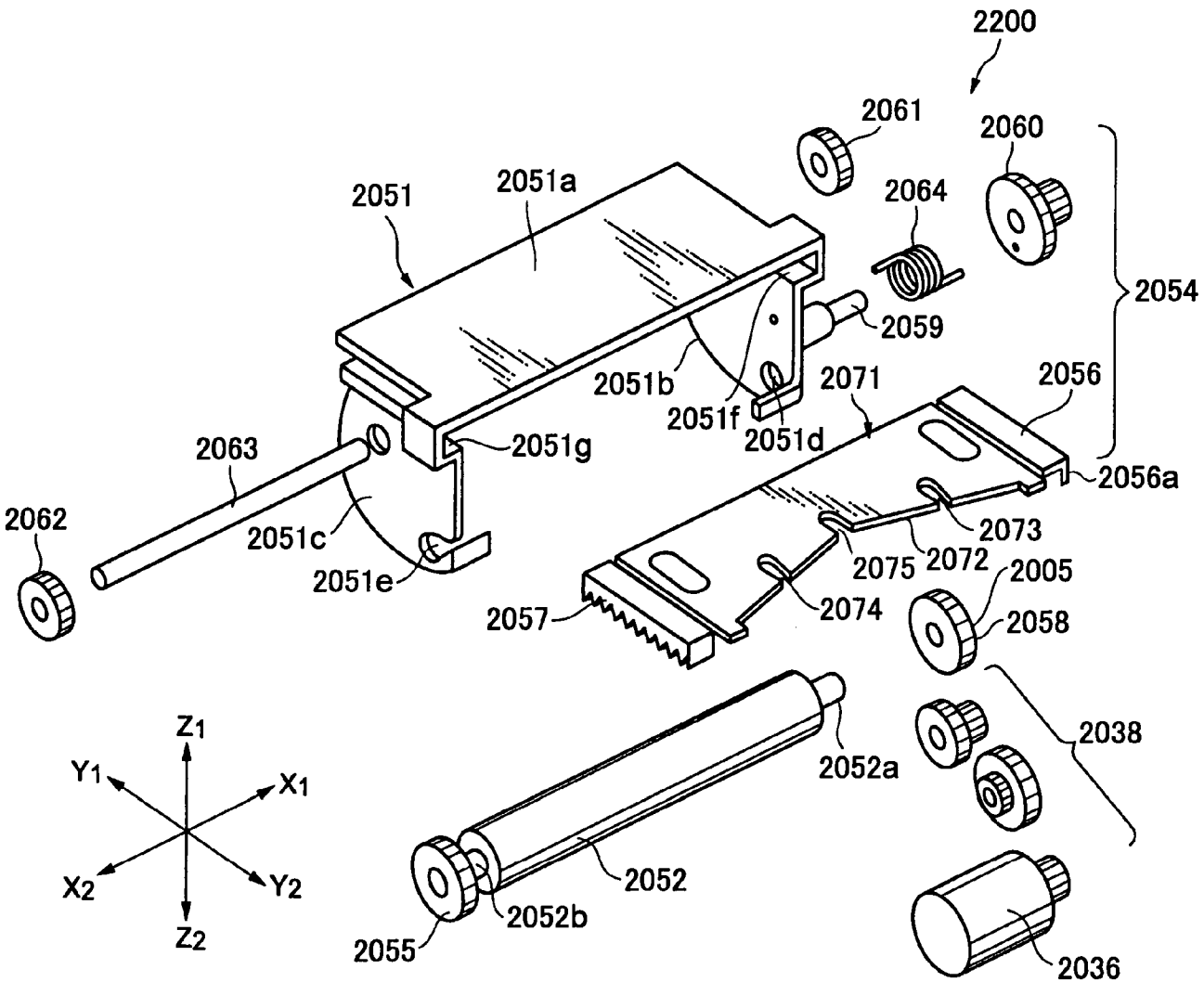
FIG. 40 is an exploded perspective view showing the second module shown in FIG. 39.
Figure 41:
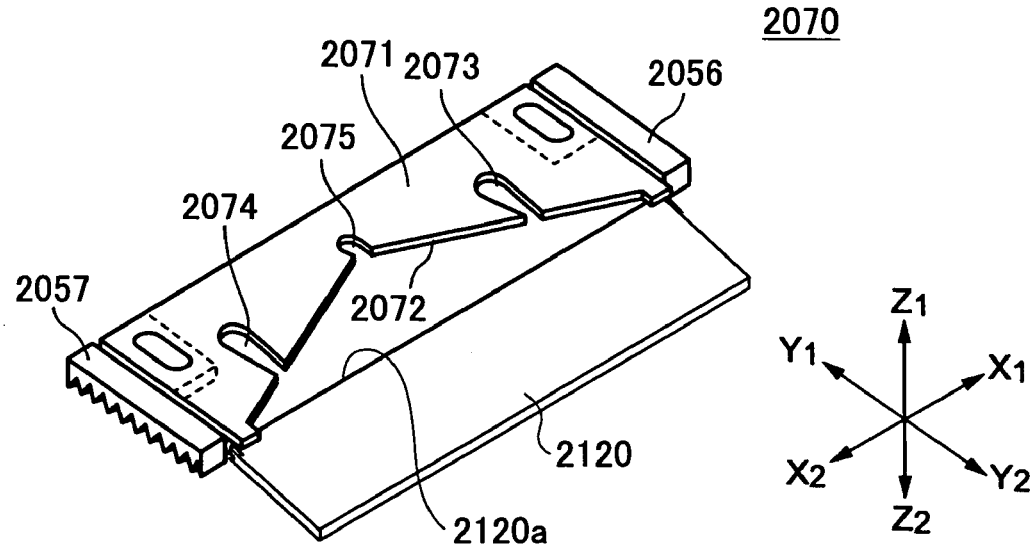
FIG. 41 is a diagram showing a cutter part according to an embodiment of the present invention.

The first pulse motor 2035 is for rotationally driving a platen, and a gear of the spindle of the first pulse motor 2035 is engaged with the first gear 2037. On the other hand, the second pulse motor 2036 is for shifting a movable blade, and a gear 2036*a* of the spindle of the second pulse motor 2036 is engaged with the second gear 2038, as illustrated in FIG. 40. In the illustration, a small diameter gear 2039 is provided in the output side of the first gear set 2037, and a small diameter gear 2040 is provided in the output side of the second gear set 2038. The first pulse motor 2035 and the second pulse motor 2036 are rotated by an angle corresponding to the number of supplied pulses. In particular, in a sequential print operation, such as an operation to issue a large number of tickets, some signals having different numbers of pulses are supplied to the second pulse motor 2036 depending on situations described in detail below, and during the sequential print operation, a paper is cut in a three-point left partial cutting manner, a two-point left partial cutting manner or a one-point left partial cutting manner. Finally, in response to receipt of a signal having a maximum number of pulses, the paper is completely cut.

Platen lock members 2041 and 2042 are disposed in the X2 and X1 sides, respectively. Also, an operation lever 2043 is provided to the platen lock member 2041.

The photo interrupter 2130 has such a structure that a light receiver faces a light emitter. Normally, the light receiver receives light and becomes ON. When a light shielding plate part 2056*a*, which is a portion of a rack described in detail below, is positioned between the light receiver and the light emitter, light is blocked and the light receiver becomes OFF. The photo interrupter 2130 detects that the movable blade member 1071 is slid back in the Y1 direction.

As shown in FIG. 39 and FIG. 40, a second module 2050 has such a structure that a platen roller 2052, the movable blade member 2071 and a gear set 2054 are mounted to an almost U-shaped second support member 2051. FIG. 40 is an exploded perspective view showing the second module 2050, and the shape of each member thereof is roughly illustrated. A mechanism 2200 to slide the movable blade member 2071 back and forth is composed of the gear set 2054 and racks 2056 and 2057 described in detail below.

The almost U-shaped second support member 2051 includes a top plate part 2051*a* and flange parts 2051*b* and 2051*c* disposed in the both sides of the top plate part 1051*a*. The platen roller 2052 is supported in such a structure that shaft parts 2052*a* and 2052*b*, which are projected in the both sides of the platen roller 2052, are engaged with shaft receiver parts 2051*d* and 2051*e*, respectively, of the second support member 2051. In addition, a gear 2055 is fixed to the shaft part 2052*b*. The plat movable blade member 2071 includes a V-shaped blade part 2072 having the V-shape bottom in the Y1 directional side and is fixed to the rack parts 2056 and 2057 in the X1 and X2 sides, respectively. The movable blade member 2071 is supported in such a structure that the rack parts 2056 and 2057 are supported to guide parts 2051*f* and 2051*g* formed in flange parts 2051*b* and 2051*c*, respectively, and can be shifted in the Y1-Y2 direction. The cutter part 2070 is composed of the fixed blade member 2120 and the movable blade member 2071. The cutter part 2070 can cut a paper in such ways that the paper can be partially cut except for three points, two points and one point. In order to realize these cutting ways, the movable blade member 2071 includes three notch parts 2073, 2074 and 2075, the shapes of which are described in detail below. The gear set 2054 includes a gear 2058 supported by the shaft part 2052*a*, a gear 2060 supported by an shaft 2059 on the flange part 2051*b* by being engaged with the gear 2058, a pinion 2061 engaged with the gear 2060, and another pinion 2062. The pinions 2061 and 2062 are fixed to both ends of an shaft member 2063 bridged between the flange parts 2051*b* and 2051*c*, and are engaged with the racks 2056 and 2057, respectively. A recovery spring 2064 is tensed between the gear 2060 and the flange part 2051*b* by the shaft 2059. The recovery spring 2064 forces the movable blade member 2071 to be shifted in the Y1 direction and be pulled in the interior of the second support member 2051.

The thermal line printer 2010 is incorporated into the mobile terminal device 2020, as illustrated in FIGS. 35A and 35B and FIG. 36. The mobile terminal device 2020 includes a chassis 2021, a casing 2022 for covering the chassis 2021, a lid 2024 supported to the Y1 side shaft 2023, a Y1 side roll paper accommodation part 2025, and an operation button 2026 on the casing 2022. The first module 2030 is fixed at a position in the casing 2022 so as to face the roll paper accommodation part 2025. The second module 2050 is fixed on bottom surface of the edge of the lid 2024.

As shown by dot lines in FIG. 35B and FIG. 36, the lid 2024 is opened, and a thermal paper roll 2080 is mounted in the roll accommodation part 2025. Then, when the lid 2024 is closed, the second module 2050 is coupled with the first module 2030, as illustrated in FIG. 35A and FIG. 36. Specifically, the shaft parts 2052*a* and 2052*b* of the platen roller 2052 are locked by being engaged with the platen roller lock members 2041 and 2042, and the platen roller 2052 presses the paper 2081 on the thermal head 2032. The end of the paper 2081 is protruded from an exit 2027. Also, the cutter part 2070 is formed in such a structure that the blade part 2072 of the movable blade member 2071 is located to face the fixed blade part 2033*b*. In addition, the gear 2055 is engaged with the small diameter gear 2039, and the gear 2058 is engaged with the small diameter gear 2040.

The control circuit 2140 controls driving of the thermal head 2032 and the first and the second pulse motors 2035 and 2036.

In response to a print instruction, the thermal head 2032 is driven and heated, and at the same time, the motor 2035 is driven to rotate the platen roller 2052 via the first gear set 2037 and the gear 2055. Then, a printed paper portion 2082 passes the cutter part 2070 and is delivered from the exit 2027. Heat generated in the thermal head 2032 is released through the thermal head support member 2033. Upon completion of the printing, a cut instruction is issued, and the motor 2036 is driven to drive the racks 2056 and 2057 via the second gear set 2038, the gear set 2054 and the pinions 2061 and 2062. Also, both X1-X2 sides of the movable blade member 2071 are driven, and the movable blade member 2071 is slid in the Y2 direction through guidance of the X1-X2 sides by guide parts 2051*f* and 2051*g*. Then, the motor 2036 is inversely driven so that the movable blade member 2071 is slid back in the Y1 direction and the printed paper portion 2082 is cut.

When the operation lever 2043 is manipulated, the locked shaft parts 2052*a* and 2052*b* of the platen roller 2052 are unlocked, and a thermal paper roll can be replenished from the opened lid 2024.

It is noted that the above-mentioned structure of the cutter part 2070 is applicable to printers other than a thermal line printer. In addition, the cutter part 2070 is not limited to the above-mentioned structure where the cutter part 2070 is integrally provided to the thermal printer 2010. The cutter part 2070 can be used separately from the thermal printer 2010.

[Structure and Operation of the Cutter Part 2070]

An exemplary structure of the cutter part 2070 is described.

As shown in FIGS. 34A and 34B, FIG. 41 and FIG. 42, the movable blade member 2071 is disposed to face the fixed blade member 2120. A blade part 2072 of the movable blade member 2071 has V-shape whose bottom is in the Y1 directional side as illustrated in FIG. 34B. For this reason, when the movable blade member 2071 is slid in the Y2 direction, the blade part 2072 of the movable blade member 2071 is in point-contact with the blade part 2120*a* at two contact points. In addition, predefined blade pressure is applied to these contact points, and the positions of the contact points are shifted from the both sides of X1-X2 direction to the center side. Thus, shear force is properly applied, and the paper 2081 can be smoothly cut.

A description is given of how blade pressure is generated. As shown in FIG. 42, the top plate part 2051*a* guides both sides thereof with respect to the X1-X2 direction, and the movable blade member 2071 limitedly moves in the Z1 direction. Accordingly, the blade part 2072 of the movable blade member 2071 presses the blade part 2120*a* in the Z2 direction and slides the blade part 2120*a* in the Y2 direction. As a result, Z2 and Y2 directional forces occur in the fixed blade member 2120, and the fixed blade member 2120 curves the plate spring parts 2121*e*, 2121*f* and 2121*g* and slightly moves in the Z2 direction. As a result, Z1 directional blade force F is generated in the fixed blade member 2120 by spring force of the plate spring parts 2121*e*, 2121*f* and 2121*g*.

Figures 43A, 43B, 43C:
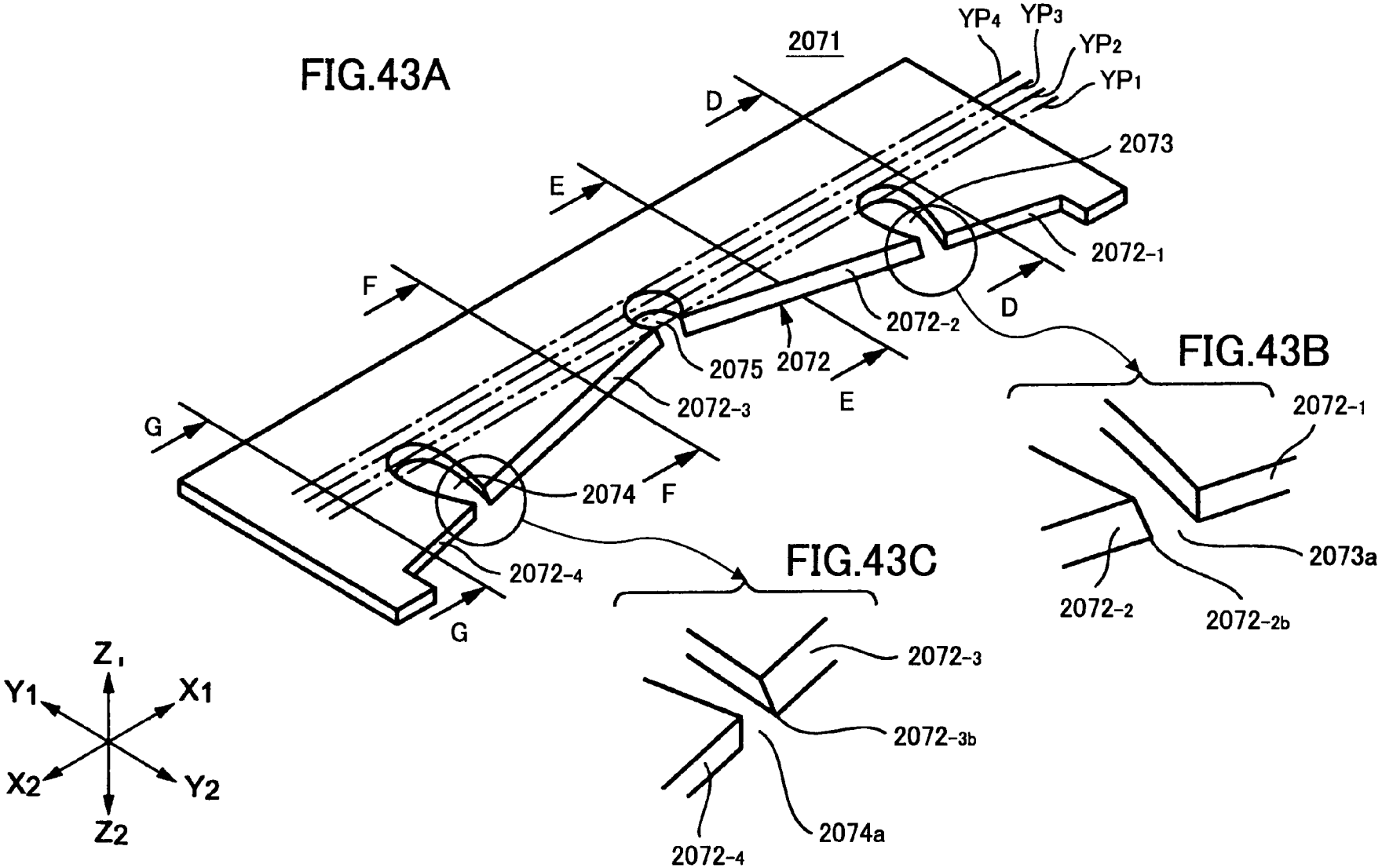
FIGS. 43A through 43G are enlarged views showing a movable blade member and portions thereof according to an embodiment of the present invention.
Figure 44:
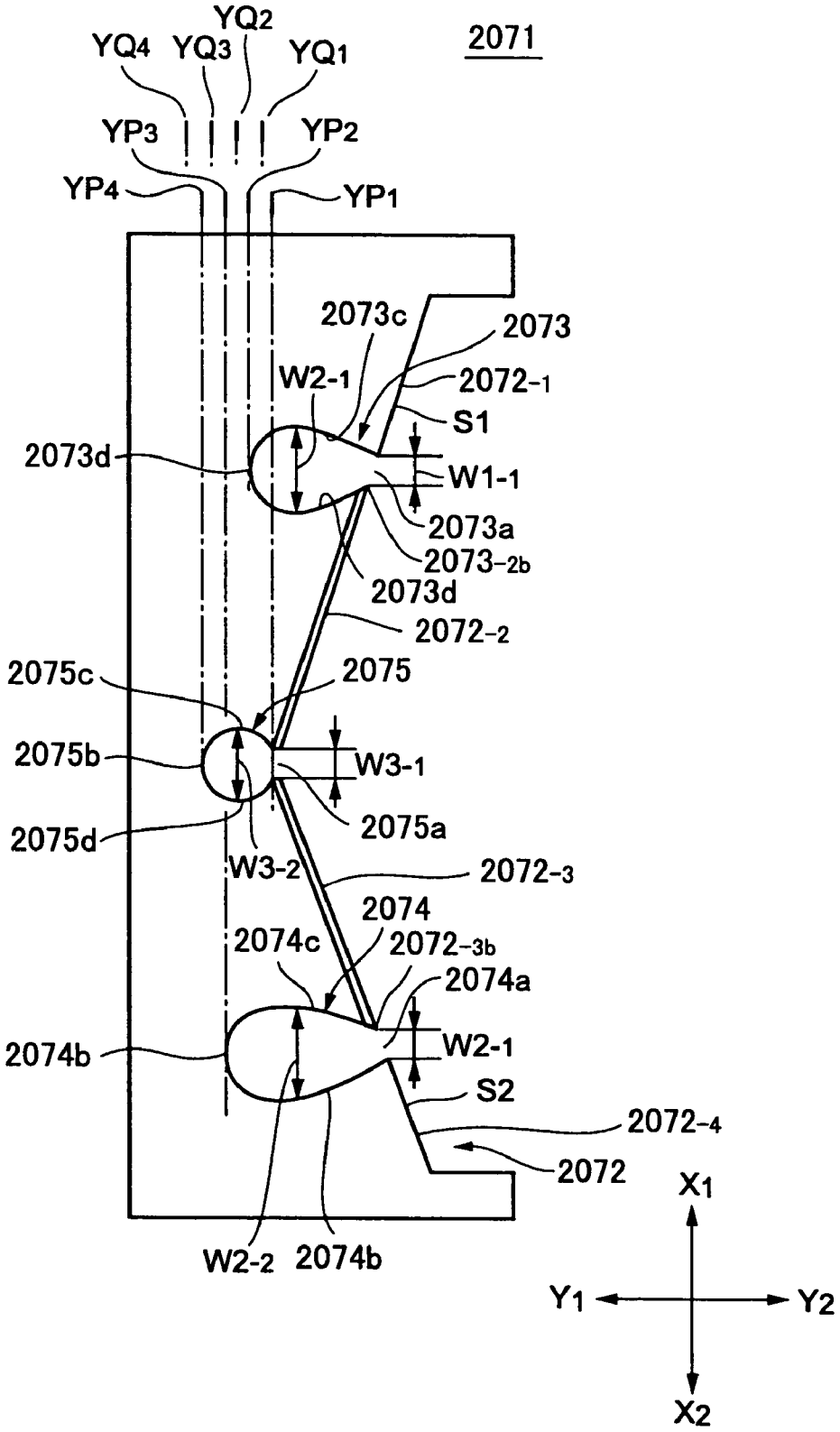
FIG. 44 is a plan view showing the movable blade member shown in FIG. 43.

Also, as shown in FIG. 43A and FIG. 44, the movable blade member 2071 includes the blade part 2072 having V shape configured from a pair of slopes S1 and S2. In addition, the movable blade member 2071 includes a first notch part 2073 along the slope S1, a second notch part 2074 along the slope S2, and a third notch part 2075 at the bottom of the V shape. The third notch part 2075 is formed as an almost circle, and the first and second notch parts 2073 and 2074 are formed as ovals having long axes in the Y1-Y2 direction.

As shown in FIG. 44, the first notch part 2073 includes an entrance part 2073*a* having a width W11 with respect to the X1-X2 direction, a most inner edge part 2073*b* located at the most inner position with respect to the Y1 direction, and edge parts 2073*c* and 2073*d* located between the entrance part 2073*a* and the most inner edge part 2073*b*. Each of the edge parts 2073*c* and 2073*d* is widen in the X1-X2 direction toward the Y1 direction from the entrance part 2073*a*. In other words, a width W21 between edge parts 2073*c* and 2073*d* is greater than the width W11 of the entrance part 2073*a*, that is, W21>W11.

Like the first notch part 2073, the second notch part 2074 includes an entrance part 2074*a* having a width W21, a most inner edge part 2074*b*, and edge parts 2074*c* and 2074*d* located to have a width W22 between the edge parts 2074*c* and 2074*d*. For the second notch part 2074, it holds that W22>W12.

The third notch part 2075 includes an entrance part 2075*a* having a width W13, a most inner edge part 2075*b*, and edge parts 2075*c* and 2075*d* located to have a width W23 between the edge parts 2075*c* and 2075*d*. For the third notch part 2075, it holds that W23>W13.

Regarding the Y1-Y2 direction, YP2, YP3 and YP4 represent positions of the most inner edge parts 2073*b*, 2074*b* and 2075*b*, respectively. Also, YP1 represents a position slightly shifted in the Y1 direction from the entrance part 2075*a* of the third notch part 2075. YP1 is positioned in the nearest side with respect to the Y2 direction. YP2 is positioned in the Y1 directional side from YP1. YP3 is positioned in the Y1 directional side from YP2. YP4 is positioned in the Y1 directional side from YP3. Thus, YP1, YP2, YP3 and YP4 are aligned in that order with respect to the Y1 direction. In other words, the most inner edge parts 1073*b*, 1074*b* and 1075*b* of the first, the second and the third notch parts 2073, 2074 and 2075, respectively, are positioned differently with respect to the Y1-Y2 direction.

YQ1 through YQ4 represent the positions of the blade part 2120*a* of the fixed blade part 2120 relative to the position of the movable blade member 2071. YQ2 is positioned between YP2 and YP3. YQ3 is positioned between YP3 and YP4. YQ4 is positioned in the Y1 directional side from YP4. YQ1 is positioned in the Y2 directional side from YP1.

Figure 43D:
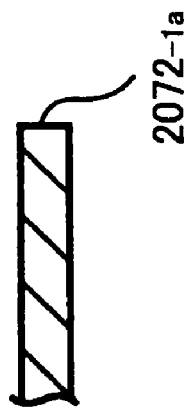
Figure 43E:
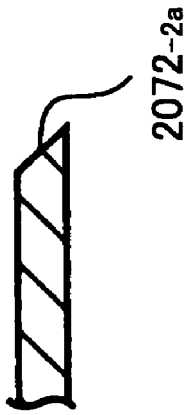
Figure 43F:
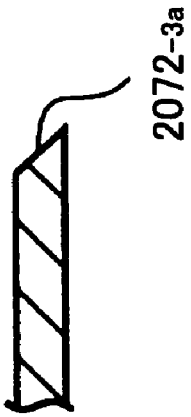
Figure 43G:
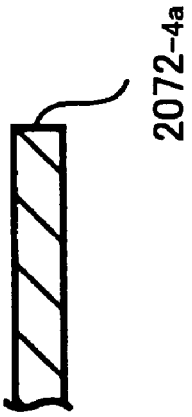

The blade part 2072 is described. The blade part 2072 includes a blade part 2072-1, which is an X1 side portion of the blade part 2072 from the first notch part 2073, a blade part 2072-2, which is a portion of the blade part 2072 between the first and the third notch parts 2073 and 2075, a blade portion 2072-3, which is a portion of the blade part 2072 between the second and the third notch parts 2074 and 2075, and a blade portion 2072-4, which is an X2 side portion of the blade part 2072 from the second notch part 2074. As shown in FIGS. 43D and 43G, the blade parts 2072-1 and 2072-4 include vertical surfaces 2072-1*a* and 2072-4*a*. As shown in FIGS. 43E and 43F, the blade parts 2072-2 and 2072-3 include slope surfaces 2072-2*a* and 2072-3*a* projecting in the Z1 side in the Y2 direction. The blade part 2072-2 having the slope surface 2072-2*a* is wedge-shaped, and as shown in FIG. 43B, the blade part 2072-2 includes a sharp part 2072-2*b*, which is sharpened in the Y2 direction, at the X1 directional end, that is, at a position facing the entrance part 2073*a* of the blade part 2072-2. Similarly, the blade part 2072-3 is wedge-shaped, and as shown in FIG. 43C, the blade part 2072-3 includes a sharp part 2072-3*b*, which is sharpened in the Y2 direction, at the X2 directional end, that is, at a position facing the entrance part 2073*a* of the blade part 2072-3. As described below, the sharp parts 2072-2*b* and 2072-3*b* occupy positions where cutting of a paper is restarted by piercing the paper, and the sharp shape is useful to start to smoothly cut the paper.

An exemplary paper cut operation of the cutter part 2070 is described.

Figure 45B:
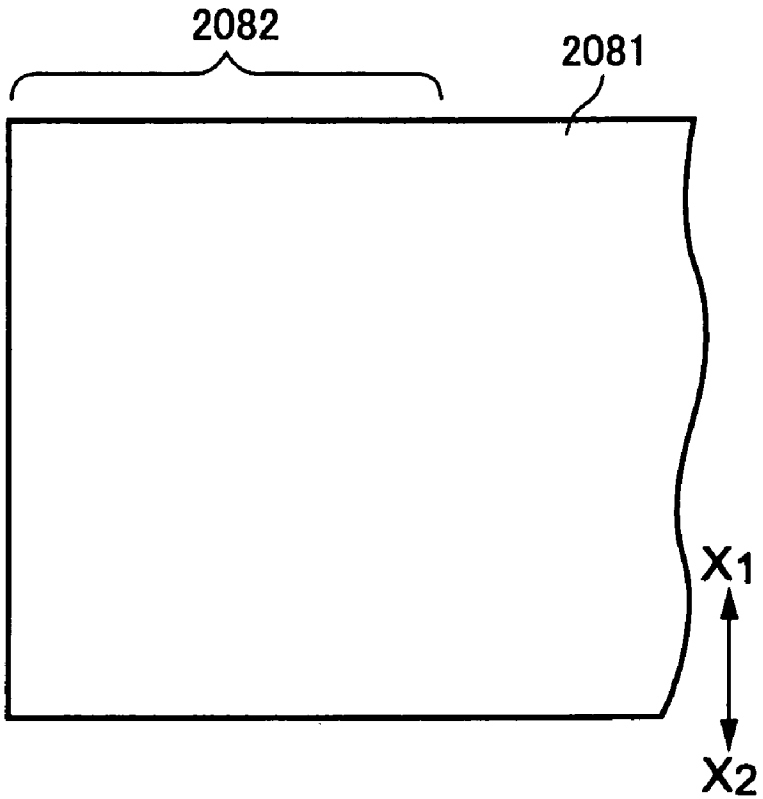
FIGS. 45A and 45B are diagrams showing a condition of the cutter part before operation.
Figure 45A:
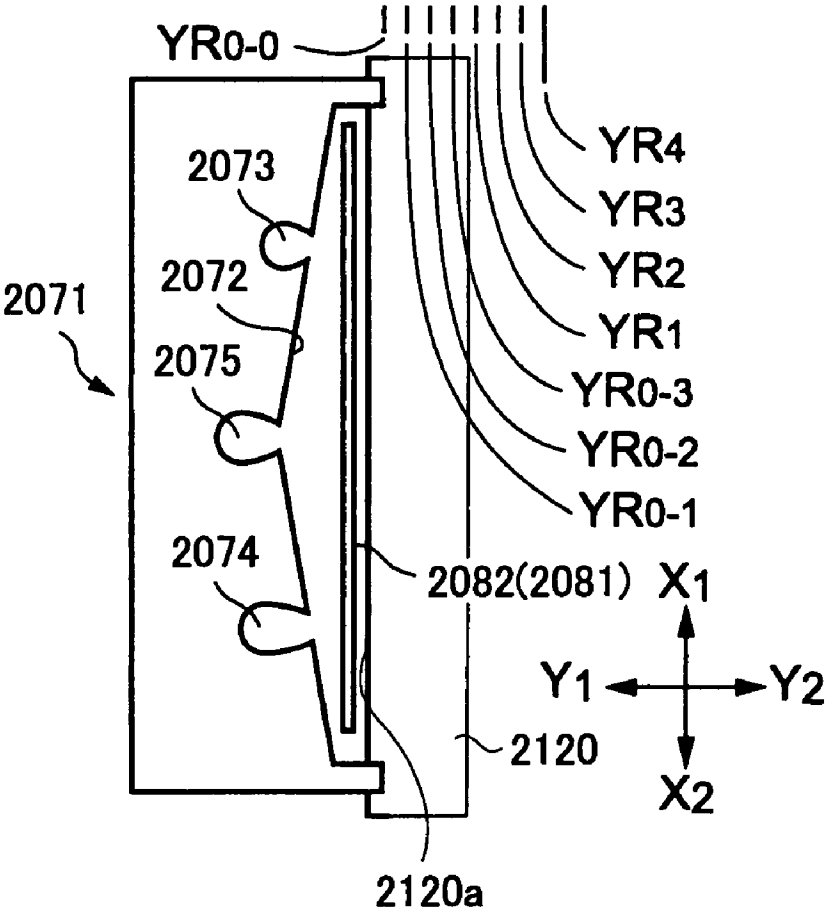

FIGS. 45A and 45B show an exemplary condition of the cutter part 2070 before start of the operation. FIG. 46 through FIG. 52 illustrate positions of the movable blade member 2071 slid in the Y2 direction and paper cutting conditions corresponding to the positions. FIGS. 46A through 52A show positions of the movable blade member 2071 relative to the blade part 2120*a* of the fixed blade member 2120. FIGS. 46B through 52B show paper cutting conditions. The movable blade member 2071 is shifted to YR4 via YR0-1, YR0-2, YR0-1, YR0-3, YR1, YR2 and YR3. Depending on types of instructions, the final position of the movable blade member 2071 may be set as YR1, YR2 or YR3. It is noted that YR1, YR2, YR3 and YR4 correspond to YQ1, YQ2, YQ3 and YQ4, respectively.

As shown FIGS. 45A and 45B, the movable blade member 2071, which is in a status where the operation of the movable blade member 2071 is not started, is positioned at YR0-0, and the paper 2081 has not been cut.

Figure 46B:
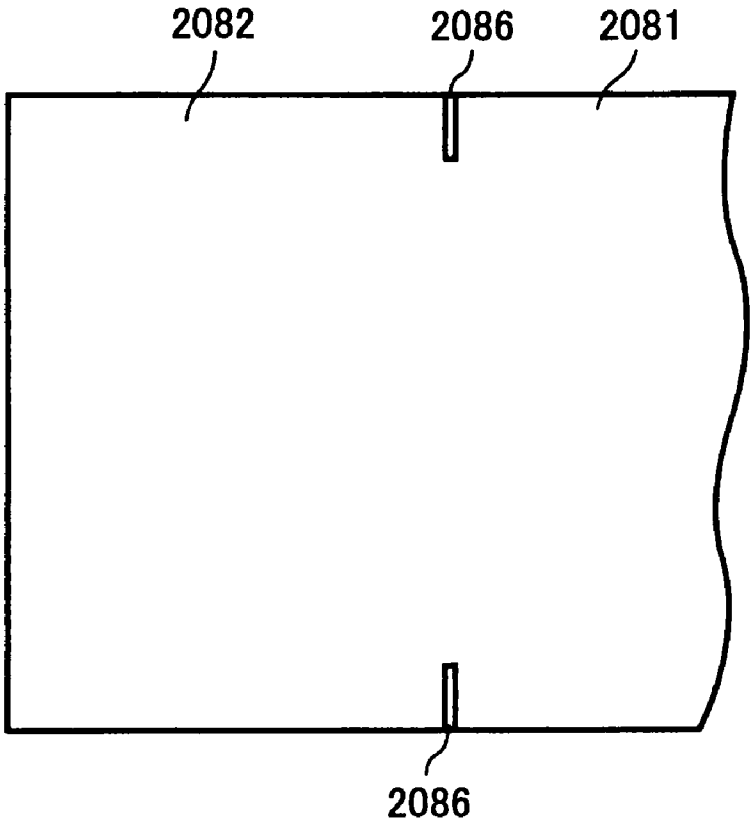
FIGS. 46A and 46B are diagrams showing another condition of the cutter part before operation.
Figure 46A:
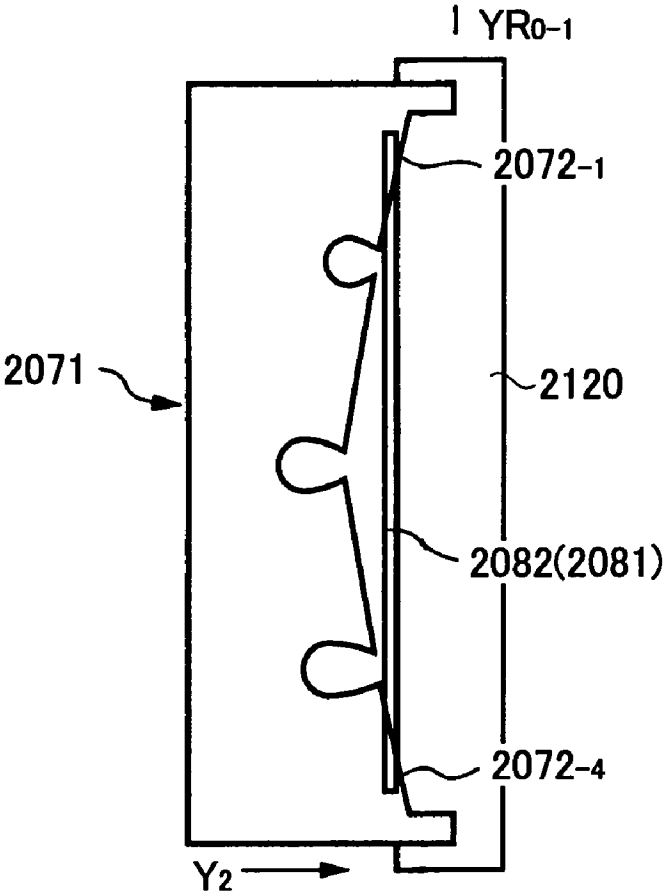

When the movable blade member 2071 starts to move in the Y2 direction, the blade parts 2072-1 and 2072-4 overlap the blade part 2120*a* of the fixed blade member 2120, and the paper 2081 starts to be cut from the X1 and X2 sides. In a condition where the movable blade member 2071 is positioned at YR0-1 as illustrated in FIG. 46A, the paper 2081 is in a cutting condition where the paper 2081 has a cut portion 2086 shown in FIG. 46B.

Figure 47B:
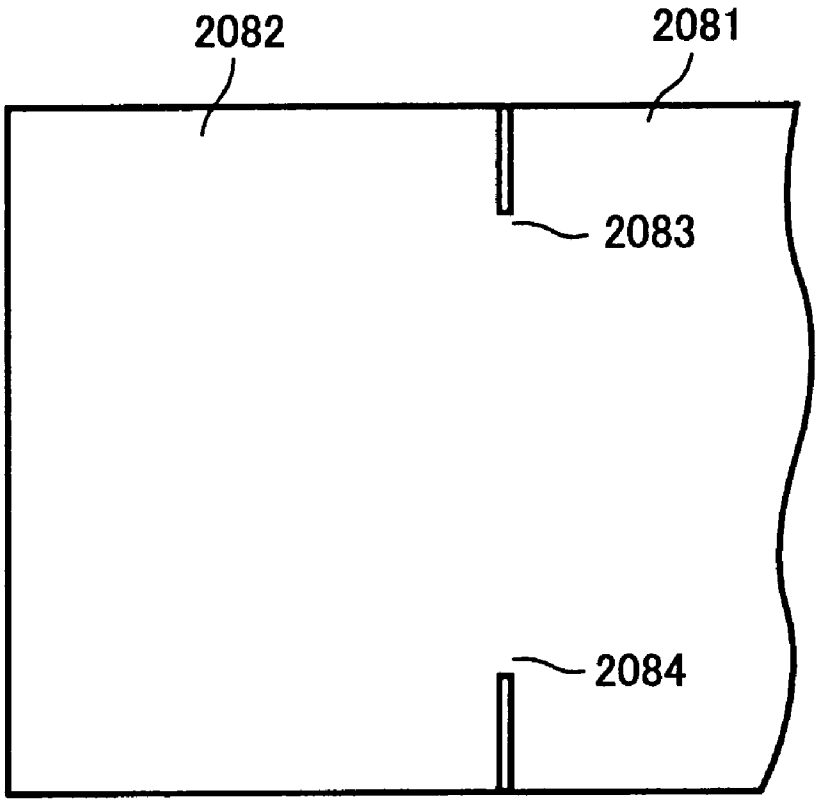
FIGS. 47A and 47B are diagrams showing a condition where the movable blade member is further slid and cutting is stopped.
Figure 47A:
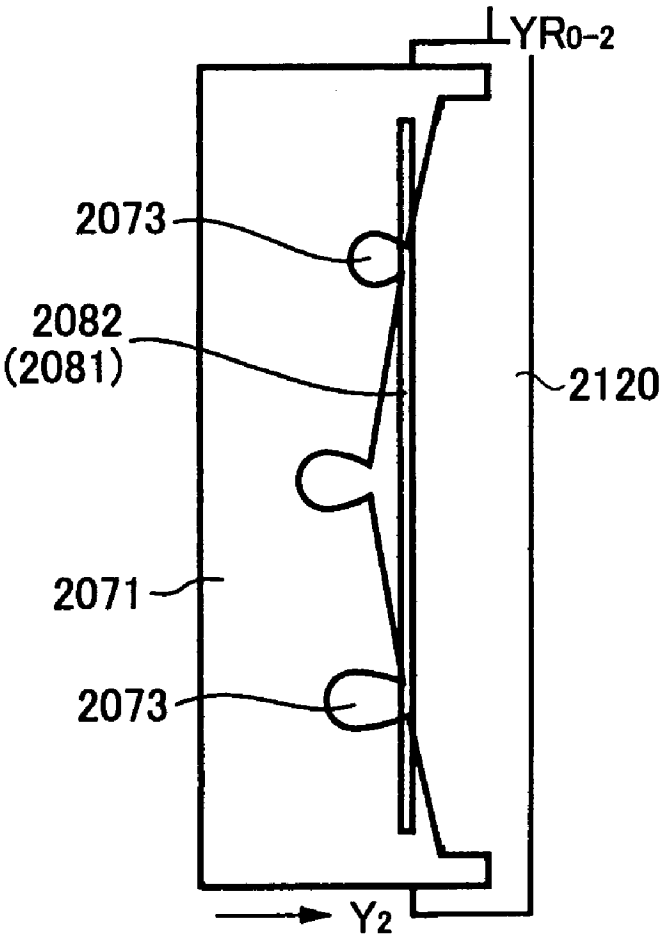

When the movable blade member 2071 moves to YR0-2 as illustrated in FIG. 47A, the entrance parts 2073*a* and 2074*a* of the first and the second notch parts 2073 and 2074, respectively, overlap the blade part 2120*a*, and the cutting of the paper 2081 is stopped. As shown in FIG. 47B, first and second uncut portions 2083 and 2084 start to be formed in the paper 2081. The first uncut portion 2083 of the first notch part 2073 is in a condition shown in FIG. 53B.

Figure 48B:
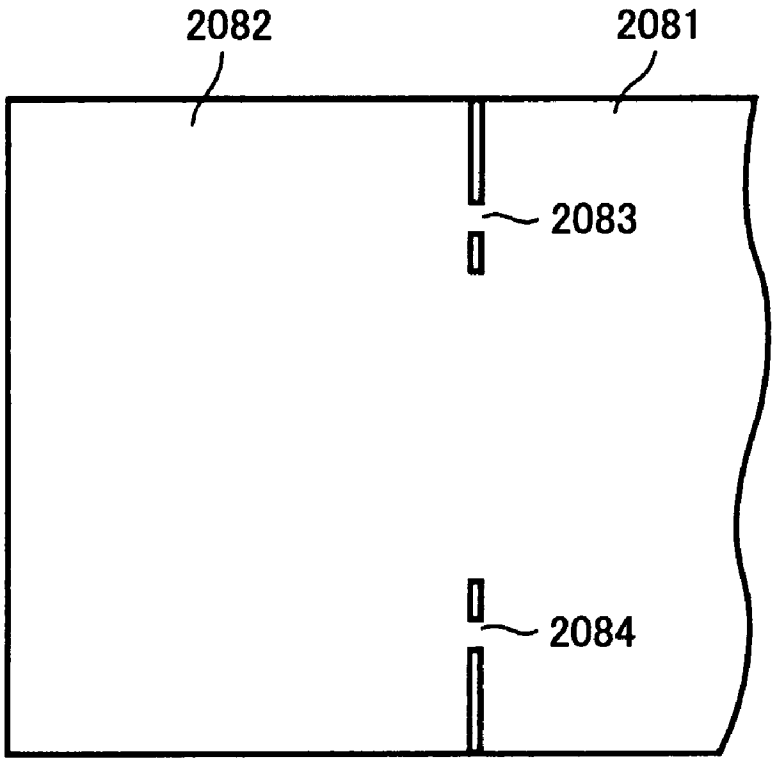
FIGS. 48A and 48B are diagrams showing a condition where the movable blade member is further slid and the cutting restarts.
Figure 48A:
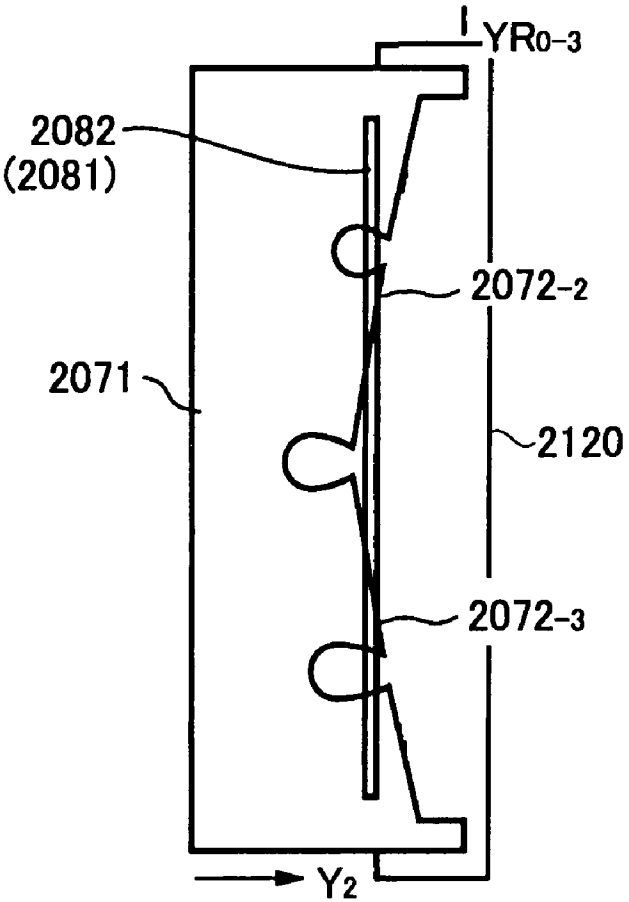

When the movable blade member 2071 moves to the YR0-3 as illustrated in FIG. 48A, the blade parts 2072-2 and 2072-3 start to overlap the blade part 2120*a*, and the cutting of the paper 2081 restarts. As shown in FIG. 48B, the first and the second uncut portions 2083 and 2084 are formed, and the paper 2081 restarts to be cut from the X2 end of the first uncut part 2083 and the X1 end of the second uncut part 2084. The first uncut portion 2083 of the first notch part 2073 is in a condition shown in FIG. 53C.

Here, the cutting of the paper 2081 restarts with a portion other than the ends of the paper 2081, that is, the surface of the paper 2081. In order to smoothly restart the cutting of the paper 2081, the paper 2081 is pierced by the sharp parts 2072-2*b* and 2072-3*b*. It is noted that the paper cutting can be smoothly restarted even after the cutter part 2070 has been used for long time. Also, as in the case shown in FIG. 46A, the paper 2081 is cut by shear force generated through movement of contact points where blade pressure is applied. Accordingly, since it is possible to prevent generation of paper powder, the thermal printer 2010 having the cutter part 2070 is preferably used, for example, in a kitchen from the aspect of good hygiene.

Figure 49B:
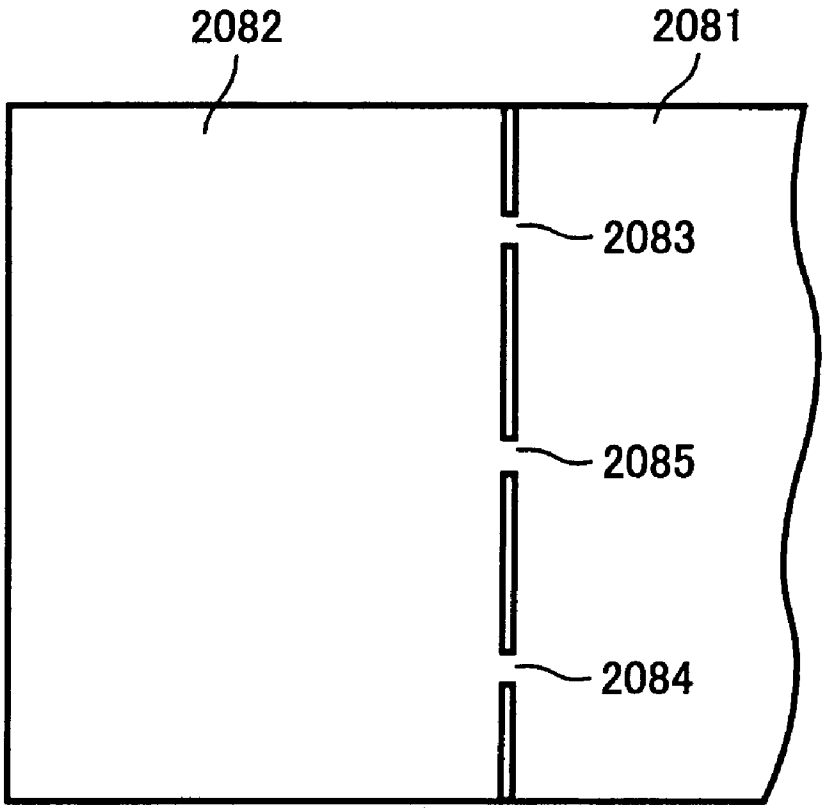
FIGS. 49A and 49B are diagrams showing a condition where the movable blade member is further slid and a paper is cut in three-point left partial cutting.
Figure 49A:
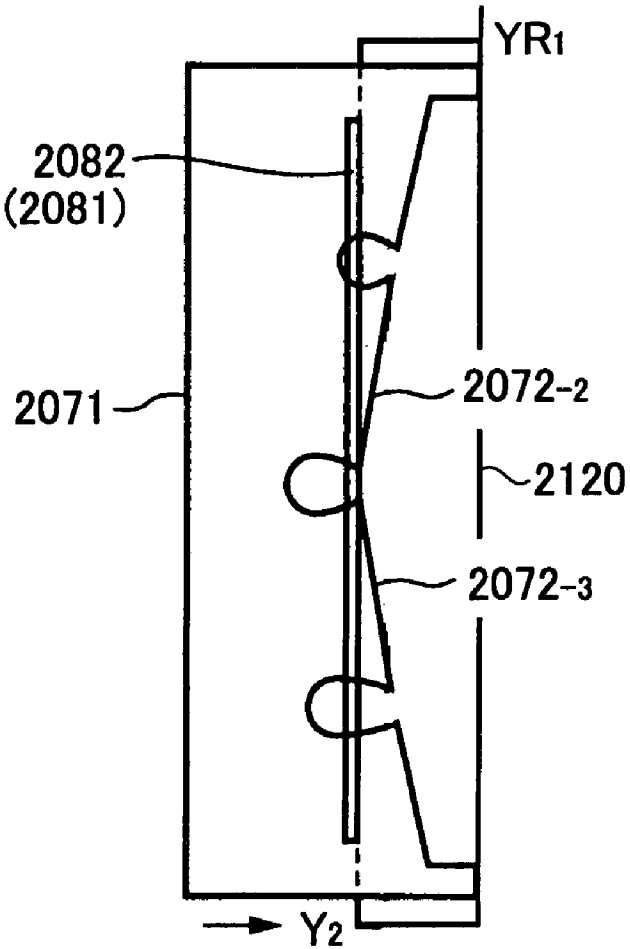

When the movable blade member 2071 moves to YR1 as illustrated in FIG. 49A, the blade parts 2072-2 and 2072-3 pass through the blade part 2120*a*, and the third notch part 2075 overlaps the blade part 2120*a*. At this time, as shown in FIG. 49B, a third uncut part 2085 is formed in the paper 2081. The paper 2081 is cut in a condition where the third uncut part 2085 is formed at the center with respect to the width direction of the paper 2081 and the first and the second uncut parts 2083 and 2084 are formed at the both ends thereof, that is, in a three-point left partial cutting condition. The first uncut portion 2083 of the first notch part 2073 is in a condition shown in FIG. 53D.

Figure 50B:
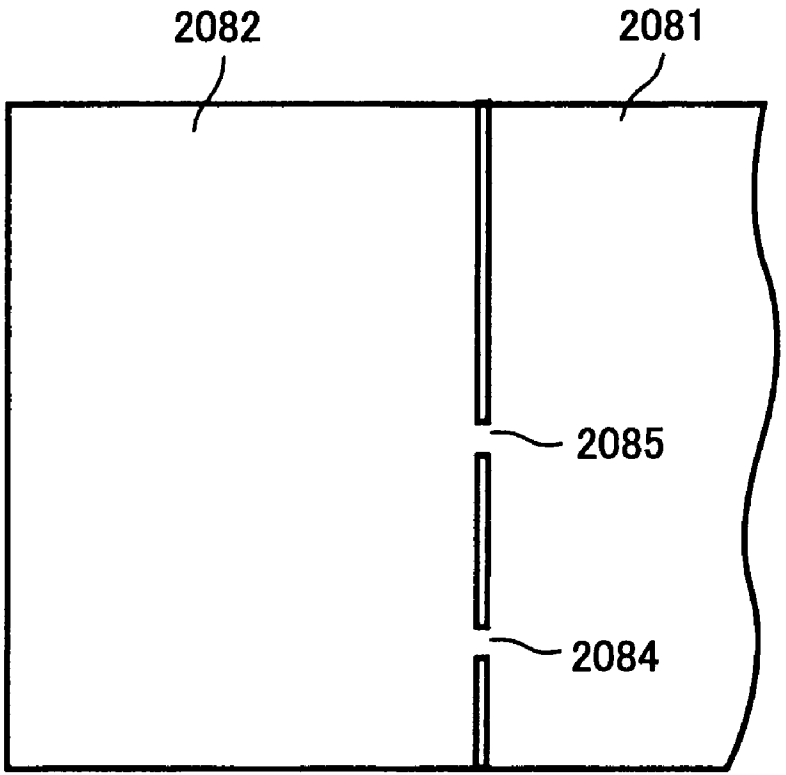
FIGS. 50A and 50B are diagrams showing a condition where the movable blade member is further slid and the paper is cut in two-point left partial cutting.
Figure 50A:
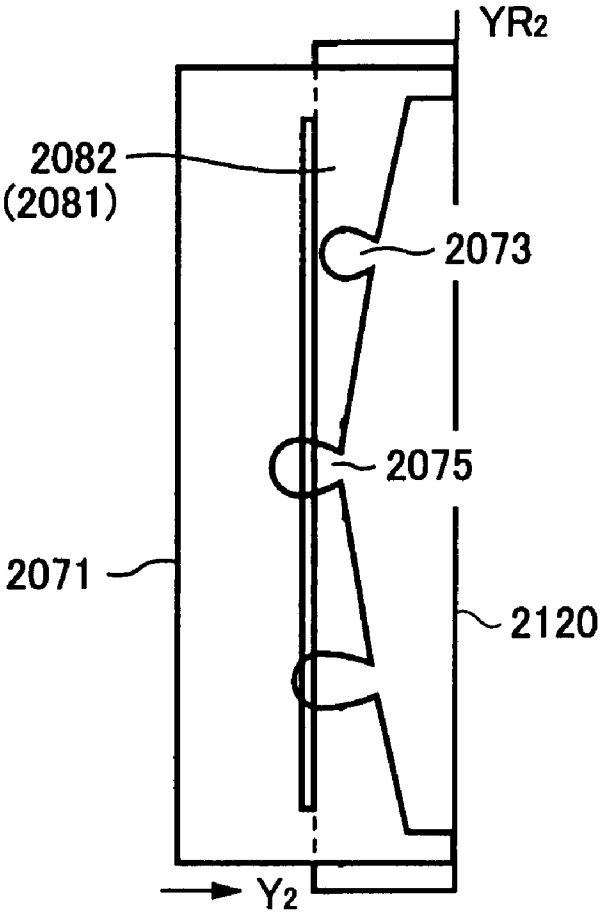
Figure 53A:
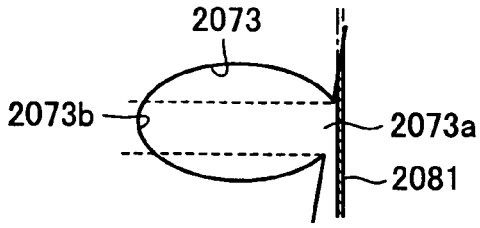
FIGS. 53A through 53F are diagrams illustrating operations of a first notch part to form a first uncut part and then cut the first uncut part.
Figure 53B:
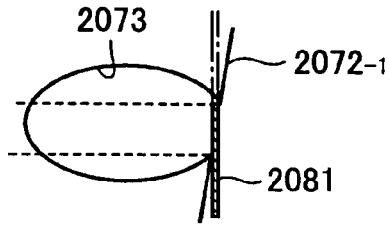
Figure 53C:
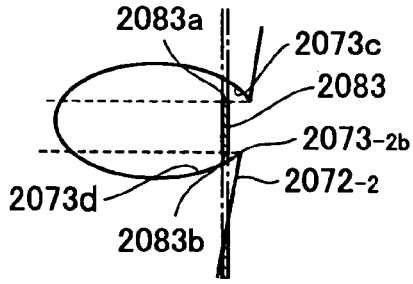
Figure 53D:
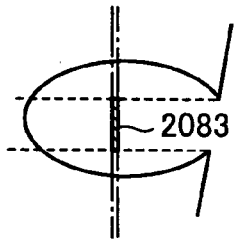
Figure 53E:
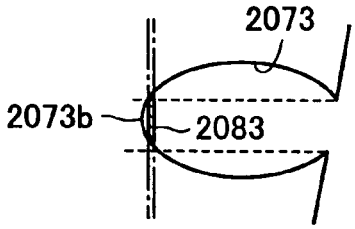
Figure 53F:
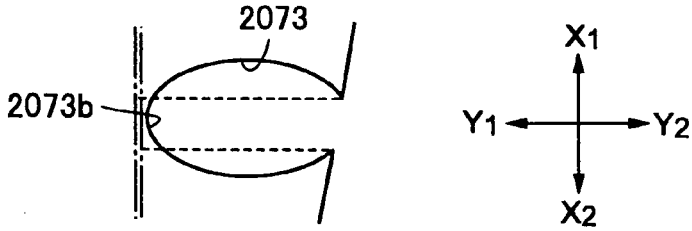

When the movable blade member 2071 moves to YR2 as illustrated in FIG. 50A, the whole portion of the first notch part 2073 reaches the blade part 2120*a*, as illustrated in FIGS. 53E and 53F, and the most inner edge part 2073*b* of the first notch part 2073 cuts the first uncut part 2083 in cooperation with the movable blade member 2071. At this time, the paper 2081 is cut in a condition where the third and the second uncut parts 2085 and 2084 are formed as illustrated in FIG. 53B, that is, in a two-point left partial cutting condition.

Figure 51B:
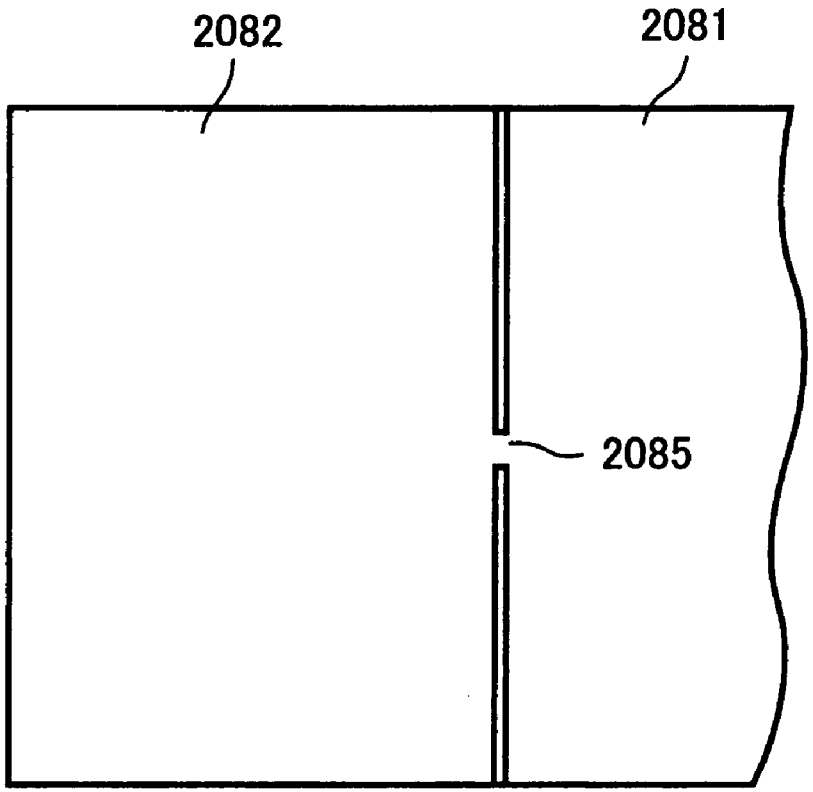
FIGS. 51A and 51B are diagrams showing a condition where the movable blade member is further slid and the paper is cut in one-point left partial cutting.
Figure 51A:
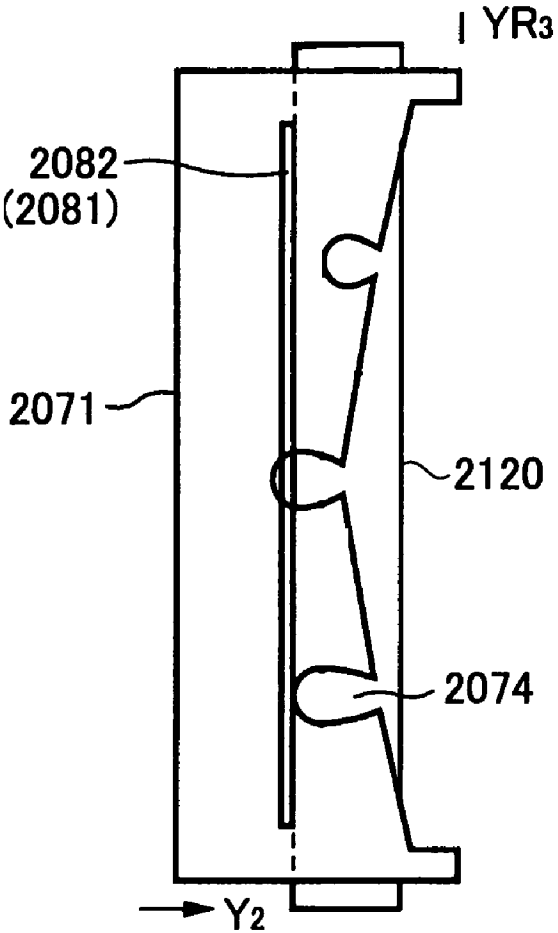

When the movable blade member 2071 moves to YR3 as illustrated in FIG. 51A, the whole portion of the second notch part 2074 reaches the blade part 2120*a*, and the most inner edge part 2074*b* of the second notch part 2074 cuts the second uncut part 2084 in cooperation with the movable blade member 2071. At this time, the paper 2081 is cut in a condition where only the third uncut part 2085 is formed as illustrated in FIG. 51B, that is, in a one-point left partial cutting condition.

Figure 52B:
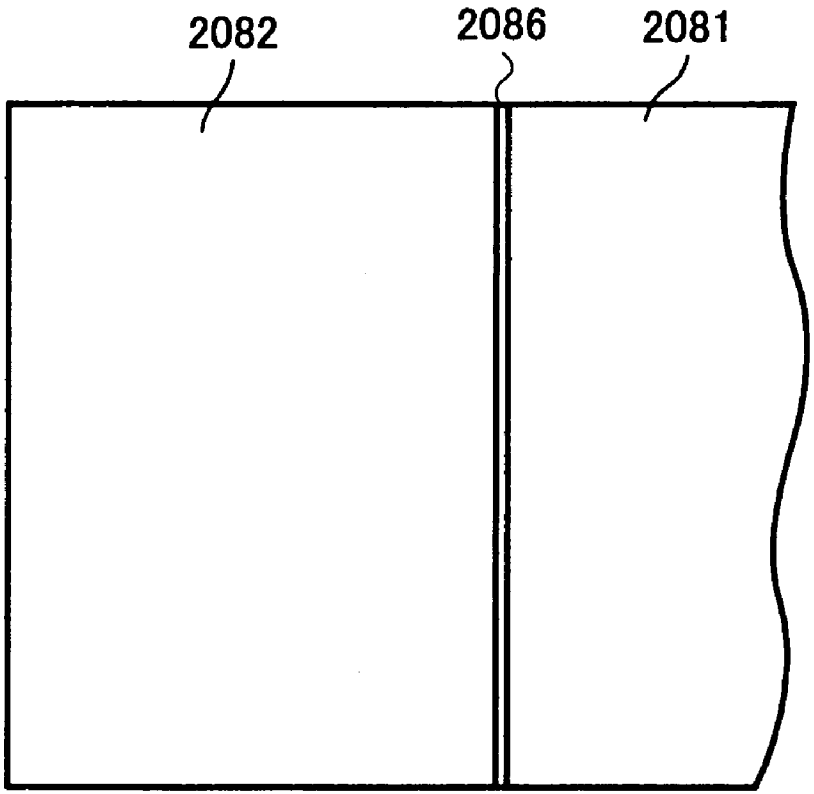
FIGS. 52A and 52B are diagrams showing a condition where the movable blade member is further slid and the paper is completely.
Figure 52A:
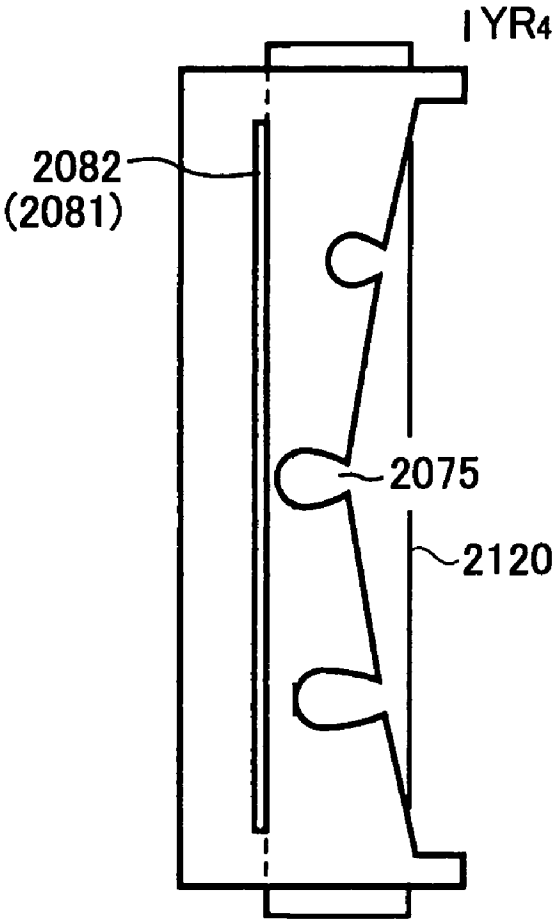

When the movable blade member 2071 moves to YR4 as illustrated in FIG. 52A, the whole portion of the third notch part 2075 reaches the blade part 2120*a*, and the most inner edge part 2075*b* of the third notch part 2075 cuts the third uncut part 2085 in cooperation with the movable blade member 2071. The paper 2081 is completely cut as illustrated in FIG. 52B, and the printed paper portion 2082 is cut.

If the sharp parts 2072-2*b* and 2072-3*b* are provided, it is possible to realize a longer life-span of the cutter part 2070, which can be used for three-point left partial cutting.

Here, by appropriately setting a program of a microcomputer, the second pulse motor 2036 can be controlled in such a way that the movable blade member 2071 moves to YR1 and then returns, moves to YR2 and then returns, or moves YR3 and then returns.

When the movable blade member 2071 moves to YR1 and returns, the paper 2081 is cut in three-point left partial cutting as illustrated in FIG. 49B. When the movable blade member 2071 moves to YR2 and then returns, the paper 2081 is cut in the two-point left partial cutting as illustrated in FIG. 50B. When the movable blade member 2071 moves to YR3 and then returns, the paper 2081 is cut in the one-point left partial cutting, as illustrated in FIG. 51B. In these conditions, a user can separate the printed paper portion 2082 from the paper 2081 by tearing the printed paper portion 2082.

In particular, if the printed paper portion 2082 is cut in the three-point left partial cutting or the two-point left partial cutting, the printed paper portion 2082 is coupled to the paper 2081 via a plurality of connection points located away from each other with respect to the width direction of the paper 2081. For this reason, even if the paper 2081 has a strong wind, it is possible to prevent the printed paper portion 2082 from be rotated and reversed. Accordingly, the mobile terminal device 2020 having the thermal printer 2010 can be preferably used to print ordered menu contents, for example, in a kitchen where the mobile terminal device 2020 has a strong wind from an electric fan. On the other hand, if the printed paper portion 2082 cut in the one-point left partial cutting has a strong wind, there is a risk that the printed paper portion 2082 may be rotated and reversed around the uncut portion. In such a case, a user cannot properly read the ordered menu contents. However, there is no possibility that such a problem may occur in the three-point left partial cutting and the two-point left partial cutting.

An exemplary relation between the first notch part 2073 and the first uncut part 2083 is described.

As shown in FIGS. 53B through 53D, the first notch part 2073 is shifted in the Y2 direction from the formed first uncut part 2083, and the first uncut part 2083 intrudes the interior of the first notch part 2073.

As shown in FIG. 44 and FIG. 53A, the edge parts 2073*c* and 2073*d* of the first notch part 2073 are widened in the X1-X2 direction toward the Y1 direction from the entrance part 2073*a*.

Thus, the edge part 2073*c* moves from the X1 side edge 2083*a* of the formed first uncut part 2083 to the X1 side, and the edge part 2073*d* moves from the X2 side edge 2083*b* of the first uncut part 2083 to the X2 side. Accordingly, the edge parts 2073*c* and 2073*d* are not in friction with the first uncut part 2083, and thereby no Y2 directional friction force occurs in the first uncut part 2083. As a result, no unnecessary twist force is generated in the paper 2081.

The same discussion holds in a relation between the second notch part 2074 and the formed second uncut part 2084, and no Y2 directional force is generated in the second uncut part 2084. In addition, the same discussion holds in a relation between the third notch part 2075 and the formed third uncut part 2085, and no Y2 directional force is generated in the third uncut part 2085.

Thus, the paper 2081 can be cut in such a way that no unnecessary twist force is generated in the paper 2081.

Also, the first notch part 2073 has smoothly curved shape such that the most inner edge part 2073*b* and the edge parts 2073*c* and 2073*d* are not crooked. For this reason, the contact point between the edge part of the first notch part 2073 and the blade part 2120*a* can move smoothly during cutting, and there is no possibility that the edge part of the first uncut part 2073 may be engaged and locked with the blade part 2120*a*. In addition, the contact points between the edge parts of the second and the three notch parts 2074 and 2075 and the blade part 2120*a* can move smoothly, and there is no possibility that the edge parts of the second and the third notch parts 2074 and 2075 are engaged and locked with the blade part 2120*a*.

[Variations of the Movable Blade Member 2071]

Next, variations of the movable blade member 2071 are described.

Figures 54A, 54B, 54C:
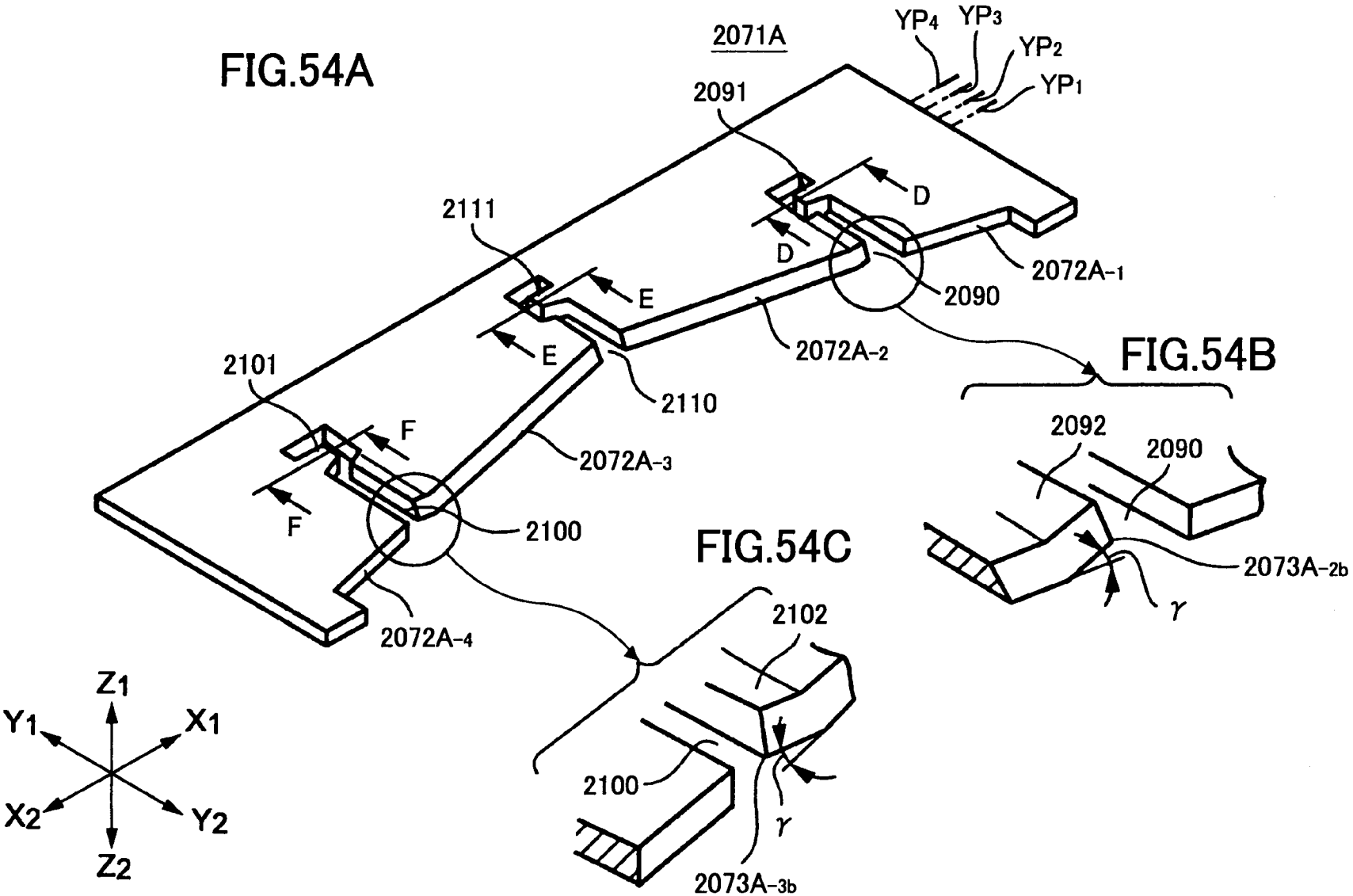
FIGS. 54A through 54F are diagrams showing a first variation of the movable blade member.
Figure 54D:
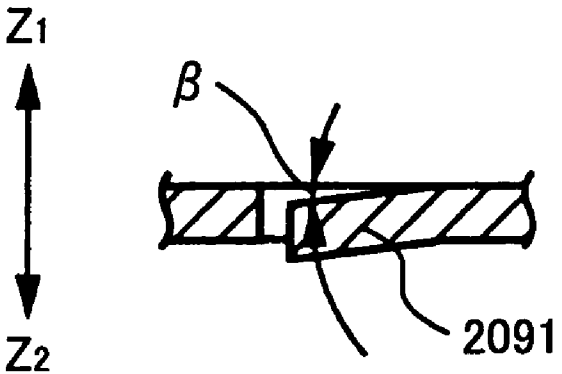
Figure 54E:
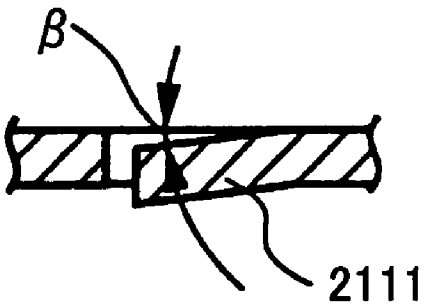
Figure 54F:
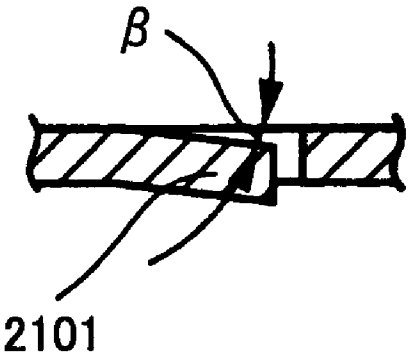
Figure 55:
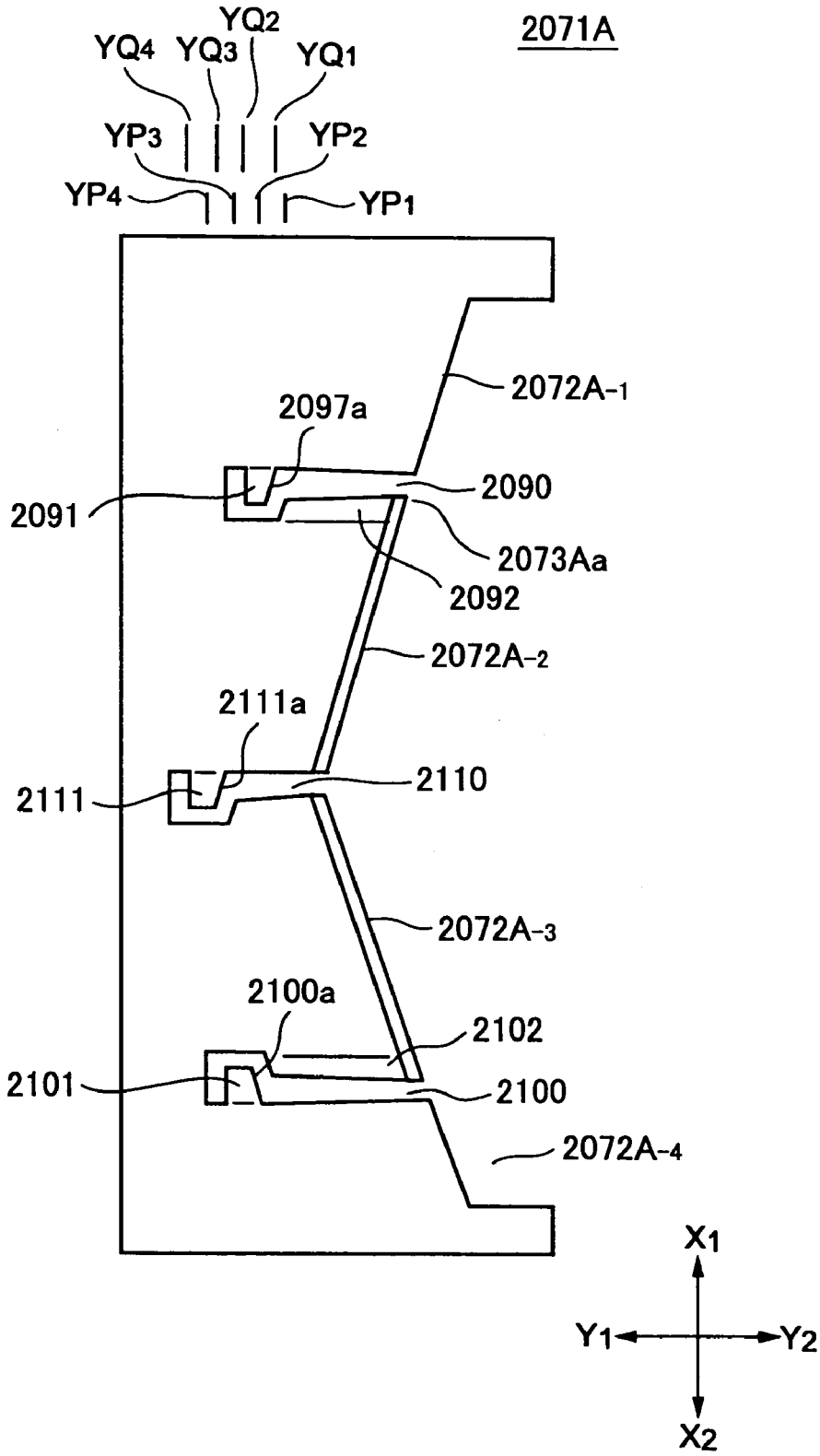
FIG. 55 is a plan view showing the movable blade member shown in FIG. 54.

FIG. 54 and FIG. 55 show an exemplary movable blade member 2071A according to a first variation of the movable blade member 2017. In the illustration, components corresponding to the components shown in FIG. 43 and FIG. 44 are designated by the same reference numerals. A movable blade member 2071A includes a first notch part 2073A, a second notch part 2074A and a third notch part 2075A. The first notch part 2073A includes a slit 2090 and a tongue-shaped blade part 2091 located in the inner side of the slit 2090. The second notch part 2074A includes a slit 2100 and a tongue-shaped blade part 2111 located in the inner side of the slit 2100. The third notch part 2075A includes a slit 2110 and a tongue-shaped blade part 2111 located in the inner side of the slit 2110. Sharp parts 2072A-2*b* and 2072A-3*b* are formed in the center side of the movable blade member 2071A of a portion facing entrances of the first and the second notch parts 2073A and 2074A. Each of the slits 2090, 2100 and 2110 is taper-shaped such that the width of the inner side thereof is slightly greater than the width of the entrance thereof. The tongue-shaped blade parts 2091, 2101 and 2111 correspond to the most inner edge parts 2073*b*, 2074*b* and 2075*b*, and are disposed at positions corresponding to the most inner edge parts 2073*b*, 2074*b* and 2075*b*, respectively. As shown in FIGS. 54D, 54E and 54F, the tongue-shaped blade parts 2091, 2101 and 2111 are inclined by β in the Z2 direction, and respective Y2 side edges 2091*a*, 2101*a* and 2111*a* are slightly inclined in the Y1 side. Accordingly, the tongue-shaped blade parts 2091, 2101 and 2111 are in point-contact with the fixed blade part, and each of the uncut parts 2083, 2084 and 2085 is cut from one side of the width direction by moving the contact point.

In the movable blade member 2071A, an X2 side portion 2092 of the slit 2090, that is, a center side portion from the slit 2090 of the movable blade member 2071A, is inclined by γ in the Z1 direction, as illustrated in FIG. 54B. Also, an X1 side portion 2102 of the slit 2100, that is, a center side portion from the slit 2100 of the movable blade member 2071A, is inclined by γ in the Z1 direction, as illustrated in FIG. 54C. During Y2 directional sliding of the movable blade member 2071A, edge parts of the blade parts 2072A-2 and 2072A-3 smoothly move above the blade part of the fixed blade part. Thus, the blade part of the movable blade member 2071A in point-contact with the blade parts of the fixed blade member 2120 can be smoothly switched from the blade parts 2072A-1 and 2072A-4 to the blade parts 2072A-2 and 2072A-3, respectively, without locking.

Figures 56A, 56B, 56C:
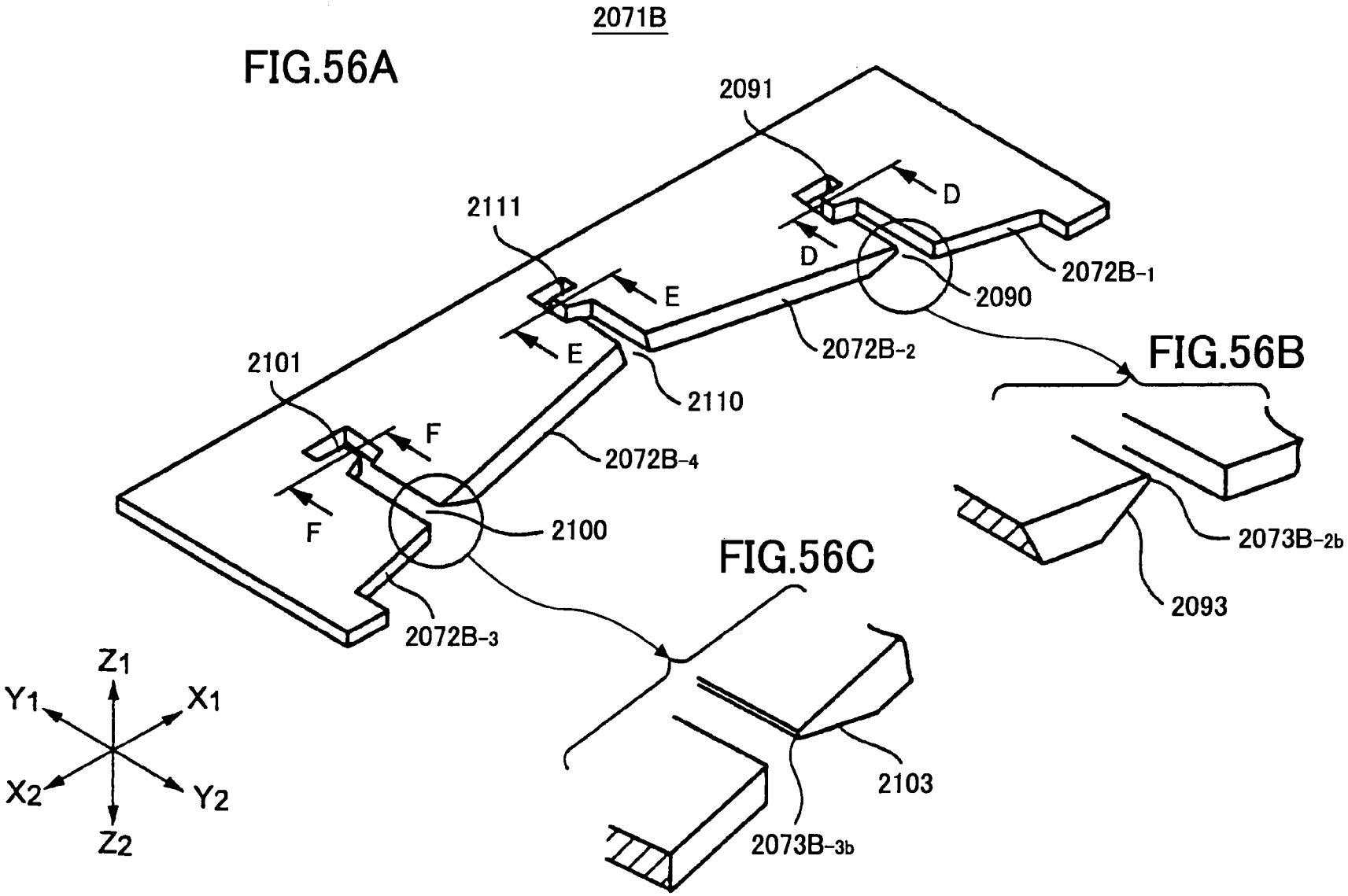
FIGS. 56A through 56F are diagrams showing a second variation of the movable blade member.
Figure 56D:
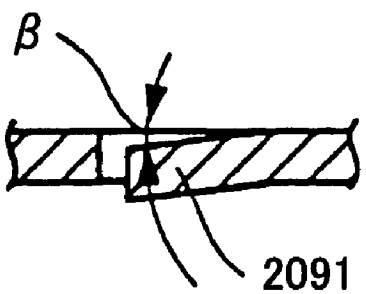
Figure 56E:
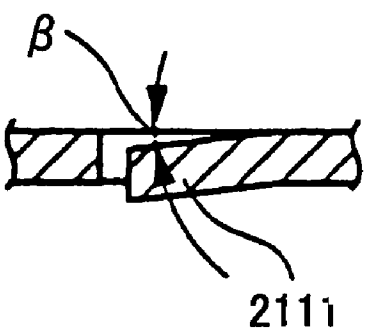
Figure 56F:
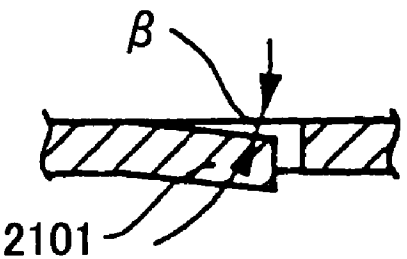
Figure 56F:
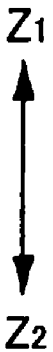

FIG. 56A shows an exemplary movable blade member 2071B according to a second variation of the movable blade member 2071. The movable blade member 2071B differs from the movable blade member 2071A in the shape of the portions 2092 and 2102. As shown in FIGS. 56B and 56C, Z2 side surfaces of the portions 2092 and 2102 are formed as slope surfaces 2093 and 2103. In this structure, the blade part of the movable blade member 2071 in point-contact with the blade part of the fixed blade member 2120 can be smoothly switched from the blade parts 2072B-1 and 2072B-4 to the blade parts 2072B-2 and 2072B-3, respectively, without locking.

Figure 57:
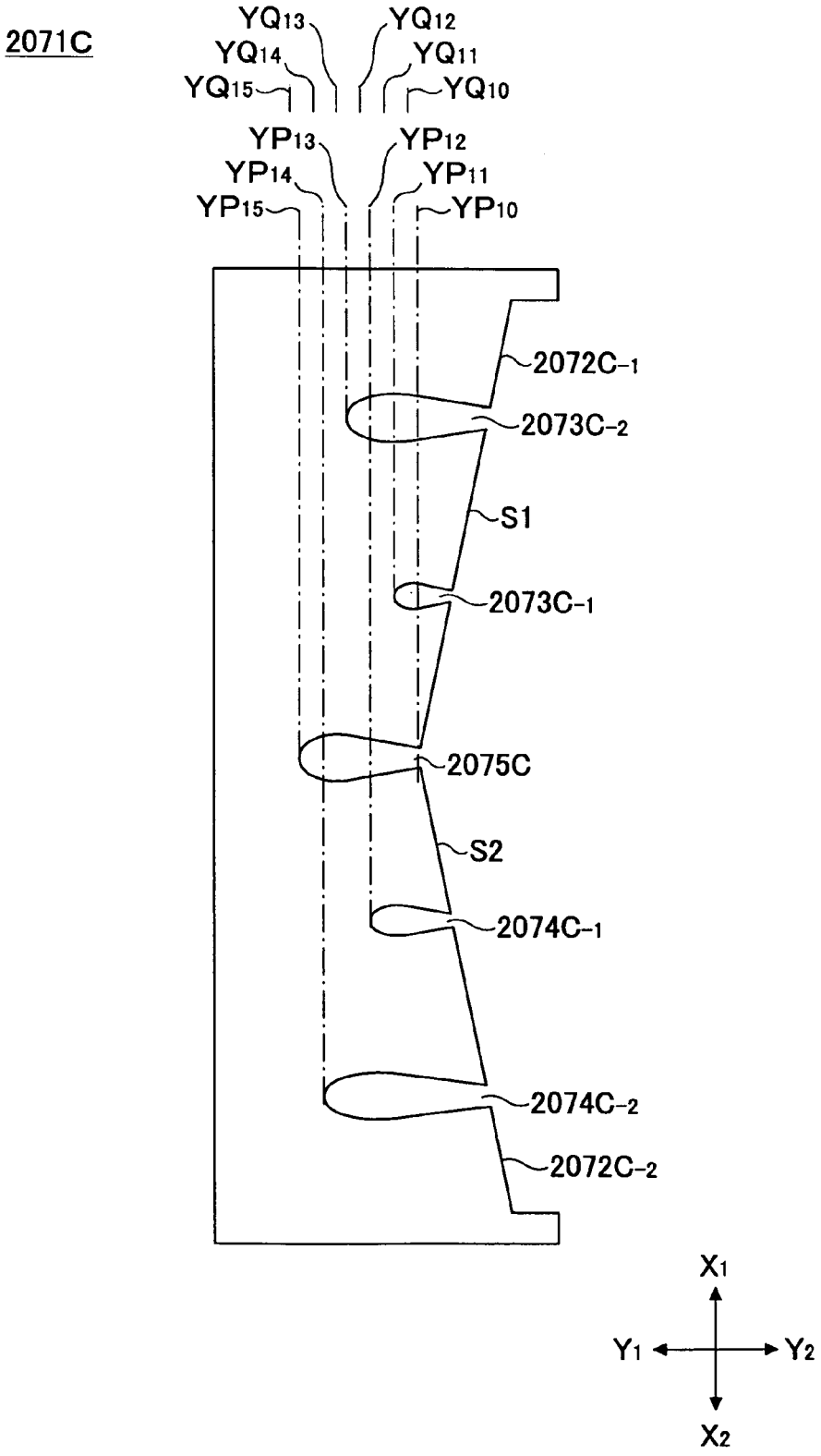
FIG. 57 is a diagram showing a third variation of the movable blade member.

FIG. 57 shows an exemplary movable blade member 2071C according to a third variation of the movable blade member 2071. The movable blade member 2071C differs from the movable blade member 2071 in the number of notch parts, and includes five notch parts. These notch parts are numbered in the order where formed uncut parts are cut. The movable blade member 2071C includes a fifth notch part 2075C at the V shape bottom, that is, at the center of the movable blade member 2071C. Also, the movable blade member 2071C includes a first notch part 2073C-1 and a third notch part 2073C-2 along the slope S1, and a second notch part 2074C-1 and a fourth notch part 2074C-2 along the slope S2. The first and the second notch parts 2073C-1 and 2074C-1 are positioned in both sides of the fifth notch part 2075C, and the third and the fourth notch parts 2073C-2 and 2074C-2 are positioned in the outer sides from the first and the second notch parts 2073C-1 and 2074C-1, respectively. Also, YP10 represents the position of an entrance part of the fifth notch part 2075C. YP11 represents the position of the most inner edge part of the first notch part 2073C-1. YP12 represents the position of the most inner edge part of the second notch part 2074.C-1. YP13 represents the position of the most inner edge part of the third notch part 2073C-2. YP14 represents the position of the most inner edge part of the fourth notch part 2074C-2. YP15 represents the position of the most inner edge part of the fifth notch part 2075C. YP10 through YP15 are positioned from the Y2 side to the Y1 side in that order. YQ10 through YQ15 indicate positions of the blade part 2120*a* relative to the position of the movable blade member 2071C, and are positioned slightly in the Y1 side.

Figure 58A:
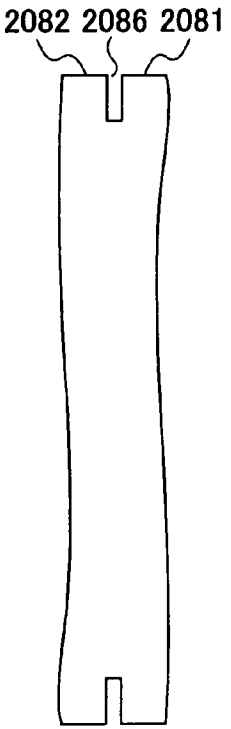
FIGS. 58A through 58I are diagrams illustrating paper cutting conditions performed by a cutter part of the movable blade member shown in FIG. 57.
Figure 58B:
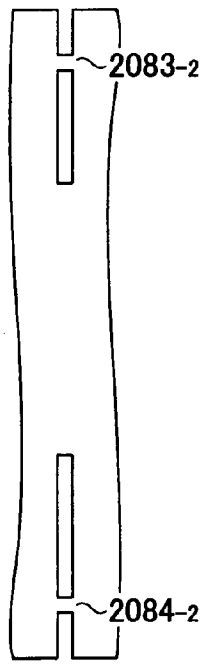
Figure 58C:
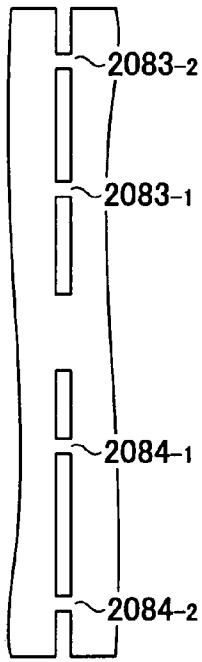
Figure 58D:
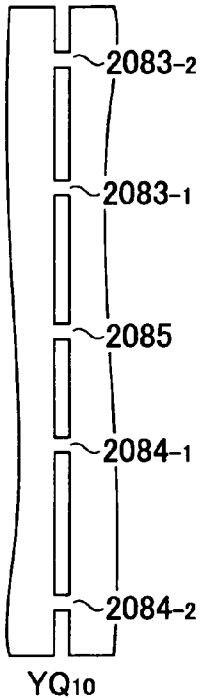

When the movable blade member 2071C is slid in the Y2 direction and the relative position of the blade part 2120*a* of the fixed blade member 2120 to the movable blade member 2071C reaches YQ10, a portion 2086 of the paper 2081 is cut from both sides with respect to the width direction thereof as sequentially illustrated in FIGS. 58A, 58B and 58C. Then, as shown in FIG. 58D, the paper 2081 is cut in a five-point left partial cutting in such a way that first through fifth uncut parts 2083-1, 2084-1, 2083-2, 2084-2 and 2085 are formed.

Figure 58E:
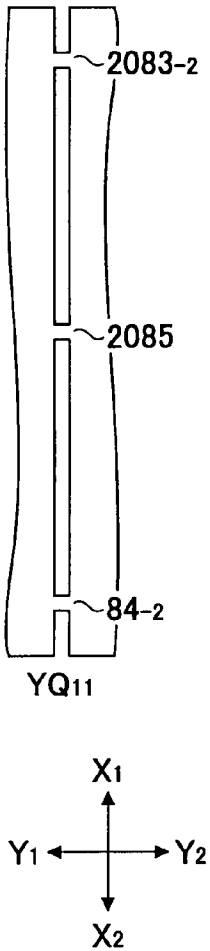

When the movable blade member 2071C is further slid in the Y2 direction and the relative position of the blade part 2120*a* to the movable blade member 2071 reaches YQ11, the most inner edge part of the first notch part 2073C-1 cuts the first uncut part 2083-1. As a result, as shown in FIG. 58E, the paper 2081 is cut in four-point left partial cutting.

Figure 58F:
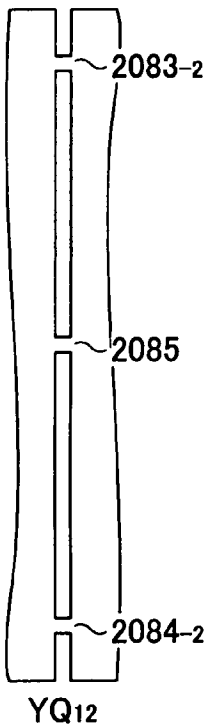
Figure 58G:
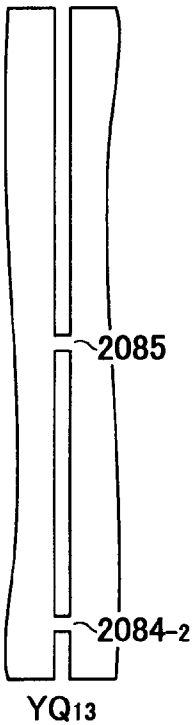
Figure 58H:
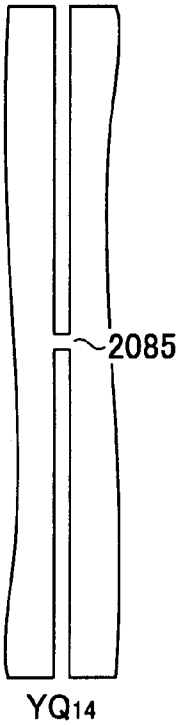
Figure 58I:
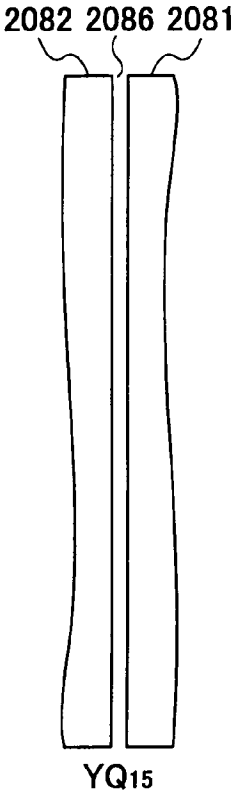
Figure 58I:
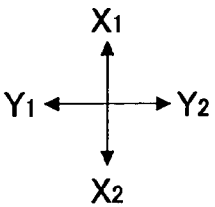

When the relative position reaches YQ12, the most inner edge part of the second notch part 2074C-1 cuts the second uncut part 2084-1. As a result, as shown in FIG. 58F, the paper 2081 is cut in three-point left partial cutting. When the relative position reaches YQ13, the most inner edge part of the third notch part 2073C-2 cuts the third uncut part 2083-2. As a result, as shown in FIG. 58G, the paper 2081 is cut in two-point left partial cutting. When the relative position reaches YQ14, the most inner edge part of the fourth notch part 2074C-2 cuts the fourth uncut part 2084-2. As a result, as shown in FIG. 58H, the paper 2081 is cut in one-point left partial cutting in such a way that the printed paper portion 2082 is connected to the paper 2081 at only the fifth uncut part 2083-1. When the relative position reaches YQ15, the most inner edge part of the fifth notch part 2075C cuts the fifth uncut part 2085. As a result, the paper 2081 is completely cut.

The first through the fifth uncut parts 2083-1, 2084-1, 2083-2, 2084-2 and 2085 are sequentially cut in that order. Namely, the first and the second uncut parts 2083-1 and 2084-1 near the center uncut part 2085 are sequentially cut. Then, after the third and the fourth uncut parts 2083-2 and 2084-2 in both sides of the paper 2081 with respect to the width direction thereof is sequentially cut, the fifth uncut part 2085 at the center of the paper 2081 is finally cut. In this fashion, the plurality of uncut parts are sequentially cut at the beginning with uncut parts near the center of the paper 2081 in a well-balanced way. As a result, the printed paper portion 2082 cannot be twisted around the center of the band-shaped paper 2081, and the uncut parts can be smoothly cut.

Next, specific examples of use of the thermal printer 2010 and the cutter part 2070 are described. A predefined program corresponding to an example of use is programmed in the control circuit 2140, and the thermal printer 2010 and the cutter part 2070 are operable in accordance with the predefined program.

[Printing for Credit Payment]

Under control of the control circuit 2140, the thermal printer 2010 and the cutter part 2070 consecutively perform a series of operations: 1) printing of a receipt for a customer, 2) first partial cutting, 3) printing of a transaction sheet for a shop. 4) second partial cutting, 5) journal recording, and 6) third partial cutting.

In the first and the second partial cutting operations, a paper is cut in a three-point left partial cutting manner, and in the third partial cutting operation, the paper is cut in a one-point left partial cutting manner.

Figure 59:
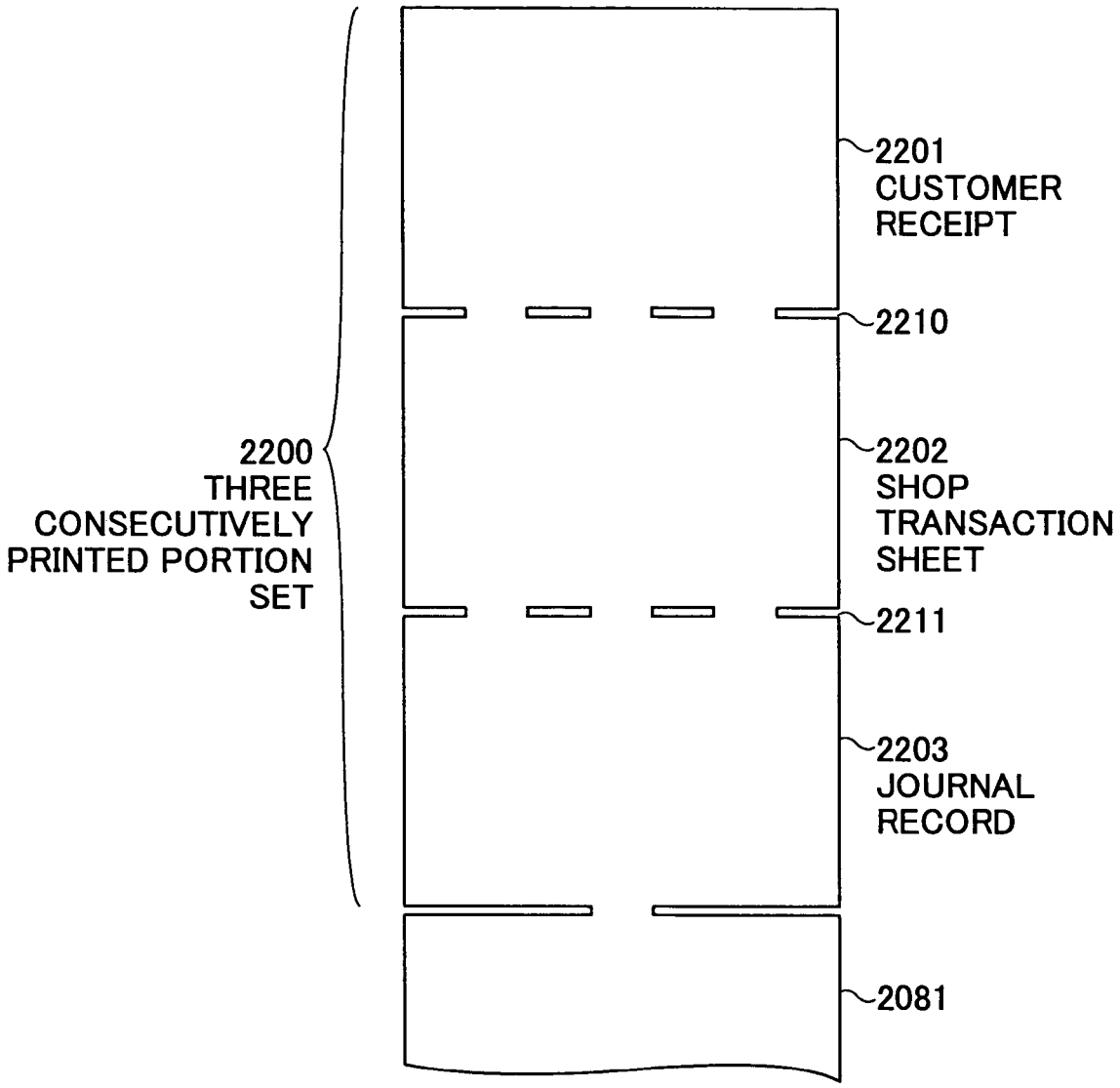
FIG. 59 is a diagram illustrating an exemplary printed and cut paper portion for credit payment.

FIG. 59 shows an exemplary set of three consecutively printed portions produced in the above-mentioned operations.

The three consecutively printed portion set 2200 includes a customer receipt 2201, a shop transaction sheet 2202, and a journal record 2203. Also, the three consecutively printed portion set 2200 includes three-point left partial cut parts 2210 and 2211 and a one-point left partial cut part 2212. After the formation of the three consecutively printed portion set 2200, an operator manually separates the three consecutively printed portion set 2200 from the paper 2081.

If the journal record 2203 is connected to the paper 2081 at three connection points, there is a risk that when the operator pulls the customer receipt 2201, the three consecutively printed portion set 2200 may be separated from the paper 2081 at an unexpected portion other than between the journal record 2203 and the paper 2081, for example, between the shop transaction sheet 2202 and the journal record 2203, because of equal connection force of the three partial cut portions 2210 through 2212. In this case, there arises a problem that the operator needs to hold the journal record 2203.

However, in the above-mentioned case where the third partial cut portion is formed as the one-point left partial cut portion 2212, even if the operator holds an arbitrary portion of the three consecutively printed portion set 2200, the operator can reliably separate the three consecutively printed portion set 2200 at the one-point left partial cut part 2212 because of weakness of the connection force at the one-point left partial cut part 2212 relative to the three-point left partial cut parts 2210 and 2211. Thus, it is possible to properly separate the three consecutively printed portion set 2200 from the paper 2081.

[Successive Printing of a Receipt and a Coupon]

Under control of the control circuit 2140, the thermal printer 2010 and the cutter part 2070 consecutively perform a series of operations: 1) printing of a receipt, 2) first partial cutting, 3) printing of a coupon, and 4) second partial cutting.

In the first partial cutting, the paper 2081 is cut in a three-point left partial cutting manner, and in the second partial cutting, the paper 2081 is cut in a one-point left partial cutting manner.

Figure 60:
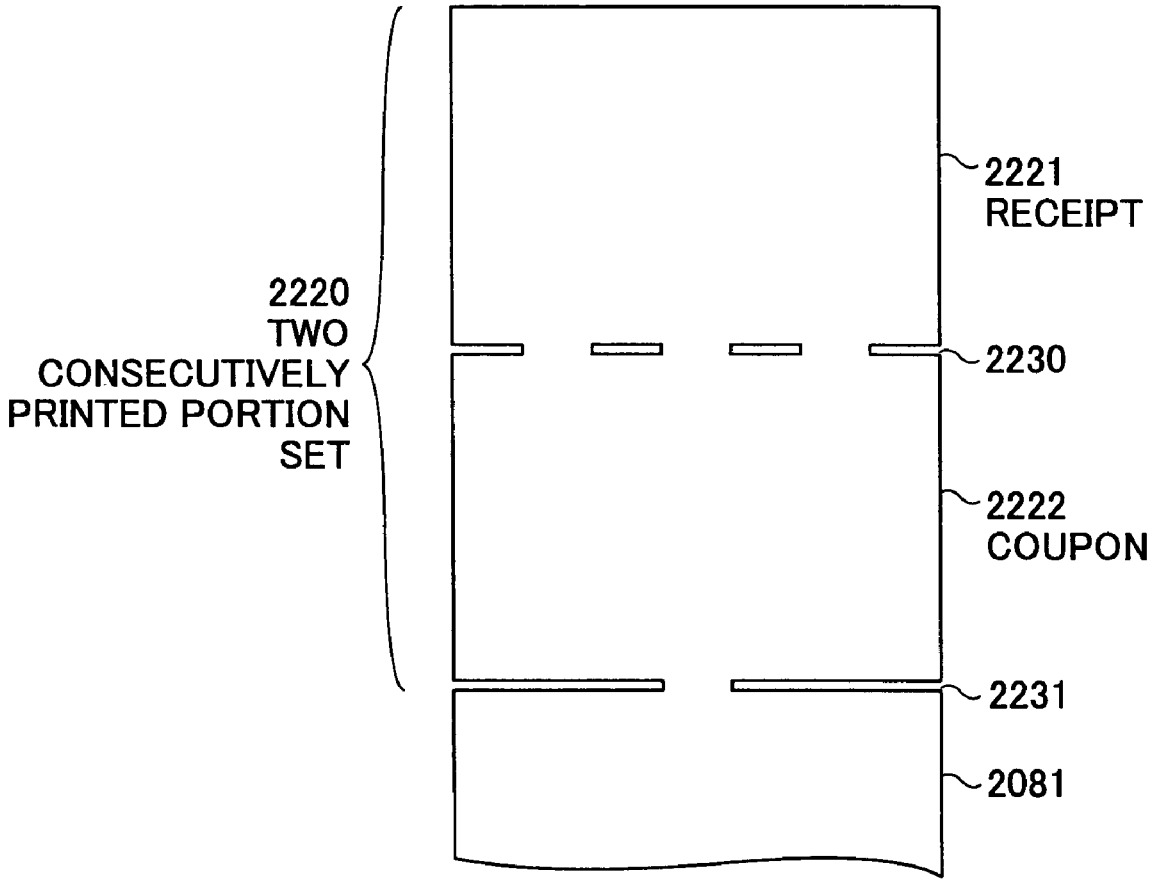
FIG. 60 is a diagram illustrating an exemplary consecutively printed and cut receipt and coupon.

FIG. 60 shows an exemplary set of two consecutively printed portions 2220 produced in the above-mentioned operations. The two consecutively printed portion set 2220 includes a receipt 2221, a coupon 2202, a three-point left partial cut part 2230 and a one-point left partial cut part 2231. After the formation of the two consecutively printed portion set 2220, an operator manually separates the two consecutively printed portion set 2220 from the paper 2081.

[Issuing of Group Tickets]

Figure 61:
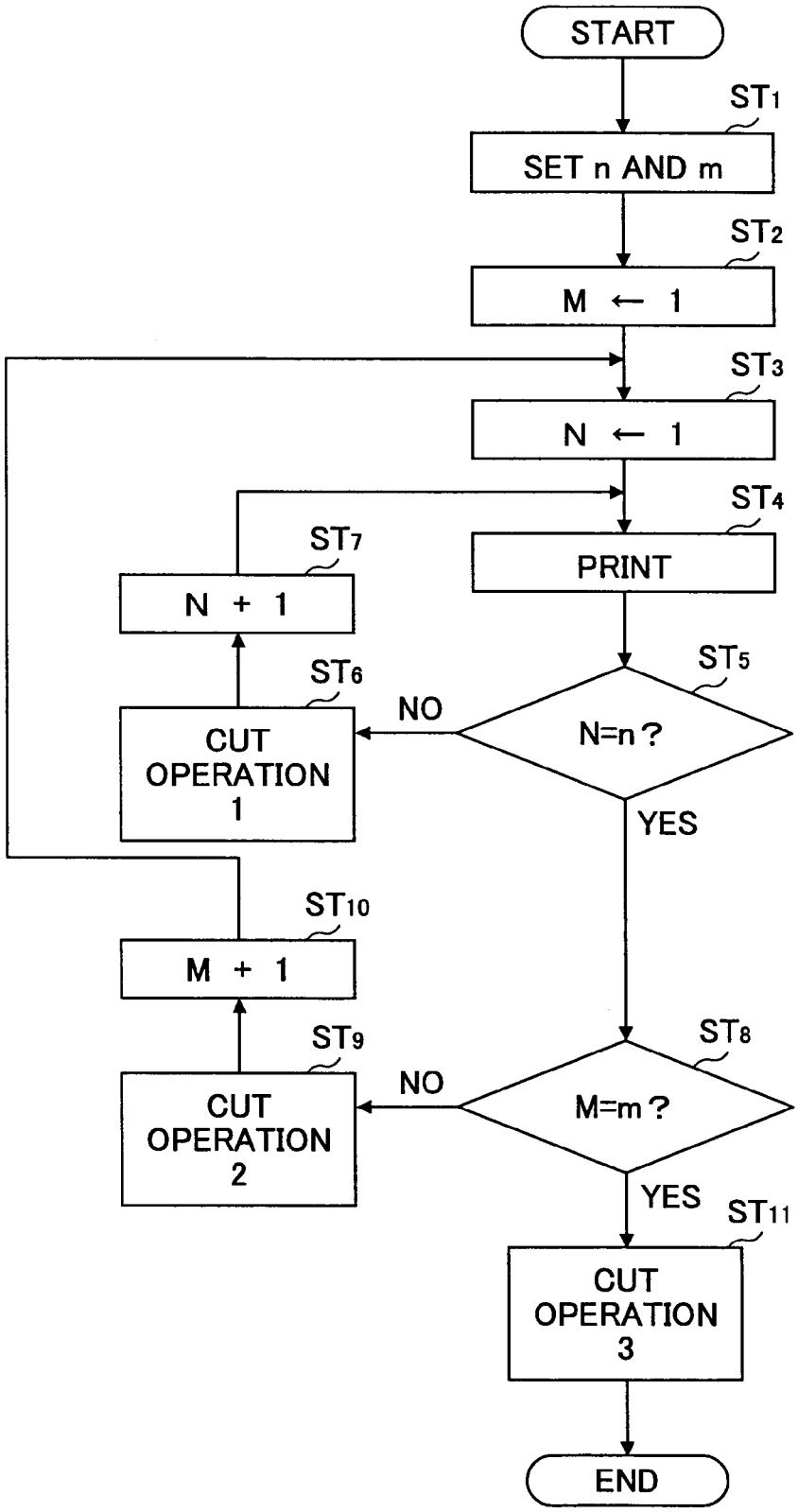
FIG. 61 is a flowchart of an operation of a control circuit according to an embodiment of the present invention.

In a case where the mobile terminal device 2020 shown in FIGS. 35A and 35B is used as a group ticket vending machine, the control circuit 2140 performs an operation as illustrated in FIG. 61.

At the beginning, an operator inputs the number of members m belonging to a group and the number of tickets n to be issued for each member in the mobile terminal device 2020 through the operation button 2026 at step ST1.

A counter variable M is set as 1 at step ST2, and a counter variable N is set as 1 at step ST3.

The control circuit 2140 issues a print instruction to the mobile terminal device 2020 at step ST4.

At step ST5, the control circuit 2140 determines whether N is equal to n. If N is not equal to n, the control circuit 2140 instructs the mobile terminal device 2020 to perform a cut operation 1 at step ST6. Subsequently, the counter variable N is incremented by 1 at step ST7, and the control circuit 2140 issues a print instruction to the mobile terminal device 2020 again at step ST4.

On the other hand, if N is equal to n at step ST5, the control circuit 2140 determines whether M is equal to m at step ST8.

If M is not equal to m, the control circuit 2140 instructs the mobile terminal device 2020 to perform a cut operation 2 at step ST9. Subsequently, the counter variable M is incremented by 1 at step ST10, and the counter variable N is set as 1 again at step ST3.

On the other hand, if M is equal to m at step ST8, the control circuit 2140 instructs the mobile terminal device 2020 to perform a cut operation 3 at step ST11.

In the cut operation 1 (ST6), the number of pulses corresponding to shifting of the movable blade member 2071 to YR1, as illustrated in FIG. 49A, is supplied to the pulse motor 2036. In the cut operation 2 (ST9), the number of pulses corresponding to shifting of the movable blade member 2071 to YR3, as illustrated in FIG. 51A, is supplied to the pulse motor 2036. In the cut operation 3 (ST11), the number of pulses corresponding to shifting of the movable blade member 2071 to YR4, as illustrated in FIG. 52A, is supplied to the pulse motor 2036.

For example, in order to issue group tickets for four group members, if the parameters m and n are equal to 4 and 1, respectively, the thermal printer 2020 and the cutter part 2070 consecutively perform a series of operations: 1) printing of a ticket for the first member, 2) first partial cutting, 3) printing of a ticket fro the second member, 4) second partial cutting, 5) printing of a ticket for the third member, 6) third partial cutting, 7) printing of a ticket for the fourth member, and 8) complete cutting, under the control circuit 2140.

Figure 62:
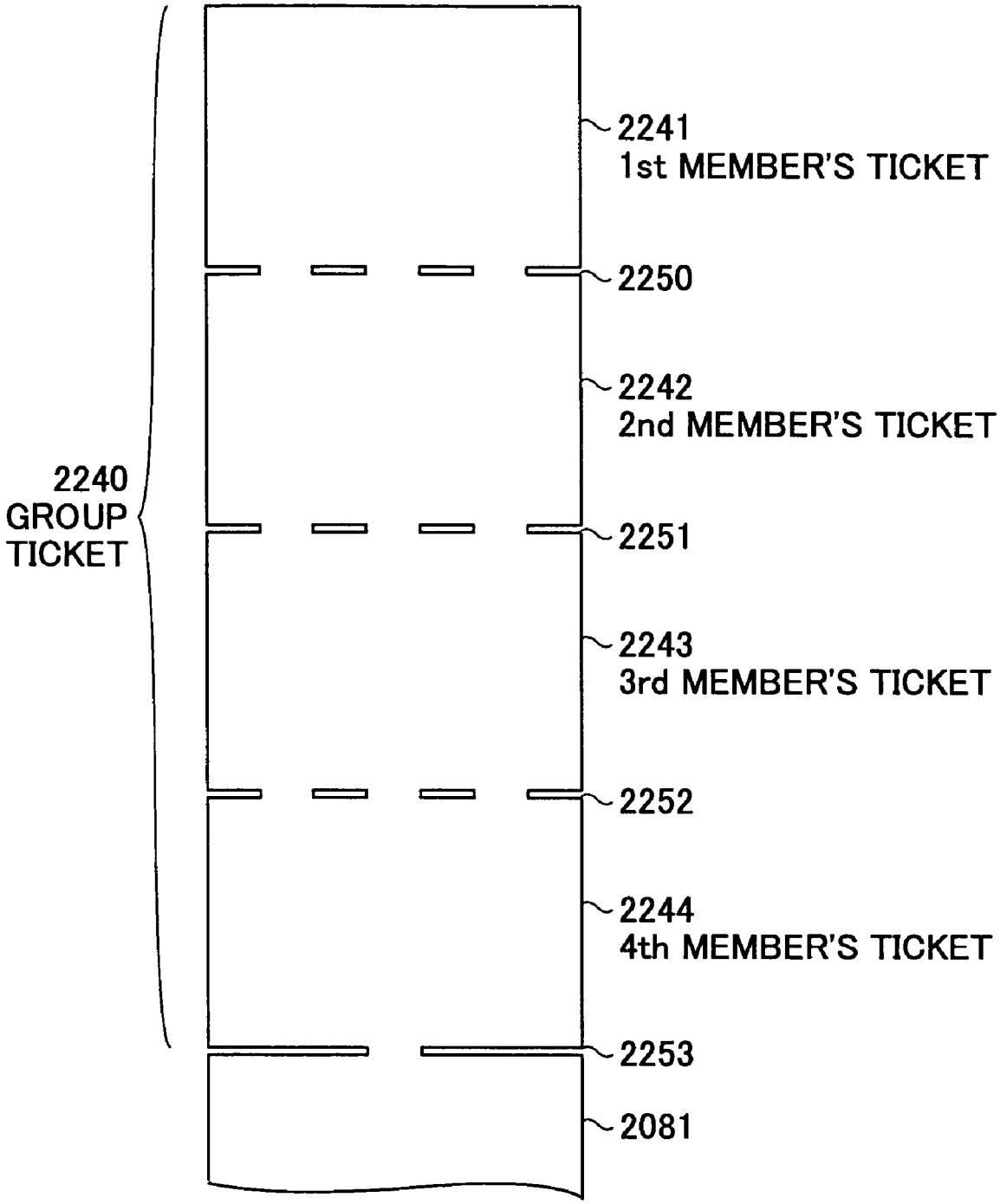
FIG. 62 is a diagram illustrating an exemplary printed and cut paper portion for a group ticket for four members.

FIG. 62 shows an exemplary group ticket 2240 for four members, which is formed as a set of four consecutively printed portion, produced in the above-mentioned operation. The group ticket 2240 includes a first member's ticket 2241, a second member's ticket 2242, a third member's ticket 2243 and a fourth member's ticket 2244. Also, the group ticket 2240 includes three-point left partial cut parts 2250, 2251 and 2252 and a full-cut part 2253. The group ticket 2240 is automatically completely cut and separated from the paper 2081 so that the group ticket 2240 can be disconnected from another group ticket.

Figure 63:
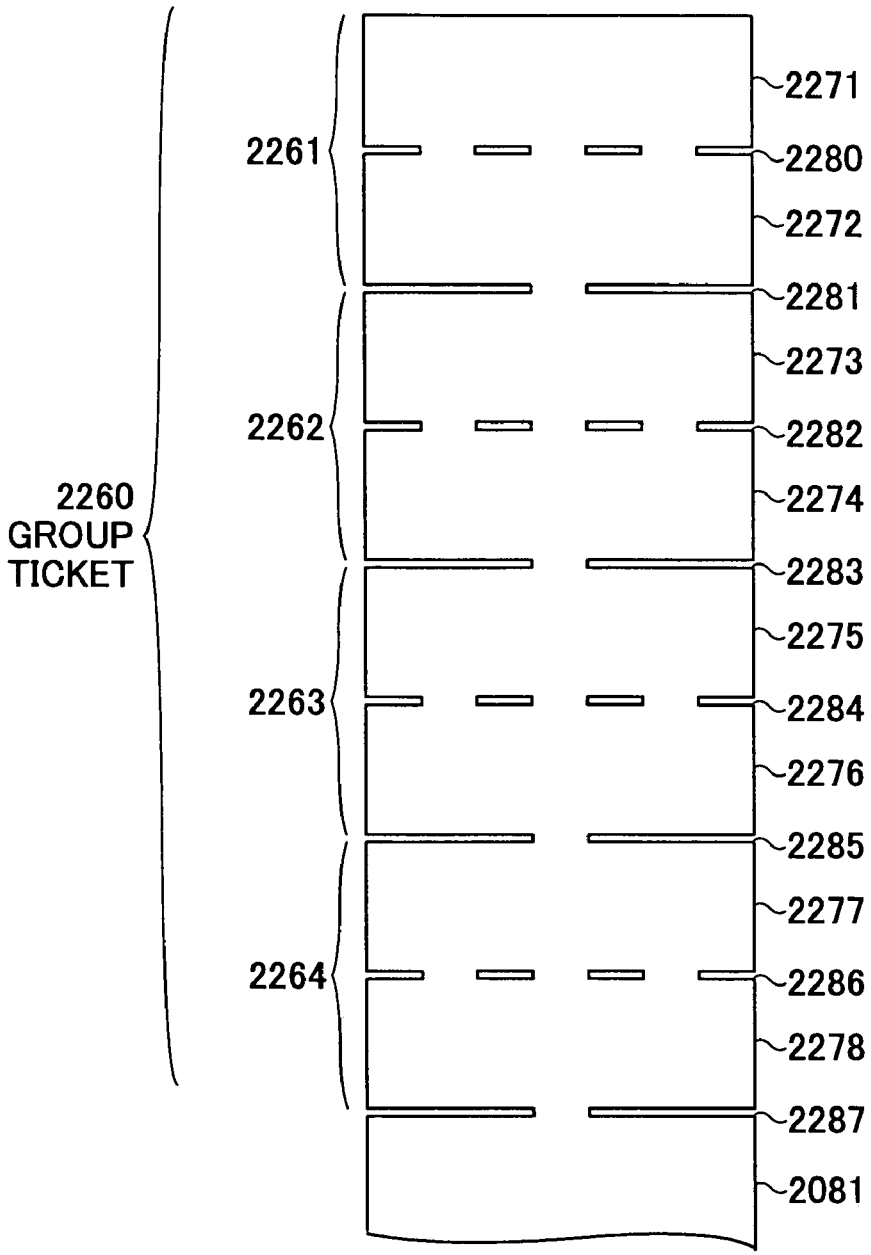
FIG. 63 is a diagram illustrating another exemplary printed and cut paper portion for a group ticket for four members.

Also, in order to issue a group ticket, including two consecutive tickets for each member, for four group members, if the above-mentioned parameter m and n are set as 4 and 2, respectively, the thermal printer 2010 and the cutter part 2070 sequentially performs the following series of operations 1) through 16) under the control circuit 2140. FIG. 63 shows an exemplary group ticket 2260 for four members, which is formed as a set of eight consecutively printed portions, produced in the operations 1) through 16).

In the operation 1), the first ticket for the first member is printed to produce a ticket 2271. In the operation 2), a three-point left partial cut part 2280 is formed as the first partial cut portion. In the operation 3), the second ticket for the first member is printed to produce a ticket 2272. In the operation 4), a one-point left partial cut part 2281 is formed as the second partial cut portion. In the operation 5), the first ticket for the second member is printed to produce a ticket 2273. In the operation 6), a three-point left partial cut part 2282 is formed as the third partial cut portion. In the operation 7), the second ticket for the second member is printed to produce a ticket 2274. In the operation 8), a one-point left partial cut part 2283 is formed as the fourth partial cut portion. In the operation 9), the first ticket for the third member is printed to produce a ticket 2275. In the operation 10), a three-point left partial cut part 2284 is formed as the fifth partial cut portion. In the operation 11), the second ticket for the third member is printed to produce a ticket 2276. In the operation 12), a one-point left partial cut part 2285 is formed as the sixth partial cut portion. In the operation 13), the first ticket for the fourth member is printed to produce a ticket 2277. In the operation 14), a three-point left partial cut part 2286 is formed as the seventh partial cut portion. In the operation 15), the second ticket for the fourth member is printed to produce a ticket 2278. In the operation 16), the paper 2081 is completely cut to form a full-cut part 2287, and the group ticket 2260 for the four members is automatically separated from the paper 2081.

The group ticket 2260 includes a two consecutively printed portion set 2261 for the first member, a two consecutively printed portion set 2262 for the second member, a two consecutively printed portion set 2263 for the third member, and a two consecutively printed portion set 2264 for the fourth member. While two consecutively printed portions of each two consecutively printed portion set are connected to each other via a three-point left partial cut part, the two consecutively printed portion sets 2261 through 2262 are connected to adjacent two consecutively printed portion sets thereof via one-point left partial cut parts 2281, 2283 and 2285. Accordingly, it is possible to easily and properly separate each two consecutively printed portion set from adjacent two consecutively printed portion set thereof.

In the case where the cutter part 2070 includes the movable blade member 2071C as illustrated in FIG. 57, the paper 2081 can be cut in five-point left partial cutting in the cut operation 1 as illustrated in 58D, in three-point left partial cutting in the cut operation 2 as illustrated in FIG. 57F, and in completely cutting in the cut operation 3 as illustrated in FIG. 57I.

Another embodiment of the present invention is described.

Figure 64:
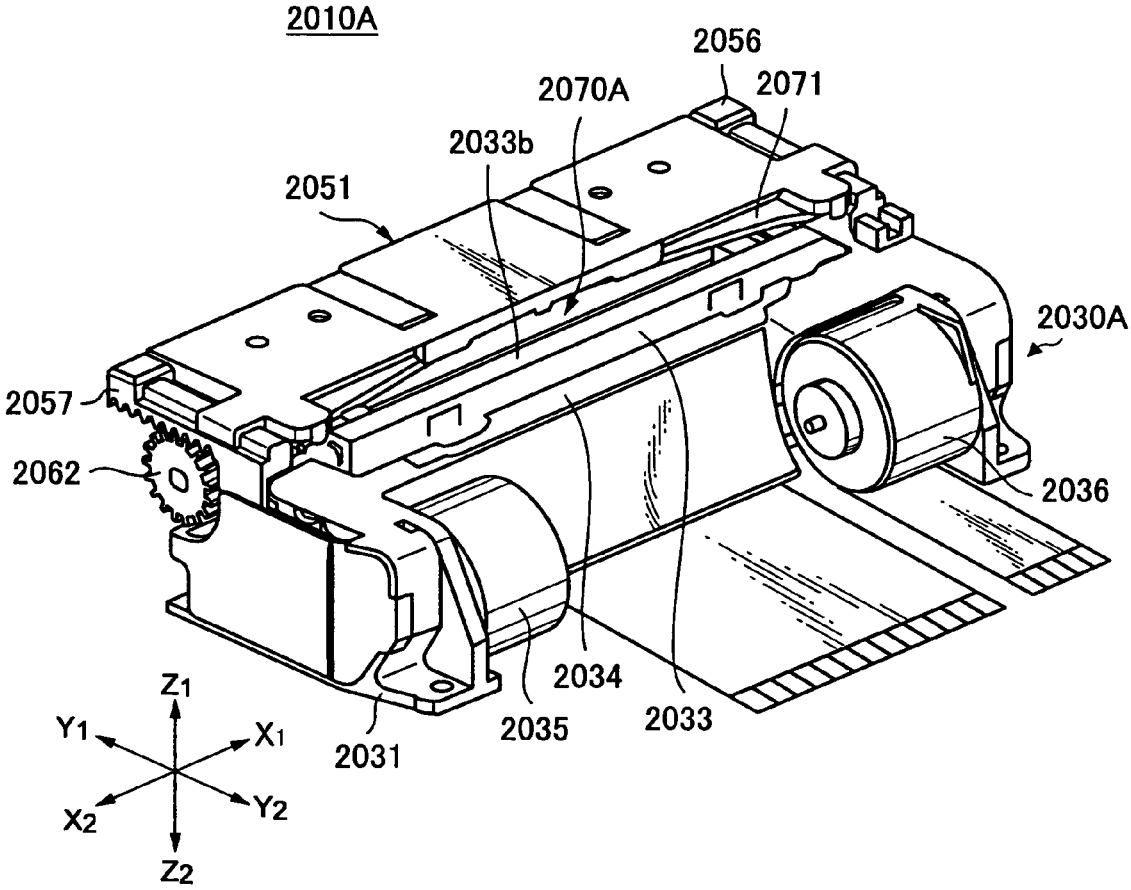
FIG. 64 is a perspective view showing a thermal printer having a cutter part according to another embodiment of the present invention.
Figure 65:
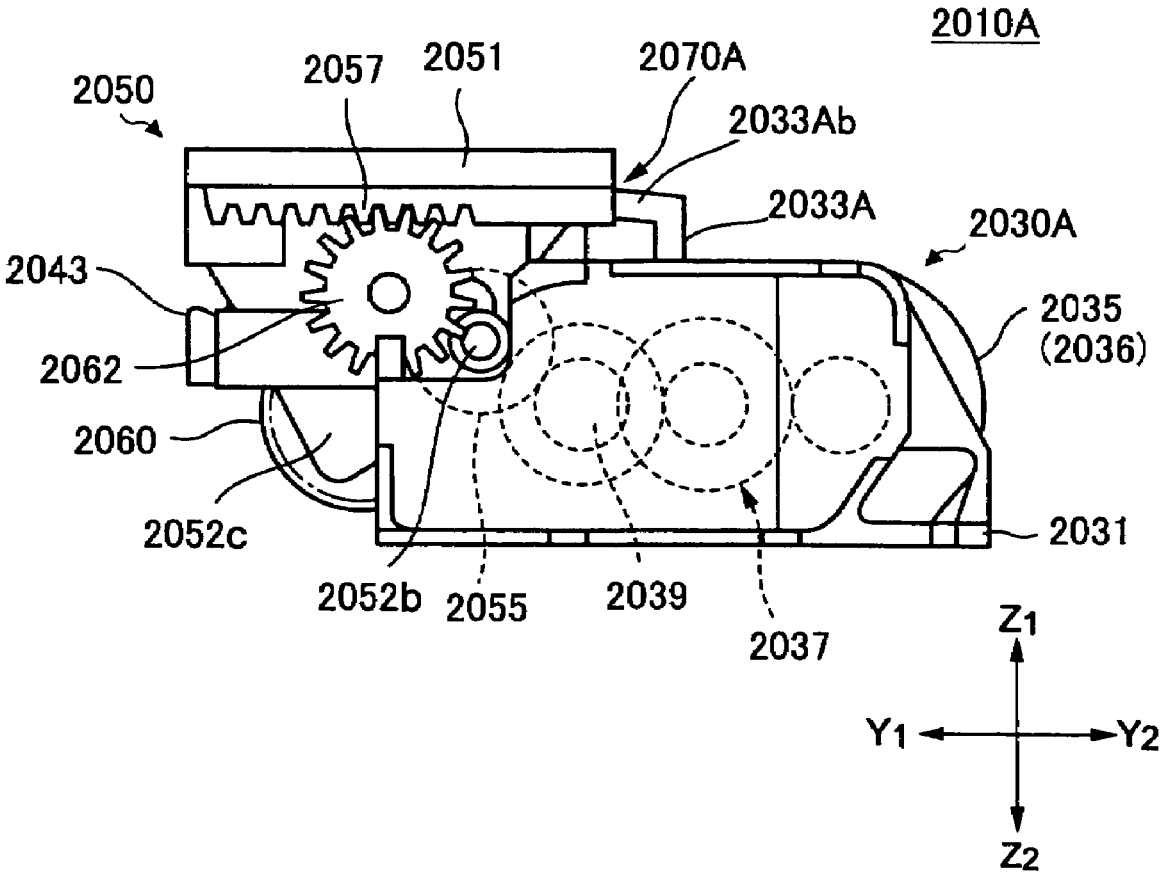
FIG. 65 is a side view showing the thermal printer shown in FIG. 64.
Figure 67A:
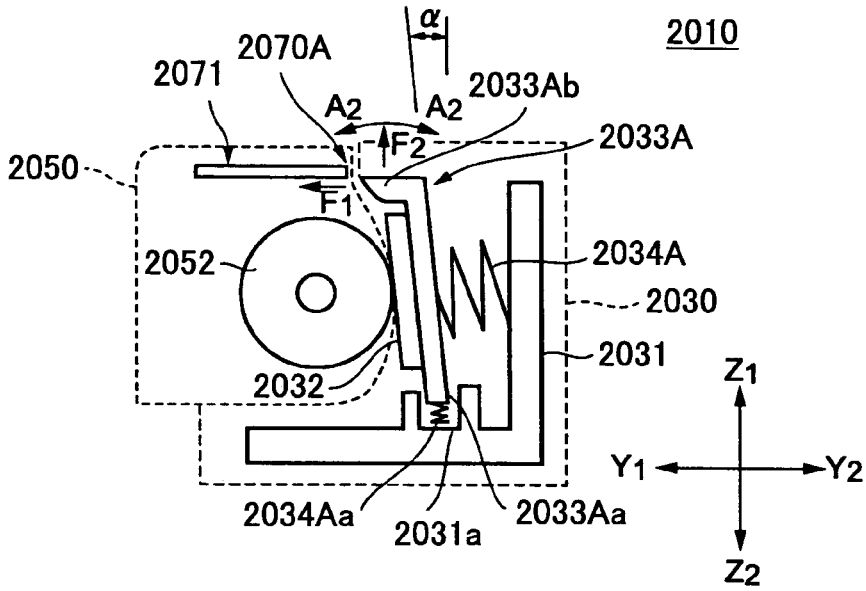
FIGS. 67A through 67C are schematic diagrams showing the thermal printers shown in FIG. 64.
Figure 67B:
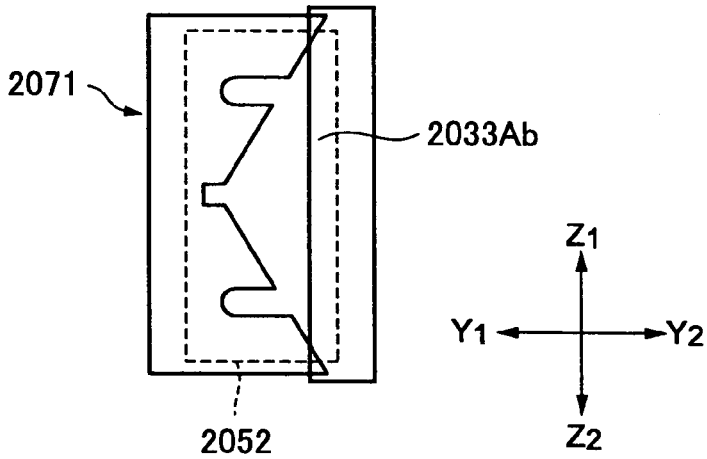
Figure 67C:
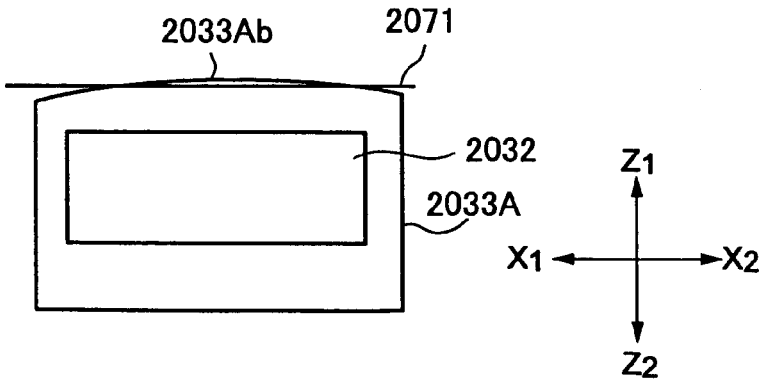

FIG. 64 and FIG. 65 show an exemplary thermal printer 2010A having a cutter part 2070A according to one embodiment of the present invention. FIGS. 67A through 67C roughly show an exemplary structure of the thermal printer 2010A.

Figure 66:
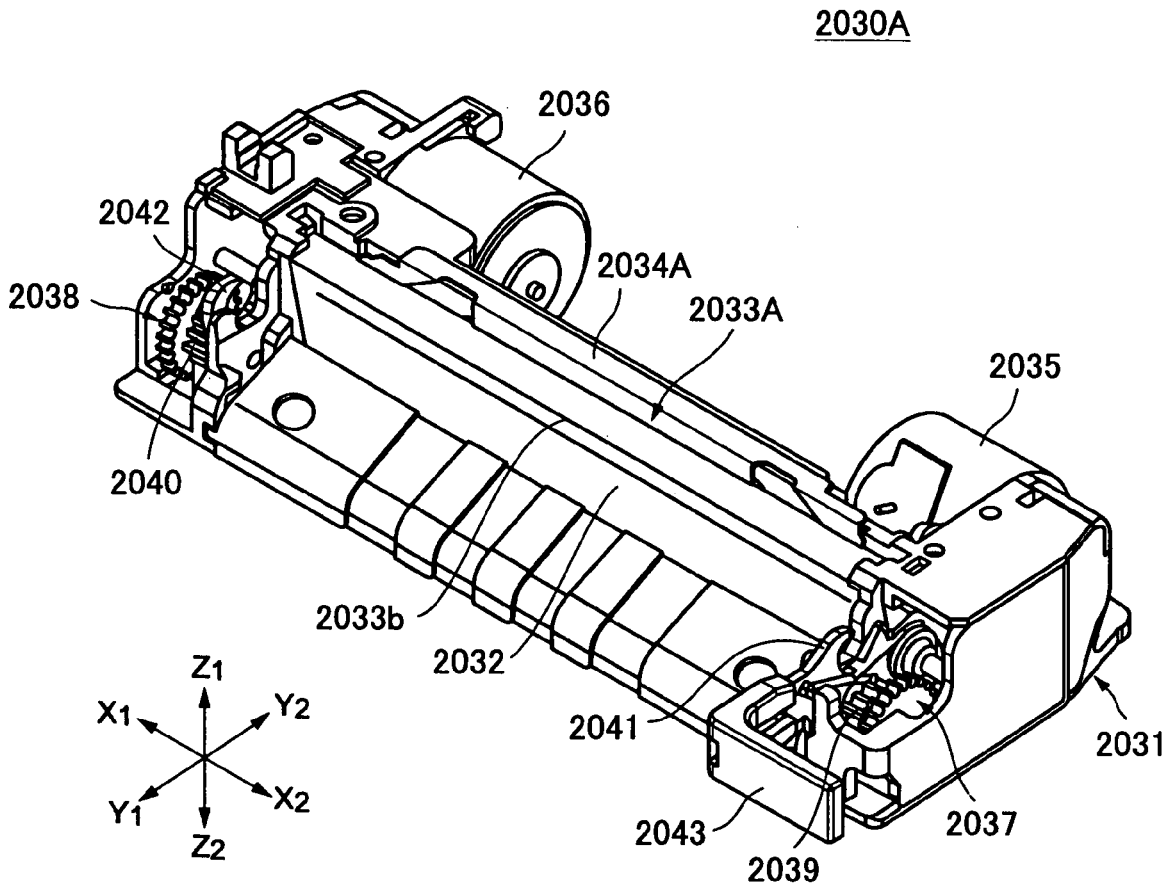
FIG. 66 is a perspective view showing a first module according to an embodiment of the present invention.

The thermal printer 2010A has such a structure that the second module 2050 shown in FIG. 39 is detachably coupled with a first module 2030A shown in FIG. 66. The cutter part 2070A is formed in a condition where the second module 2050 is coupled with the first module 2030A.

The first module 2030A differs from the first module 2030 shown in FIG. 37 in that a fixed blade part 2033Ab is formed in a portion of the thermal head support member 2033A. The fixed blade part 2033Ab is formed in the Z1 side end of the metal thermal head support member 2033A such that the fixed blade part 2033Ab is projected in the Y1 direction. As shown in FIG. 67C, the fixed blade part 2033Ab is slightly convex-curved in the Z1 direction. A plate spring portion 2034Aa, which is integrally formed in a plate spring member 2034A, intrudes in a support part 2031*a*, and a Z2 side end 2033Aa is supported by the plate spring portion 2034Aa. In this structure, the fixed blade part 2033Ab can move in a small range in the Y1-Y2 direction and in the Z1-Z2 direction. In addition, while Y2 directional movement generates Y1 directional blade pressure due to spring force of the plate spring member 2034A, Z2 directional movement generates Z1 directional blade pressure due to spring force of the plate spring portion 2034Aa.

Figure 68:
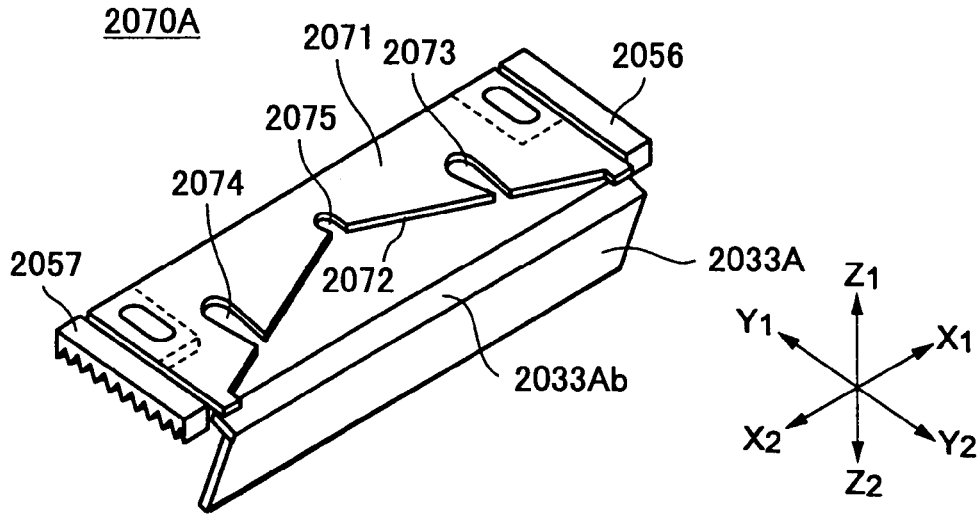
FIG. 68 is a diagram showing a cutter part according to an embodiment of the present invention.
Figure 69:
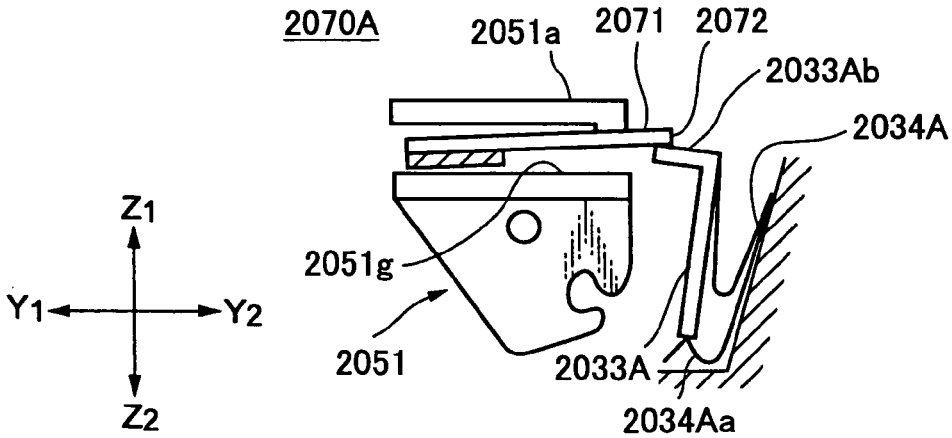
FIG. 69 is a side view showing the cutter part shown in FIG. 68.

As shown in FIG. 68 and FIG. 69, the cutter part 2070A is composed of the fixed blade part 2033Ab and the movable blade member 2071. Like the above-mentioned cutter part 2070, the cutter part 2070A can cut the paper 2081 in three-point left partial cutting, two-point left partial cutting and one-point left partial cutting manners.

The fixed blade part 2033Ab is formed as a portion of the thermal head support member 2033A, and the cutter part 2070A has no fixed blade member as an independent component. Thus, the thermal line printer 2010A includes a smaller number of components than the thermal line printer 2010 shown in FIG. 32, and can be configured to have a smaller dimension with respect to the Z1-Z2 direction than the thermal line printer 2010. As a result, it is possible to design the thermal line printer 2010A having a smaller height and a lower weight.

[Movable Blade Member Replaceable Structure]

Figure 70A:
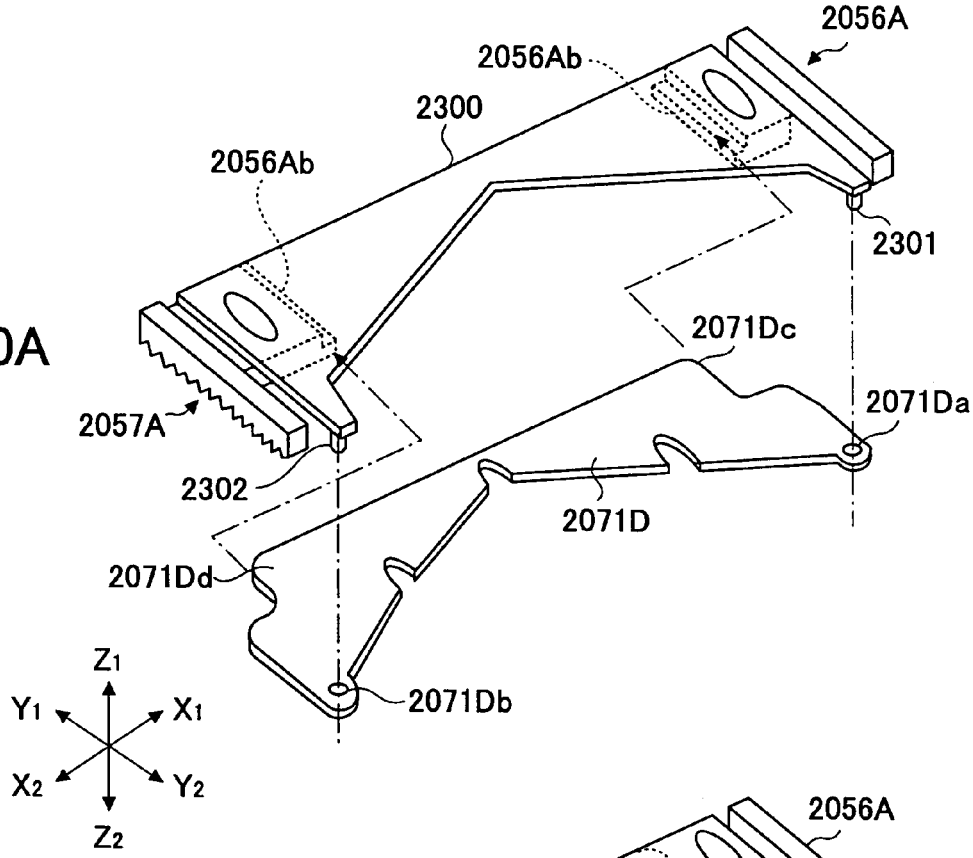
FIGS. 70A through 70C are diagrams showing an exemplary structure of a replaceable movable blade member according to an embodiment of the present invention.
Figure 70B:
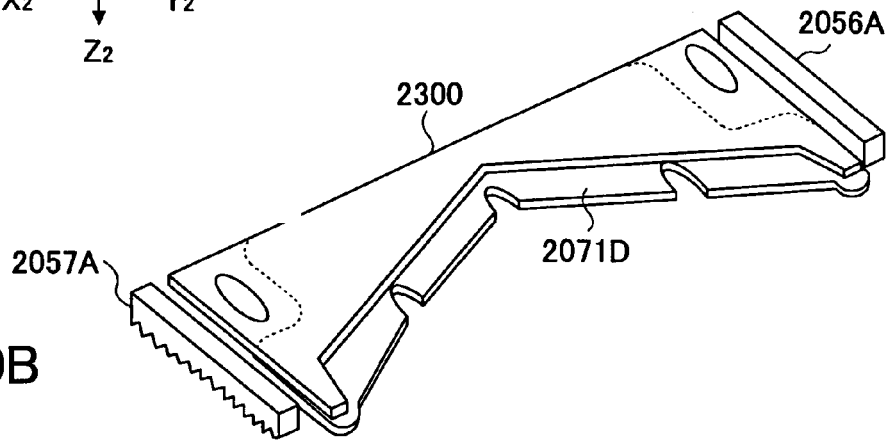
Figure 70C:
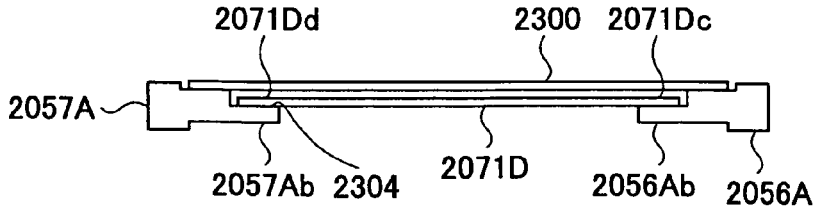

As shown in FIG. 70 and FIG. 71, a movable blade member 2071D is mounted in such a way that a user of the mobile terminal device 2020 can replace the movable blade member 2071D easily. As shown in FIGS. 70A through 70C, a movable blade support plate 2300, which is for reinforcement, has shape corresponding to the movable blade member 2071D, and locking pins 2301 and 2302 in the X1-X2 directional side of the Y2 side protrude in the Z2 direction.

Racks 2056A and 2057A are fixed in the X1-X2 directional side of the movable blade support plate 2300. As shown in FIG. 70C, the racks 2056A and 2057A includes support parts 2056Ab and 2057Ab projecting in the inner side of the racks 2056A and 2057A, respectively, and gap parts 2303 and 2304 are formed between the support parts 2056Ab and 2057Ab and the movable blade support plate 2300.

As shown in FIG. 70A, the movable blade member 2071D has an almost same shape as the movable blade member 2071 shown in FIG. 40, and includes locking holes 2071Da and 2071Db in the X1-X2 directional side of the Y2 side. A movable blade locking mechanism is composed of the locking pins 2301 and 2302 and the locking holes 2071Da and 2071Db.

As shown in FIGS. 70B and 70C, the movable blade member 2071D is supported by the support parts 2056Ab and 2057Ab in such a way that X1-X2 directional side portions 2071Dc and 2071Dd in the Y1 side are inserted in the gap parts 2303 and 2304, respectively, and is mounted to the under surface of the movable blade support plate 2300 in such a way that the locking holes 2071Da and 2071Db are engaged with the locking pins 2301 and 2302, respectively, that is, in such a way that four corners are locked.

Figure 71A:
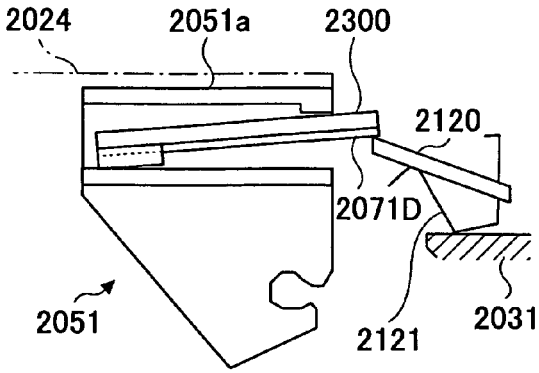
FIGS. 71A through 71D are diagrams to explain exemplary replacement of the movable blade member shown in FIG. 70.

As shown in FIG. 71A, the movable blade support plate 2300 for supporting the movable blade member 2071D is disposed in the under surface side of a top plate part 2051*a* of a second support member 2051. The movable blade member 2071D is in contact with the fixed blade member 2120. When the motor 2036 drives the movable blade support plate 2300, the movable blade member 2071D is slid integrally with the movable blade support plate 2300, and thereby the paper 2081 is cut.

Figure 71B:
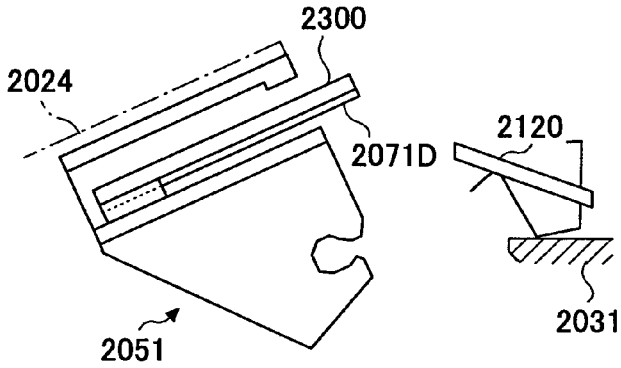
Figure 71C:
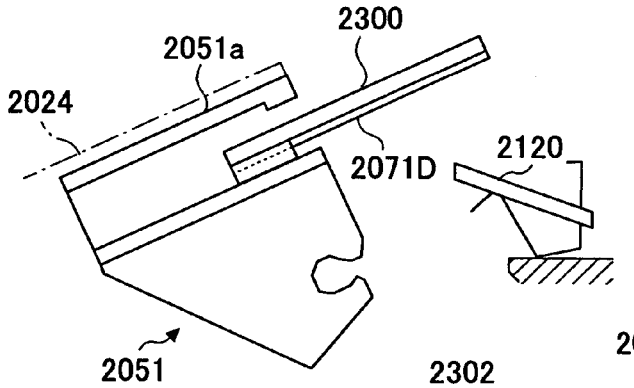
Figure 71D:
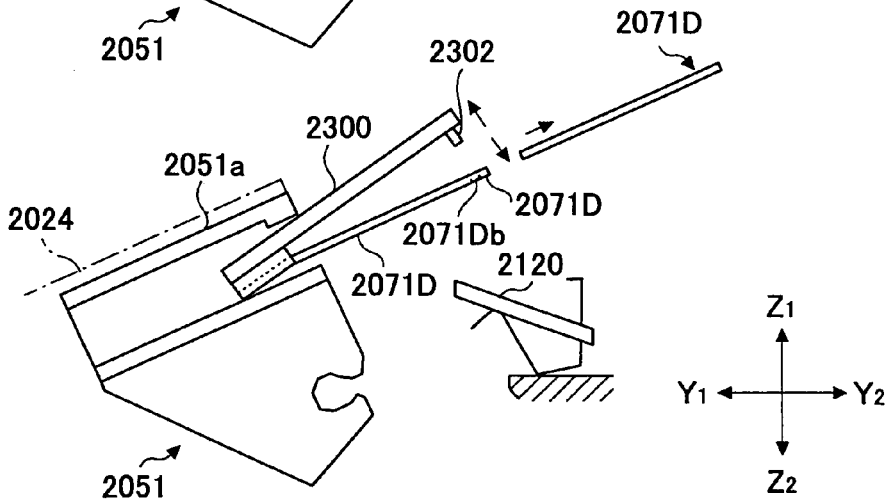

When the blade part of the movable blade member 2071D is abraded and cannot cut the paper 2081 sharply, a user of the mobile terminal device 2020 can replace the movable blade member 2071D. As shown in FIG. 71B, the user opens the lid 2024 of the mobile terminal device 2020, and shifts the movable blade support plate 2300 in the Y2 direction, as illustrated in FIG. 71B, by revolving the gear 2060 with his/her fingers such that locking portions between the movable locking holes 2071Da and 2071Db and the locking pins 2301 and 2302 are exposed to the exterior of the second support member 2051. While this condition is kept, the end side of the movable blade support plate 2300 is pressed up in the Z1 direction, and on the other hand, the end side of the movable blade member 2071D is pressed down in the Z2 direction, as illustrated in FIG. 71D, so that the locking pins 2301 and 2302 are unlocked from the locking holes 2071Da and 2071Db, respectively, and the end side of the movable blade member 2071D is pulled in the Y2 direction. In this fashion, the movable blade member 2071D is pulled out and detached from the under surface of the movable blade support plate 2300. Then, the movable blade member is replaced with a new movable blade member, and the new movable blade member is mounted to the under surface of the movable blade support plate 2300. The new movable blade member can be installed in the reverse procedure of the above-mentioned detachment.

It is noted that an object cut by the cutter part according to embodiments of the present invention is not limited to a paper. Such an object may be a synthetic-resin sheet or a metal foil. In the specification and the attached claims, the term "paper" includes synthetic-resin sheets and metal foils.

A third embodiment of the present invention is described.

FIGS. 72A through 72E roughly show exemplary structures of two specific types of thermal printers according to the third embodiment of the present invention. FIGS. 72A and 72B show exemplary structures of a first specific thermal printer 3010-1 and a second specific thermal printer 3010-2. The first specific thermal printer 3010-1 has such a structure that a first specific second module 3050-1 shown in FIG. 72D is detachably coupled with a first module 3030 shown in FIG. 72C. In addition, a cutter part is formed in the connection condition. On the other hand, the second specific thermal printer 3010-2 has such a structure that a second specific second module 3050-2 is detachably coupled with the first module 3030 shown in FIG. 72C. In addition, a cutter part is formed in the connection condition. In the first specification, the print resolution with respect to a paper feed direction is set as 203 dpi (dots per inch), and on the other hand, in the second specification, the print resolution with respect to the paper feed direction is set as 300 dpi. The first and the second specific thermal printers are the same except for the print resolution with respect to the paper feed direction. The first module 3030 can be used in common in the first specific thermal printer 3010-1 and the second specific thermal printer 3010-2. Since the first module 3030 is commonly used in the first and the second specific thermal printers 3010-1 and 3010-2, it is possible to reduce a fabrication cost of the first and the second specific thermal printers 3010-1 and 3010-2.

Next, the first module 3030, the first specific second module 3050-1, the second specific second module 3050-2, the first specific thermal printer 3010-1 and the second specific thermal printer 3010-2 are described in that order.

Throughout the following drawings, X1-X2, Y1-Y2 and Z1-Z2 represent the width, the length and the height directions of these components, respectively.

[First Module 3030]

The first module 3030 is commonly used in the first and the second specific thermal printers 3010-1 and 3010-2.

Figure 73:
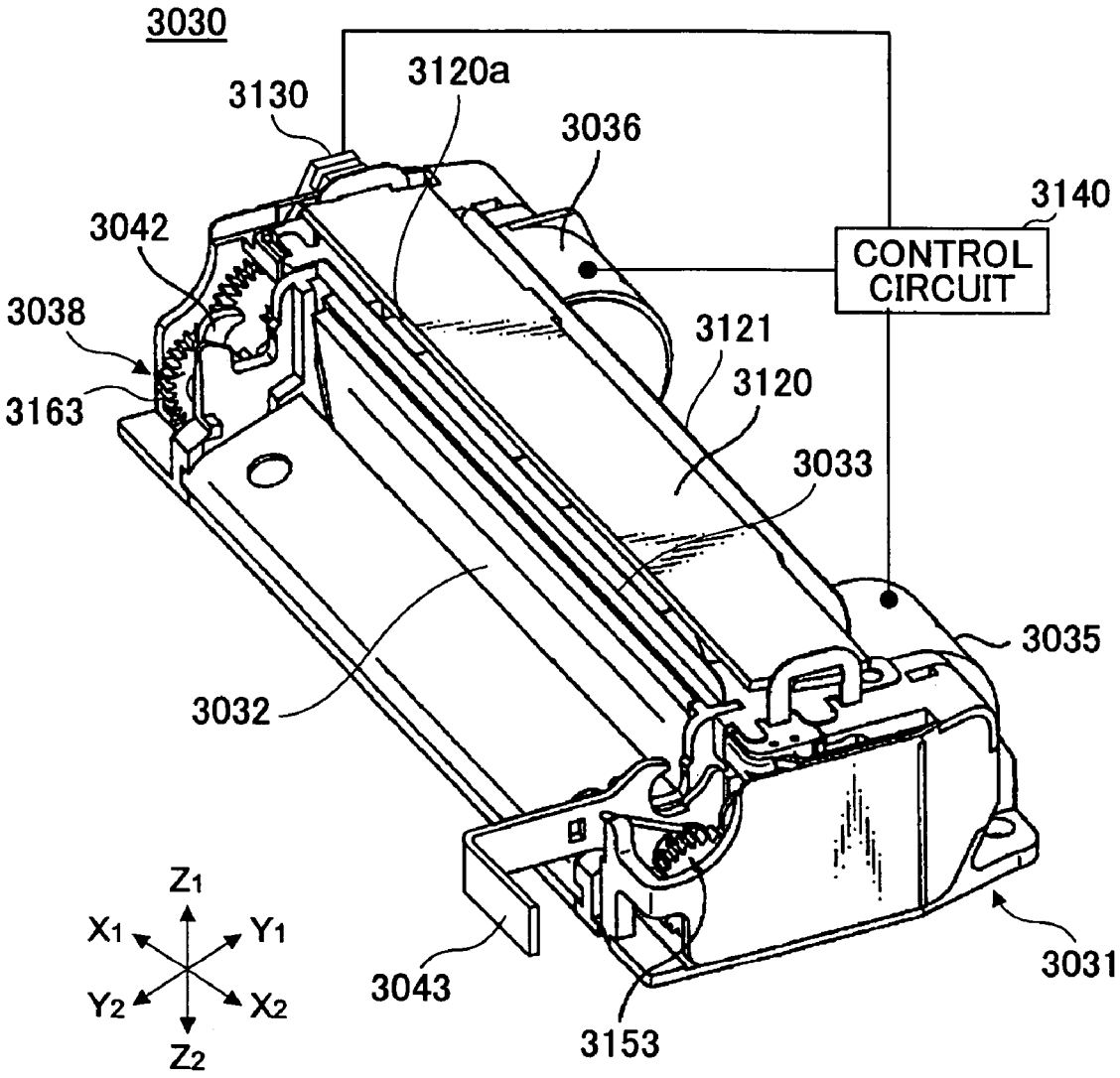
FIG. 73 is a perspective view showing a first module according to an embodiment of the present invention.
Figure 74:
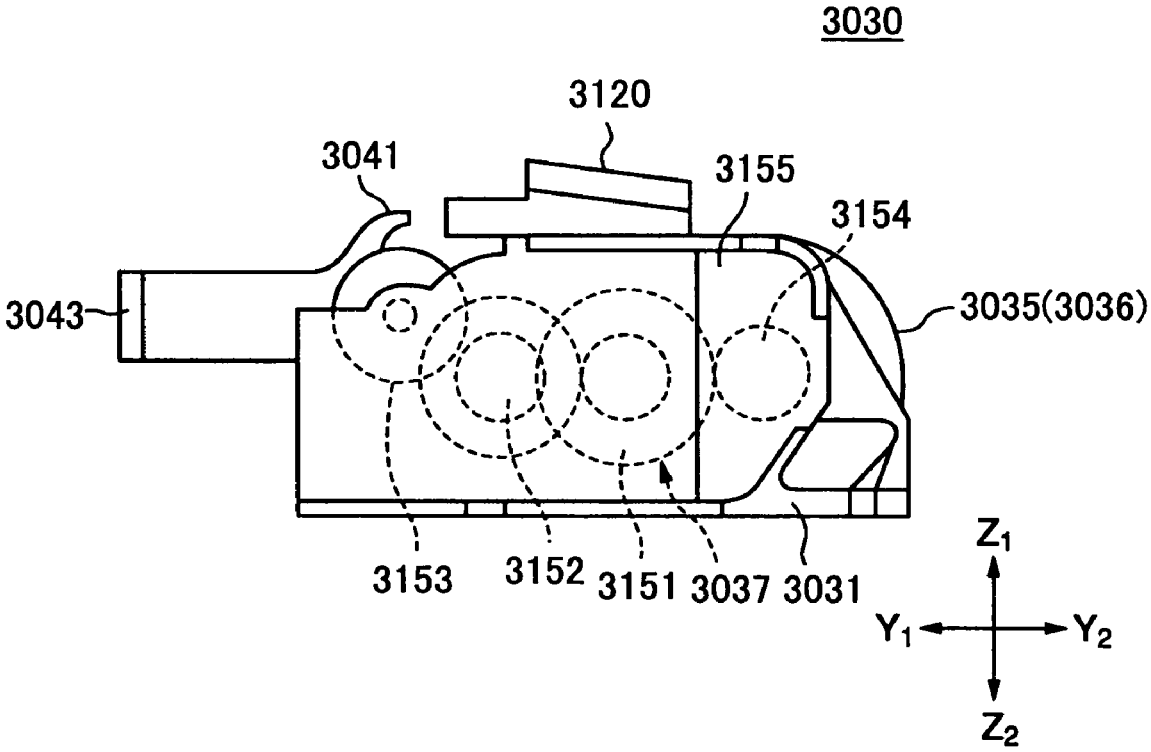
FIG. 74 is a side view showing the first module shown in FIG. 73.

As shown in FIG. 73 and FIG. 74, the first module 3030 includes a thermal head support member 3033 having such a structure that a fixed blade member 3120 and a thermal head 3032 are fixed to a frame formed as a zinc die-cast component, a head pressure applying plate spring member 3034, first and second pulse motors 3035 and 3036, first and second reduction gear sets 3037 and 3038, platen roller lock members 3041 and 3042, and a photo interrupter 3130.

A first support member 3031 is formed as a zinc die-cast component, and includes a side plate part 3031*a* in the X1 side and a side plate part 3031*b* in the X2.

Figure 76:
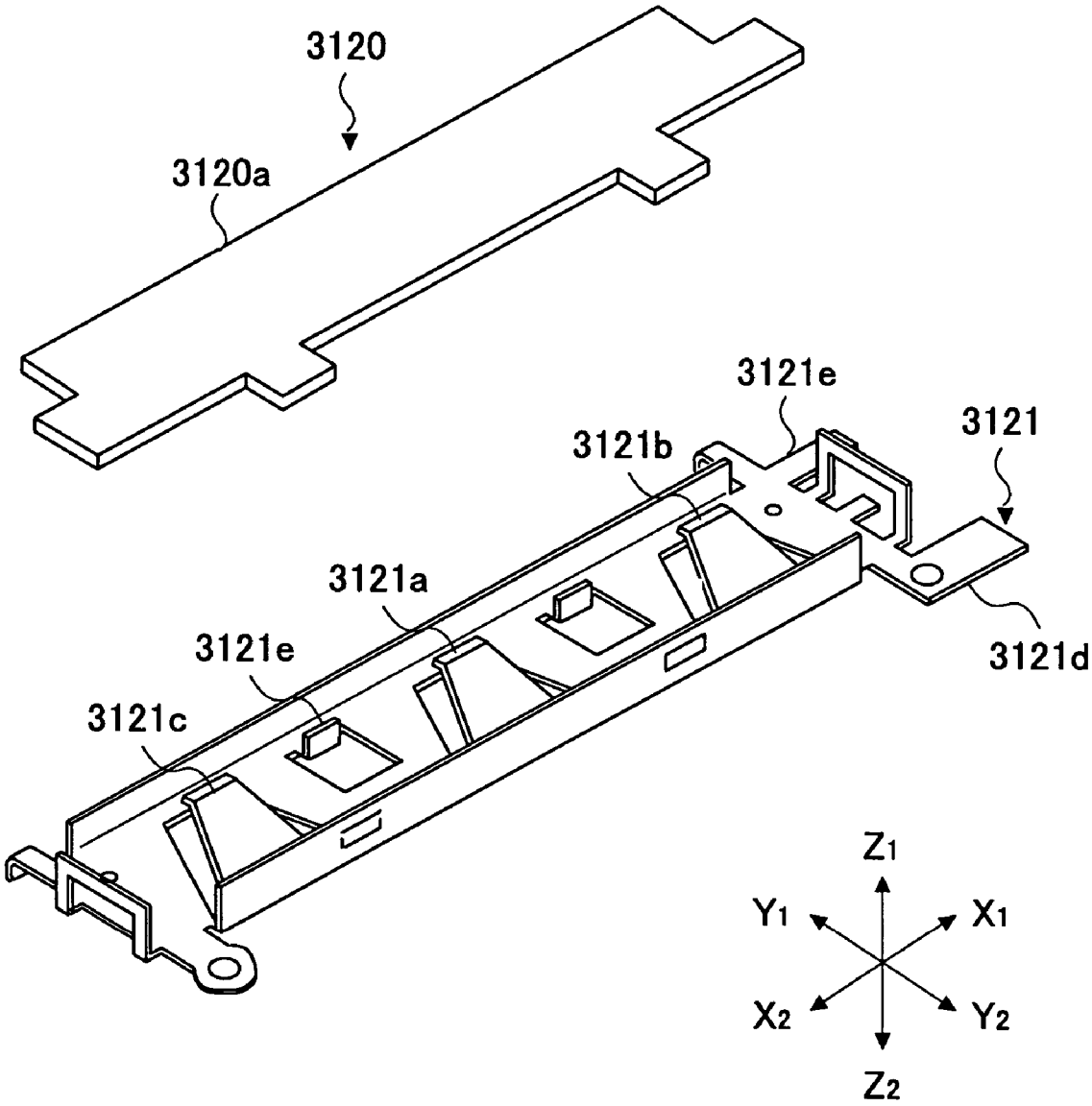
FIG. 76 is an exploded perspective view showing a fixed blade member and a support member shown in FIG. 73.

As shown in FIG. 76, the fixed blade member 3120 includes a linear blade part 3120*a*, and is mounted to a thin metal plate support member 3121 formed in press molding. The fixed blade member 3120 is fixed on a frame 3031 by screwing the support member 3121 to the frame 3031. The fixed blade member 3120 is pressed up in the Z1 direction by plate spring parts 3121*a* through 3121*c* of the support member 3121. The blade part 3120*a* is extended in the X1-X2 direction. The support member 3121 includes finger-shaped protrusion parts 3121*d* and 3121*e*, which work as lighting conductors, as described in detail below.

Figure 85A:
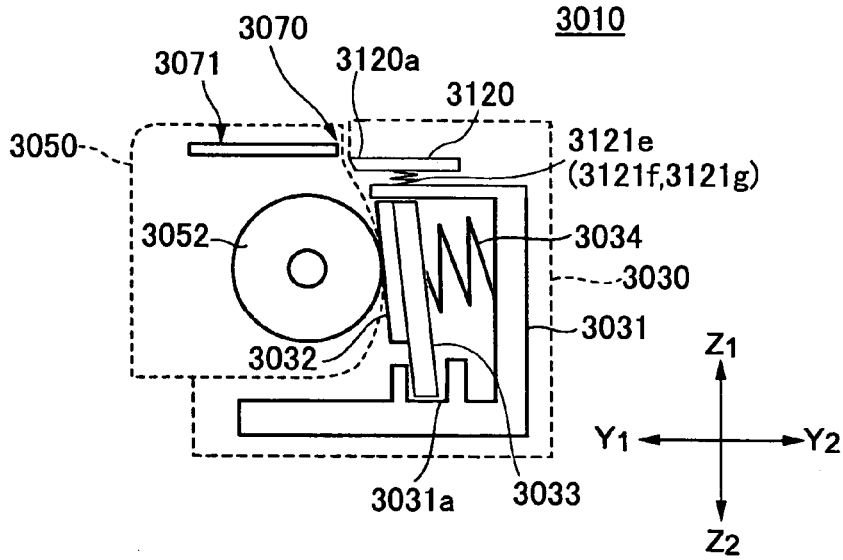
FIGS. 85A and 85B are schematic diagrams showing the thermal printer shown in FIG. 81.

As shown in FIG. 85A, the thermal head support member 3033 is supported in such a way that the thermal head support member 3033 can be rotationally driven in a small angle range. The thermal head 3032 is fixed on the Y1 side surface of thermal head support member 3033, and is pressed in the Y1 direction by the plate spring member 3034.

The first and the second motors 3035 and 3036 are the same pulse motor, and for example, rotate by 36 degree by receiving four pulses. The first pulse motor 3035 is screwed and fixed to the inner surface of the side plate part 3031*a* of the first support member 3031. The second motor 3036 is screwed and fixed to the inner surface of the side plate part 3031*b* of the first support member 3031. In the thermal printer 3010-1, the first pulse motor 3035 is used to feed a paper, and the second pulse motor 3036 is used to slide the movable blade. In the thermal printer 3010-2, the first pulse motor 3035 is used to slide the movable blade, and the second pulse motor 3036 is used to feed the paper.

Figure 75:
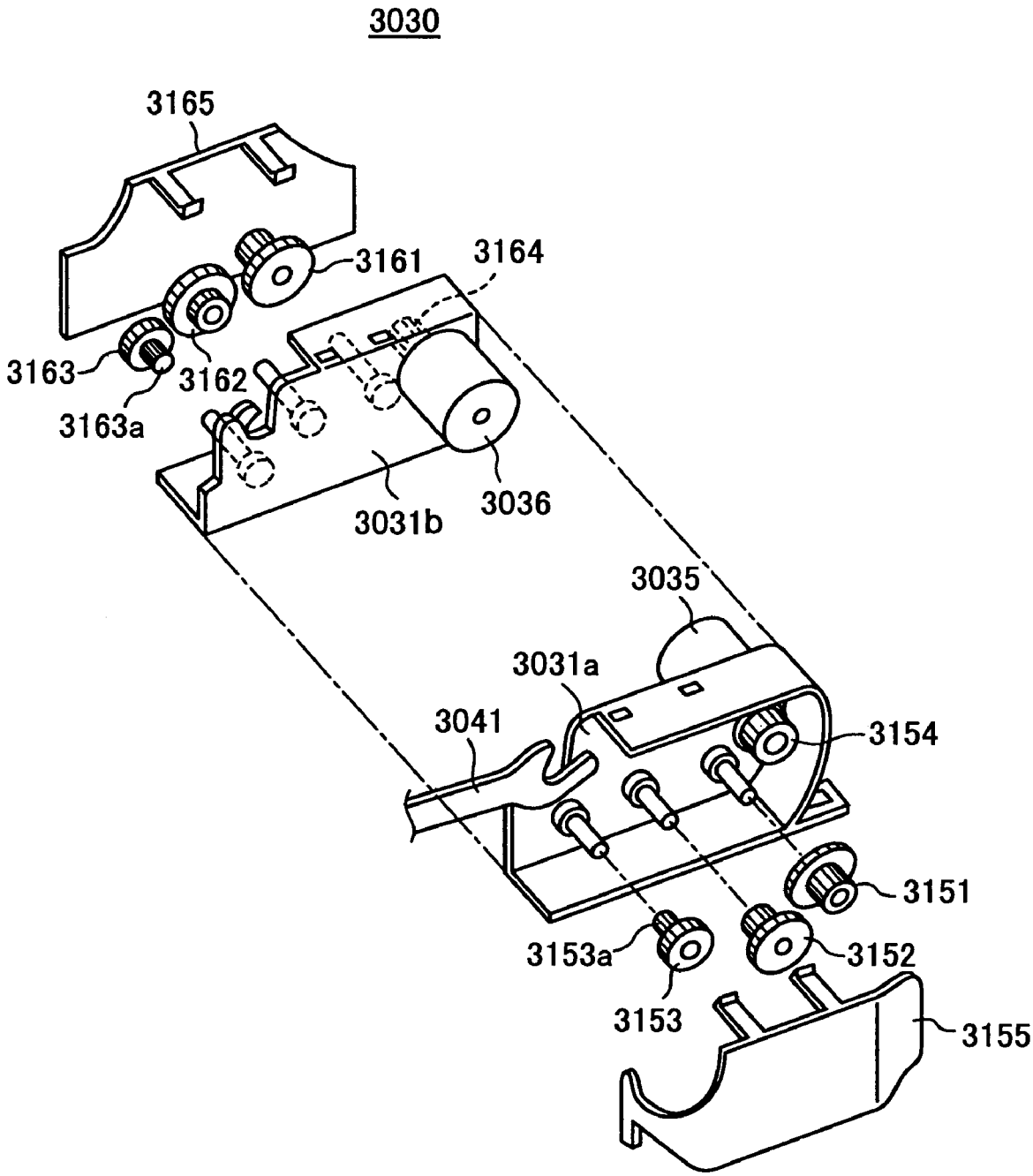
FIG. 75 is an exploded perspective view showing reduction gear sets in both sides of the first module.

As shown in FIG. 75, the first reduction gear set 3037 is disposed in the outer surface side of the side plate part 3031*a* of the frame 3031, and the second reduction gear set 3038 is disposed in the outer surface side of the side plate part 3031*b*.

In the first reduction gear set 3037, a first stage gear 3151, a second stage gear 3152 and a third stage gear 3153, each of which is formed as a two-stage gear, are engaged with each other in that order. In other words, the first stage gear 3151 is engaged with a gear 3154 fixed to the spindle of the first pulse motor 3035, and the third stage gear 3153 is provided as an output side gear. The reduction ratio is set as a value corresponding to the print resolution 203 dpi with respect to a paper feed direction, for example, which is a value such that four steps of the first pulse motor 3035 corresponds to a paper feed dimension of 0.125 mm. The first gear set 3037 is covered with a cover member 3155 made of a synthetic resin.

In the second reduction gear set 3038, a first stage gear 3161, a second stage gear 3162 and a third stage gear 3163, each of which is formed as a two-stage gear, are engaged with each other in that order. In other words, the first stage gear 3161 is engaged with a gear 3164 fixed to the spindle of the second pulse motor 3036, and the third stage gear is provided as an output side gear. The reduction ratio is set as a value corresponding to the print resolution 300 dpi with respect to a paper feed direction, for example, which is a value such that four steps of the second pulse motor 3036 correspond to a paper feed dimension of 0.085 mm. The third stage gear 3163 is made of the same materials as the third stage gear 3153. The second gear set 3038 is covered with a synthesis-resin cover member 3165. Here, if the reduction ratio of the first reduction gear set 3037 is equal to 1/20, the reduction ratio of the second reduction gear set 3038 is approximately equal to 1/30. The gears 3154 and 3164 are the same, and the third stage gears 3153 and 3163 are the same. The first stage gear 3154 differs from the first stage gear 3161 in the number of gear tooth, and the second stage gear 3152 differs from the second stage gear 3162 in the number of gear tooth.

Hook-like platen lock members 3041 and 3042 are made of metal, and disposed in the X1 and X2 sides. An operation lever 3043 is provided at the top of the platen lock member 3041.

The photo interrupter 3130 has such a structure that a light receiver part faces a light emitter. Normally, the light receiver receives light and becomes ON. When a light shielding plate part 3056*a*, which is a portion of a rack 3056 described in detail below, is intruded between the light receiver and the light emitter, light is blocked and the light receiver becomes OFF. The photo interrupter 3130 detects that the movable blade member 3071 moves back to a home position thereof in the Y1 direction.

The reduction ratios of the first and the second reduction gear sets 3037 and 3038 are not limited to the above-mentioned values. In particular, the reduction ratio of the second reduction gear set 3038 may be set as a value corresponding to the print resolution 400 dpi or 500 dpi with respect to a paper feed direction. Also, the reduction ratio of the second reduction gear set 3038 can be set as a value corresponding to a resolution lower than the standard print resolution 203 dpi with respect to a paper feed direction.

[First Specific Second Module 3050-1]

Figure 78:
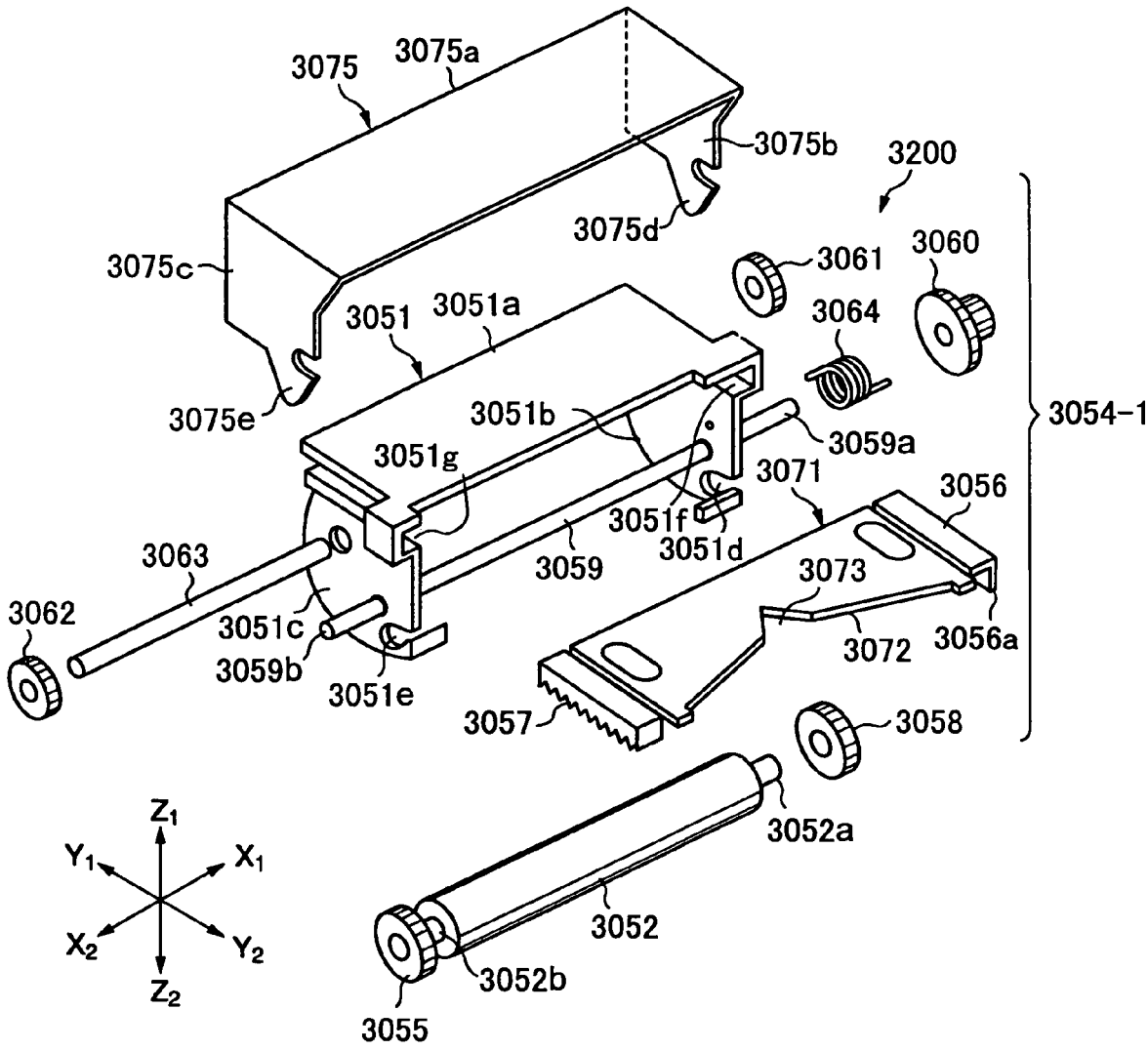
FIG. 78 is an exploded perspective view showing the first specific second module shown in FIG. 77.

FIG. 78 is an exploded perspective view showing the second module 3050-1. In FIG. 78, the shape of each component is roughly illustrated.

The second module 3050-1 includes a frame 3051, a platen roller 3052, a movable blade member 3071 and a gear set 3054-1. A cover member 3075 is mounted to the second module 3050-1 so as to cover the top surface and the side surfaces of the second module 3050-1. A mechanism 3200-1 to slide the movable blade member 3071 back and forth is composed of a gear set 3054-1 and racks 3056 and 3057.

The frame 3051 made of a synthesis resin includes a top plate part 3051*a* and flange parts 3051*b* and 3051*c* in both sides of the top plate part 3051*a*, and has almost U-shape.

The movable blade member 3071 includes arm parts 3074*a* and 3074*b* projecting in the Y2 direction in both sides of the X1-X2 direction and a V-shaped blade part 3072 having the V-shape bottom in the Y1 directional side between the arms 3074*a* and 3074*b*. The racks 3056 and 3057 are fixed to the X1 and X2 sides of the movable blade member 3071. A V-shaped notch part 3073 having the V-shape bottom in the Y1 directional side is formed at the center of the blade part 3072. The movable blade member 3071 can move in the Y1-Y2 direction in such a way that the racks 3056 and 3057 are supported by guide parts 3051*f* and 3051*g* in the flange parts 3051*b* and 3051*c*, respectively.

In addition, a user can replace the movable blade member 3071, which is described in detail below.

The platen roller 3052 is supported in such a way that shaft parts 3052*a* and 3052*b* projecting to both sides of the platen roller 3052 are supported by shaft receive parts 3051*d* and 3051*e* of the flange part 3051*b* and 3051*c*, respectively.

A gear 3055 is fixed to the X2 side shaft part 3052*b*, and a gear 3058 is supported to the X1 side shaft part 3052*a* in such a way that the gear 3058 can be rotated. The sizes of the gears 3055 and 3058 are the same. A fixed shaft member 3059 is bridged and fixed between the flange parts 3051*b* and 3051*c*, and includes a shaft part 3059*a* projecting in the X1 direction from the flange part 3051*b* and an shaft part 3059*b* projecting in the X2 direction from the flange part 3051*c*. Also, an axis member 3063 is bridged between the both side flange parts 3051*b* and 3051*c* in such a way that the axis member 3063 can be rotated, and pinions 3061 and 3062 are fixed to the axis member 3063 in both sides thereof. The pinions 3061 and 3062 are engaged with the racks 3056 and 3057, respectively. A recovery spring 3064 forces the movable blade member 3071 to move in the Y1 direction, and the movable blade member 3071 is pulled in the interior of the second support member 3051.

The cover member 3075, which is formed as a steel plate member, includes a top plate part 3075*a* and flange parts 3075*b* and 3075*c* in both sides of the top plate part 3075*a*, and has almost U-shape. The flange part 3075*b* and 3075*c* include projection parts 3075*d* and 3075*e* projecting in the Z2 direction. The projection parts 3075*d* and 3075*e* lock cover members 3165 and 3155, respectively.

The first specific second module 3050-1 and the second specific second module 3050-2 have the above-mentioned structure in common.

In the first specific second module 3050-1, a gear 3055 is fixed to the X2 side axis part 3052*b*, and a gear 3058 is supported to the X1 side axis part 3052*a* in such a way that the gear 3058 can be rotated. In addition, a two-stage gear 3060 and a recovery spring 3064 are supported to the axis part 3059*a*. The two-stage gear 3060 is engaged with the gears 3058 and 3061. The gear set 3054-1 is composed of the gears 3058 and 3061 and the two-stage gear 3060.

[Second Specific Second Module 3050-2]

In the second specific second module 3050-2, the gear 3055 is supported to the X2 side shaft part 3052*b* in such a way that the gear 3055 can be rotated. On the other hand, the gear 3058 is fixed to the X1 side shaft part 3052*a*. In addition, the two-stage gear 3060 and the recovery spring 3064 are supported to the shaft part 3059*b*. The two-stage gear 3060 is engaged with the gears 3055 and 3062. A gear set 3054-2 is composed of the gears 3055 and 3060 and the two-stage gear 3060. A mechanism 3200-2 to slide the movable blade member 3071 back and forth is composed of the gear set 3054-2 and the racks 3056 and 3057.

The first specific second module 3050-1 and the second specific second module 3050-2 have the almost same structure. The first specific second module 3050-1 slightly differs from the second specific second module 3050-2 in that either of the gears 3055 and 3058 is fixed to the shaft, and the two-stage gear 3060 and the recovery spring 3064 are disposed in either of the X1 and X2 sides. Accordingly, although two kinds of second modules have to be prepared, each of the second modules 3050-1 and 3050-2 can be fabricated less expensively than each of two kinds of conventional second modules can be fabricated.

[First Specific Thermal Printer 3010-1]

Figure 77:
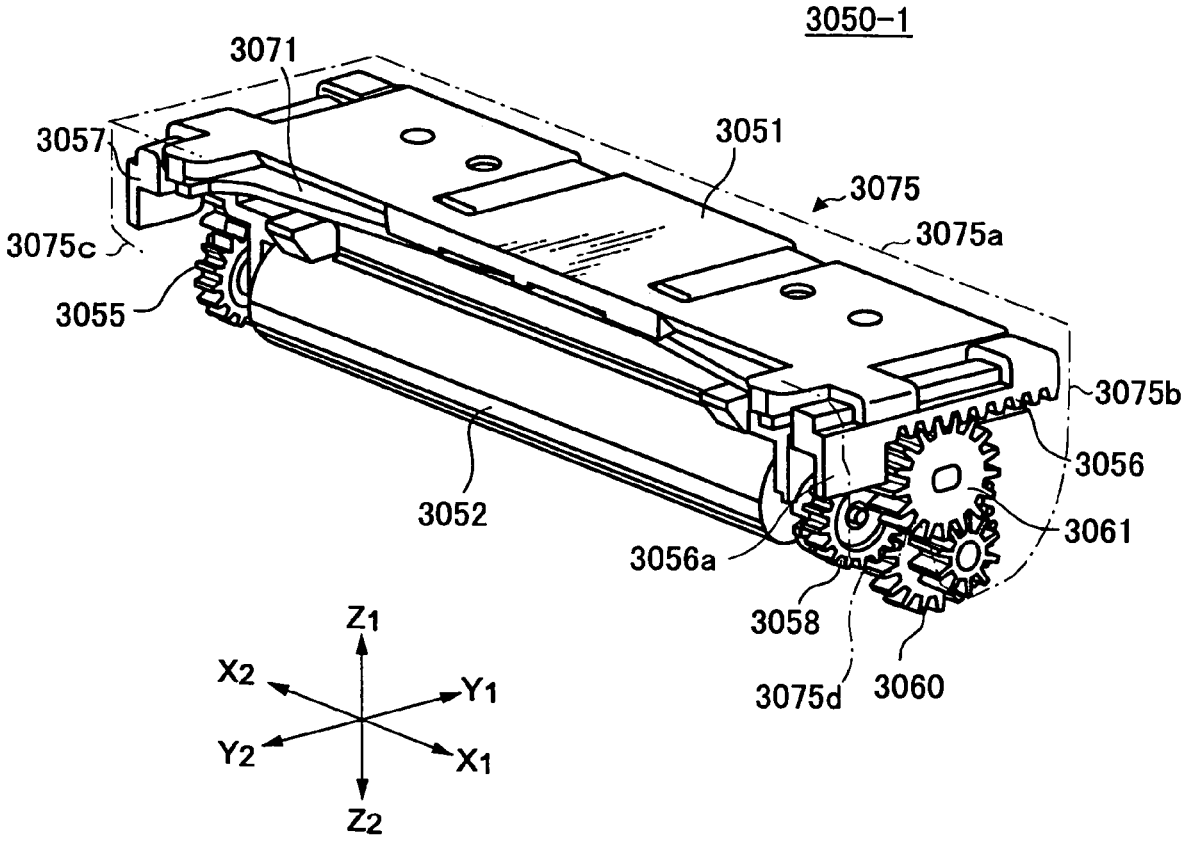
FIG. 77 is a perspective view showing a first specific second module according to an embodiment of the present invention.
Figure 81:
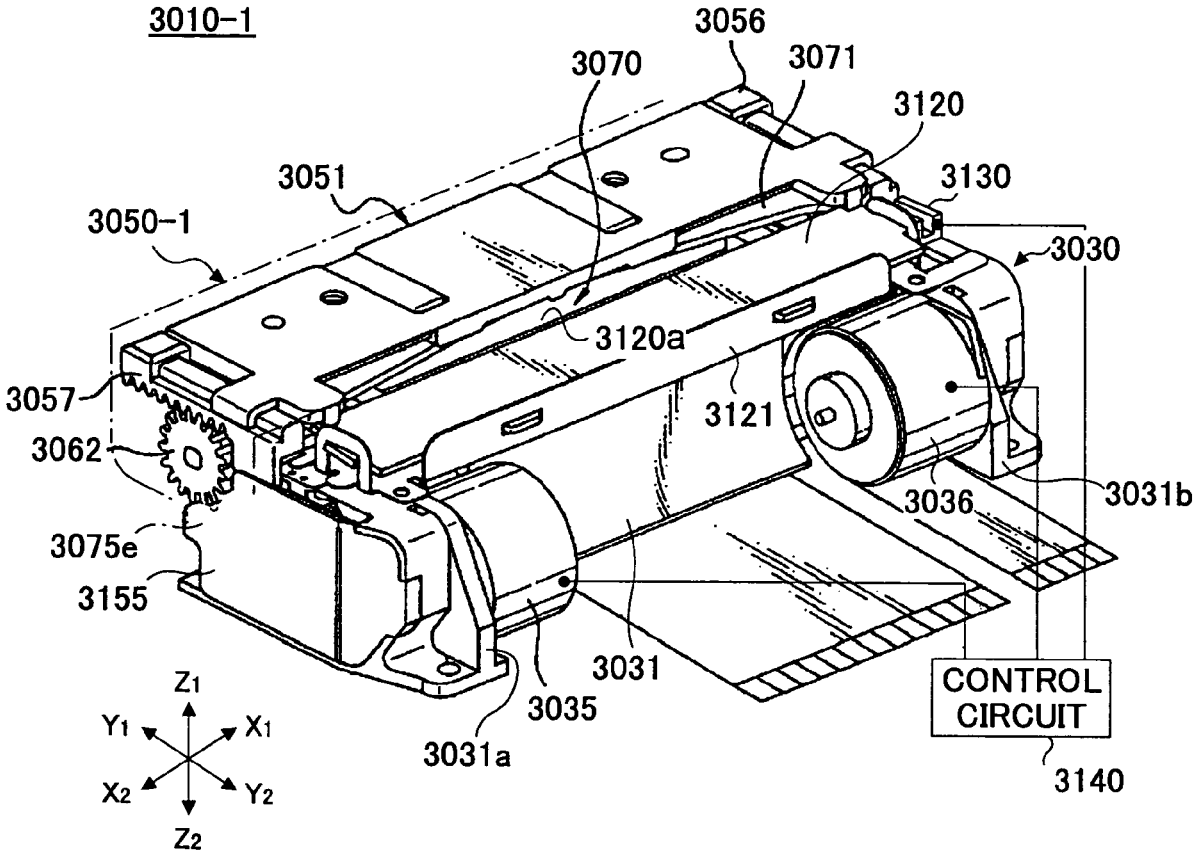
FIG. 81 is a perspective view showing a first specific thermal printer according to an embodiment of the present invention.
Figure 82:
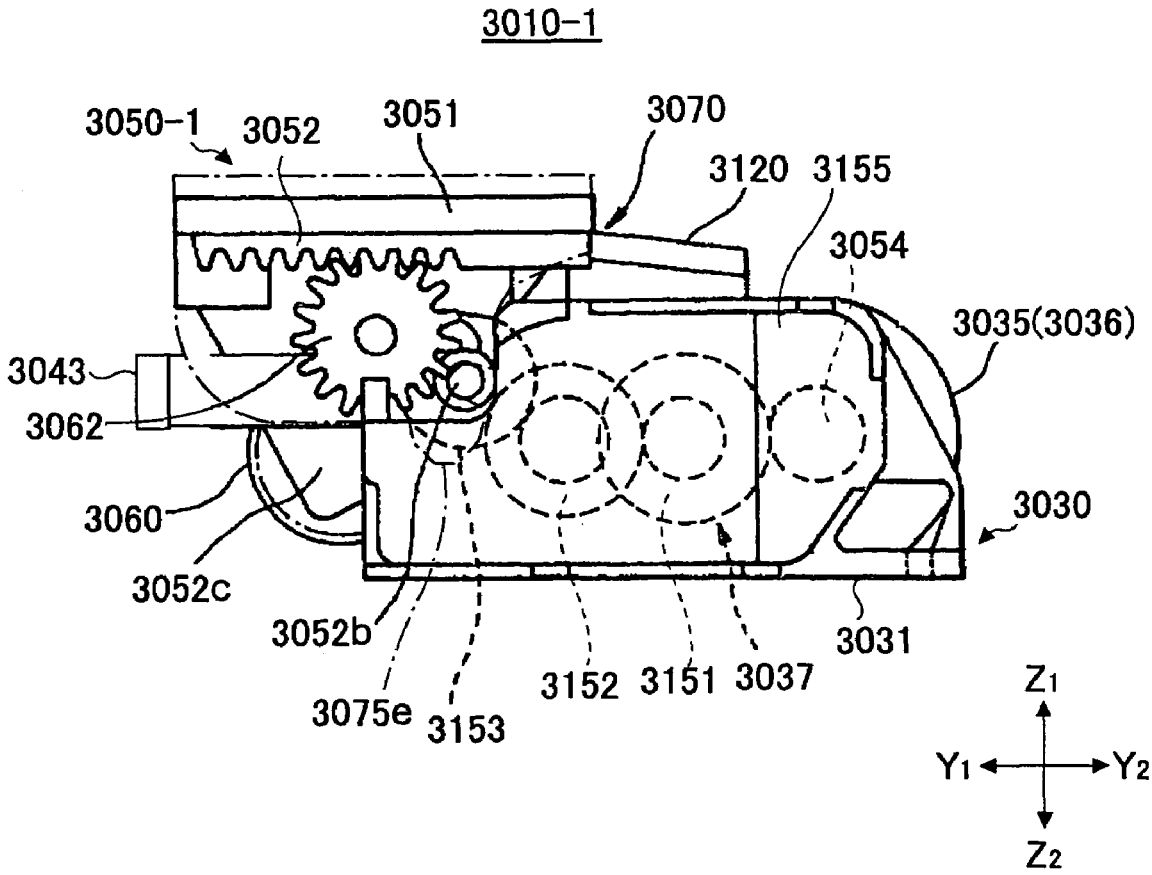
FIG. 82 is a side view showing the thermal printer shown in FIG. 81.
Figure 83C:
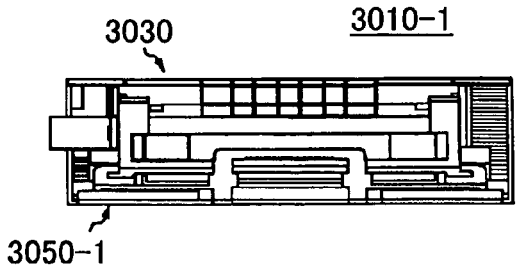
FIGS. 83A through 83E are diagrams showing the thermal printer shown in FIG. 81.
Figure 83E:
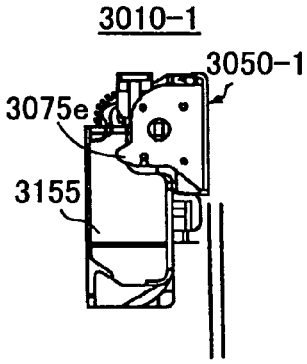
Figure 83A:
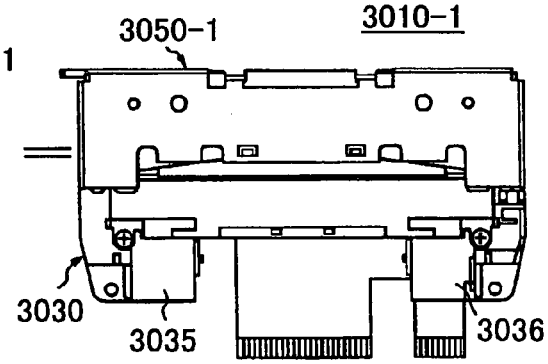
Figure 83D:
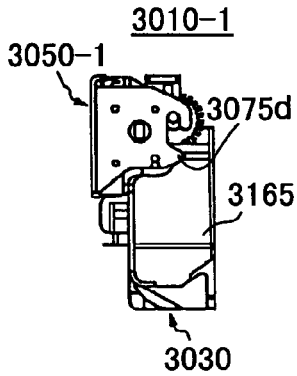
Figure 83B:
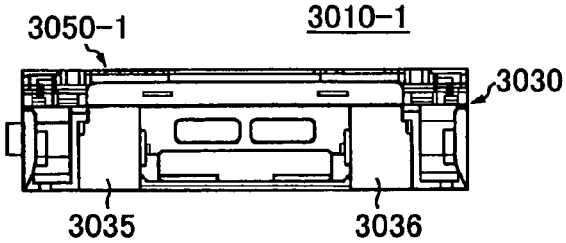

As shown in FIG. 81 through FIG. 83, the first specific thermal printer 3010-1 has such a structure that the first specific second module 3050-1 shown in FIG. 77 is detachably coupled with the first module 5030 shown in FIG. 73 and the cutter part 3070 is formed in the connection condition. Print and cut operations of the first specific thermal printer 3010-1 are controlled by a control circuit 3140 having a microcomputer. The cutter part 3070 is disposed in the downstream side from a printing position with respect to a paper feed direction.

As shown in FIG. 88 and FIG. 89, the thermal line printer 3010-1 is incorporated into the mobile terminal device 3020. The mobile terminal device 3020 includes a chassis 3021, a casing 3022 for covering the chassis 3021, a lid 3024 supported to a Y1 side shaft 3023, a Y1 side roll paper accommodation part 3025 and an operation button 3026 on the casing 3022. The first module 3030 is fixed on the casing 3022 so as to face the roll paper accommodation part 3025. The second module 3050-1 is fixed on the under surface of the end of the lid 3024.

Figure 84:
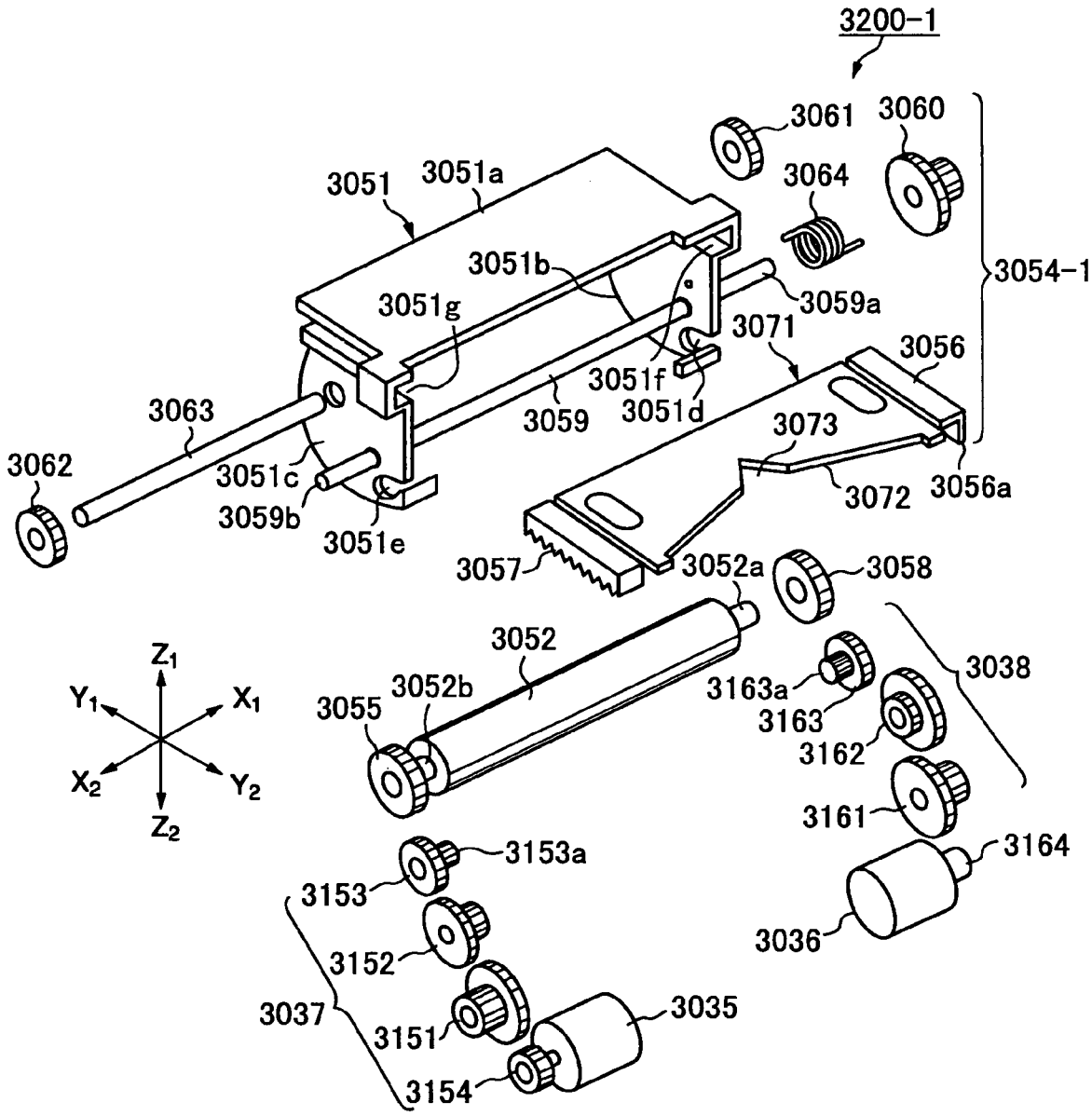
FIG. 84 is an exploded perspective view showing a rotation transmission system of the thermal printer shown in FIG. 81.
Figure 88A:
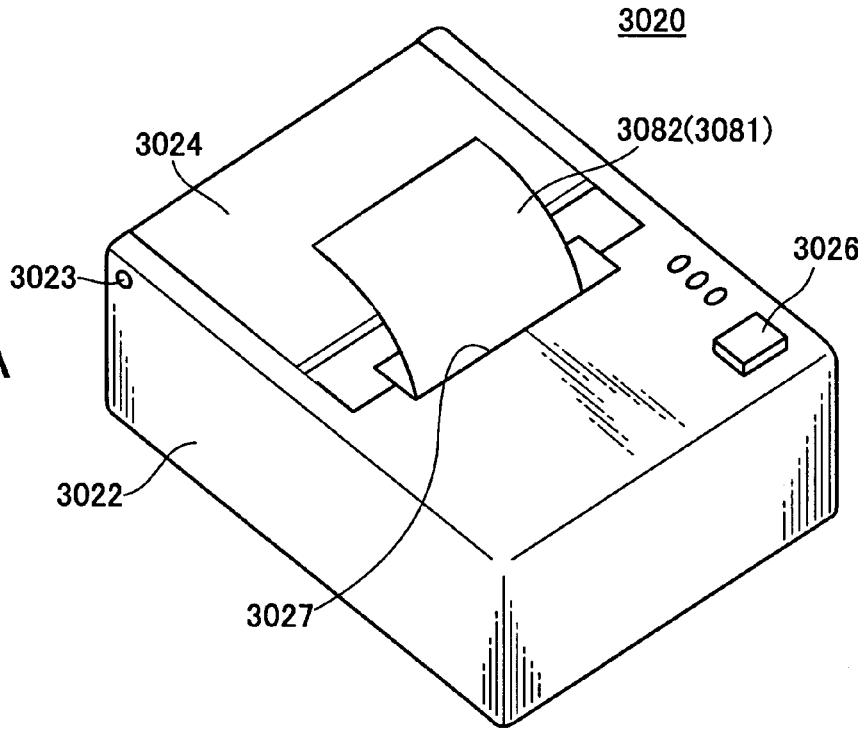
FIGS. 88A and 88B are diagrams showing a mobile terminal device incorporating the thermal printer shown in FIG. 81.
Figure 88B:
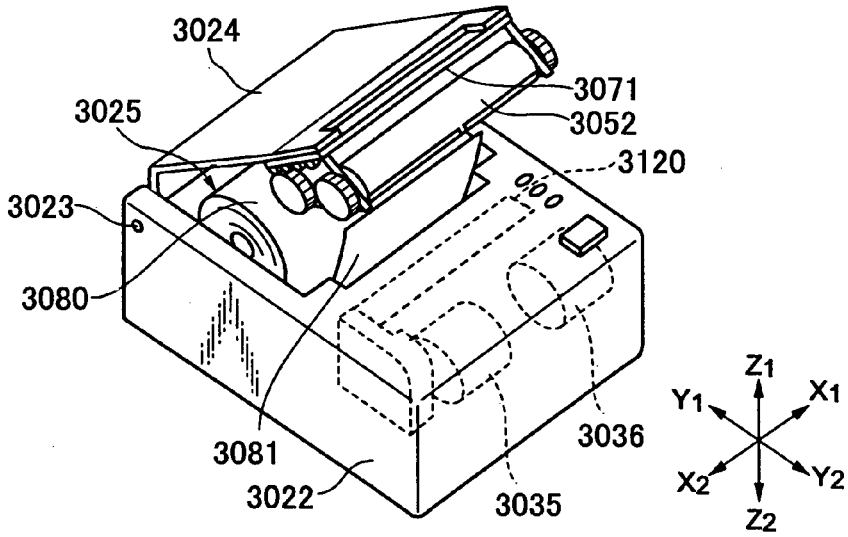
Figure 89A:
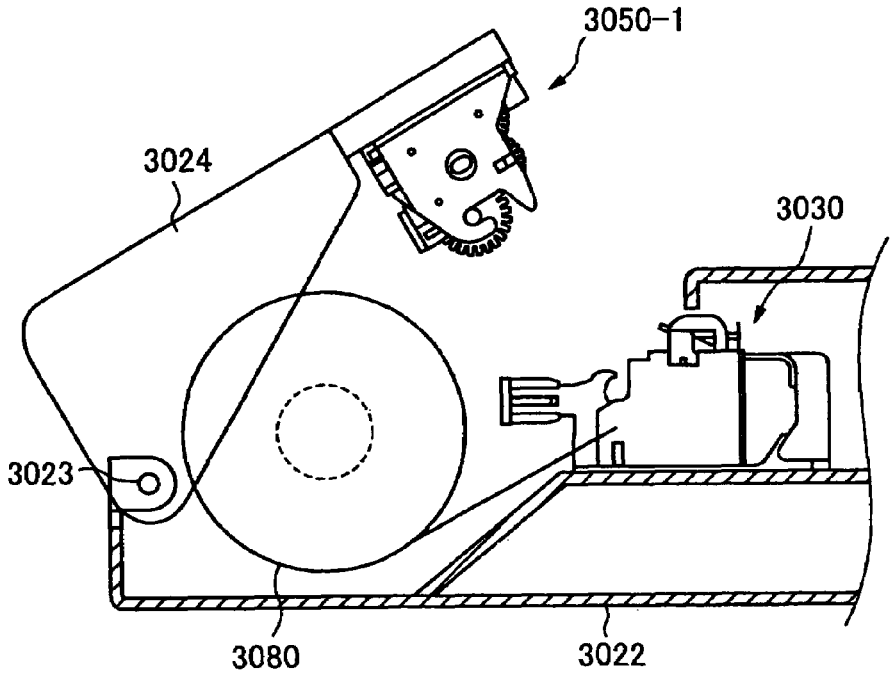
FIGS. 89A and 89B are diagrams illustrating an exemplary structure of the thermal printer of the mobile terminal device shown in FIG. 88;.
Figure 89B:
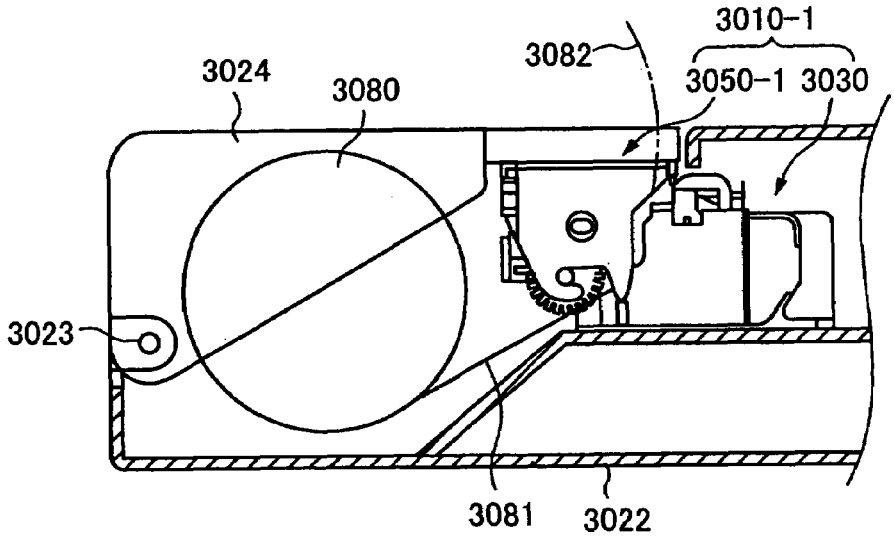

As shown in FIGS. 88B and 89A, after opening of the lid 3024, a user puts a thermal paper roll 3080 in the roll accommodation part 3025, and closes the lid 3024. Then, the second module 3050-1 is coupled with the first module 3030, as illustrated in FIGS. 88A and 89B. Specifically, the shaft parts 3052*a* and 3052*b* of the platen roller 3052 are engaged with platen roller lock members 3041 and 3042, and the platen roller 3052 presses the paper 3081 to a thermal head 3032. An end of the paper 3081 is projected in the outer side from an exit 3027. In addition, the gear 3055 is engaged with a small diameter gear 3153*a* of the two-stage gear 3153, and the gear 3058 is engaged with a small diameter gear 3163*a* of the two-stage gear 3163. As shown in FIG. 84, the gears 3055 and 3058, the gear set 3054-1, and the first and the second reduction gear sets 3037 and 3038 are positioned.

Figure 85B:
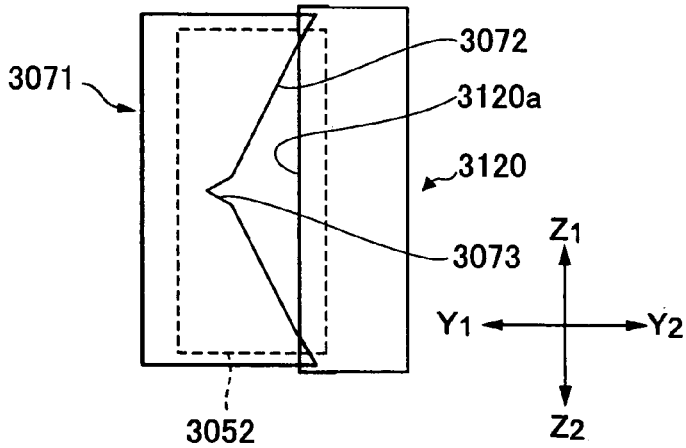
Figure 86:
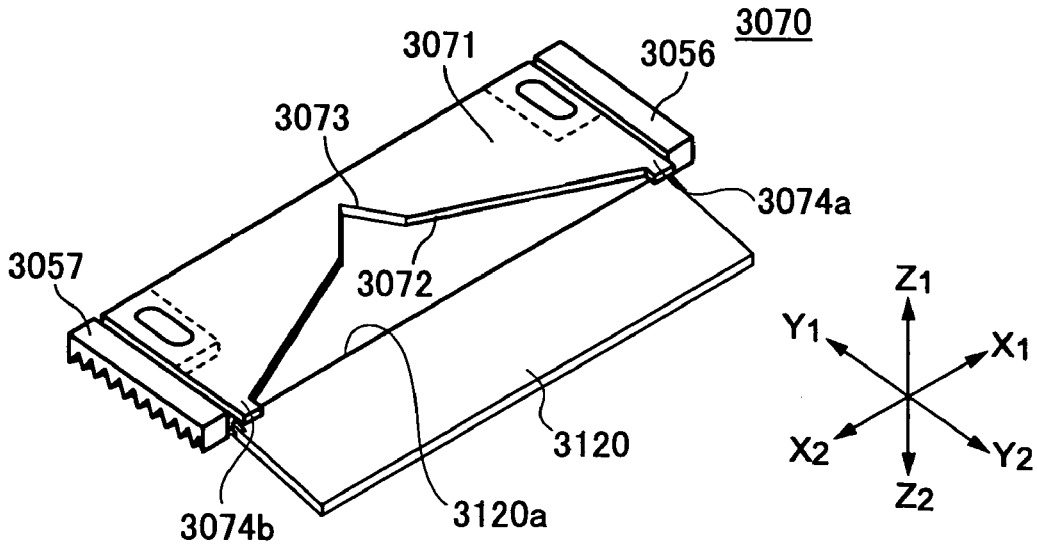
FIG. 86 is a perspective view showing a cutter part according to an embodiment of the present invention.
Figure 87:
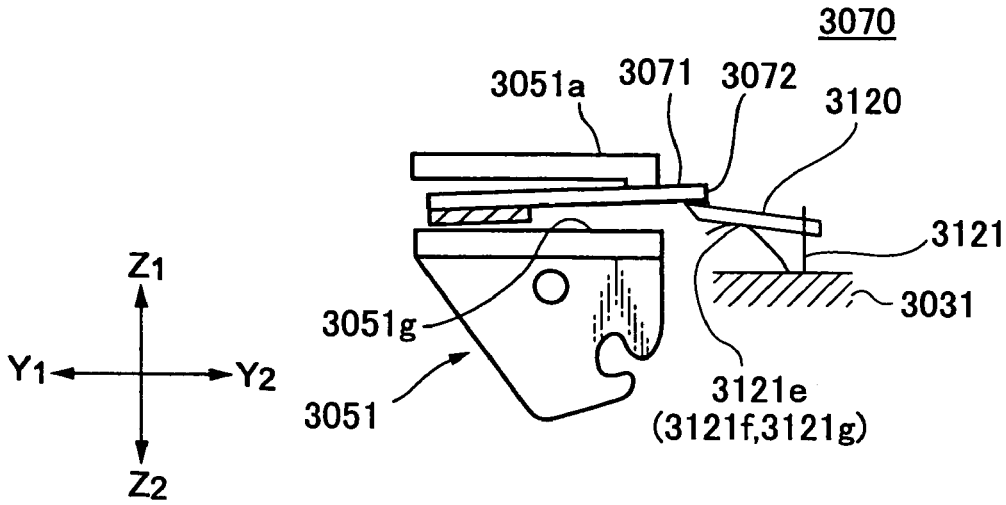
FIG. 87 is a side view showing the cutter part shown in FIG. 86.

Also, as shown in FIG. 85 through FIG. 87, the cutter part 3070 is formed in a condition where the movable blade member 3071 is positioned opposite to the fixed blade member 3120.

The control circuit 3140 controls driving of the thermal head 3032 and the first and the second pulse motors 3035 and 3036. The control circuit 3140 issues a paper feed instruction to the first pulse motor 3035 and a paper cut instruction to the second pulse motor 3036. The first pulse motor 3035 is used to feed a paper, and the second pulse motor 3036 is used to drive the cutter part 3070.

In the print instruction, the thermal head 3032 is driven and heated, and at the same time, the first pulse motor 3035 is driven to rotate the platen roller 3052 via the first reduction gear set 3037 and the gear 3055. The paper 3081 is printed at the print resolution of 203 dpi with respect to a paper feed direction, and the printed paper portion 3082 passes through the cutter part 3070 and is fed out from the exit 3027. Heat in the thermal head 3032 is released through the thermal head support member 3033.

Upon completion of the printing, in response to the cut instruction, the second pulse motor 3036 is driven to drive the racks 3056 and 3057 via the second reduction gear set 3038, the gear set 3054-1 and the pinions 3061 and 3062. Both sides of the movable blade member 3071 are simultaneously driven and guided by guide parts 3051*f* and 3051*g* to slide the movable blade member 3071 in the Y2 direction. Then, the second pulse motor 3036 is inversely driven to slide back the movable blade member 3071 in the Y1 direction to cut the printed paper portion 3082. Here, the printed paper portion can be partially cut along the way of a V-shaped notch part 3073 of the movable blade member 3071 by controlling the number of pulses supplied to the second pulse motor 3036, and the width of uncut portions can be adjusted appropriately. Since the sliding of the movable blade member 3071 is not prescribed, it is possible to partially and completely cut the printed paper portion even at a reduction ratio of the second reduction gear set 3038 corresponding to the print resolution 300 dpi with respect to a paper feed direction.

Also, when a user manipulates the operation lever 3043, the shaft parts 3052*a* and 3052*b* of the platen roller 3052 are unlocked, and the lid 3024 is raised up and opened due to spring force of the plate spring parts 3121*a* through 3121*c*. Then, the user can replenish another thermal paper roll 3081.

[Second Specific Thermal Printer 3010-2]

Figure 79:
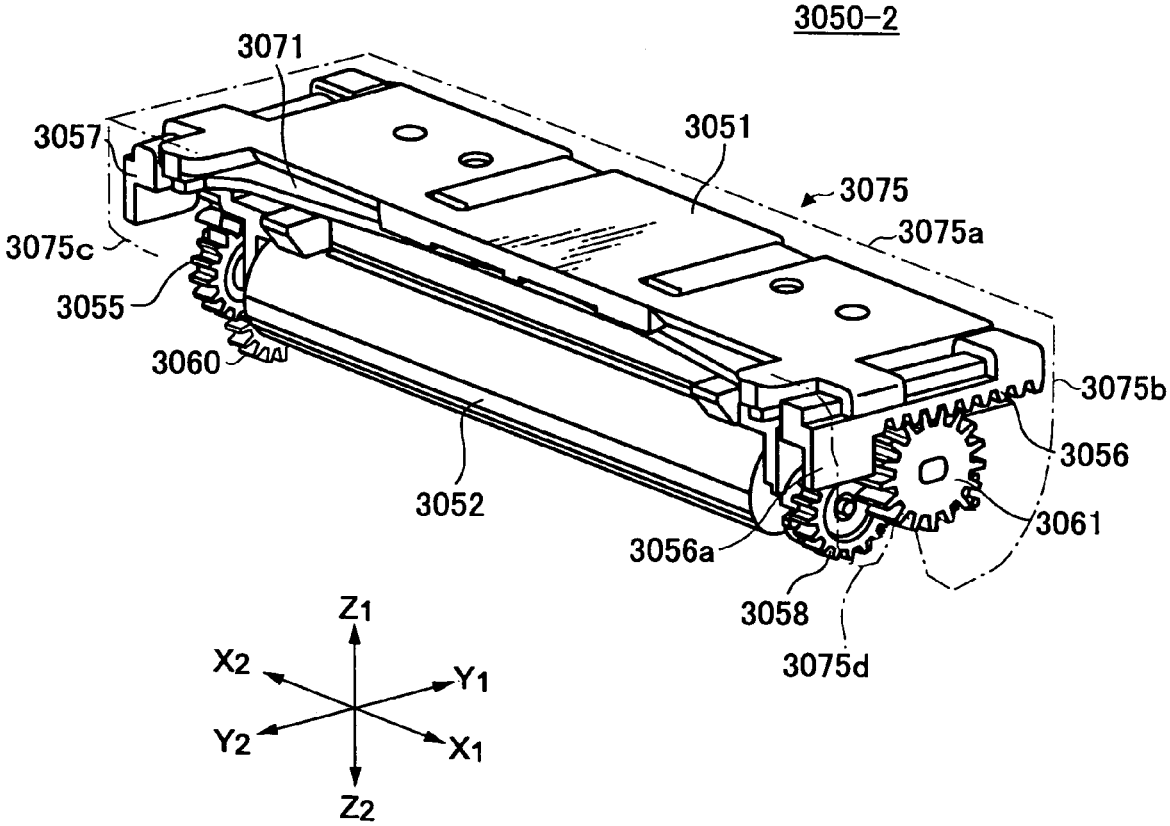
FIG. 79 is a perspective view showing a second specific second module according to an embodiment of the present invention.
Figure 80:
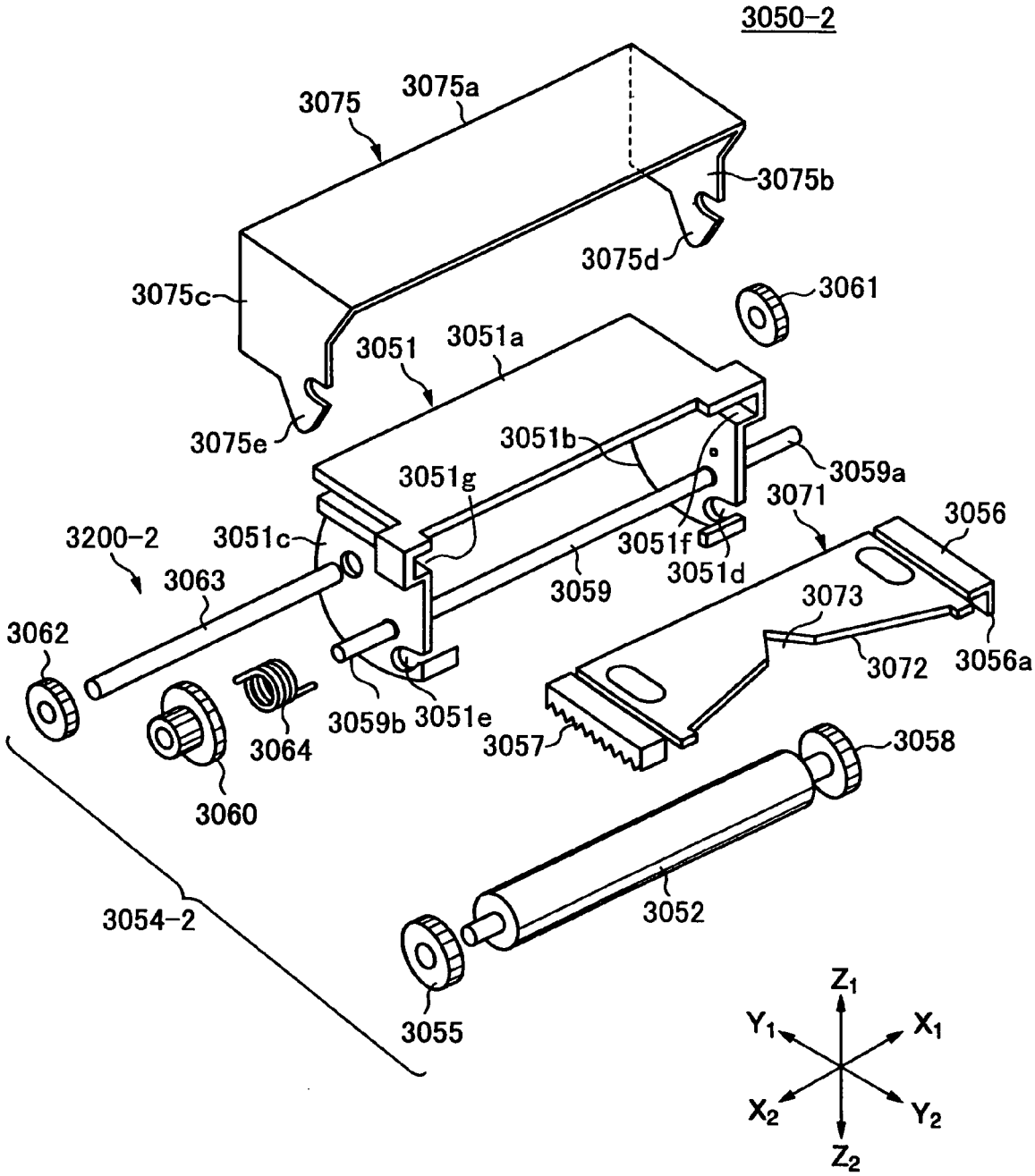
FIG. 80 is an exploded perspective view showing the second specific second module shown in FIG. 79.
Figure 90:
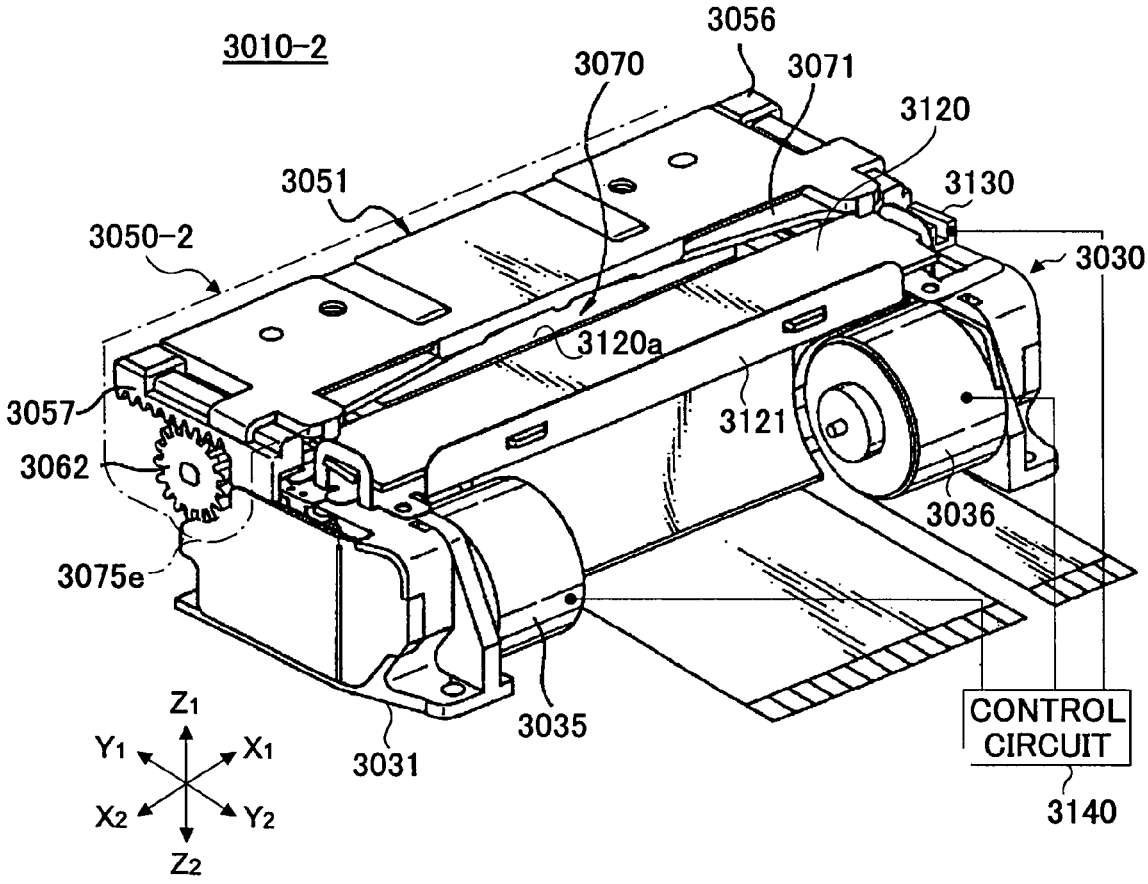
FIG. 90 is a diagram illustrating a second specific thermal printer according to an embodiment of the present invention.

As shown in FIG. 90, the second specific thermal printer 3010-2 has such a structure that the second specific second module 3050-2 shown in FIG. 79 is detachably coupled with the first module shown in FIG. 73. The cutter part 3070 is formed to have a structure such that the movable blade member 3071 is disposed to face the fixed blade member 3120.

Figure 91:
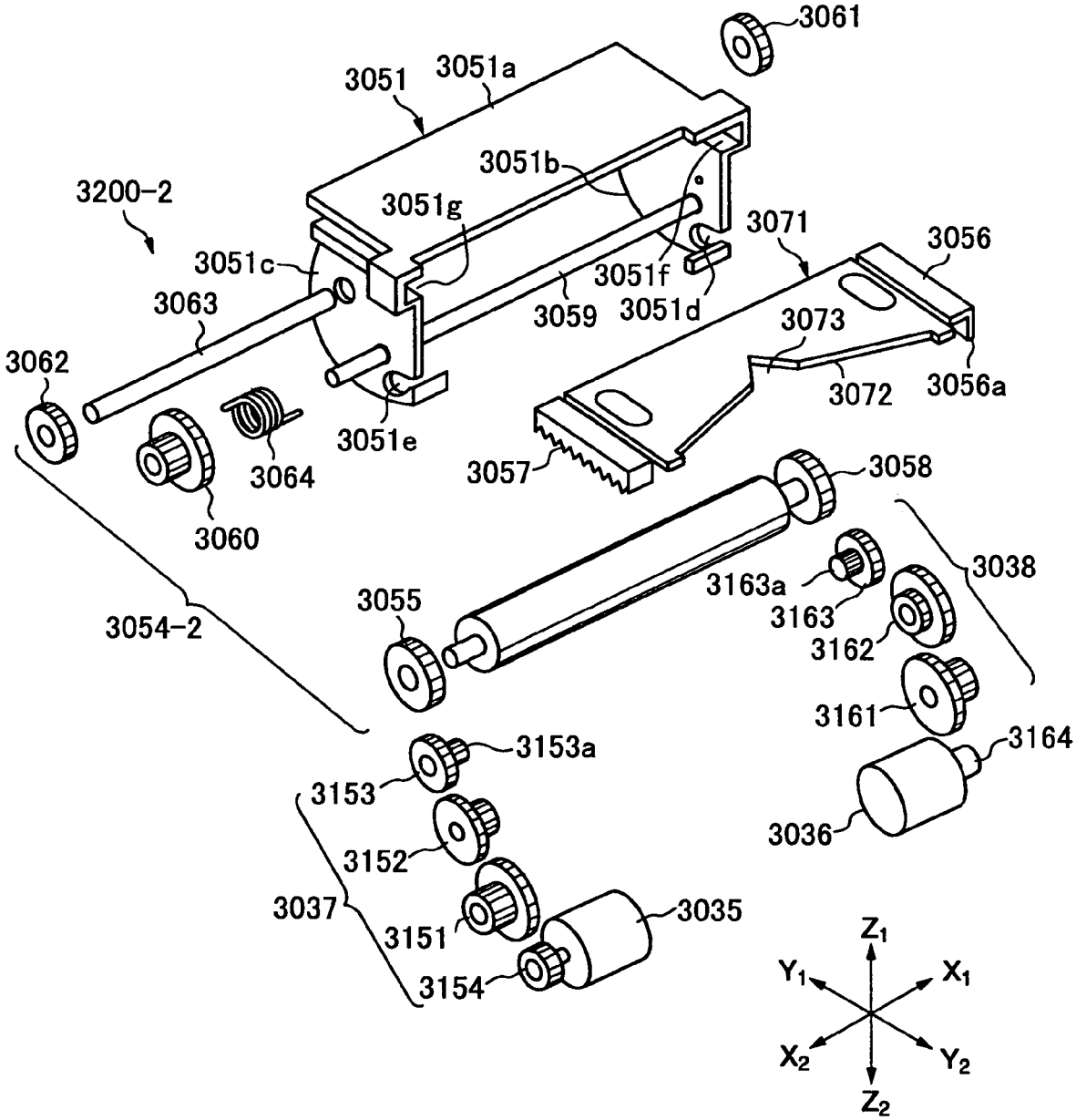
FIG. 91 is an exploded perspective view showing a rotation transmission system of the thermal printer shown in FIG. 90.

As shown in FIG. 91, the gear 3055 is engaged with a small diameter gear 3153*a* of the two-stage gear 3153, and the gear 3058 is engaged with a small diameter gear 3163*a* of the two-stage gear 3163. The gears 3055 and 3058, the gear set 3054-2, and the first and the second reduction gear sets 3037 and 3038 are positioned as illustrated in FIG. 91.

Unlike the above-mentioned case of the first specific thermal printer 3010-1, the control circuit 3140 issues a paper feed instruction to the second pulse motor 3036 and a paper cut instruction to the first pulse motor 3035. Namely, the second pulse motor 3036 is used to feed a paper, and the first pulse motor 3035 is used to drive the cutter part 3070.

In the print instruction, the thermal head 3032 is driven and heated, and at the same time, the second pulse motor is driven to rotate the platen roller 3052 via the second reduction gear set 3038 and the gear 3058 to print the paper at the print resolution 300 dpi with respect to a paper feed direction.

Upon completion of the printing, in response to receipt of the cut instruction, the first pulse motor 3035 is driven to drive the racks 3057 and 3056 via the first reduction gear set 3037, the gear set 3054-2 and the pinions 3062 and 3063 to slide the movable blade member 3071 in the Y2 direction. Then, the first pulse motor 3035 is inversely driven to slide the movable blade member 3071 back in the Y1 direction to partially or completely cut a printed paper portion 3082. Here, since the sliding of the movable blade member 3071 is not prescribed, it is possible to partially and completely cut the printed paper portion even at a reduction ratio of the first reduction gear set 3037 corresponding to the print resolution 203 dpi with respect to a paper feed direction.

Next, one or more features of the first and the second specific thermal printers 3010-1 and 3010-2 are described.

Figure 92:
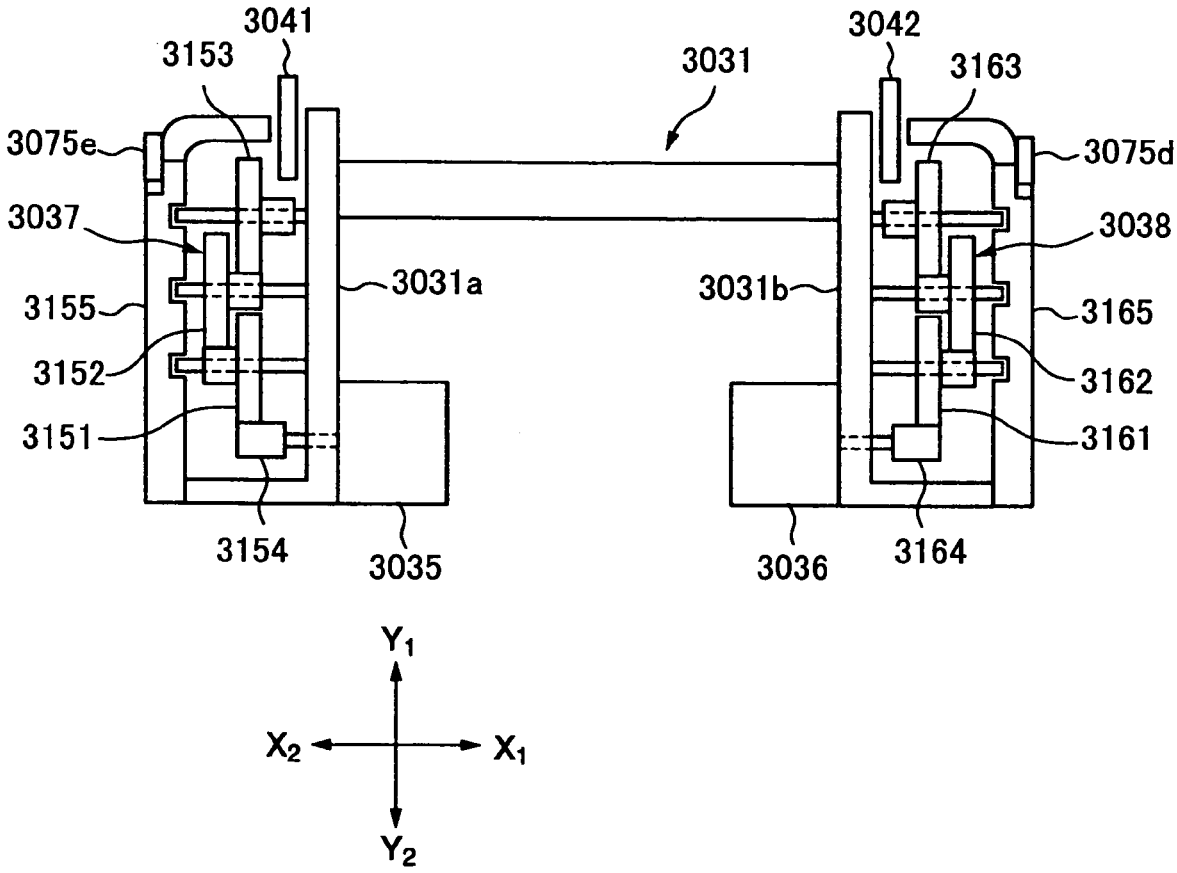
FIG. 92 is a schematic diagram showing the thermal printer shown in FIG. 81.

As shown in FIG. 92, protrusion parts 3075*d* and 3075*e* of the cover member 3075 formed as a steel sheet lock the outer surface side of the synthesis-resin cover members 3165 and 3155 in a condition where the second module 3050-1 (3050-2) is coupled with the first module 3030. As a result, it is possible to prevent outside inclination of the cover members 3165 and 3155.

Similarly, as shown in FIG. 92, the platen lock member 3041 is disposed between the side plate part 3031*a* of the frame 3031 and the cover member 3155. The platen lock member 3042 is disposed between the side plate part 3031*b* of the frame 3031 and the cover member 3165. Thereby, it is possible to prevent the platen lock members 3041 and 3042 from being inclined in the X1 and X2 directions.

Figure 93A:
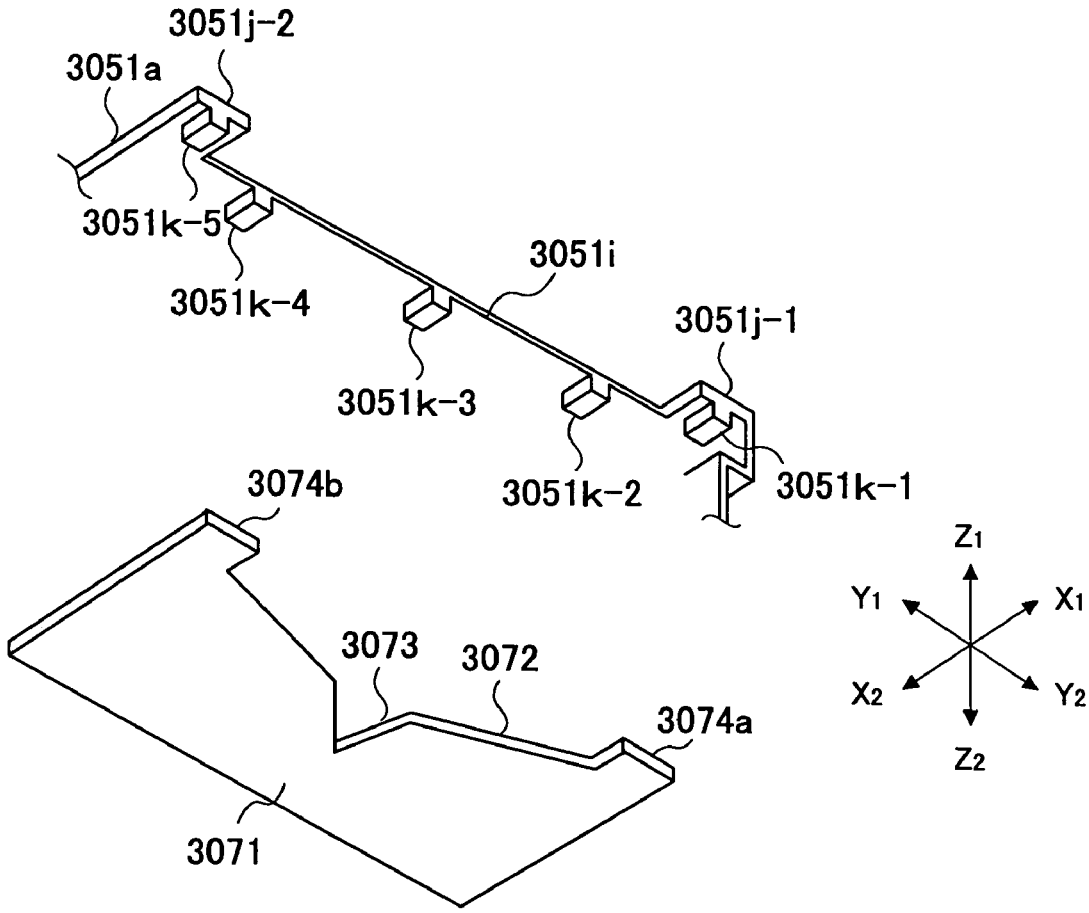
FIGS. 93A and 93B are diagrams showing an exemplary structure of a portion of a movable blade member.

As shown in FIG. 93A, the movable blade member 3071 includes finger-shaped protrusion parts 3074*a* and 3074*b* projecting in the X1-X2 directional side in the Y2 direction. As shown in FIG. 86, the finger-shaped protrusion parts 3074*a* and 3074*b* are positioned on the fixed blade member 3120 in a condition where the movable blade member 3071 is in a home position thereof. Accordingly, the movable blade member 3071 has a ground potential through an electric path composed of the fixed blade member 3120, the support member 3121 and the frame 3031.

As shown in FIG. 93A, the top plate part 3051*a* of the frame 3051 has shape corresponding to the shape of the movable blade member 3071 in the Y2 directional side, that is, the top plate part 3051*a* of the frame 3051 has shape having a concave part 3051*i* and arm parts 3051*j*-1 and 3051*j*-2 in both sides of the concave part 3051*i*. The arm parts 3051*j*-1 and 3051*j*-2 cover the finger-shaped protrusion parts 3074*a* and 4074*b* of the movable blade member 3071 located at the home position thereof. Also, in the under surface of the top plate part 3051*a* of the frame 3051, small protrusion parts 3051*k*-1 through 3051*k*-5 are formed in the arm parts 3051*j*-1 and 3051*j*-2 and along the edge of the concave part 3051*i*.

Figure 93B:
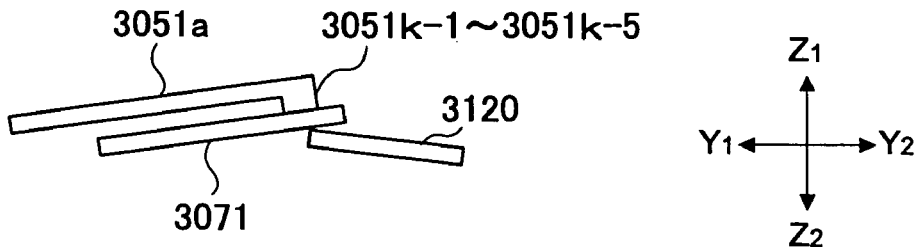

As shown in FIG. 93B, the movable blade member 3071, which is positioned in the Y2 side edge of the top plate part 3051*a*, is slid in the Y2 direction while being pressed by the protrusion parts 3051*k* through 3051*k*-5. As a result, blade pressure between the V-shaped blade part 3072 of the movable blade member 3071 and the blade part 3120*a* of the fixed blade member 3120 is well kept, and thereby the cutter part 3070 is well operable.

Also, the protrusion parts 3051*k*-2 through 3051*k*-4 are positioned near the paper 3081. Thus, even if a user forcedly pulls up the paper 3081 during cutting of the paper 3081, Z1 directional force applied to the movable blade member 3071 can be accepted by the protrusion parts. 3051*k*-2 through 3051*k*-4. As a result, it is possible to prevent generation of extraordinary load whereby the movable blade member 3071 is deformed.

Figure 94:
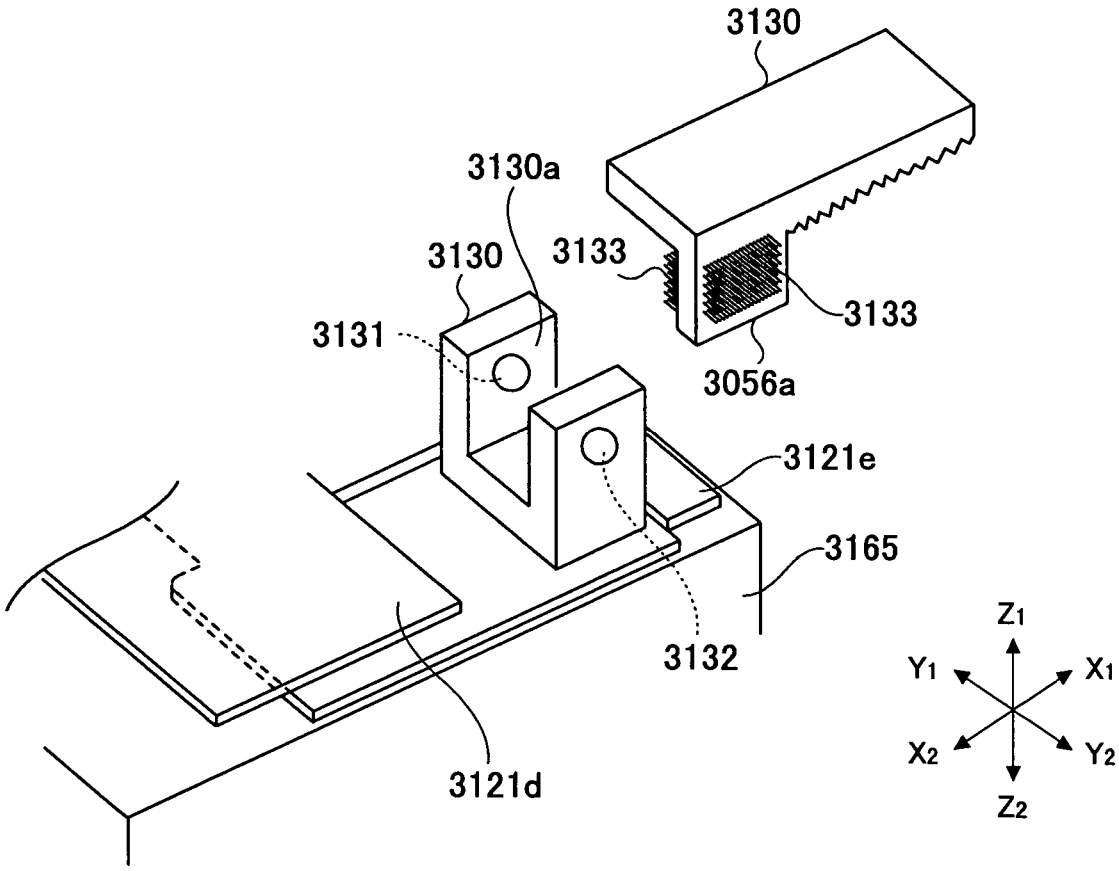
FIG. 94 is a diagram showing an photo interrupter and vicinity of thereof.

As shown in FIG. 94, the photo interrupter 3130 includes a light receiver element 3131 in the X2 side thereof, that is, in the center side of the thermal printers 3010-1 and 3010-2 with respect to the X1-X2 direction and a light emitter element 3132 in the X1 side thereof, that is, in the side surface side of the thermal printers 3010-1 and 3010-2. In this disposition, the light receiver element 3131 can easily receive not only light from the light emitter element 3132 but also light from the exterior. Thus, even if the mobile terminal device 3020 is used in direct sunlight, the photo interrupter 3130 can reliably detect the home position of the blade part. During cutting, the light shielding plate part 3056*a* blocks a groove 3130*a*, and thereby the direct sunlight is blocked. As a result, the photo interrupter 3130 can properly detect opening and closing of the cutter part 3070.

In addition, as shown in FIG. 94, a brush 3133 is provided on both surfaces of the light shielding plate part 3056*a*. Whenever the movable blade member 3071 is slid in the Y2 direction, the brush 3133 cleans the interior of the groove 3130*a* of the photo interrupter 3130. As a result, it is possible to prevent malfunction of the photo interrupter 3130 due to piled paper powder generated during cutting.

In addition, as shown in FIG. 94, the finger-shaped protrusion parts 3121*d* and 3121*e* of the support member 3121, which has a ground potential, are positioned near the terminal of the photo interrupter 3130. Thus, the finger-shaped protrusion parts 3121*d* and 3121*e* work as a lighting conductor against external static electricity such as static electricity of a user of the mobile terminal device 3020 to prevent discharge to the terminal of the photo interrupter 3130.

Figure 95A:
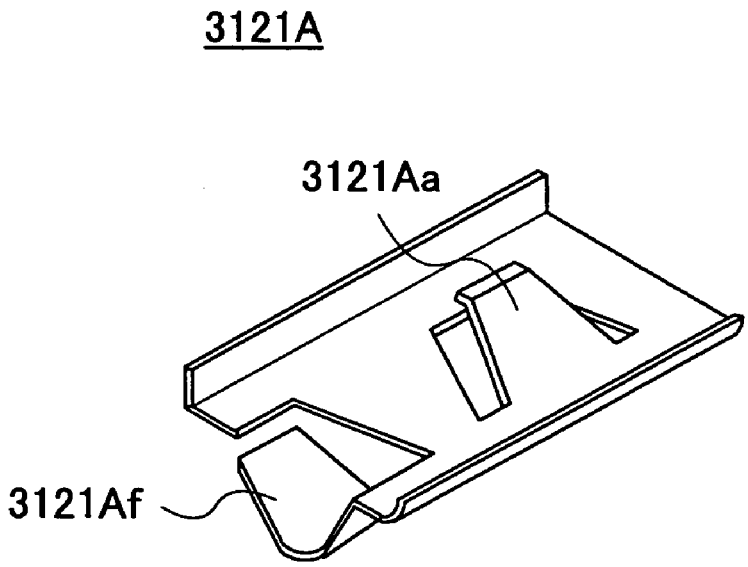
FIGS. 95A and 95B are diagrams showing a variation of a fixed blade member support member according to an embodiment of the present invention.
Figure 95B:
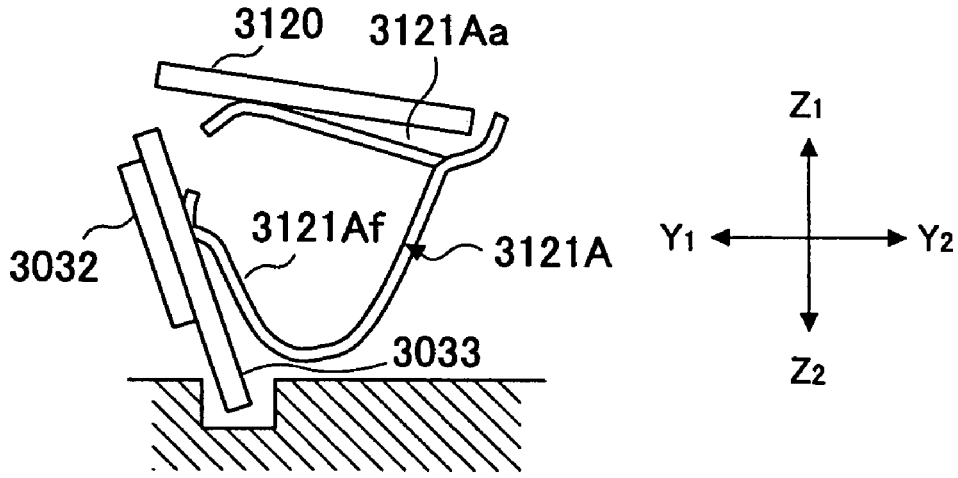

FIG. 95A shows an exemplary variation of the support member 3120 to support the fixed blade member 3120. As shown in FIGS. 95A and 95B, the support member 3120A includes a plate spring part 3121Af to push the thermal head support member 3033 in the Y1 direction as well as a plate spring part 3121Aa to push up the fixed blade member 3120 in the Z1 direction.

The present application is based on Japanese priority applications No. 2003-292507 filed Aug. 12, 2003, No. 2003-310277 filed Sep. 2, 2003, and No. 2003-318518 filed Sep. 10, 2003, the entire contents of which are hereby incorporated by reference.

The present invention is not limited to the specifically disclosed embodiments, and variations and modifications may be made without departing from the scope of the present invention.

What is claimed is:

1. A thermal printer, comprising:

a chassis including a first module having a motor and a thermal head support member to fix a thermal head, said thermal head support member having a fixed blade part working as a blade; and a lid including a second module detachably coupled with the first module, said second module having a platen roller, a movable blade member shaped to form one or more uncut points and a movable blade member movement mechanism to move the movable blade member, wherein the movable blade member is disposed to face the fixed blade part and a driving force of the motor is conveyed to the movable blade member to slide the movable blade member back and forth via a rack and pinion system disposed at each end of the movable blade member movement mechanism, and thereby forming a cutter part capable of cutting a printed portion from a printer sheet fully and/or partially in such a way that the printed portion is connected to the printer sheet via one or more uncut points, the rack and pinion system being disposed on the lid, and wherein the first module and the second module are mounted to the chassis and the lid of the thermal printer, respectively, such that when the lid is closed the driving force of the motor drives the movable blade member.

2. The thermal printer as claimed in claim 1, wherein the movable blade member has a shape forming the one or more uncut points depending on movement of the movable blade member.

3. The thermal printer as claimed in claim 1, wherein the movable blade member movement mechanism rotationally drives the movable blade member back and forth.

4. A thermal printer, comprising:

a first module having a motor and a thermal head support member to fix a thermal head, said thermal head having a fixed blade part working as a blade; and a second module detachably coupled with the first module, said second module having a platen roller, a movable blade member and a movable blade member movement mechanism to move the movable blade member, wherein the movable blade member is disposed to face the fixed blade part and a driving force of the motor is conveyed to the movable blade member movement mechanism, and thereby a cutter part is formed.

5. The thermal printer as claimed in claim 4, wherein the movable blade member movement mechanism slides the movable blade member back and forth.

6. The thermal printer as claimed in claim 5, wherein the movable blade member has shape capable of forming a plurality of uncut parts depending on movement of the movable blade member.

7. The thermal printer as claimed in claim 4, wherein the movable blade member movement mechanism rotationally drives the movable blade member back and forth.

* * * * *

UNITED STATES PATENT AND TRADEMARK OFFICE

CERTIFICATE OF CORRECTION

PATENT NO. : 7,273,325 B2
APPLICATION NO. : 10/832382
DATED : September 25, 2007
INVENTOR(S) : Sumio Watanabe et al.

It is certified that error appears in the above-identified patent and that said Letters Patent is hereby corrected as shown below:

Title Page, item [57] Column 2 (Abstract), Line 4, after “and” delete “an”.

Signed and Sealed this

Twenty-ninth Day of April, 2008

JON W. DUDAS
*Director of the United States Patent and Trademark Office*